US011123616B2

(12) United States Patent
Martell et al.

(10) Patent No.: US 11,123,616 B2
(45) **Date of Patent: *Sep. 21, 2021**

(54) SNAP FIT GOLF BAG ASSEMBLY

(71) Applicant: KARSTEN MANUFACTURING CORPORATION, Phoenix, AZ (US)

(72) Inventors: James Martell, Phoenix, AZ (US); John Loudenslager, Austin, TX (US); Brian McGuire, Phoenix, AZ (US); Ryan Bruce, Phoenix, AZ (US); David Higdon, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 235 days.

This patent is subject to a terminal disclaimer.

(21) Appl. No.: 16/109,659

(22) Filed: Aug. 22, 2018

(65) Prior Publication Data

US 2019/0001202 A1 Jan. 3, 2019

Related U.S. Application Data

(63) Continuation-in-part of application No. 15/788,535, filed on Oct. 19, 2017, now Pat. No. 10,610,751, (Continued)

(51) Int. Cl.
*A63B 55/40* (2015.01)
*A63B 55/20* (2015.01)
(Continued)

(52) U.S. Cl.
CPC ..... *A63B 55/40* (2015.10); *A63B 55/20* (2015.10); *A63B 55/408* (2015.10); *A63B 55/53* (2015.10); *A63B 55/57* (2015.10)

(58) Field of Classification Search
CPC ..... A63B 55/40; A63B 55/408; A63B 55/53; A63B 55/20; A63B 55/57
(Continued)

(56) References Cited

U.S. PATENT DOCUMENTS 1,769,011 A 7/1930 Bickford
2,064,433 A * 12/1936 Kronthal ..... A63B 55/10 211/70.2
(Continued)

FOREIGN PATENT DOCUMENTS

CN 201227506 4/2009
CN 202122804 1/2012
(Continued)

OTHER PUBLICATIONS

International Search Report and Written Opinion, dated Nov. 1, 2018, from corresponding Int'l Appl. No. PCT/US18/47613, filed Aug. 22, 2018.
(Continued)

*Primary Examiner* — Sue A Weaver

(57) ABSTRACT

A golf bag includes a divider top, a base, and a plurality of stays comprising a first stay, a second stay, and a main stay having a first end opposite a second end. The golf bag further comprises a top hinge coupled to the first end of the main stay. A base hinge can be coupled to the second end of the main stay, wherein the main stay can be hingedly connected to the divider top by the top hinge, and the stay can be hingedly connected to the base by the base hinge. Other embodiment of the golf bag are also described.

20 Claims, 99 Drawing Sheets

Related U.S. Application Data which is a continuation-in-part of application No. 15/437,337, filed on Feb. 20, 2017, now Pat. No. 10,173,113, which is a continuation of application No. 15/405,154, filed on Jan. 12, 2017, now Pat. No. 10,173,112, which is a continuation of application No. 15/058,414, filed on Mar. 2, 2016, now Pat. No. 9,586,109.

(60) Provisional application No. 62/295,567, filed on Feb. 16, 2016, provisional application No. 62/151,155, filed on Apr. 22, 2015, provisional application No. 62/127,033, filed on Mar. 2, 2015, provisional application No. 62/211,568, filed on Aug. 28, 2015, provisional application No. 62/410,044, filed on Oct. 19, 2016, provisional application No. 62/461,054, filed on Feb. 20, 2017, provisional application No. 62/548,720, filed on Aug. 22, 2017, provisional application No. 62/570,024, filed on Oct. 9, 2017.

(51) Int. Cl.
*A63B 55/53* (2015.01)
*A63B 55/00* (2015.01)
*A63B 55/57* (2015.01)

(58) Field of Classification Search
USPC ..... 206/315.3, 315.6, 315.8, 315.7
See application file for complete search history.

(56) References Cited

U.S. PATENT DOCUMENTS 2,148,947 A 2/1939 Jackson
3,547,054 A 12/1970 Caldwell et al.
3,674,072 A 7/1972 Shuto
3,901,299 A 8/1975 Picco
4,226,389 A 10/1980 Neth
4,249,586 A 2/1981 Setani
4,282,983 A 8/1981 Swartzbaugh
4,350,194 A 9/1982 Brown
4,459,827 A 7/1984 Rhodes
4,600,100 A 7/1986 Solheim
D288,653 S 3/1987 Crymes
4,735,394 A 4/1988 Facco
4,767,039 A 8/1988 Jacober
4,778,136 A 10/1988 Reimers
4,834,235 A 5/1989 Solheim et al.
4,898,352 A 2/1990 Hoffman
4,995,510 A 2/1991 Fletcher
5,005,679 A 4/1991 Hjelle
5,158,220 A 10/1992 Glass
5,160,109 A 11/1992 de Leeuw
1,438,311 A 12/1992 Kerlogue
5,178,273 A 1/1993 Igarashi
5,245,898 A 9/1993 Somal et al.
5,329,712 A 7/1994 Keller
5,339,951 A 8/1994 Chen
5,351,921 A 10/1994 Chen
5,354,131 A 10/1994 Mogil
5,356,003 A 10/1994 Gretz et al.
5,392,907 A 2/1995 Blanchard et al.
5,407,155 A 4/1995 Chung
5,415,285 A 5/1995 Reimers
5,505,300 A 4/1996 Joh
5,529,385 A 6/1996 Tsao
5,538,813 A 7/1996 Biafore, Jr. et al.
5,597,144 A 1/1997 Lee
5,634,616 A 6/1997 Wang et al.
5,640,855 A 6/1997 Crescenzo et al.
5,657,869 A 8/1997 Carroll, III
5,662,303 A 9/1997 Rellinger et al.
5,671,842 A * 9/1997 Jaworski ..... A63B 55/00 206/315.3
5,722,253 A 3/1998 Todd
5,765,691 A 6/1998 Hall
5,769,220 A 6/1998 Hong
5,799,786 A 9/1998 Beck et al.
5,816,544 A 10/1998 Hsieh
5,823,485 A 10/1998 Park
5,853,086 A 12/1998 Chang
5,899,328 A 5/1999 Dulyea
5,915,551 A 6/1999 Vavro
5,964,346 A 10/1999 O'Connor
5,997,105 A 12/1999 Wu
6,068,270 A 5/2000 Kim
6,068,271 A 5/2000 Vanaman
6,099,097 A 8/2000 Hocker et al.
6,220,433 B1 4/2001 Kang
6,234,582 B1 5/2001 Wu
6,283,260 B1 9/2001 Yasuda, Sr.
6,296,117 B1 10/2001 Chen
6,311,836 B1 11/2001 Maeng
6,382,572 B1 5/2002 Lin
6,386,362 B1 5/2002 Cheng
6,390,295 B2 5/2002 Rhee
6,394,325 B1 5/2002 Taylor
6,427,835 B1 8/2002 Chang
6,481,674 B1 11/2002 Lin
6,494,416 B2 12/2002 Wang
6,510,944 B2 1/2003 Chang
6,513,661 B1 2/2003 Mogil
6,598,744 B2 7/2003 Chen
6,609,615 B2 8/2003 Lin
6,834,891 B2 12/2004 Matsubara et al.
7,025,202 B2 4/2006 Janen et al.
7,445,399 B2 11/2008 Dunn et al.
7,617,935 B2 * 11/2009 Reilley ..... B65D 83/0463 206/530
7,681,859 B2 3/2010 Kim
7,762,518 B2 7/2010 Ogawa et al.
7,837,032 B2 11/2010 Smeltzer
7,870,954 B2 1/2011 Quartarone, III
7,886,902 B1 2/2011 Cimini et al.
8,141,705 B2 3/2012 Aubery et al.
8,410,748 B2 4/2013 Wilson
8,573,393 B2 11/2013 Cole et al.
8,757,373 B2 6/2014 Aubery
8,827,073 B2 9/2014 Herron et al.
8,869,981 B2 10/2014 Tang
8,910,785 B2 12/2014 Loudenslager
8,997,981 B1 4/2015 Gilkerson
9,307,813 B2 4/2016 Bruce
9,314,679 B2 4/2016 Engel
9,586,109 B2 * 3/2017 Martell ..... A63B 55/20
9,662,553 B2 5/2017 Cheng
9,713,754 B2 7/2017 Herron et al.
9,827,471 B1 11/2017 Wang
9,931,554 B2 4/2018 Marquez et al.
10,173,113 B2 * 1/2019 Martell ..... A63B 55/20
10,610,751 B2 * 4/2020 Martell ..... A63B 55/40
2002/0043475 A1 4/2002 Wang
2002/0125381 A1 9/2002 Yoon
2003/0015634 A1 1/2003 Yoon
2004/0035729 A1 2/2004 Chang
2004/0079659 A1 4/2004 Feng
2004/0108234 A1 6/2004 Meissner
2005/0051982 A1 3/2005 Su
2005/0072696 A1 4/2005 Yang
2007/0138040 A1 6/2007 Chan
2007/0193902 A1 8/2007 Myers et al.
2007/0246384 A1 10/2007 Shiao
2008/0135431 A1 6/2008 Tan
2008/0164166 A1 7/2008 Quartarone
2008/0314941 A1 12/2008 Knych et al.
2010/0051489 A1 3/2010 Shiao
2010/0140122 A1 6/2010 Quartarone et al.
2010/0294404 A1 11/2010 Anderson
2011/0180575 A1 7/2011 Abramowitz et al.
2012/0055820 A1 3/2012 McGuire et al.
2013/0032499 A1 2/2013 Loudenslager
2014/0034527 A1 2/2014 Anderson

(56) References Cited

U.S. PATENT DOCUMENTS

| | | | |
|---|---|---|---|
| 2015/0014196 | A1 | 1/2015 | Hargis |
| 2015/0265020 | A1 | 9/2015 | McCue et al. |
| 2016/0213986 | A1 | 7/2016 | Foxman |

FOREIGN PATENT DOCUMENTS

| | | |
|---|---|---|
| CN | 202387180 | 8/2012 |
| CN | 202478518 | 10/2012 |
| CN | 102764495 | 11/2012 |
| CN | 202933449 | 5/2013 |
| CN | 202961748 | 6/2013 |
| CN | 203090379 | 7/2013 |
| CN | 203196243 | 9/2013 |
| CN | 203540000 | 4/2014 |
| CN | 203874408 | 10/2014 |
| CN | 104338305 | 2/2015 |
| CN | 103230668 | 12/2015 |
| CN | 205042058 | 2/2016 |
| CN | 207153029 | 3/2018 |
| GB | 2327361 | 1/1999 |
| GB | 2333712 | 8/1999 |
| JP | 3188092 | 1/2014 |
| KR | 1020140115142 | 9/2014 |

OTHER PUBLICATIONS

PCT International Search Report and Written Opinion dated May 11, 2016 from corresponding PCT Application No. PCT/US16/020333, Filed Mar. 2, 2016.

Callaway ORG. 14 CART BAG; https://www.callawaygolf.com/accessories/golf-bags/cart-bags/bags-2018-org-14-cart.html; date accessed: Dec. 17, 2018.

* cited by examiner

SNAP FIT GOLF BAG ASSEMBLY

CROSS REFERENCES

This is a continuation-in-part of U.S. patent application Ser. No. 15/788,535, filed on Oct. 19, 2017, now U.S. Pat. No. 10,610,751, which is a continuation-in-part of U.S. patent application Ser. No. 15/437,337, filed Feb. 20, 2017, now U.S. Pat. No. 10,173,113, which is a continuation of U.S. patent application Ser. No. 15/405,154, filed Jan. 12, 2017, now U.S. Pat. No. 10,173,112, which is a continuation of U.S. patent application Ser. No. 15/058,414, filed on Mar. 2, 2016, now U.S. Pat. No. 9,586,109, which claims priority of U.S. Provisional Patent Application No. 62/295,567, filed Feb. 16, 2016, U.S. Provisional Patent Application No. 62/151,155, filed Apr. 22, 2015, U.S. Provisional Patent Application No. 62/127,033, filed Mar. 2, 2015, and U.S. Provisional Patent Application No. 62/211,568, filed Aug. 28, 2015. Furthermore, U.S. patent application Ser. No. 15/788,535, claims priority of U.S. Provisional Patent Application No. 62/410,044, filed Oct. 19, 2016, and U.S. Provisional Patent Application No. 62/461,054, filed Feb. 20, 2017. This also claims priority to U.S. Provisional Patent Application No. 62/548,720, filed Aug. 22, 2017, and U.S. Provisional Patent Application No. 62/570,024, filed Oct. 9, 2017, the contents of which all the above are fully incorporated herein by reference.

FIELD OF THE INVENTION

The present disclosure relates to a golf bag. More specifically, the disclosure relates to a golf bag formed of a plurality of components that interconnect by snap fit or otherwise to simplify bag assembly by eliminating rivets, and that reduces packaging volume resulting in more efficient and cost effective shipping. The disclosure also relates to a kit for a golf bag that allows for self-assembly of the golf bag by the recipient.

BACKGROUND

A golf bag is a specially designed bag used to transport golf clubs. There are two main classes of golf bags: carry bags and cart bags. Golf bags have certain limitations with regards to manufacturing and shipping. For example, known golf bags are typically completely assembled prior to shipment to an end user or point of sale. To account for the size of the assembled bag, a shipping package generally has a volume exceeding 5,000 cubic inches (in3). As shipping package fees shift from a package weight based fee to a package size based fee, golf bags will be subject to additional charges due to excessive package dimensions, substantially increasing shipping costs. In addition, the threat of tariffs on assembled goods from abroad, such as China or Vietnam or South Korea, provide added pressure for a solution to golf bag manufacturing. Accordingly, there is a need in the art for reducing the package volume for shipping a golf bag and for a golf bag system to allow an end user or point of sale recipient to easily assemble the golf bag after receipt.

In addition, assembly of both types of golf bags is often performed where particular parts of the bag (inside and out) are manufactured in different factories and then assembled in a different manufacturing site. This leads to necessary increases in package size and package volume to ship each component of the golf bag and the overall assembled golf bag itself. As shipping package fees shift from package weight to package size, golf bag components, accessories, and the overall finished product will be subject to additional charges due to excessive package dimensions, and substantially increasing shipping costs. Accordingly, there is a need in the art for reducing the package volume for shipping the whole golf bag or parts of the golf bag, and for a method to easily assemble golf bags in a reduced volume shipping supply chain.

Known cart bags and carry bags have certain common components. Both bags include a base, a top having one or more dividers, at least one stay, and a generally cylindrical flat (also known as the "outer shell" or "outer housing") having one or more storage pockets. The at least one stay interconnects the base and the top to define a sub-assembly. The sub-assembly is then connected to the cylindrical flat to define the known golf bag. During assembly of the golf bag, the cylindrical flat and the top are positioned to circumferentially overlap. A plurality of rivets are then set around the top circumference to fasten the flat and the top. Similarly, the flat and the base are also positioned to circumferentially overlap, and a plurality of rivets are then set around the base circumference to fasten the cylindrical flat and the base. This process results in a durable attachment of the golf bag components. Previously, the assembly process is complex, time intensive, and labor intensive. Golf bag components must be properly aligned, which often requires adjustment and realignment. Once aligned, each rivet must be individually set around both the top and the bottom of the bag.

The sub-assembly and the flat of known golf bags are typically fabricated at a first location, and then shipped to a second location for assembly. The sub-assembly is fabricated to define a golf bag frame with the at least one stay connected to and separating the base and the top. Similarly, the flat is fabricated into a generally cylindrical or tubular shape. After shipping to the second location, the flat is secured to the sub-assembly. After assembly at the second location, the golf bags are shipped to the consumer in their fully assembled state.

There is a need in art for a golf bag that can be assembled easily through non-manufacturing means (i.e. riveting). There is need for a golf bag that can be shipped in a kit (such as in a collapsed configuration), and require minimal assembly steps and manufacturing tools upon delivery to a vendor or assembly site. Furthermore, in order to reduce the cost of shipping, there is a need in the art for a golf bag that can be shipped to a recipient in smaller packaging than is required for a finished golf bag.

BRIEF DESCRIPTION OF THE DRAWINGS

FIG. 105B is a perspective view of an embodiment of a golf bag easy-access/zippered pocket, in a closed configuration.

FIG. 106 is a perspective view of another embodiment of a golf bag, with locations designated for the easy-access/zippered pocket of FIG. 110.

FIG. 107 is a side view of another embodiment of a golf bag, with a removable pocket.

FIG. 108 is a side view of the golf bag of FIG. 112, with the removable pocket shown in a partially-connected configuration.

FIG. 109 is a side view of the golf bag of FIG. 113, with the removable pocket shown in a disconnected configuration.

FIG. 110 is a side view of another embodiment of a golf bag, with a removable pocket which is concealed under a lip of the golf bag flat.

FIG. 111 is a perspective view of a cart bag with a pocket configured to receive a removable cooler bag, along with a removable cooler bag, according to an embodiment.

FIG. 112 is a perspective view of removable cooler bag, according to an embodiment.

FIG. 113 is a perspective view of an embodiment of a cart bag, illustrating the position of the stay behind the flat.

FIG. 114 is a perspective view of the golf bag of FIG. 113, as viewed along line 114-114 of FIG. 113.

FIG. 115 is a perspective view of the golf bag of FIG. 113 with the flat removed to illustrate an embodiment of the sub-assembly.

FIG. 116 is a perspective view of the golf bag of FIG. 114 with the flat removed to illustrate the sub-assembly.

Figure 115:
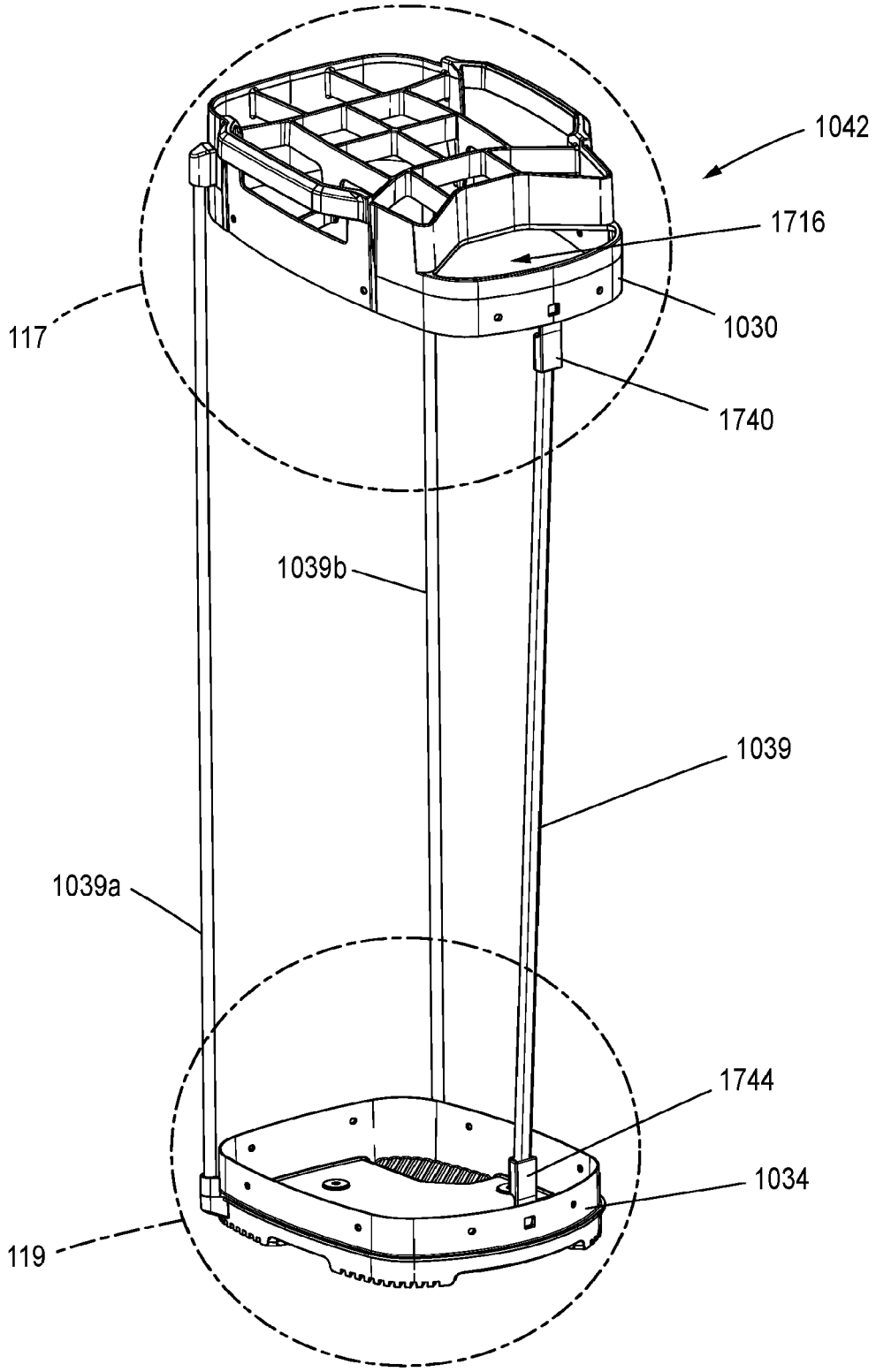
Figure 117:
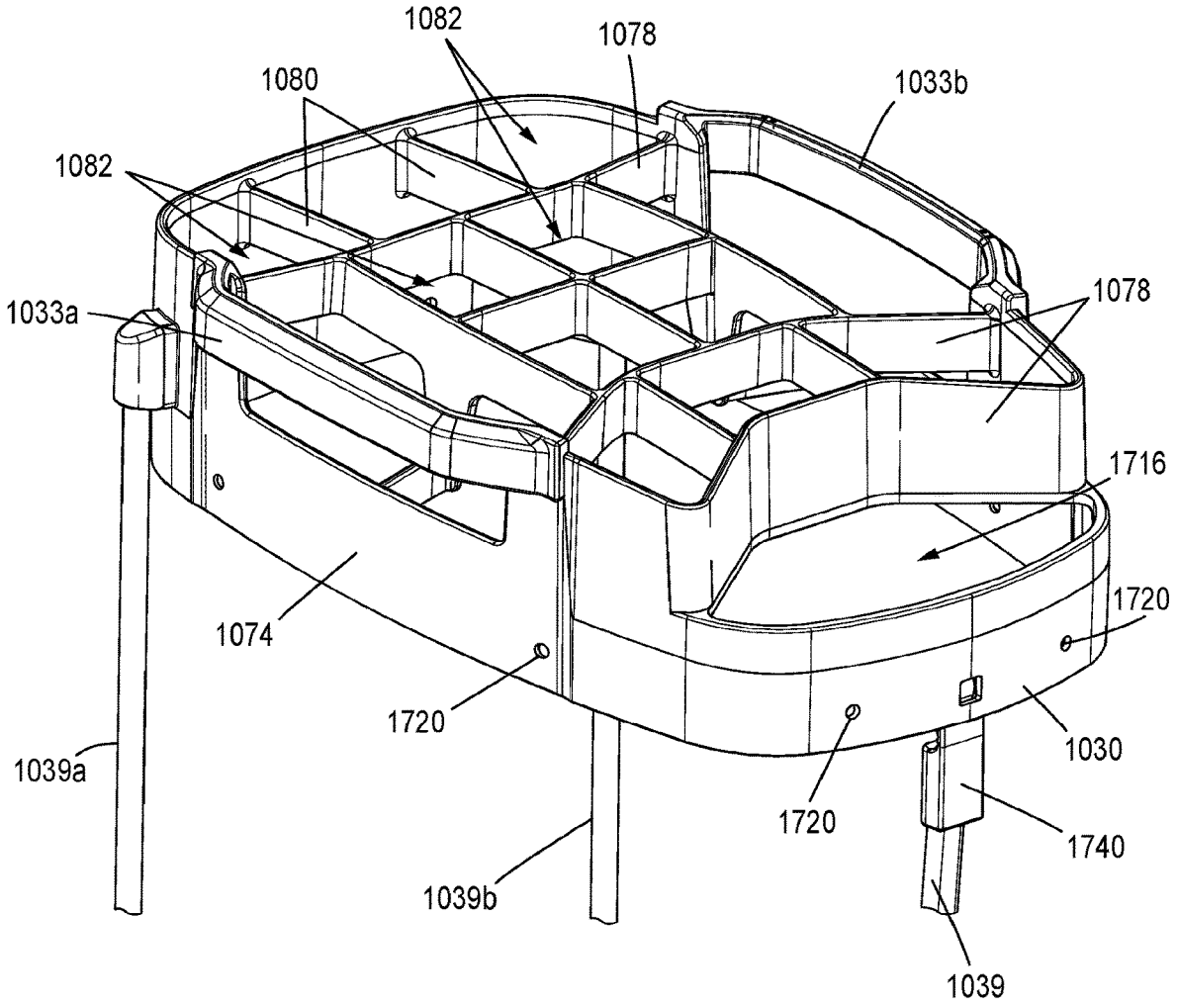

FIG. 117 is a close up of the divider top, taken along line 117-117 of FIG. 115.

Figure 116:
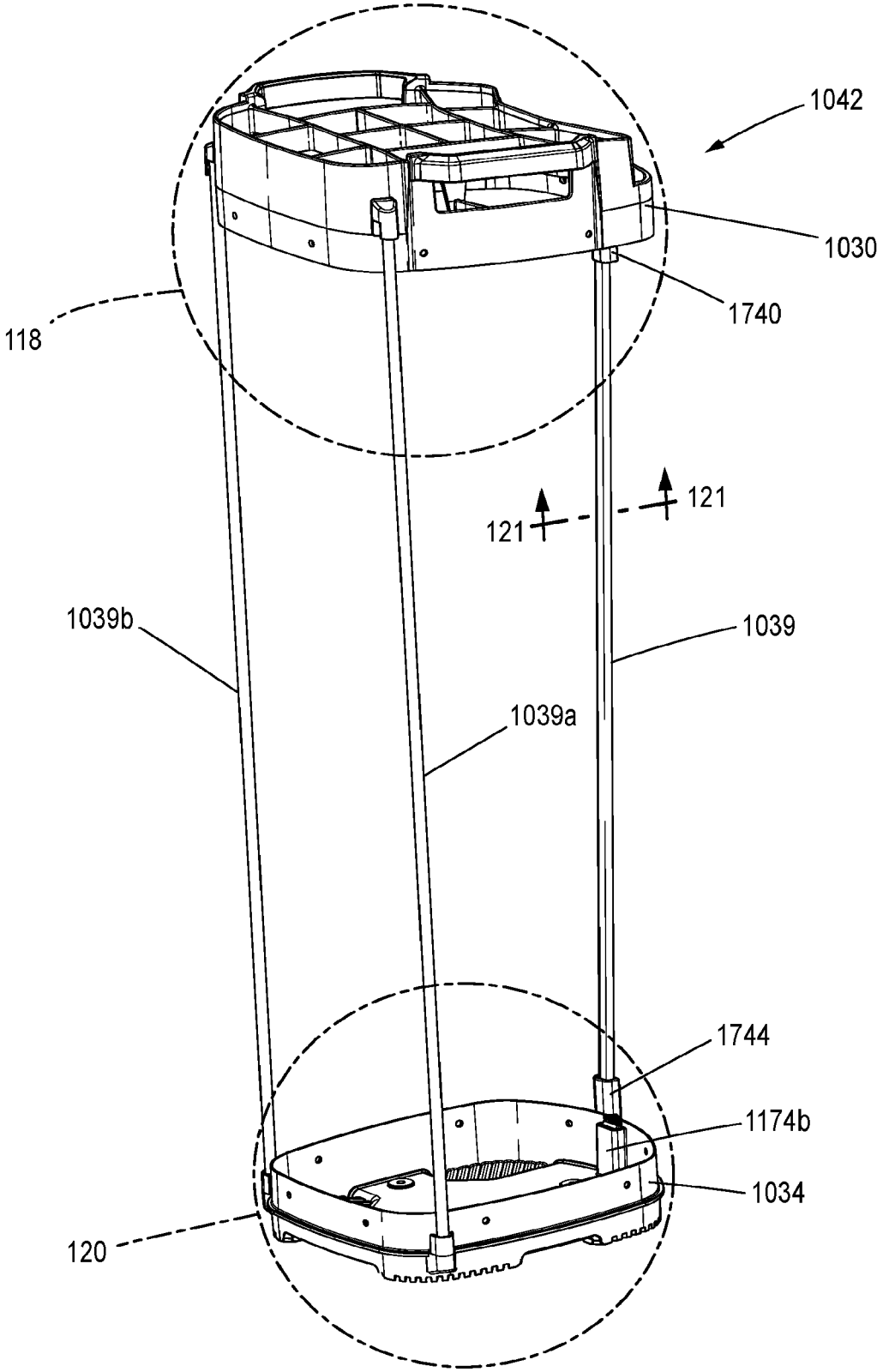
Figure 118:
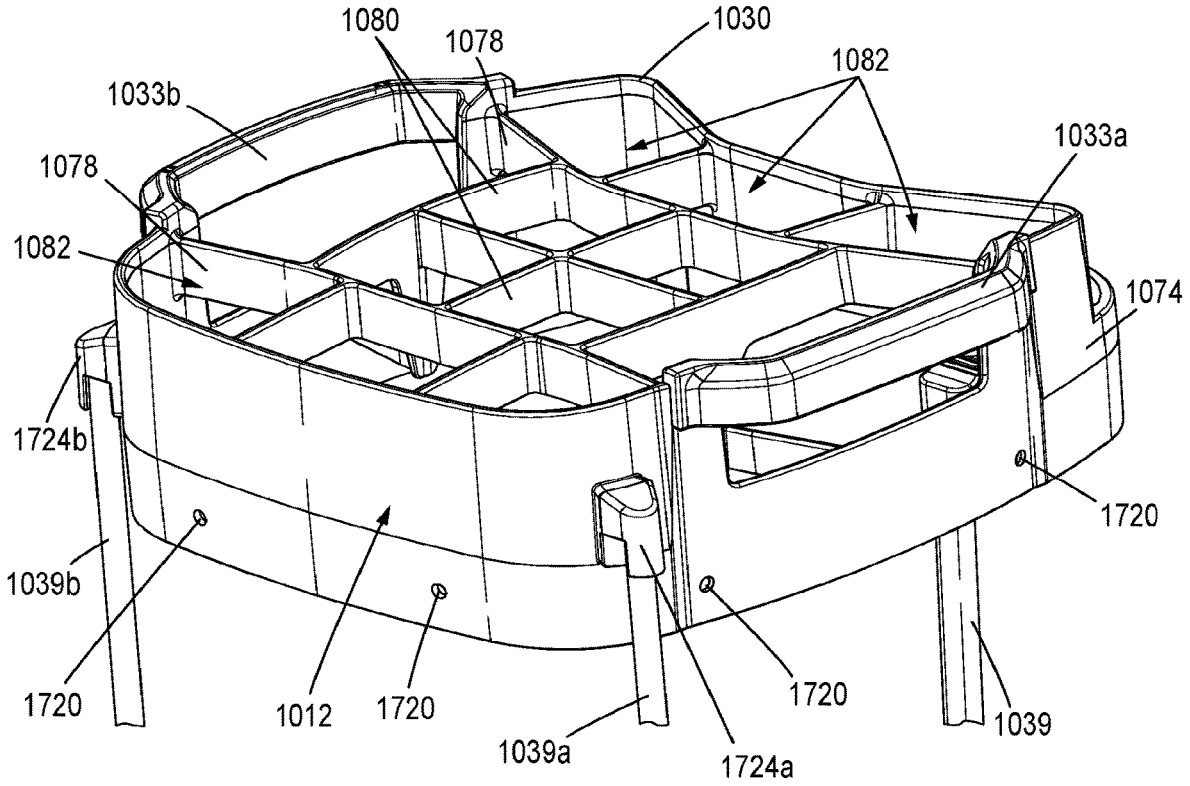

FIG. 118 is a close up of the divider top, taken along line 118-118 of FIG. 116.

Figure 119:
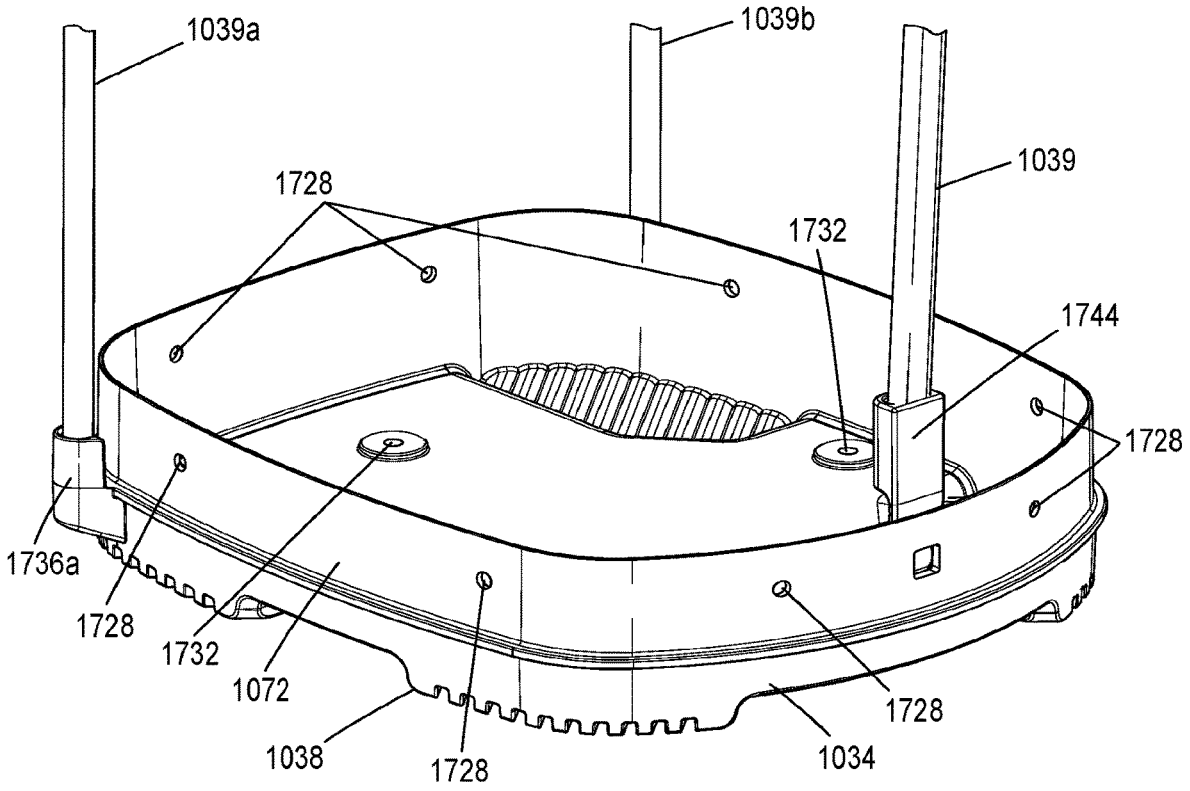

FIG. 119 is a close up of the divider top, taken along line 119-119 of FIG. 115.

Figure 120:
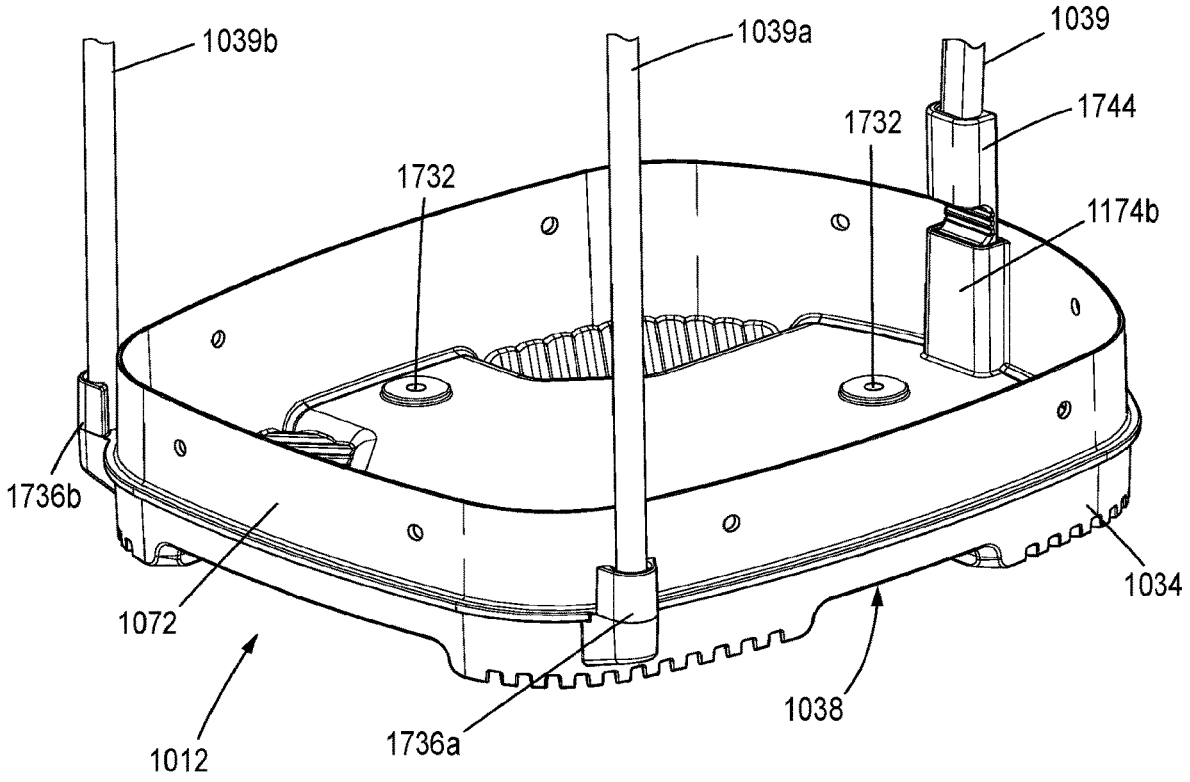

FIG. 120 is a close up of the divider top, taken along line 120-120 of FIG. 116.

Figure 121:
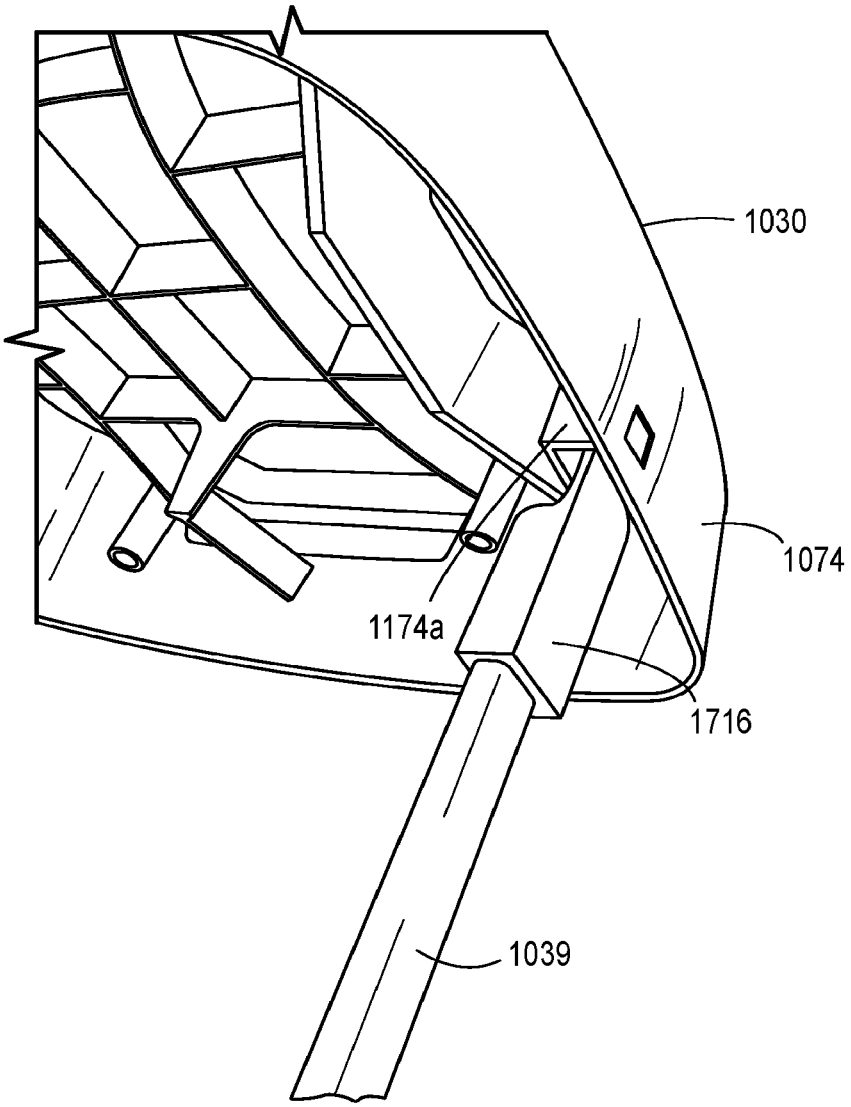

FIG. 121 is a close up of a portion of the divider top, taken along line 121-121 of FIG. 116.

Figure 122:
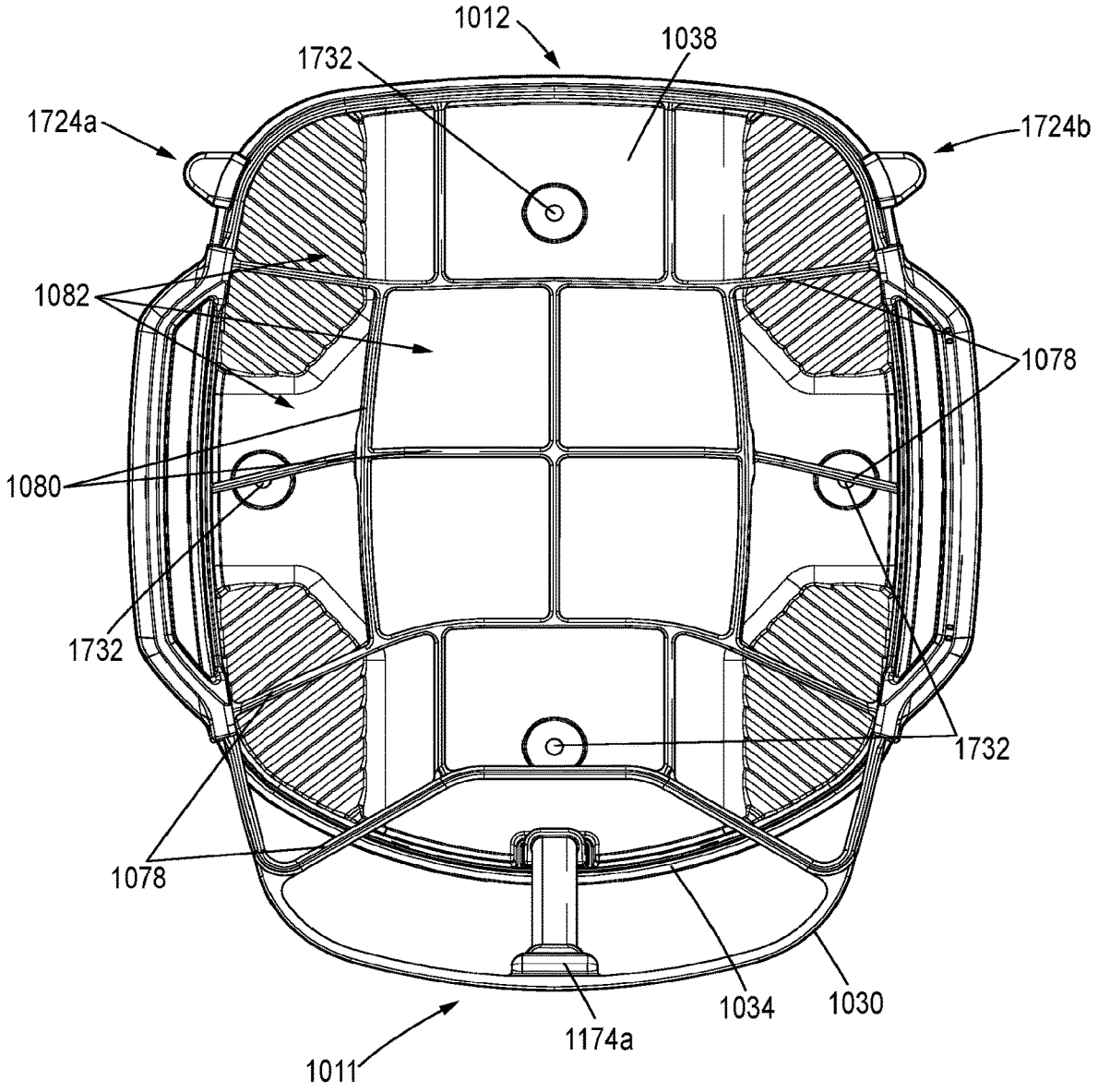

FIG. 122 is a top down view of the sub-assembly shown in FIG. 115.

Figure 123:
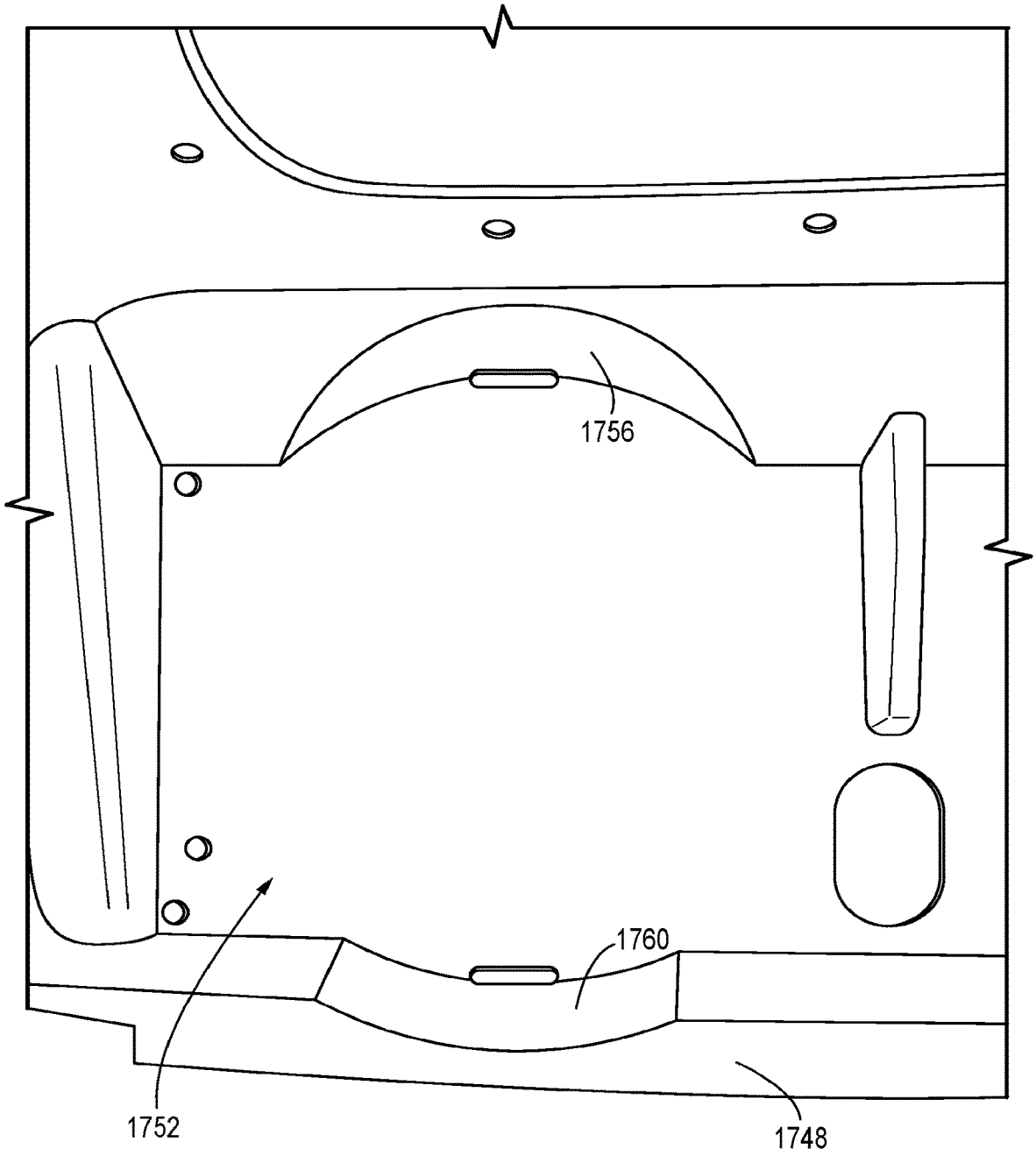

FIG. 123 is a top down view of an example of a portion of a liner of a golf cart that is configured to receive a golf bag.

Figure 113:
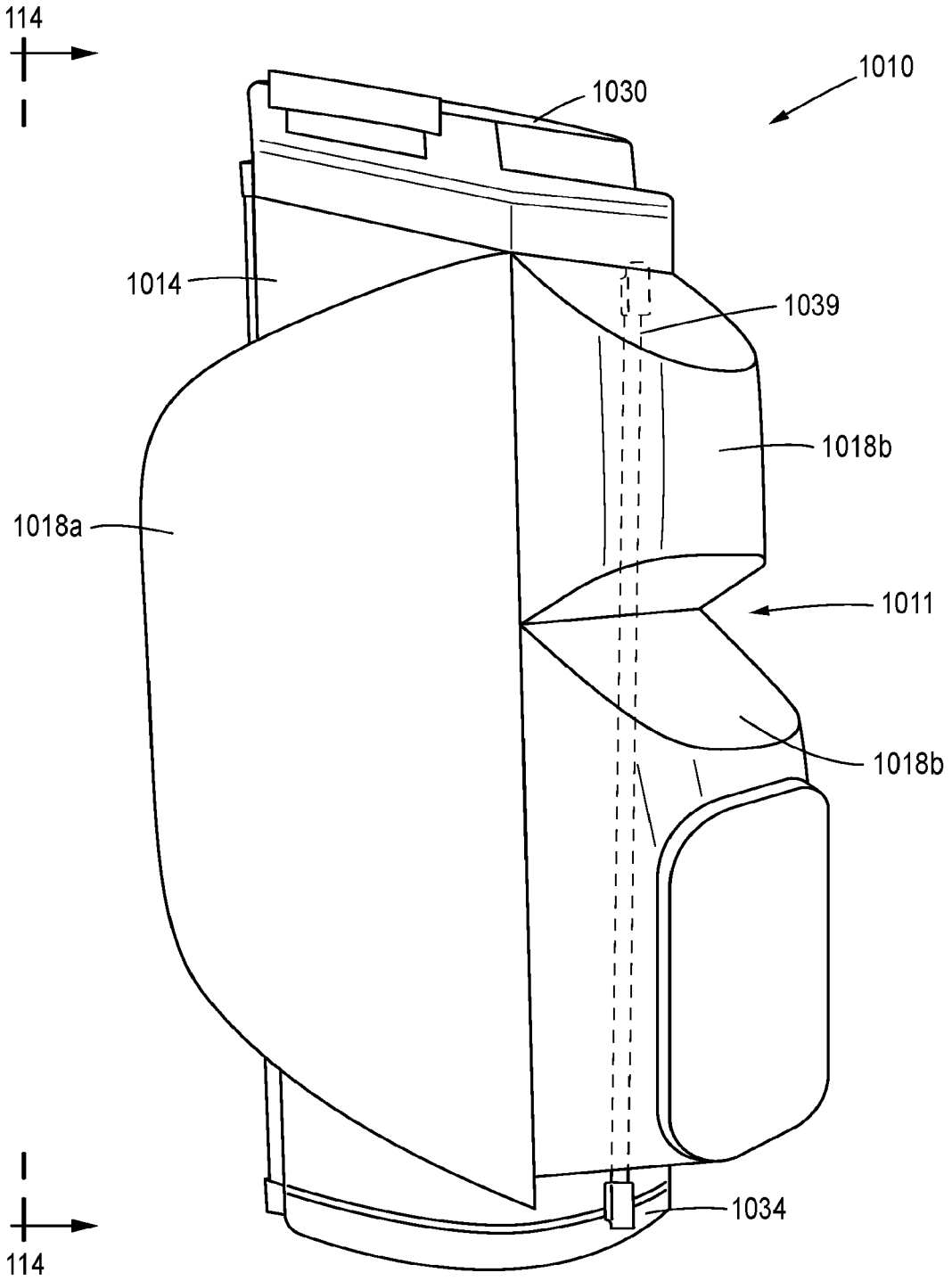
Figure 124:
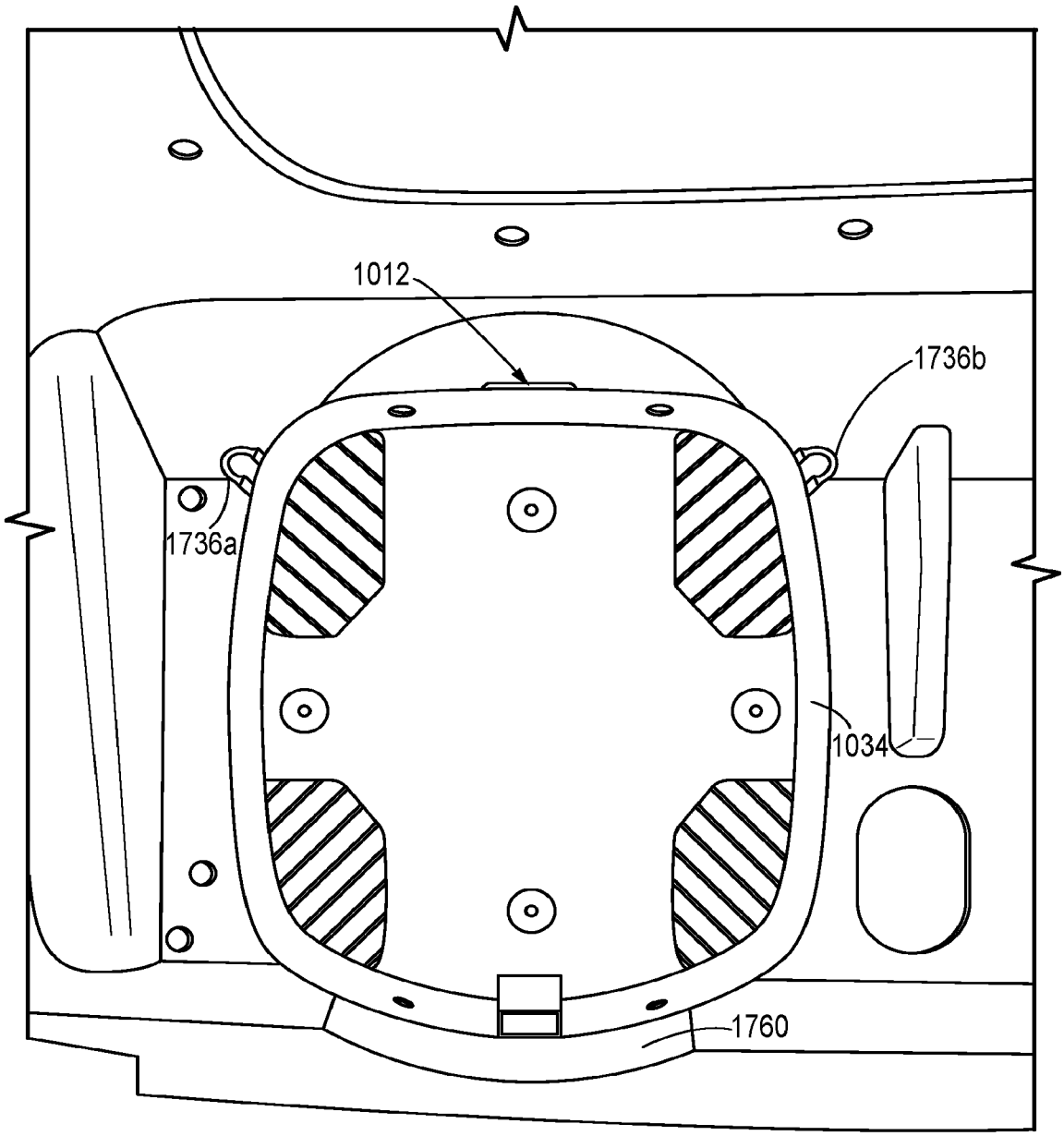

FIG. 124 is the top down view of the liner of FIG. 123 with the base of the golf bag of FIG. 113 positioned therein.

Figure 125:
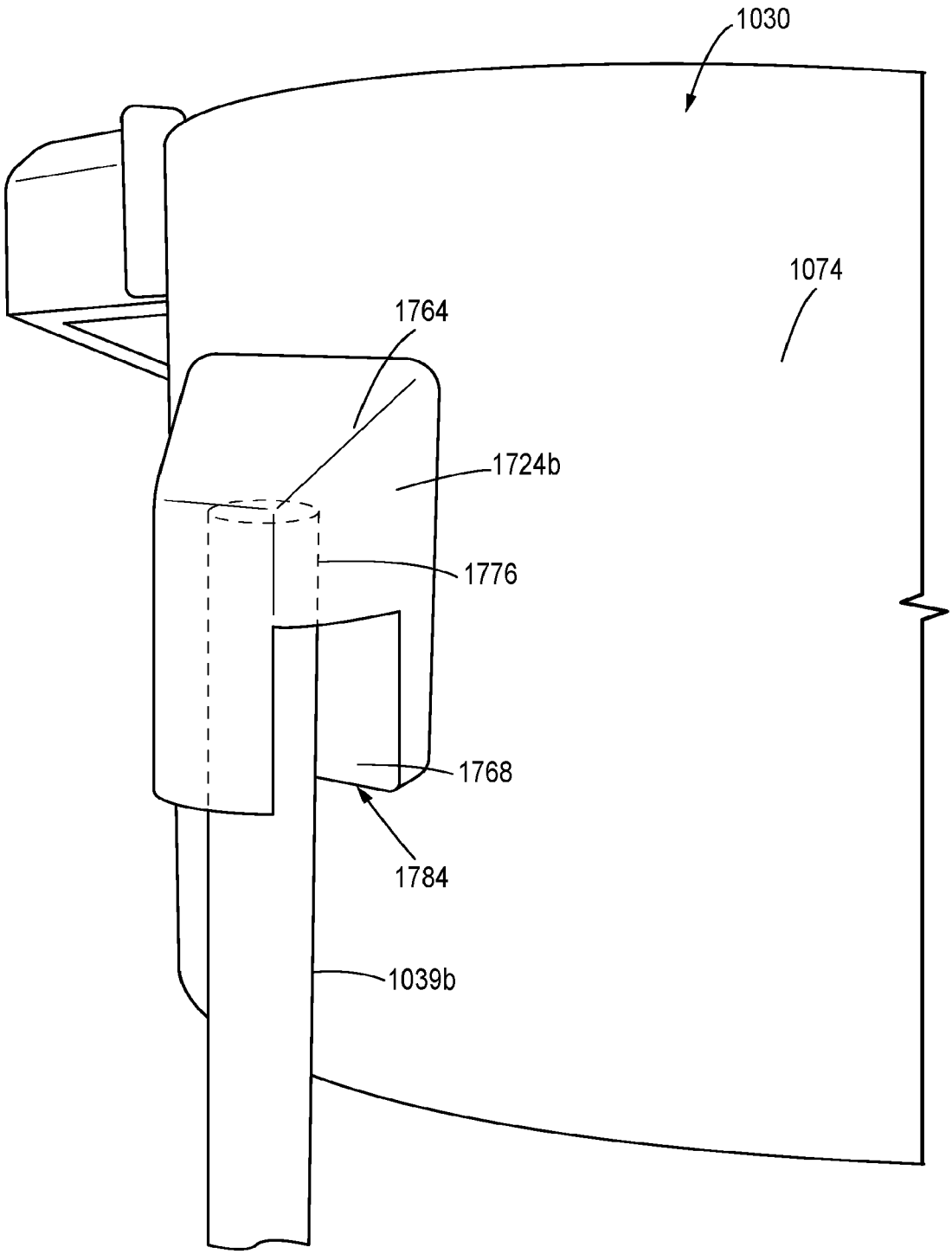

FIG. 125 is a perspective view of a top stay hub of the golf bag of FIG. 113 with the stay positioned therein.

Figure 126:
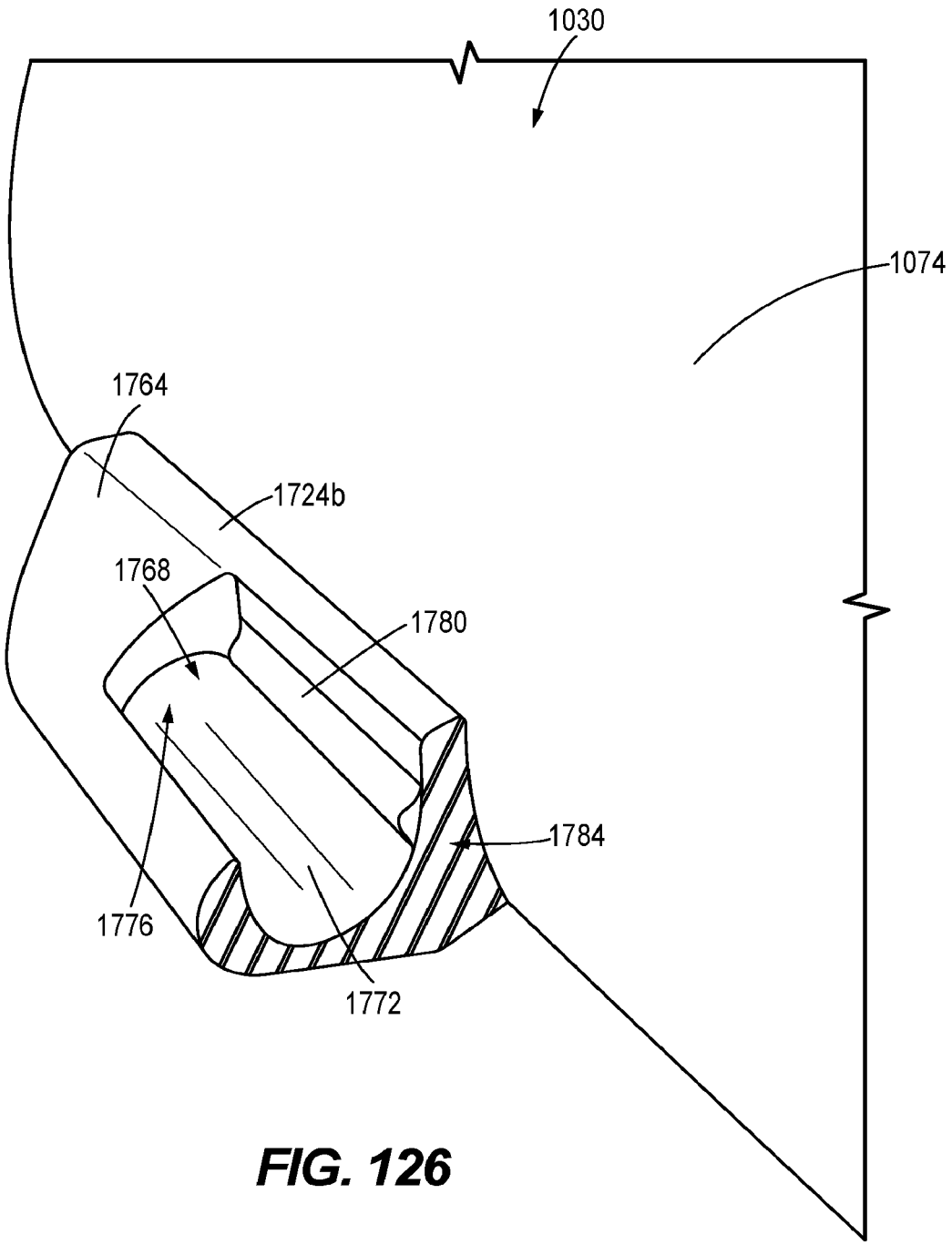

FIG. 126 is a perspective view of the top stay hub of FIG. 125 with the stay removed.

Figure 127:
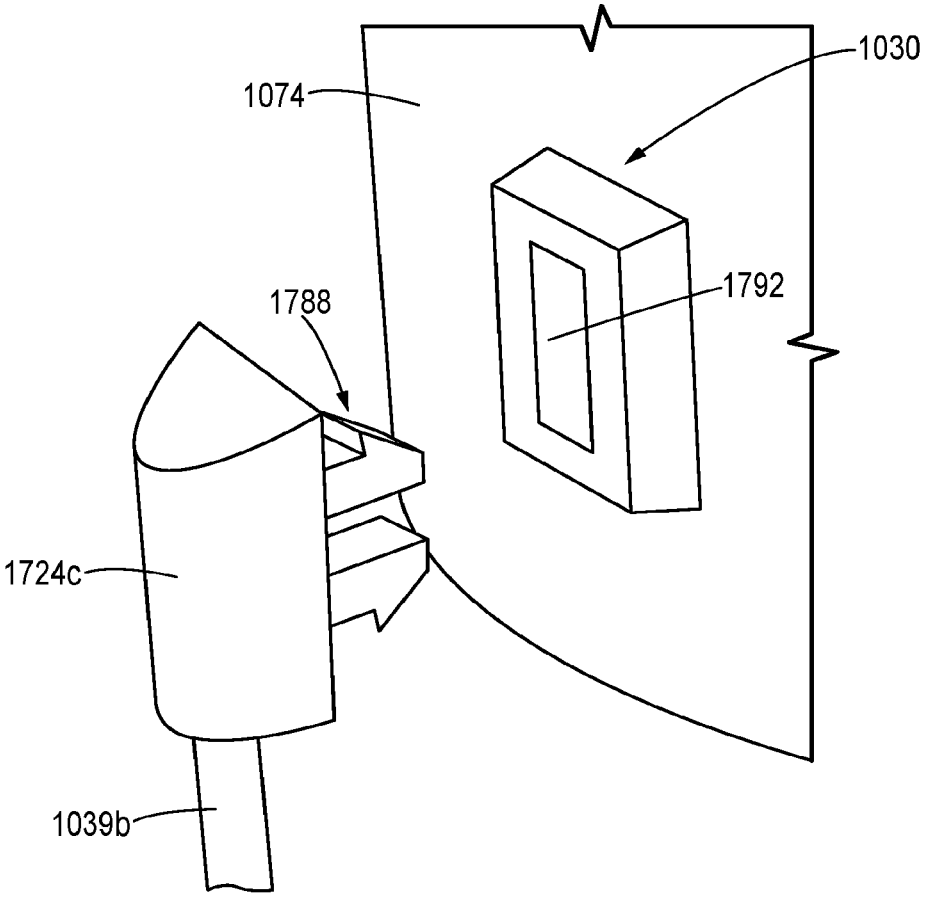

FIG. 127 is a perspective view of an alternative embodiment of a top stay hub for use with the golf bag of FIG. 113.

Figure 128:
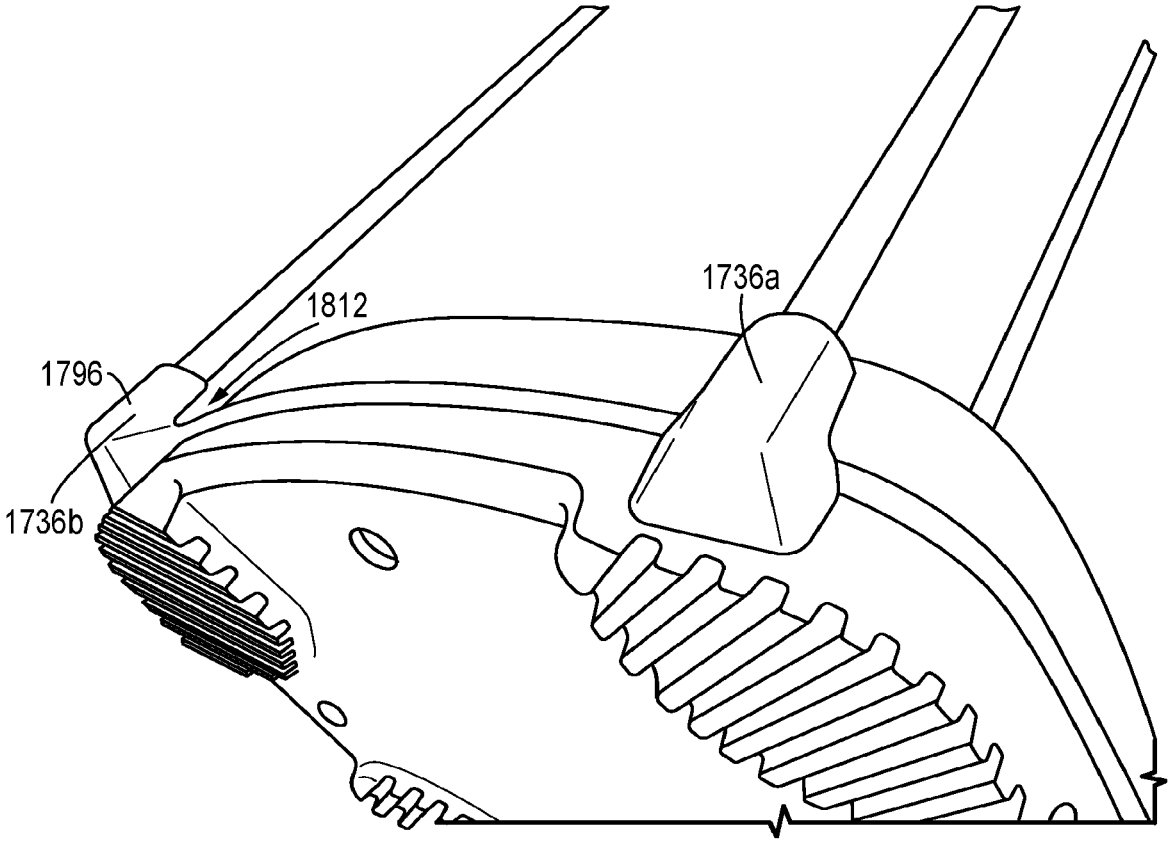

FIG. 128 is a perspective view of a base stay hub of the golf bag of FIG. 113.

Figure 129:
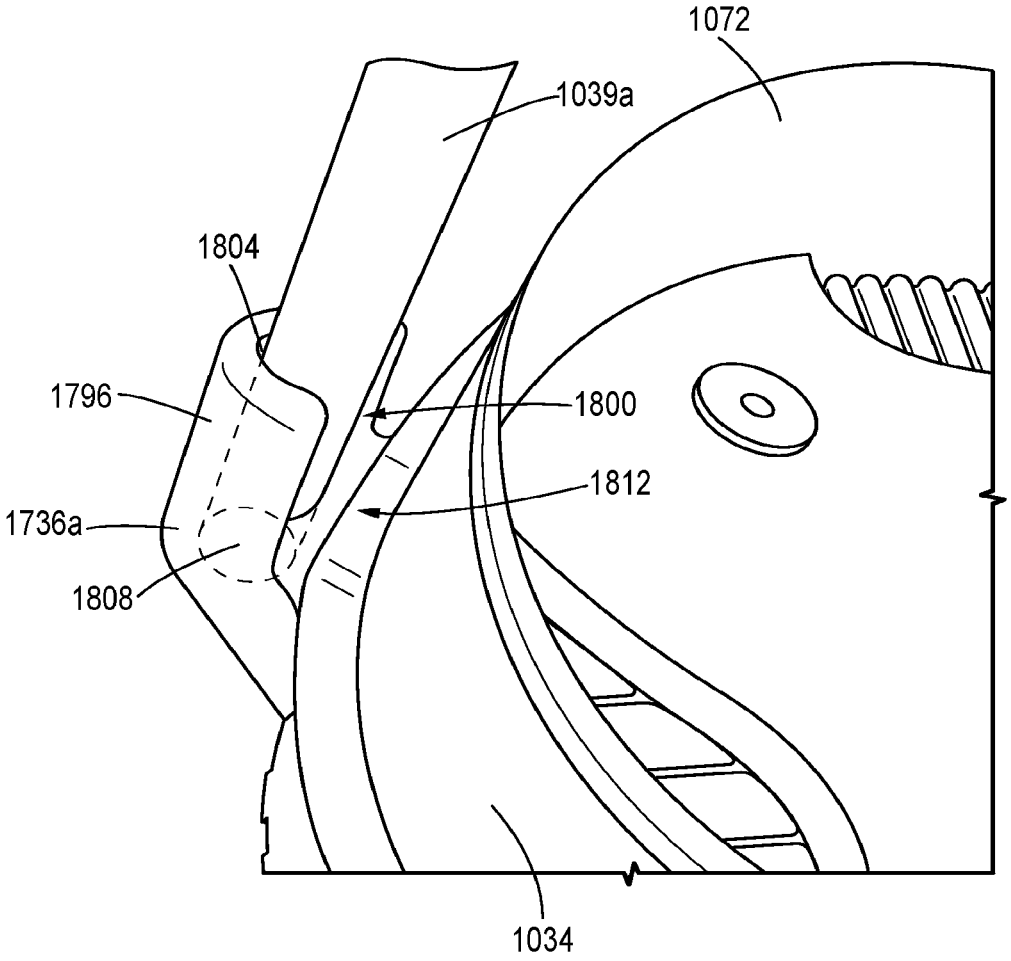

FIG. 129 is a close up view of one of the base stay hubs of FIG. 128.

Figure 130:
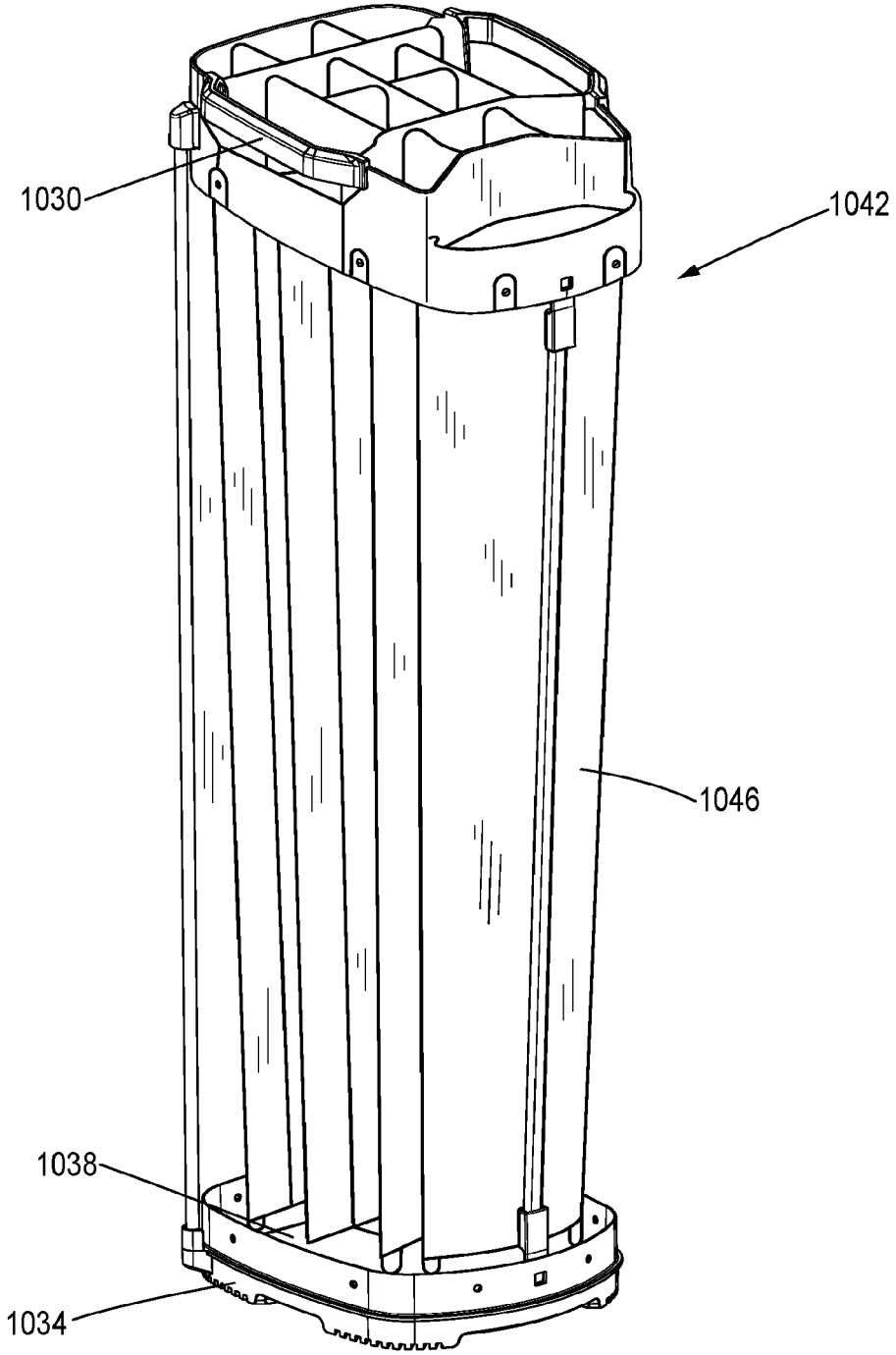

FIG. 130 is a perspective view of a divider sleeve coupled to the sub-assembly of FIG. 115.

Figure 131:
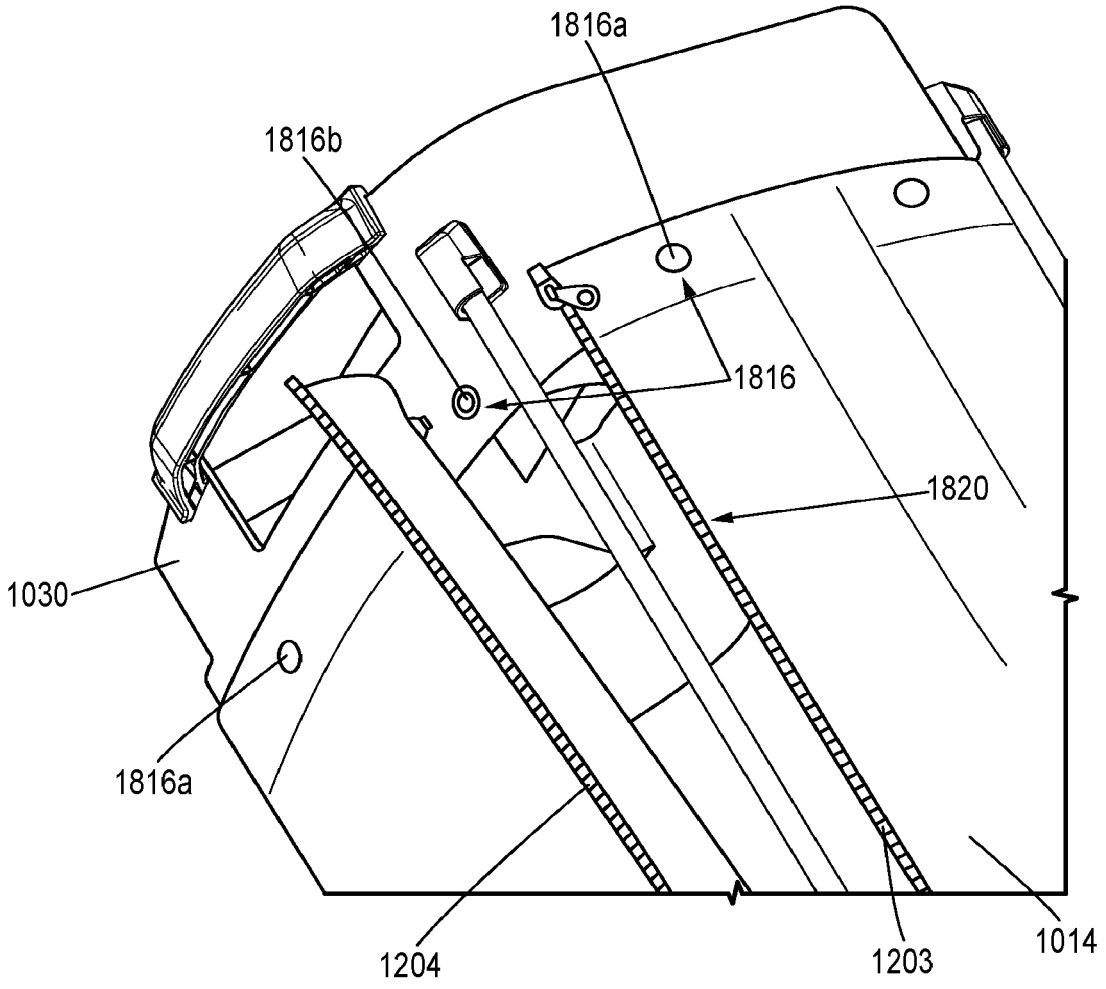

FIG. 131 is a perspective view of a portion of the flat being attached to the divider top of the sub-assembly of FIG. 115.

Figure 132:
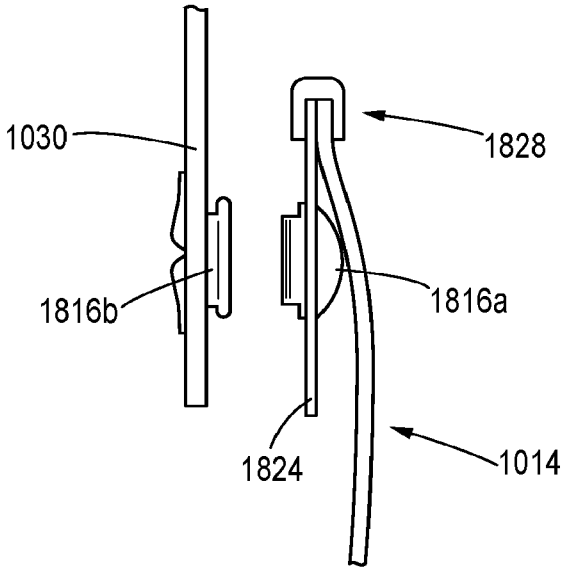

FIG. 132 is a section view of a portion of the divider top and the flat.

Figure 133:
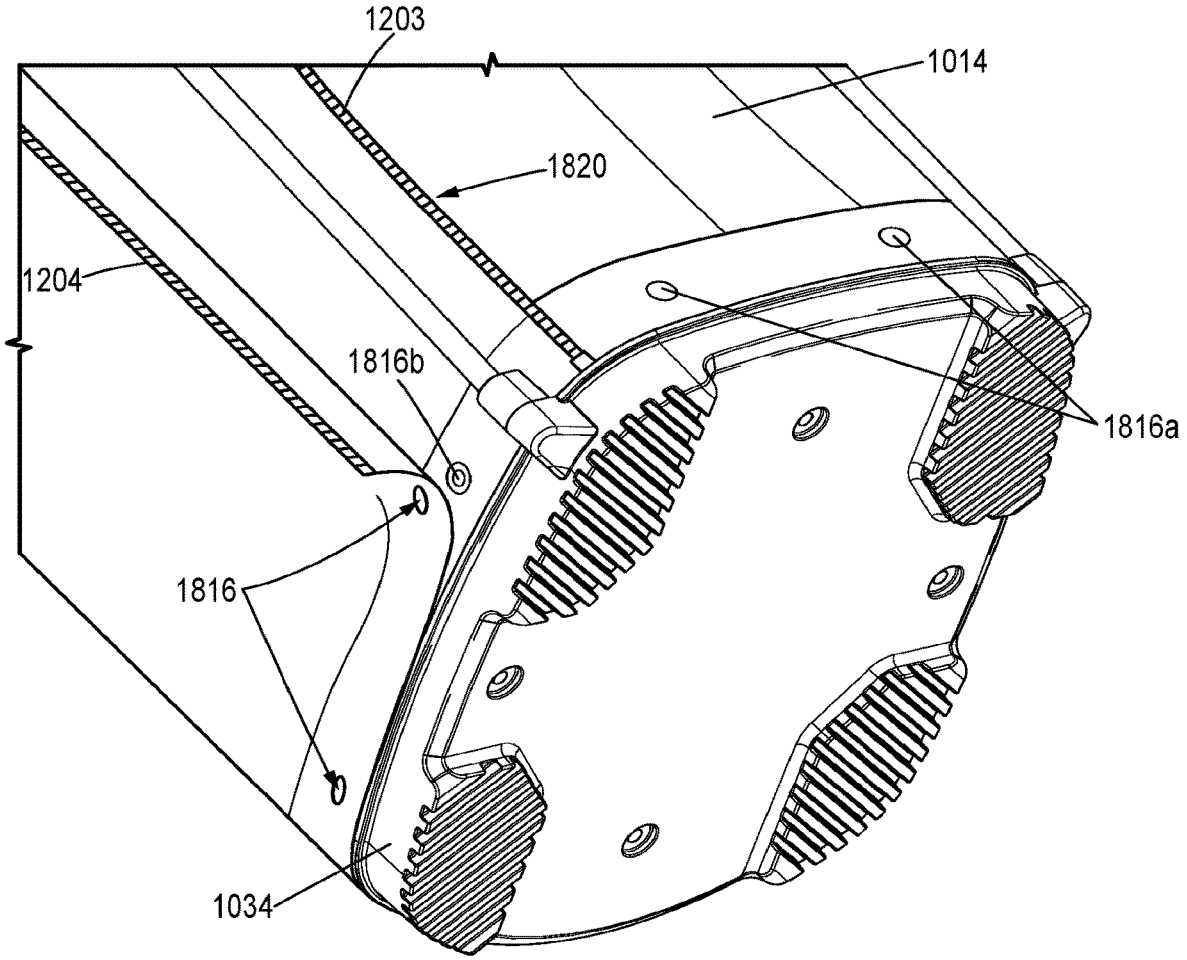

FIG. 133 is a perspective view of a portion of the flat being attached to the base of the sub-assembly of FIG. 115.

Figure 134:
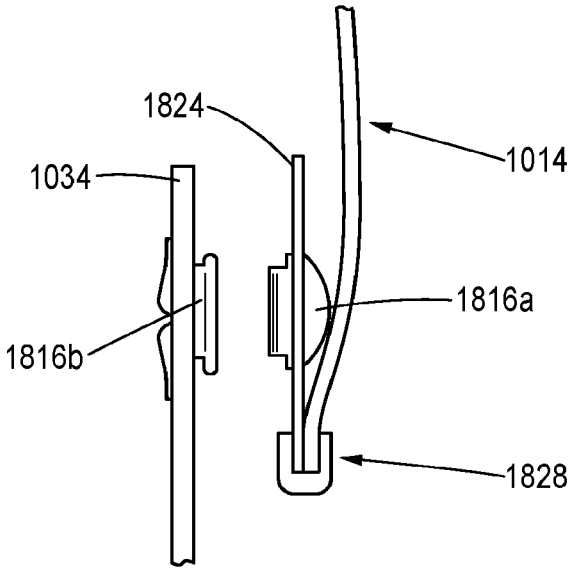

FIG. 134 is a section view of a portion of the base and the flat.

Figure 135:
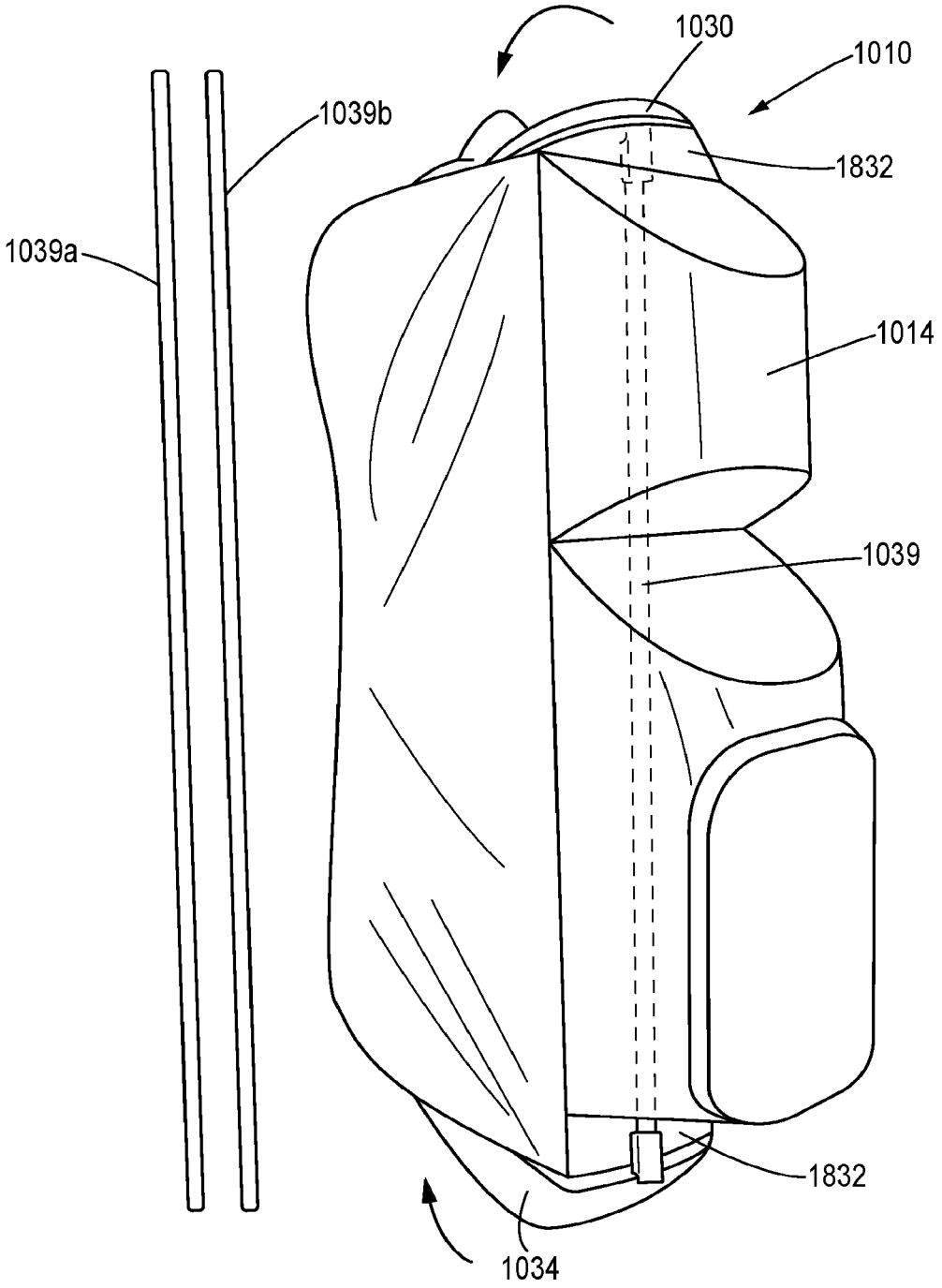

FIG. 135 is a perspective view of the golf bag of FIG. 113, shown in a collapsed configuration.

Figure 136:
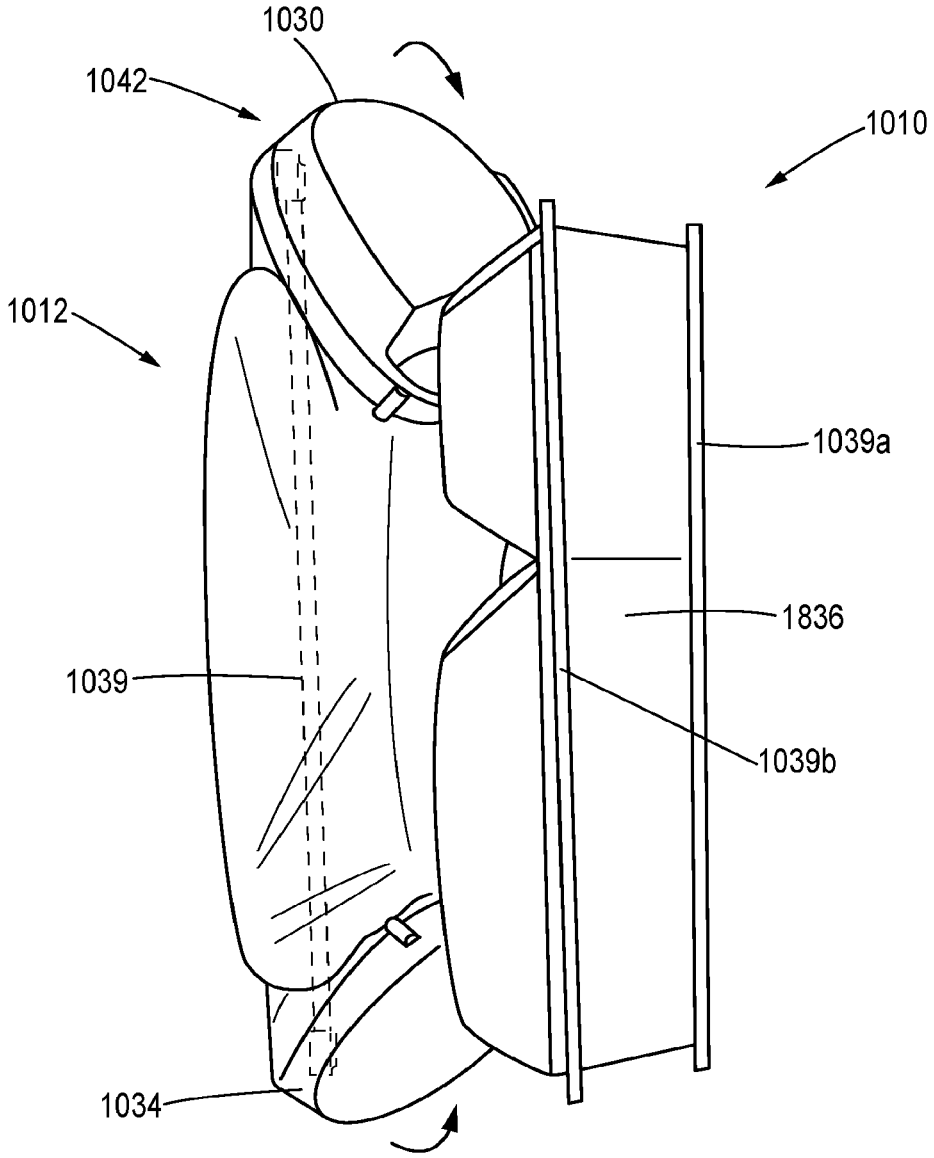

FIG. 136 is a perspective view of another embodiment of a golf bag, shown in a collapsed configuration.

Figure 137:
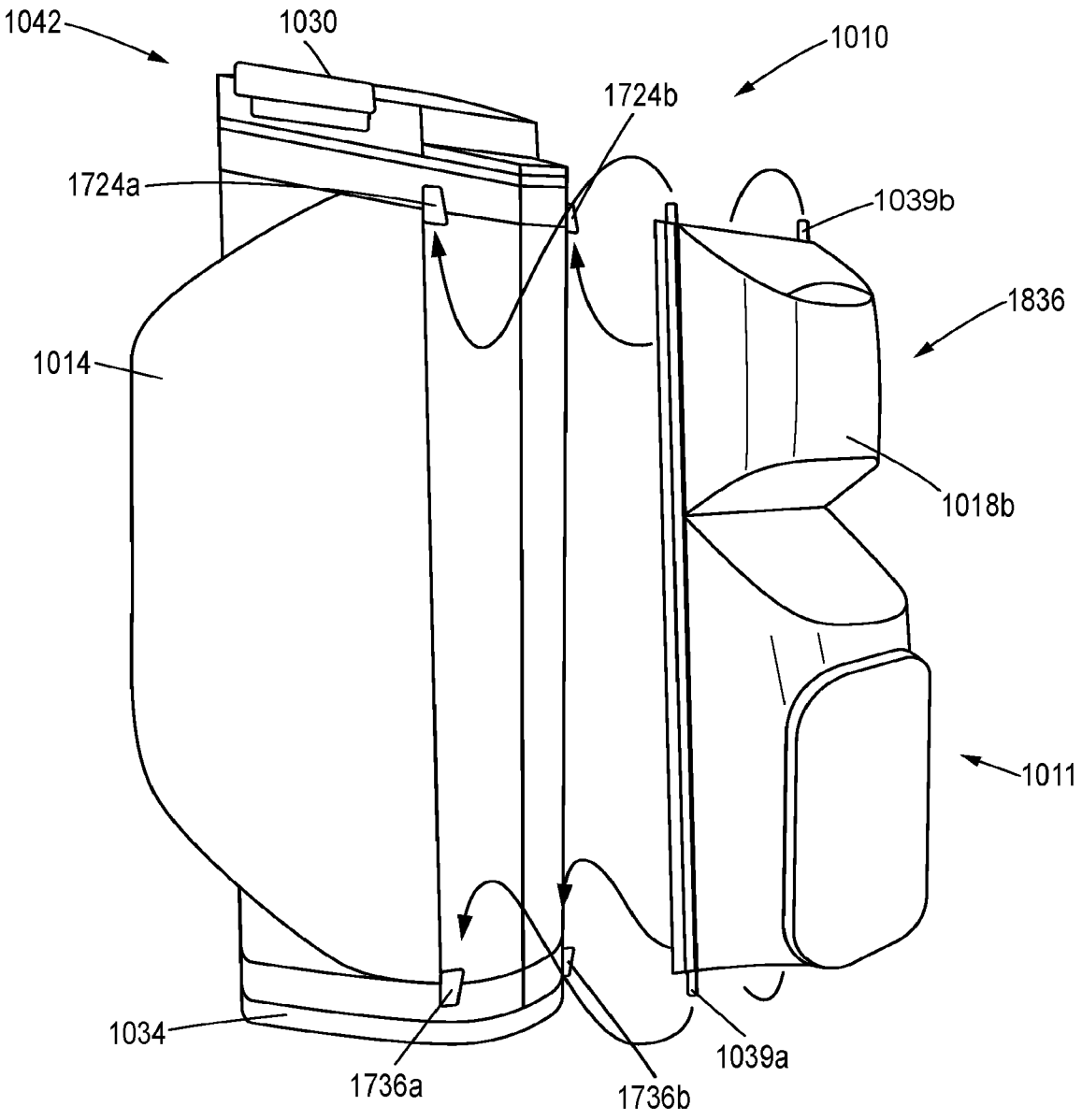

FIG. 137 is a perspective view of the golf bag of FIG. 136 illustrating assembly.

Figure 138:
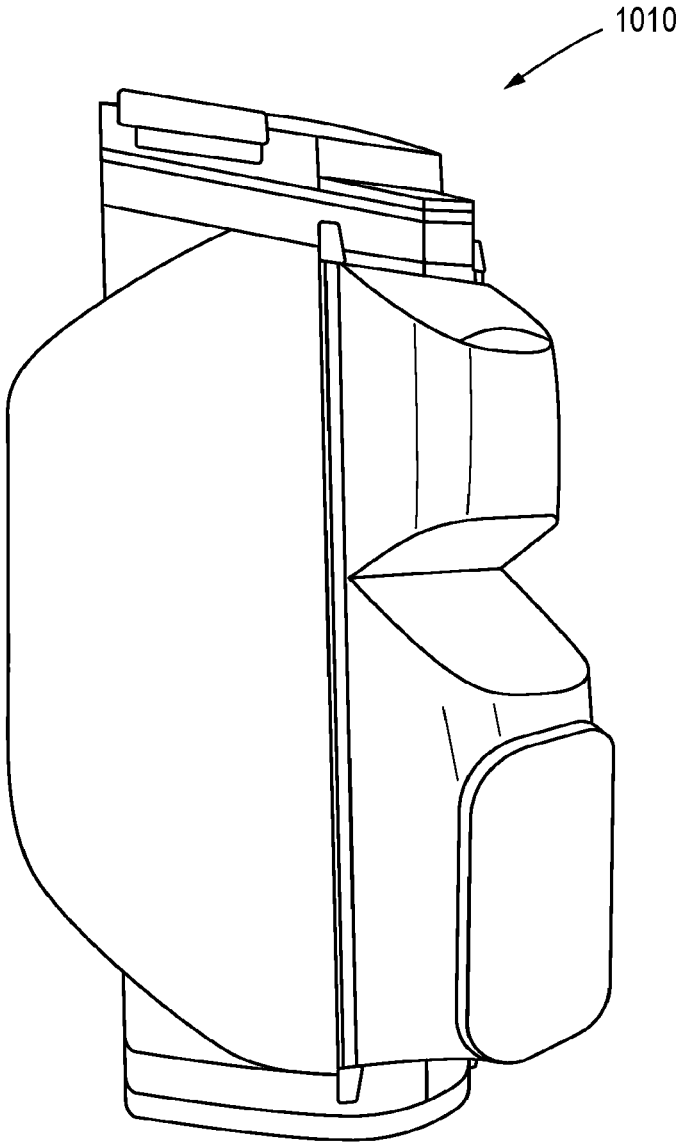

FIG. 138 is a perspective view of the golf bag of FIG. 136 in a deployed configuration.

Figure 139:
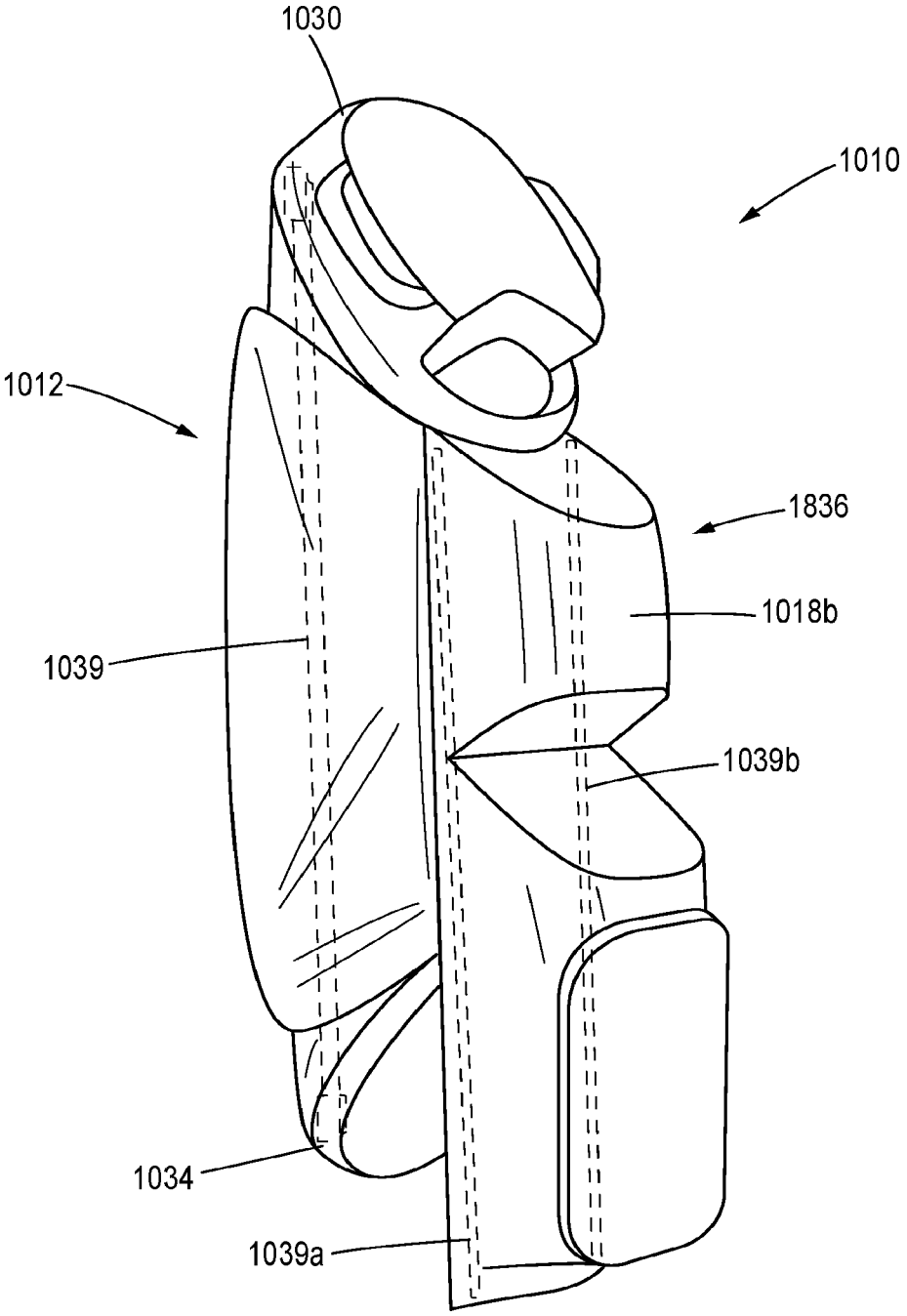

FIG. 139 is a perspective view of another embodiment of a golf bag, shown in a collapsed configuration.

Figure 103:
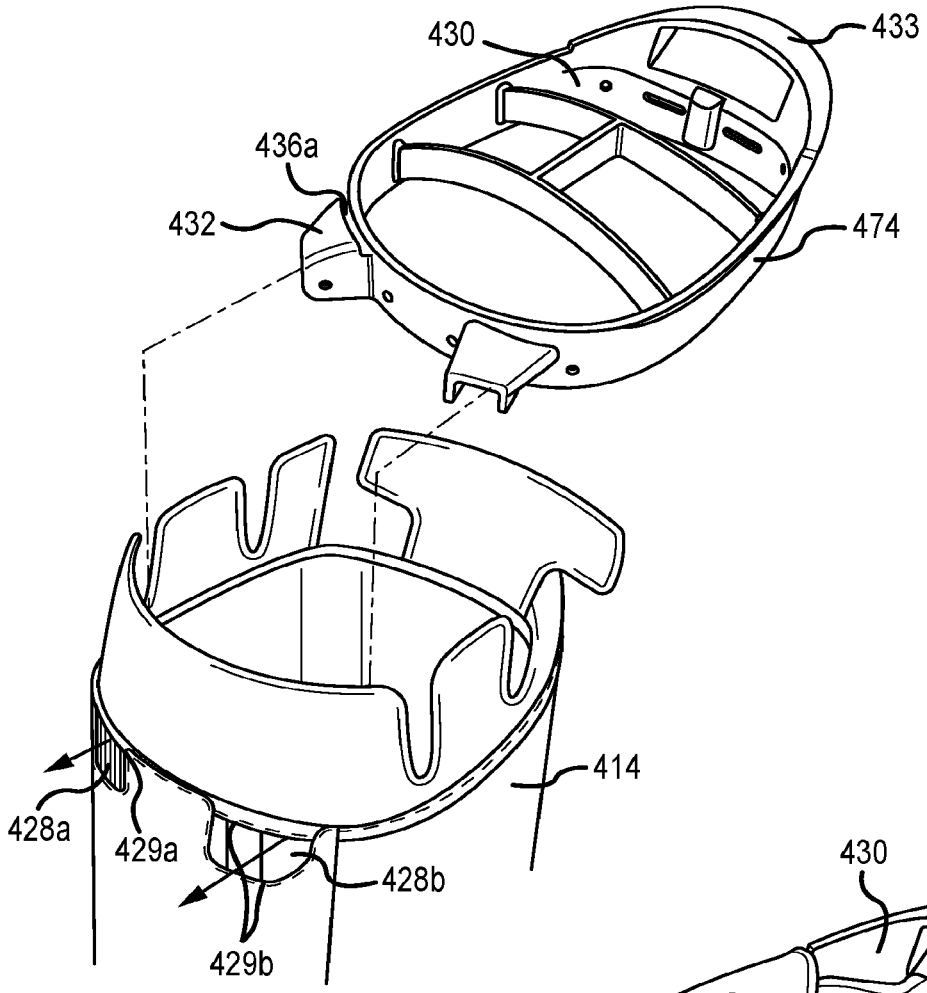
FIG. 103 is a perspective view a divider top with a leg mounting bracket being inserted into a flat with windows to receive the leg mounting bracket, according to an embodiment.
Figure 140:
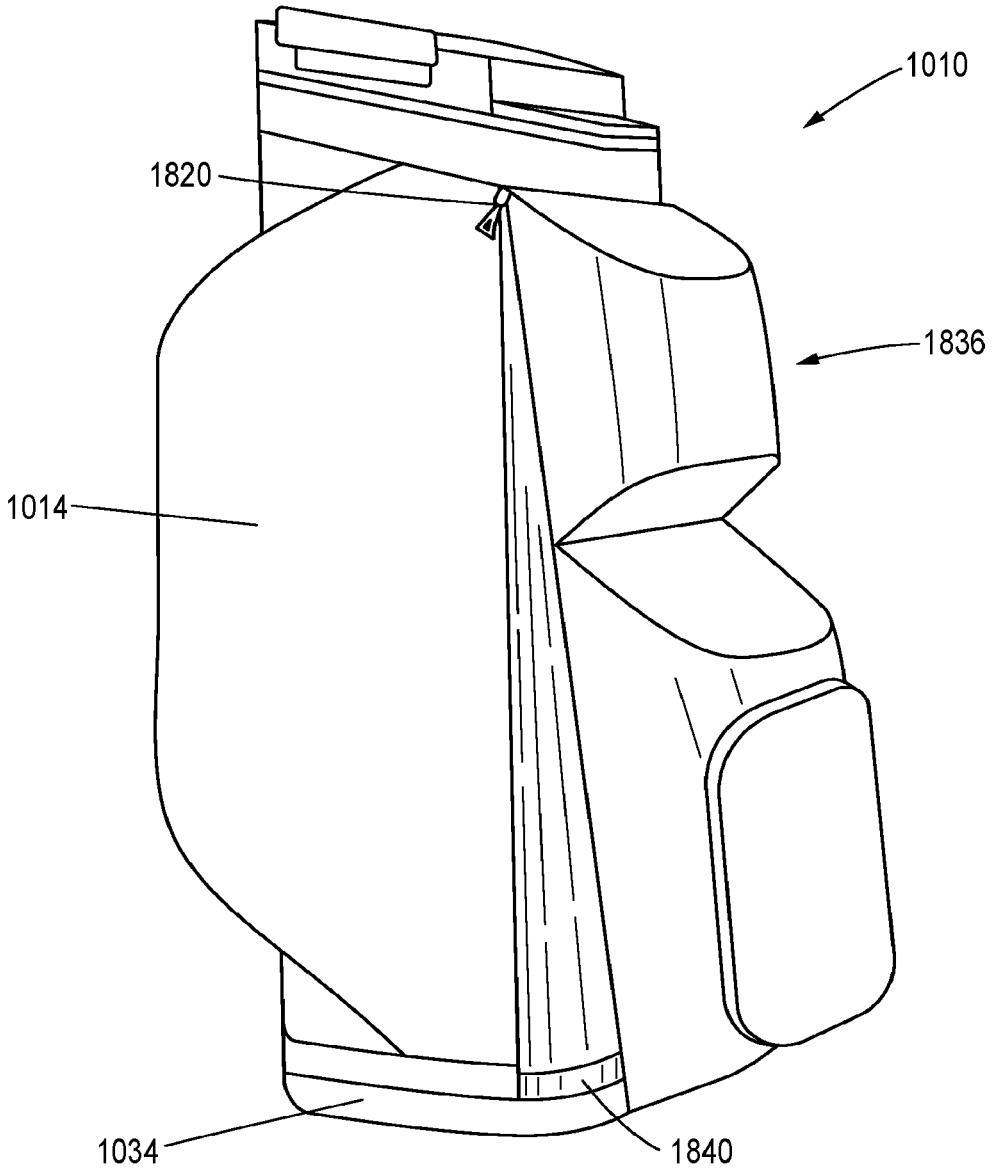

FIG. 140 is a perspective view of the golf bag of FIG. 103 illustrating assembly.

Figure 141:
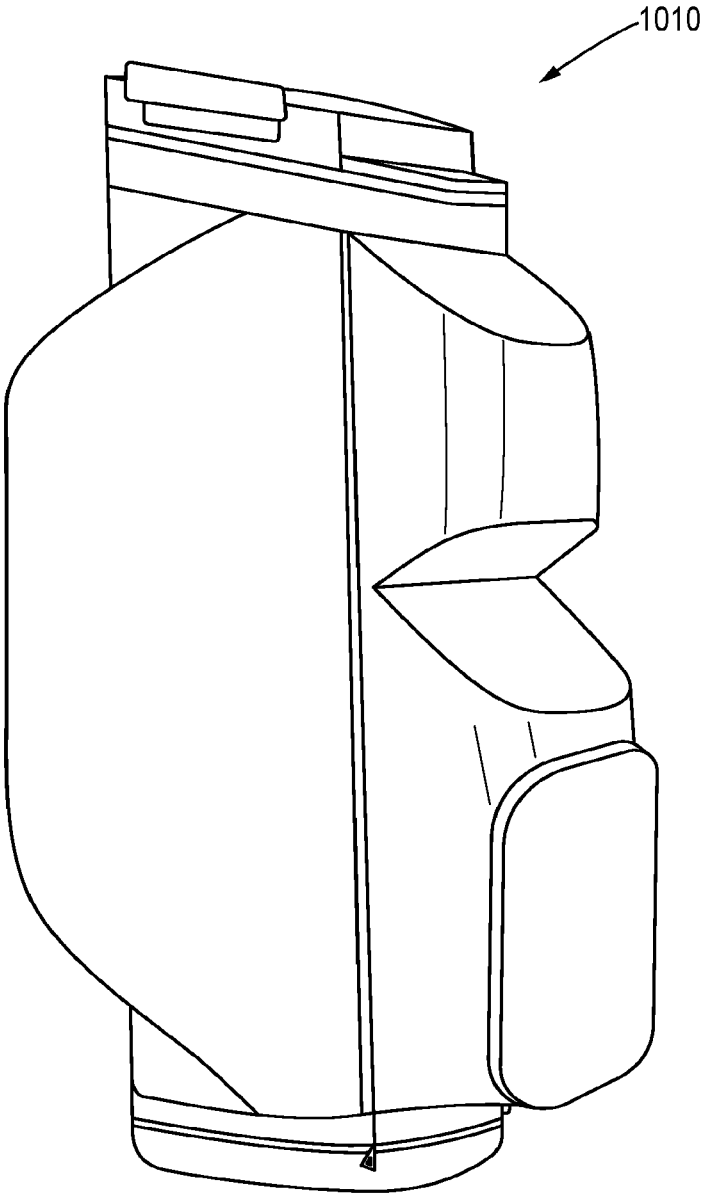

FIG. 141 is a perspective view of the golf bag of FIG. 139 in a deployed configuration.

Figure 142:
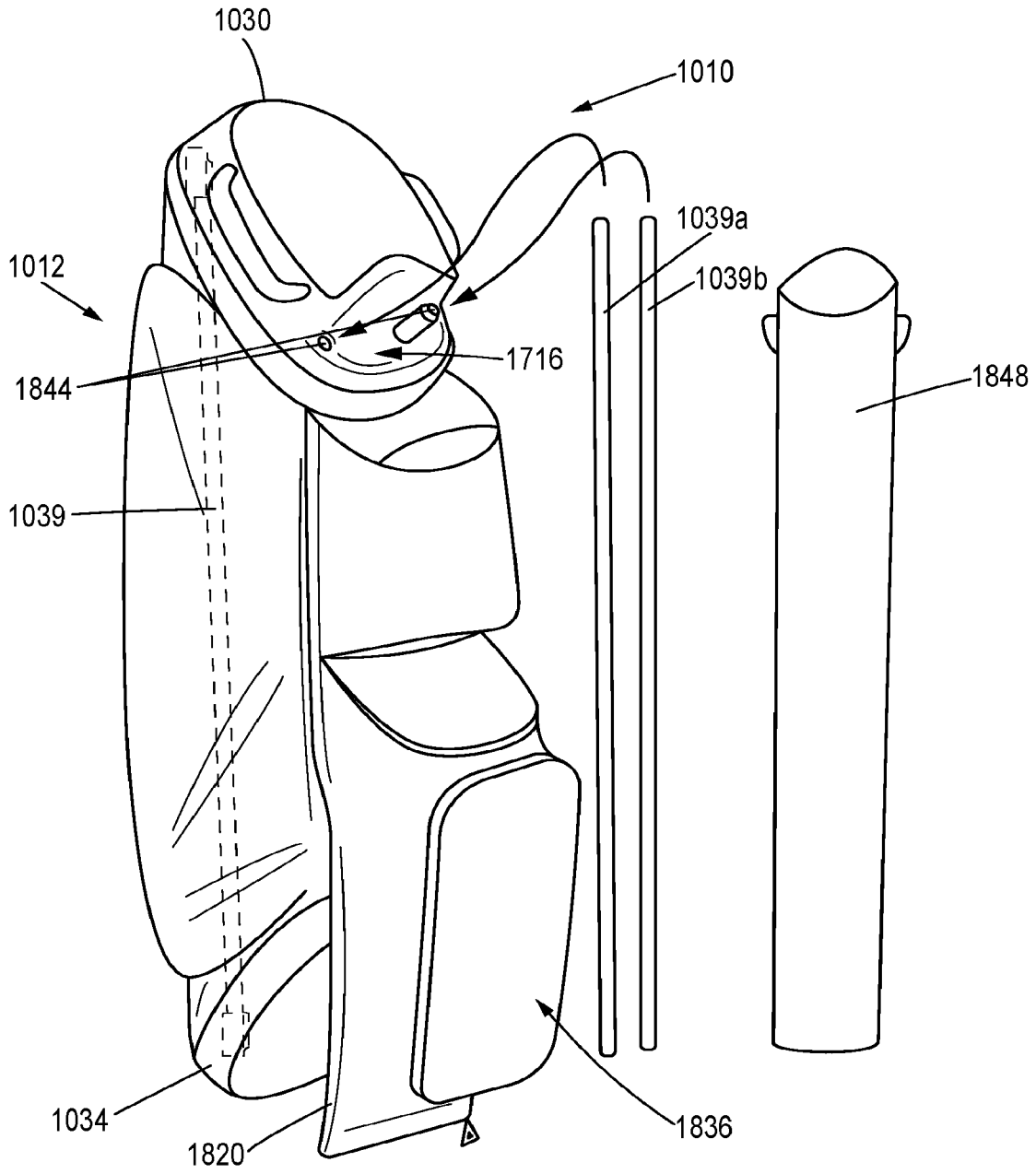

FIG. 142 is a perspective view of another embodiment of a golf bag, shown in a collapsed configuration.

Figure 143:
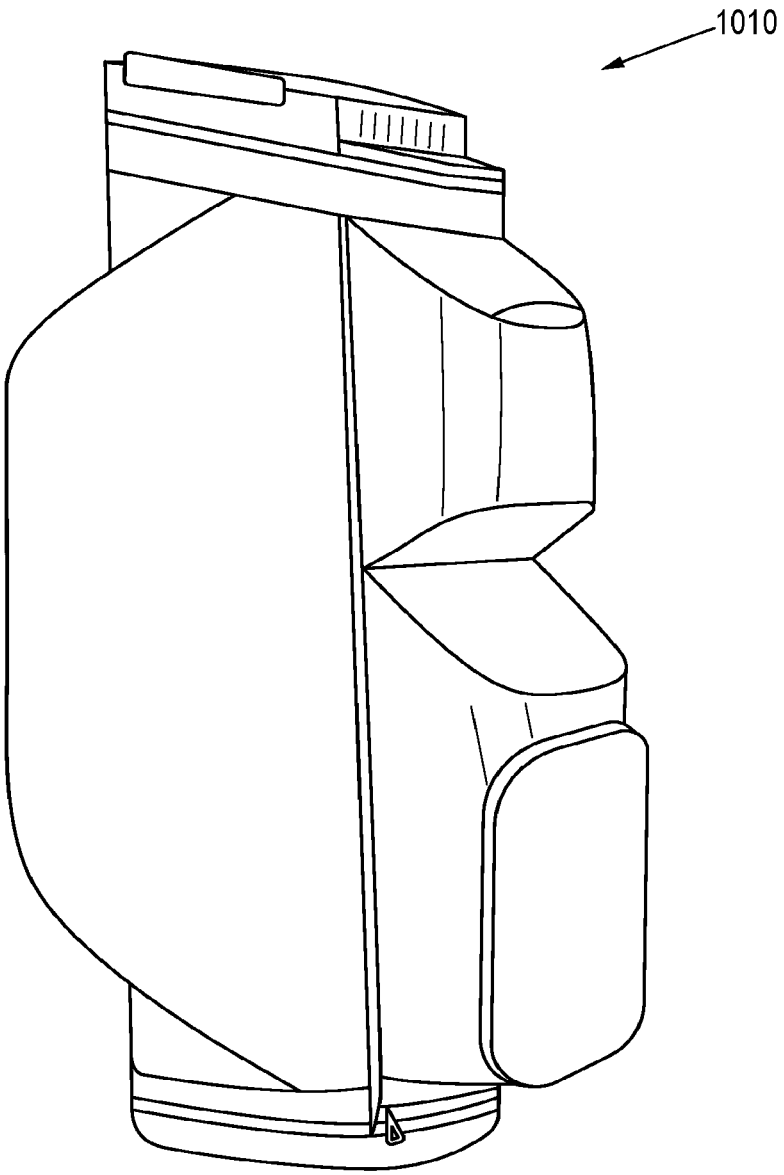

FIG. 143 is a perspective view of the golf bag of FIG. 142 in a deployed configuration.

Figure 144:
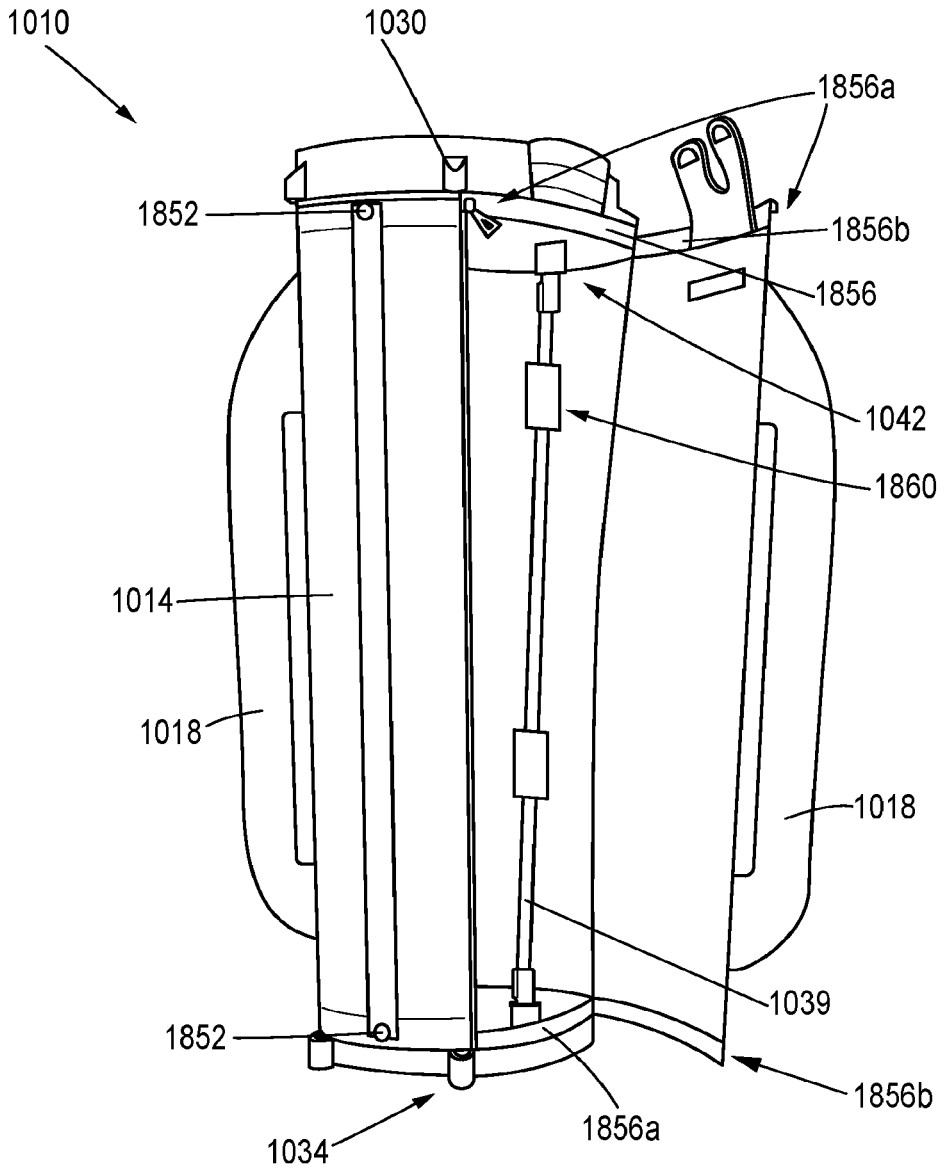

FIG. 144 is a perspective view of another embodiment of a golf bag, with a portion of the flat removed.

Figure 145A:
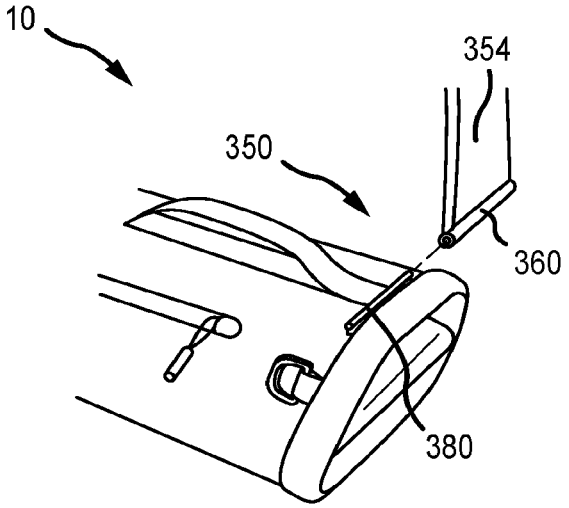

FIG. 145A is a perspective view of another embodiment of a golf bag, with a removable strap connection mechanism in a detached configuration.

Figure 145B:
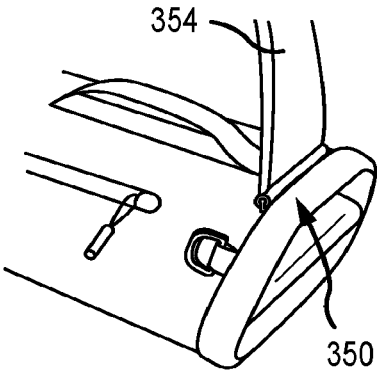

FIG. 145B is a perspective view of the golf bag of FIG. 145A, with the removable strap connection mechanism in an attached configuration.

Figure 146:
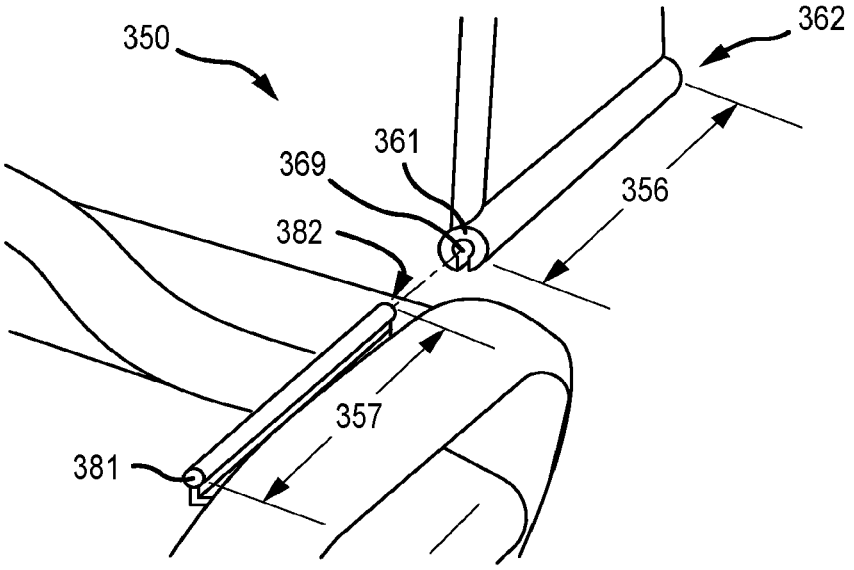

FIG. 146 is a close up perspective view of the golf bag of FIG. 145A, with the removable strap connection mechanism in a detached configuration.

Figure 147:
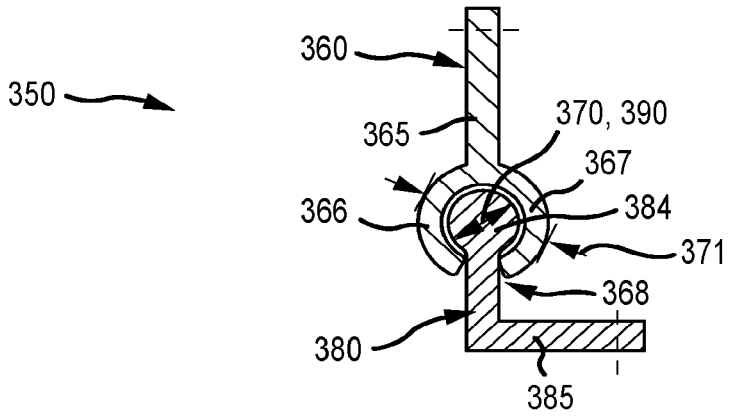

FIG. 147 is a cross-sectional view of the removable strap connection mechanism of FIG. 145B, with bag attachment tab at a 90 degree angle from the strap attachment tab.

Figure 148:
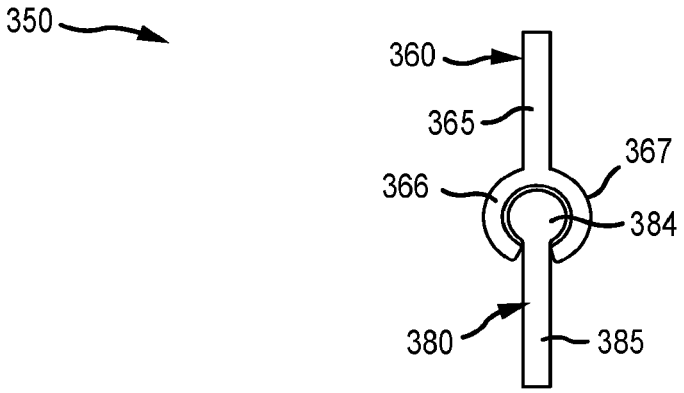

FIG. 148 is a cross-sectional view of the removable strap connection mechanism of FIG. 145B, with the bag attachment tab at a 180 degree angle from the strap attachment tab.

Presented below is a golf bag that can be a carry or cart bag that is manufactured so that the golf bag can be assembled through mechanical means such as snap fit connections that do not require complex tooling. This snap fit assembly provides economic savings in shipping costs, production time, and enables the end user to assemble a golf bag rather than previous golf bags that required full assembly at the molding or specialized manufacturing plant. The golf bag comprises a divider top, a divider sleeve, a base, and a flat. Some embodiments of the golf bag can further comprise a stand assembly with legs and a spring. The stand assembly can be deployed to support the golf bag or retracted to allow for convenient carrying or storing of the golf bag. As stated above, the components of the golf bag can use snap fit connections to engage other components of golf bag. The snap fit connections eliminate the need for riveting, which requires skilled labor and expensive equipment. The golf bag can comprise a sub-assembly from which the golf bag is assembled. The snap fit connections further enable the golf bag to be produced as a self-assembly kit which is completed by the end-user of the golf bag. In some embodiments, certain components, such as pockets, are removable from the golf bag. The removable nature of these components allows for quick and easy customization of the golf bag.

The golf bag incorporating a sub-assembly provides advantages over previously designed golf bags. These advantage include (1) improving the golfer's experience with the golf bag by reducing bunching or gathering of the divider sleeve near the base, (2) easing golf club insertion and removal from the golf bag when the golf bag is positioning in a tripod configuration with the stand assembly deployed. In addition, the connection members provide the manufacturer with the ability to adjust the tension of the divider sleeve (and sub-assembly) during manufacturing process. Further, efficiencies and cost savings are realized during manufacture and assembly of the golf bag described herein, including the reduction of installation materials, such as rivets, and the decrease of the amount of time to connect the sub-assembly to the divider top and base, through the use of snap fit connections and self-fasteners. This results in a reduction in total assembly time and cost for a golf bag. Shipping cost and tariff avoidance are also achievable because of the pre-assembled nature of the invention as well as reduced shipping volume.

Definitions

Unless otherwise defined, all technical and scientific terms used herein have the same meaning as commonly understood by one of ordinary skill in the art. In case of conflict, the present document, including definitions, will control. Preferred methods and materials similar or equivalent to those described herein can be used in practice or testing of the present invention. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein are intended to be open-ended transitional phrases, terms or words that do not preclude the possibility of additional acts or structures. The singular forms "a," "and" and "the" include plural references unless the context clearly dictates otherwise. The present disclosure also contemplates other embodiments "comprising," "consisting of" and "consisting essentially of" the embodiments or elements presented herein, whether explicitly set forth or not.

The modifier "about," "approximately," or "roughly" used in connection with a quantity is inclusive of the stated value and has the meaning dictated by the context (for example, it includes at least the degree of error associated with the measurement of the particular quantity). The modifier "about," "approximately," or "roughly" should also be considered as disclosing the range defined by the absolute values of the two endpoints. For example, the expression "from about 2 to about 4" also discloses the range "from 2 to 4." The term "about," "approximately," or "roughly" may refer to plus or minus 10% of the indicated number. For example, "about 10%" may indicate a range of 9% to 11%, and "about 1" may mean from 0.9-1.1. Other meanings of "about," "approximately," or "roughly" may be apparent from the context.

"Golf bag" as used herein may mean a special type of storage bag for holding or storing golf clubs. A golf bag can be used to store golf clubs long term or move and hold golf clubs during play. Some golf bags also provide a means of storing other paraphernalia, such as tees, golf balls, a range finder, ball marker, divet repair tools, golf gloves, rain gear for club and golf bag, and miscellaneous articles that a golf player may want access to on the golf course. A golf bag comprises at least a flat, one or more stays, a base, and a divider top, as defined below.

"Flat" as used herein may mean a tubular portion, outer shell, outer housing, or cover that attaches to and extends between the divider top and the base of a golf bag. The flat can be formed from leather, synthetic leather, fabric or other suitable material. The flat may include, among other features, one or more pockets and at least one carrying handle. Some embodiment of the flat further comprise one or more shoulder straps.

"Base" as used herein may mean a component that is a foundation for the golf bag. The base can support the golf clubs to prevent them from falling out of a bottom end of the flat. The base can be in contact with the ground, providing a sturdy structure that provides shape to the flat.

"Divider top" as used herein may mean a component that gives the top of the golf bag a rigid shape and comprises apertures for receiving and dividing out (or sorting) the golf clubs that are inserted into the flat.

"Stay(s)" as used herein may mean one or more stiff members that provide rigidity to the flat. The one or more stays connect the base and the divider top.

There are two classes of golf bags: "carry bags" and "cart bags," as described above. "Carry bag" as used herein may mean, as its name implies, a golf bag that is typically carried between holes by a golf player during a round of golf. The carry bag typically weighs less than the cart bag. To reduce weight, the carry bag typically is fabricated of lighter weight materials than the cart bag, and may have a smaller diameter, such as less than 9 inches. There are several types of carry bags, including a stand bag, which includes retractable legs that deploy to form a tripod and facilitate a free standing position, and a Sunday bag, which is effectively an ultra-lightweight, flexible "sleeve" that receives golf clubs, but has minimal storage capacity for golf accessories to further reduce weight.

"Cart bag" as used herein may mean a golf bag that is typically about 9 to 14 inches in diameter, includes a plurality of pockets for storing golf accessories (e.g. golf balls, rain gear, range finder, etc.), and is typically fabricated of a relatively stiff and heavy material including leather, synthetic leather, or fabric. Due to its substantial size, weight, and capacity for storing golf accessories, the cart bag is not typically carried by a golfer while playing golf. Instead, the cart bag is transported by a caddy, a motorized cart, a push cart, or a pull cart. Non-limiting examples of a cart bag include a staff bag or a tour bag.

"Snap fit connection" as used herein may mean any connection that is engaged via a pressing force and which cannot be released by an opposite pulling force of the same value. A snap fit connection can be a snap fastener, a snap fit attachment, an interference fit, a snap button, or other similar securing assembly that forms a connection or is otherwise connected by an assembler. A snap fit connection can be secured without the use of a tool.

Most snap fit connections comprise at least one flexible component. Typically, one component of the snap fit connection has a protrusion or ramp, and a second receiving component has an indentation, aperture, or housing that receives the protrusion or ramp of the first component. However, snap fit connections are not limited to this typical embodiment. Many elements of the golf bag are described with "snap fit" as an adjective, meaning that the element can be engaged with either itself or another element of the golf bag via a snap fit connection. For instance, a snap fit bracket could be a bracket that is engaged with the divider top via a snap fit connection.

"Collapse" as used herein may mean the action of folding, compacting, bending, compressing, or otherwise converting a unit to a state that takes up less volume than an original state or a deployed state of the unit. The collapsed state of the golf bag can also be called a "shipping configuration."

"Deploy" as used herein may mean the action of unfolding, expanding, opening up, or otherwise converting a unit to a state that takes up more volume than the collapsed state of the unit. The deployed state of the golf bag can also be called the "operational configuration."

"Recipient" as used herein may mean a user of the golf bag, a person (such as a customer) who receives the golf bag in the form it is shipped from a supplying company (as defined below), one or more persons associated with a point of sale (e.g., a golf shop, etc.), a distributor, or any other person who receives the golf bag.

"Assembler" as used herein may mean either a recipient who is required to self-assemble the golf bag or a worker at a manufacturing location who assists in the assembly process of the golf bag.

"Manufacturing site" as used herein may mean any factory, assembly plant, supplying company, manufacturing location, warehouse, workplace, or other location where assembly of the golf bag takes place before being sold, shipped, or otherwise given to the recipient.

"Supplying company" as used herein may mean the company which is selling, shipping out, or otherwise distributing the golf bag. It should be understood that the manufacturing sites, as defined above, are owned, contracted with, overseen, hired, or otherwise associated with the supplying company.

"Sub-assembly" as used herein may mean a grouping, assembly, unit, or structure of a number of components of the golf bag (for example, the base or the divider top). The sub-assembly is a partially assembled unit that can be used to complete the assembly of the golf bag. Different embodiments of the sub-assembly can comprise different components. In many embodiments, the sub-assembly is collapsible. The sub-assembly can be included in a golf bag kit, as defined below.

"Golf bag kit" as used herein may mean a collection of components or parts that can be assembled into a golf bag. The kit includes all the components necessary for completing the golf bag, with the possible exception of tools needed for assembly. The kit can comprise a golf bag that is partially assembled. In most embodiments, the kit comprises components, parts, a sub-assembly, and/or partially assembled portions of a golf bag that are collapsed into a box for shipping. In other words, the kit can comprise a golf bag in a collapsed configuration along with the necessary components to expand, deploy, and/or complete the golf bag. The volume of the box needed to hold the kit is generally less than the volume of a box that would be needed to hold the fully assembled golf bag. In some embodiments, the kit components are shipped in separate boxes, but the overall shipping volume of the components remains less than the shipping volume of the fully assembled golf bag. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

I. Golf Bag

Described herein is an easy to manufacture golf bag that further saves on shipping costs, without sacrificing ergonomics, durability, and a multitude of options for storing and carrying golf clubs and golf related items needed by a golfer during a round of golf. The golf bag can comprise snap fit components. The golf bag can be a carry bag or a cart bag. The carry bag comprises at least a flat including one or more straps, one stay, a base, a divider top, and a stand assembly including legs. The cart bag comprises at least a flat, two or more stays, a base, and a divider top. For ease of discussion and understanding, and for the purposes of description only, the following detailed description illustrates a golf bag as a carry bag or as a cart bag. It should be appreciated that the referenced figures are provided for purposes of illustration and aspects of the carry bag 10 or cart bag 1010 are disclosed herein may be incorporated into a golf bag of any suitable class, type, or size. Generally, the golf bag 10, 1010 is of a size suitable to carry a plurality of full length golf clubs, for example, a set of golf clubs that includes a combination of one or more of a driver, a wood, a hybrid, an iron, a wedge, and/or a putter. A full length golf club is not collapsible, and has a length of approximately 32 inches to approximately 49 inches, depending on the club.

FIGS. 1-90, 94A-104, and 107-110 illustrate embodiments a golf bag 10 having features and embodiments that resemble a carry type golf bag. FIGS. 91-93C, 105A-106, and 111-144 illustrate embodiments of a golf bag 1010 having features typically associated with a cart bag. The features disclosed for golf bag 10 and golf bag 1010 can be selectively implemented into either a carry bag or a cart bag as appropriate. For the purposes of the following description, golf bags 10 and 1010 are referenced both as generic golf bags and specifically as a carry bag 10 and a cart bag 1010.

FIGS. 1B, 1C, 1D, and 1E illustrate a right side view, a back view, a left side view, and a front view, respectively, of an embodiment of a golf bag 10. Referencing FIGS. 1 and 113, general components of a golf bag 10, 1010 include a base 34, 1034, a divider top 30, 1030, a divider sleeve 46, 1046, one or more stays 39, 1039, and a flat 14, 1014. The golf bag 10, 1010 can be formed from a sub-assembly 42, 1042 comprising one or more of: the base 34, 1034, divider top 30, 1030, divider sleeve 46, 1046, one or more stays 39, 1039, and flat 14, 1014. The divider top 30, 1030 attaches to the one or more stays 39, 1039, the flat 14, 1014, and the divider sleeve 46, 1046. The base 34, 1034 attaches the one or more stays 39, 1039, the flat 14, 1014, and the divider sleeve 46, 1046. The one or more stays 39, 1039 provide rigidity to the golf bag 10, 1010, holding the base 34, 1034 and divider top 30, 1030 in a fixed position relative to each other. The roughly cylindrical flat 14, 1014 defines a compartment for storing the golf clubs and stretches between the divider top 30, 1030 and the base 34, 1034. The divider sleeve 46, 1046 attaches to the divider top 30, 1030 and stretches towards the base 34, 1034. The divider sleeve 46, 1046 is either attached to the base 34, 1034 or a bottom end of the flat 14, 1014 via connection members 50. The divider top 30, 1030 and divider sleeve 46, 1046 provide a means of separating the golf clubs within the golf bag 10, 1010 so that the golf clubs do not bunch together or catch on each other. The components of the golf bag 10, 1010 are described in more detail in the sections below.

A. Divider Top & Divider Sleeve

Figure 7:
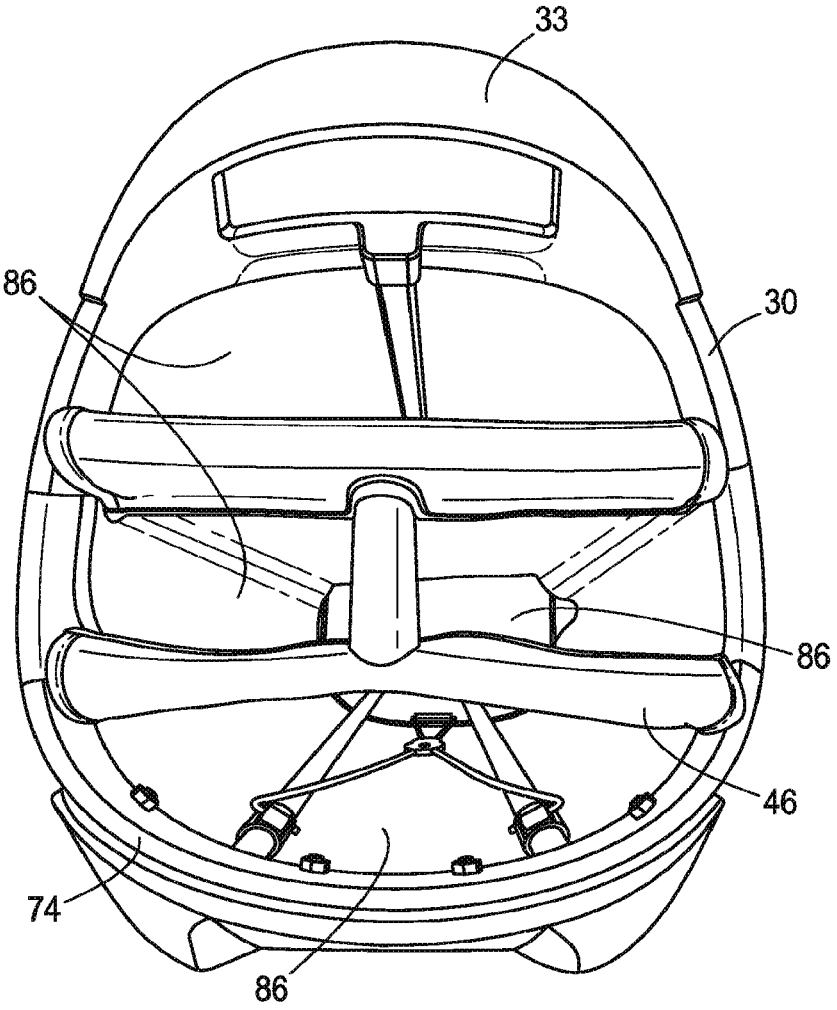
FIG. 7 is a perspective view of a portion of the golf bag of FIG. 2 taken along line 7-7 of FIG. 2, illustrating the divider top with the divider sleeve attached.

The golf bag 10, 1010 comprises a divider top 30, 1030 and divider sleeve 46, 1046. FIGS. 7, 8, 117, and 118 illustrate a divider top 30, 1030. FIG. 7 illustrates the divider top 30 with the divider sleeve 46 attached. As shown in FIG. 7, the divider apertures 82 define an entry to a plurality of divider sections 86 of the divider sleeve 46 that extend from the divider top 30 towards the base 34. The divider sections 86, 1086 respectively receive one or more golf clubs, allowing a golfer to sort or isolate certain golf clubs while the clubs are received in the golf bag 10, 1010. For example, the golfer may isolate woods and/or hybrids from irons. As another example, the golfer may sort irons between a plurality of divider sections 86, 1086 such as lower lofted irons (e.g. 4-iron through 7-iron) being in a separate divider section 86, 1086 than higher lofted irons (e.g. 8-iron through wedge(s)).

Figure 8:
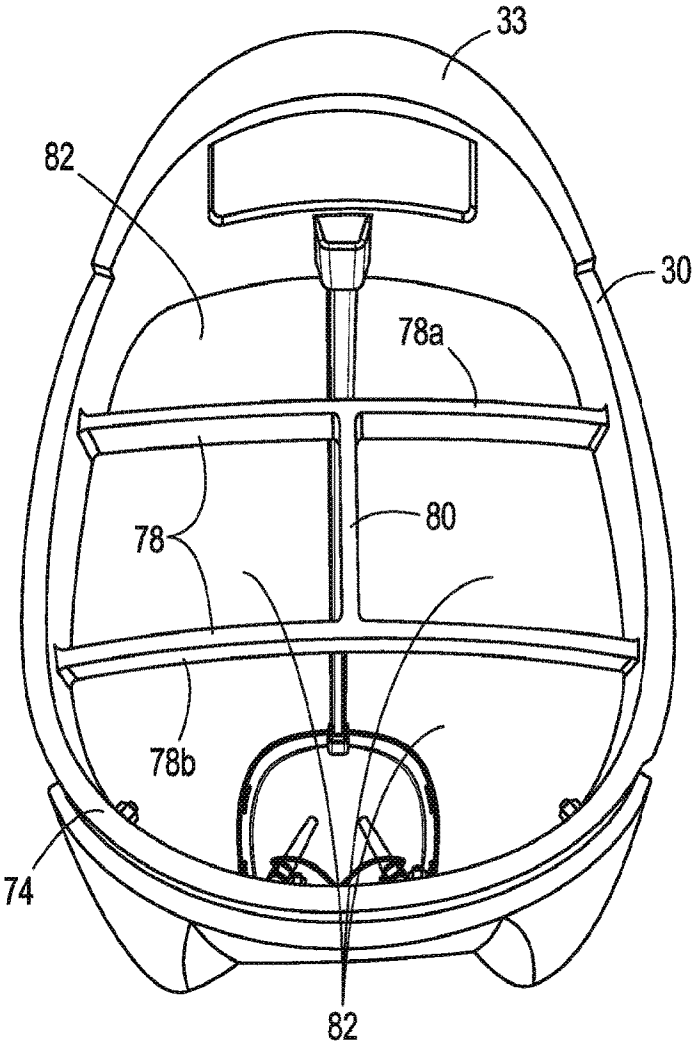
FIG. 8 is a perspective view of a portion of the golf bag of FIG. 7, illustrating the divider top with the divider sleeve removed.

The divider top 30, 1030 includes an outer ring 74, 1074 that defines a perimeter of the divider top 30, 1030. The divider top 30, 1030 comprises one or more handles 33, 1033*a*, 1033*b*, which are formed with or otherwise connected to the divider top 30, 1030, and extend beyond the perimeter defined by the outer ring 74, 1074. Referring now to FIGS. 8, 117, and 118, the divider sleeve 46, 1046 is detached to further illustrate the divider top 30, 1030. In one embodiment, at least one cross member 78, 1078, extends across a portion defined by the outer ring 74, 1074 to define a plurality of divider apertures 82, 1082. As illustrated in FIG. 8, a plurality of cross members 78*a*, 78*b* extend across portions defined by the ring 74, and at least one intermediate member 80 extends between the cross members 78*a*, 78*b* to define divider apertures 82. The cross members 78, 1078 and/or intermediate members 80, 1080 can define any suitable number of divider apertures 82, 1082, including, but not limited to, 2, 3, 4, 5, 6, 7, 8, 9, 10, 11, 12, 13, 14, 15, 16, 17, 18, or 20 apertures.

The divider apertures 82, 1082 can comprise various shapes including, but not limited to, squares, rectangles, triangles, parallelograms, trapezoids, circles, and ovals. Multiple shapes of divider apertures 82, 1082 can be implemented into the same divider top 30, 1030 to create a pattern. In some embodiments, one or more divider apertures 82, 1082 are shaped to accommodate a specific type of club. For example, in the embodiment of FIG. 117, putter well aperture 1716 is designed to accommodate a putter-type club. In some embodiments, one or more apertures 82, 1082 can open at different heights above a bottom edge of the divider top 30, 1030. Differing heights of the apertures can allow for shorter clubs to be placed in the apertures that open at a lower height and longer clubs to be placed in the apertures that open at a higher height.

The divider top 30, 1030 further comprises a top stay receiving channel 166, 174*a*, which is configure to receive a top stay hinge 162, 1740, and connects the stay 39, 1039 to the divider top 30, 1030. Typically, the top stay receiving channel 166, 174*a* is located on an interior surface of the outer ring 74, 1074 and positioned adjacent to a back side of the golf bag 10, 1010. Some embodiments of the divider top 30, 1030 can also comprise one or more stay hubs for directly receiving secondary stays. These stay hubs can be located on an external surface of the outer ring 74, 1074.

Some embodiments of the divider top 30, 1030 further comprise a flat attachment mechanism for engaging the flat 14, 1014. The flat attachment mechanism for engaging the flat 14, 1014 can comprise attachment apertures, snap buttons, surfaces to engage self-fastening connection members of the flat, or other suitable connection means. In most embodiments, the flat attachment mechanism is integral or located on the outer ring 74, 1074. In some embodiments, the flat is directly sewn or adhered to the divider top 30, 1030 rather than being connected via an attachment mechanism.

In some embodiments, the divider top 30, 1030 further comprises a divider attachment mechanism. The divider attachment mechanism can comprise attachment apertures, snap buttons, other snap fit connections, surfaces to engage self-fastening connection members of the divider sleeve 46, 1046, or other suitable connection means. The connection of the divider sleeve 46, 1046 to the divider top 30, 1030 is described in further detail below.

The divider top 30, 1030 can be formed as one integral piece or multiple pieces joined together. In some embodiments, the divider top 30, 1030 comprises multiple pieces to allow for easy customization of the divider top 30, 1030. The divider top 30, 1030 can be a modular divider top assembly, such as modular divider top assembly 830 described below. The divider top 30, 1030 can comprise a cover, such as cover 870 described below. Multi-piece embodiments of the divider top 30, 1030 can allow for color customization and/or divider aperture customization. For example, the number and/or shape of apertures 82, 1082 can be customized based on the recipient's desired aperture pattern. Some golfers prefer a large number of apertures 82, 1082 to allow sorting of each golf club into an individual aperture 82, 1082. Other golfers prefer a small number of apertures 82, 1082 to allow easy insertion of multiple clubs into each of the larger apertures.

1. Modular Divider Top

Referring to FIGS. 94-97, a modular divider top assembly 830 comprising a top ring 840 and a cross member portion 850 is illustrated. Although the illustrated embodiment of the modular divider assembly 830 resembles the divider top 30 of a carry bag, the modular divider assembly 830 concept can be applied in any class, type, or design of golf bag. The divider top portions are molded such that the cross member portion 850 fits within the top ring portion 840. In some embodiments, the cross member portion 850 attaches to the divider sleeve 46. The modular coupling of the top ring 840 and the cross member portion 850 allows various embodiments of the cross member portion 850 to be interchangeably attached to the top ring 840. This allows for cost-effective customization of the divider layout in a golf bag 10, 1010.

Figure 96:
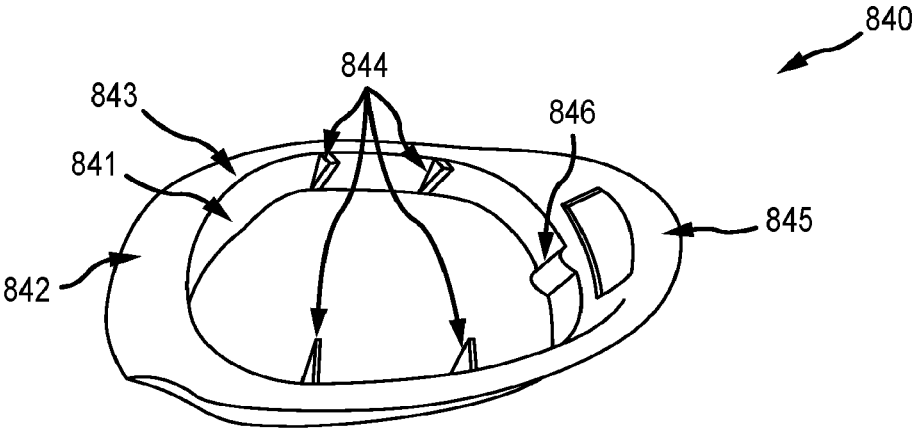
FIG. 96 is a perspective top view of the top ring of the modular divider top, according to an embodiment.
Figure 97A:
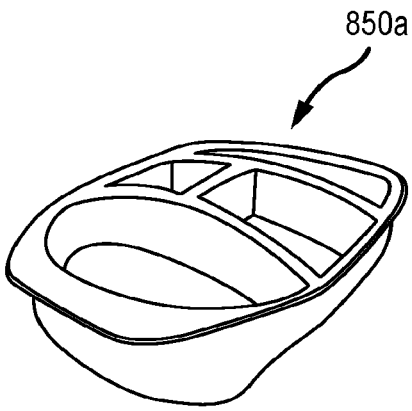
FIG. 97A is a perspective view of the cross-member portion of the modular divider top of FIG. 94A.
Figure 97B:
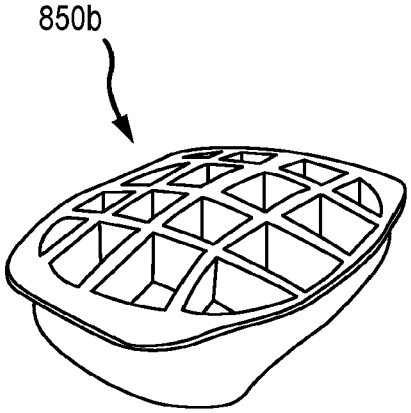
FIG. 97B is a perspective view of the cross-member portion of the modular divider top of FIG. 94B.
Figure 98:
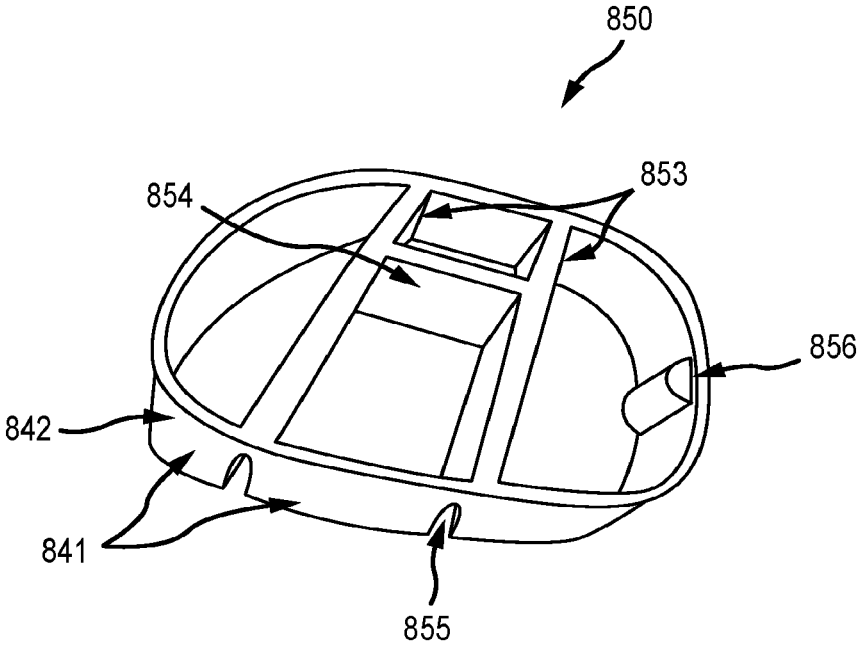
FIG. 98 is a perspective top view of the cross-member portion of FIG. 97A.
Figure 99:
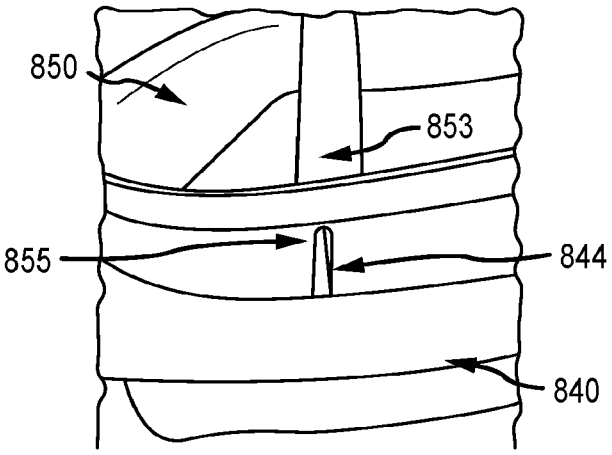
FIG. 99 is an perspective side view of the cross-member portion being inserted onto the top ring of the modular divider top, according to an embodiment.

As illustrated in FIG. 96, the top ring 840 of the modular divider top 830 comprises an wall 841, a ledge 842, an interior shelf 843, interior supports 844, and a handle 845. Some embodiments comprise more than one handle. The wall 841 forms a bottom portion of the top ring 840 and extends vertically downward from the ledge 842. The wall 841 can have a height between 0.5 and 2.5 inches. The height of the wall 841 is measured from a bottom edge of the wall 841 to the wall's intersection with the ledge 842. For instance, the wall height can be 0.5, 1.0, 1.2, 1.4, 1.6, 1.8, 2.0, 2.2, 2.4, or 2.5 inches. The ledge 842 of the top ring 840 extends outward from the wall 841 and corresponds to a ledge on the golf bag 10 body. The ledge 842 helps retain the top ring 840 at the top of the golf bag 10, preventing it from slipping down into the body of the golf bag 10. The handle 845 is located at a rear end of the top ring 840, such that when the top ring 840 is installed on the golf bag 10, the handle 845 is located at the back side of the golf bag 10. The interior shelf 843 of the top ring 840 corresponds to a ledge of the cross member portion 850. The interior shelf 843 can circumscribe the entire interior of the top ring 840, or the interior shelf 843 can circumscribe only a portion of the top ring 840 interior.

Figure 2:
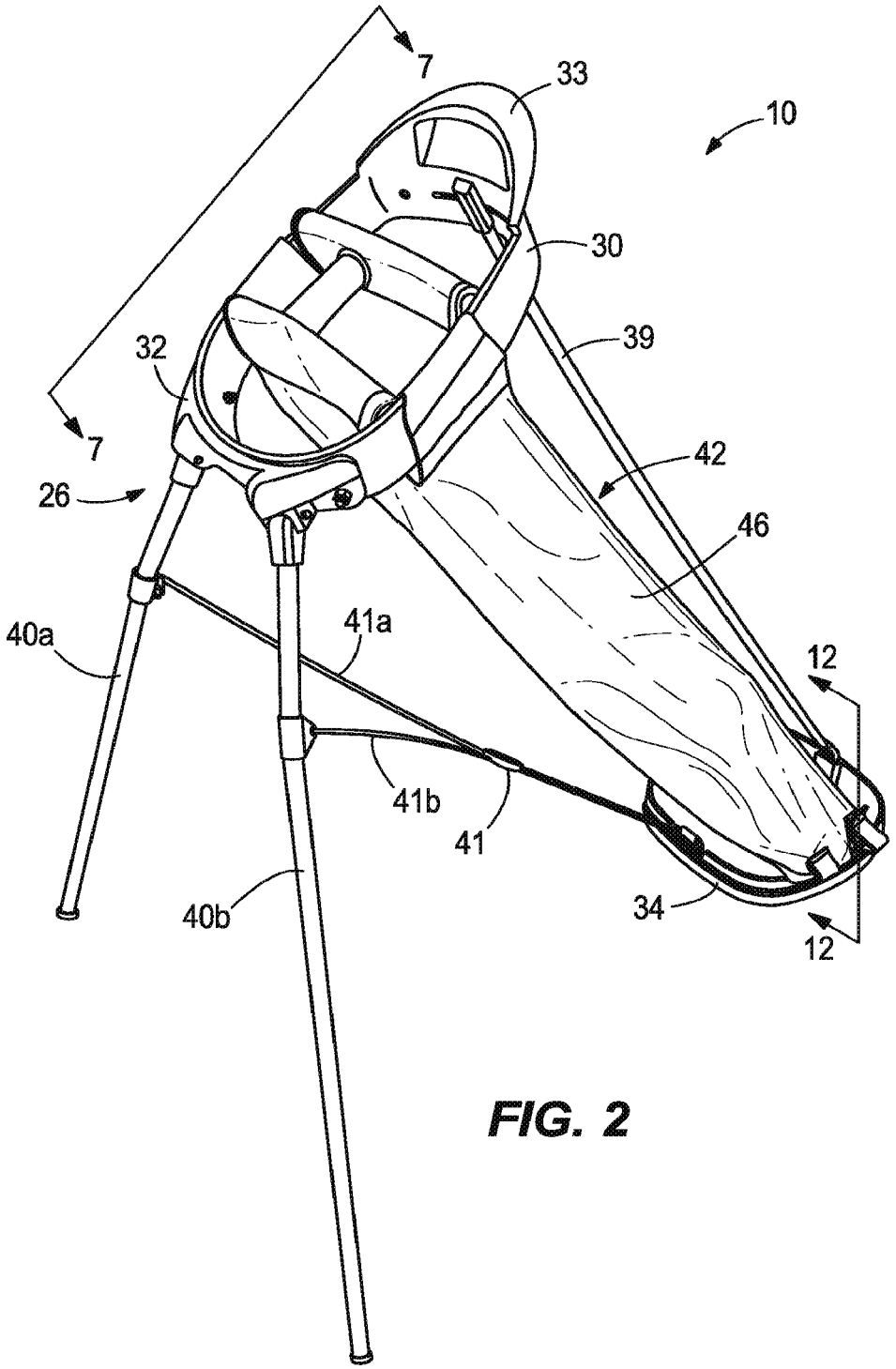
FIG. 2 is a perspective view of a second side of the golf bag of FIG. 1A, opposite the first side and with the flat removed to illustrate a sub-assembly.

In some embodiments, interior supports 844 extend inward from a plurality of sides of the top ring 840. The interior supports 844 can comprise side-to-side supports and/or front-to-back supports (not illustrated). The top ring 840 can comprise no supports or 1, 2, 3, 4, 5, or 6 supports. In some embodiments, the interior supports 844 are ribs that extend inward and upward at an angle of between 15 and 45 degrees. The interior supports 844 can be 15, 20, 25, 30, 35, 40, or 45 degrees. These ribs can comprise a length between 0 and 2 inches. The length of the ribs can be 0.2, 0.4, 0.6, 0.8, 1.0, 1.2, 1.4, 1.6, 1.8, or 2.0 inches. These ribs can connect to the top ring at one end of each rib, as depicted in FIG. 2. In other embodiments, the interior supports are beams (not illustrated) that extend either fully from one side of the top ring 840 to an opposite side of the top ring 840 (side-to-side supports) or fully from a front to a back of the top ring 840 (front-to-back supports). In some embodiments, the front-to-back supports may intersect two or more of the side-to-side supports. Similarly, the side-to-side supports may intersect two or more of the front-to-back supports. The beams may take on a straight or an arcuate shape. Some embodiments, such as the one illustrated in FIG. 95, do not include interior supports. In some embodiments, the top ring 840 further includes an internal protrusion 846 near the rear end of the top ring 840. The internal protrusion 846 can comprise a hub for the stay 39 to connect to the modular divider assembly 830. The hub has a cavity that extends up into the internal protrusion 846 for receiving the stay 39.

As illustrated in FIG. 96, the cross member portion 850 of the modular divider top 830 comprises a main body wall 851, an external ledge 852, a plurality of side-to-side cross members 853, and a plurality of front-to-back cross members 854. The main body wall 851 is sized to fit within the top ring 840. The external ledge 852 circumscribes the main body wall 851 and corresponds to the interior shelf 843 of the top ring 840. The interior shelf 843 of the top ring 840 and the external ledge 852 of the cross member portion 850 prevents the cross member portion 850 from sliding below the top ring 840 and helps secure the cross member portion 850 in place. The plurality of side-to-side cross members 853 can comprise 1, 2, 3, 4, or more cross members that extend from one side of the main body wall 851 to an opposite side of the main body wall 851. In some embodiments, one or more of the side-to-side cross members 853 intersect two or more of the front-to-back cross members 854. In some embodiments, one or more of the side-to-side cross members 853 do not contact the main body wall 851. The plurality of front-to-back cross members 854 can comprise 1, 2, 3, 4, 5, or more cross members. In some embodiments, one or more of the front-to-back cross members 854 intersect two or more of the side-to-side cross members 853. In some embodiments, one or more of the front-to-back cross members 854 do not contact the main body wall 851 of the cross member portion 850.

Figure 3:
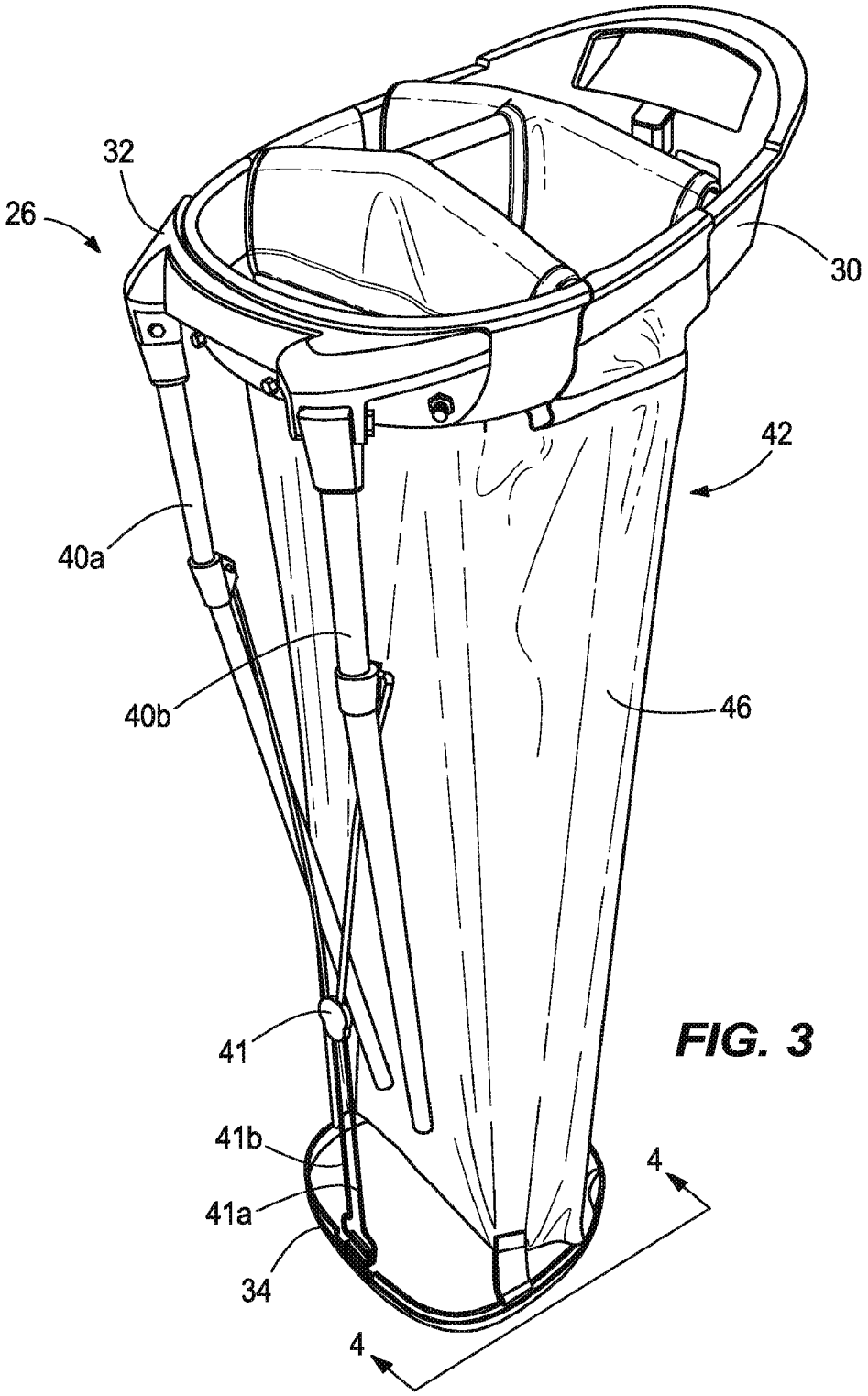
FIG. 3 is a perspective view of the golf bag of FIG. 2, illustrating the sub-assembly with the stand in a retracted configuration to facilitate carrying of the bag.
Figure 4:
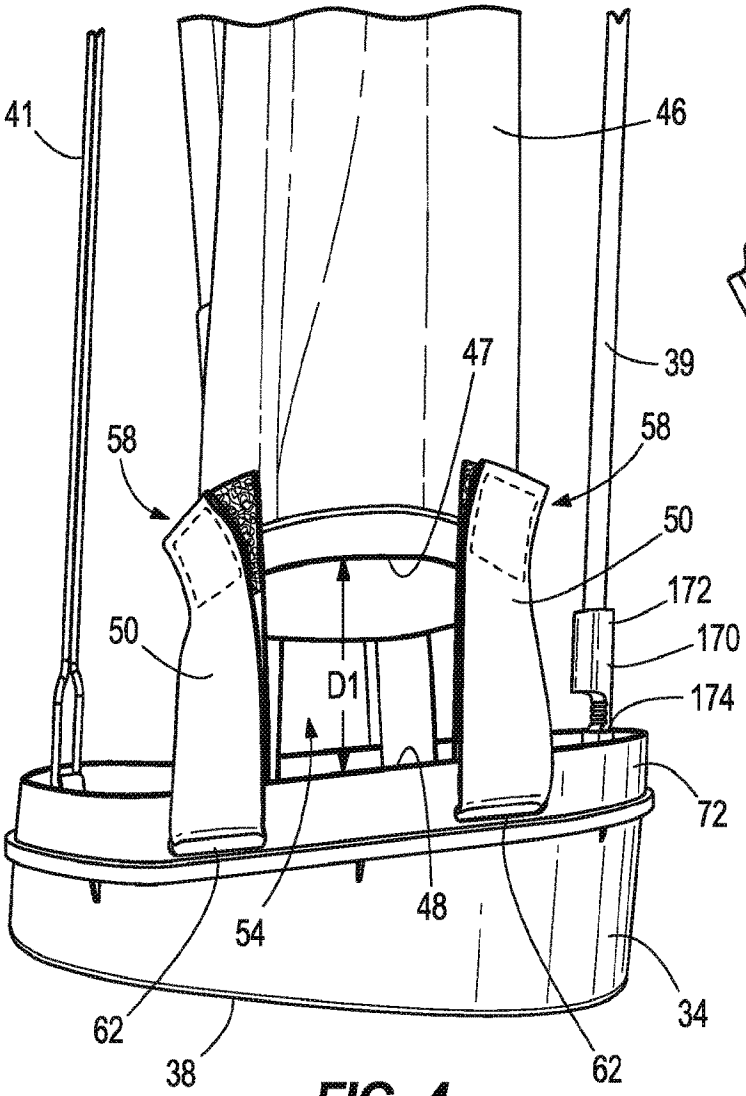
FIG. 4 is a side view of a portion of the golf bag of FIG. 2 taken along line 4-4 of FIG. 3, illustrating a portion of the sub-assembly including a plurality of connection members that couple a divider sleeve to a base, and a gap between the divider sleeve and the base when the base stand assembly is in a retracted configuration.

The structural combination of the side-to-side cross members 853 and the front-to-back cross members 854 creates 3, 4, 5, 6, 7, 8, 9, 10, 11, 12, 13, 14, or more openings for receiving golf clubs. In some embodiments, interchangeable cross member portions 850 are provided with either 4, 5, 7, or 14 openings for receiving golf clubs. As shown in FIGS. 3 and 4, the cross members comprise a hollowed-out groove or channel 855 that engages the interior supports 844 of the top ring 840. In some embodiments, the cross member portion 850 further includes a notch 856 that corresponds to the internal protrusion 846 on the top ring 840. The internal protrusion 846 and the notch 856 align the cross member portion 850 with the top ring 540 during assembly of the modular divider top 830.

Figure 100:
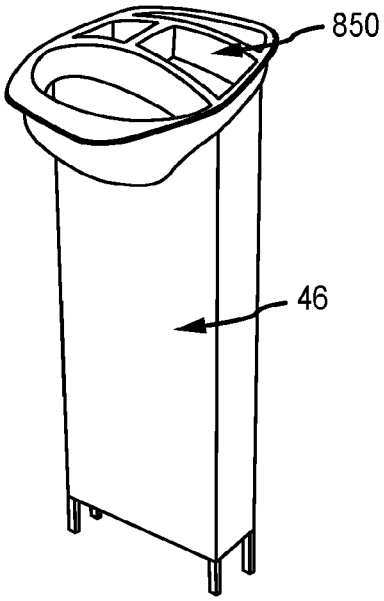
FIG. 100 is a perspective view of the cross-member portion of the modular divider top attached to the divider sleeve, according to an embodiment.

The divider sleeve 46 comprises one or more compartments that extend from the top towards the base 34 of the golf bag 10. FIG. 100 illustrates the divider sleeve 46 attached to the cross member portion 850 of the modular divider top 830. As described with reference to FIGS. 4-6C, the divider sleeve 46 can further comprise a plurality of connection members (or fasteners) at a bottom end 47 of the divider sleeve 46. The plurality of connection members can comprise 1, 2, 3, 4, 5, 6, or more connection members. The connection members can comprise elastic pieces and clips, snaps, or any other suitable mechanical fastening mechanism. The connection members at the base of the divider sleeve can be secured to the base of the golf bag 10, 1010 or to a bottom end of the flat 14.

Advantages of the modular divider top assembly 830 include efficient customization of a divider top, a clean appearance, an overall divider top weight that is lighter than singular divider tops, and better protection for club shafts. As described below, the divider top 30, 1030 can comprise a lighter overall weight because the cross member portion 850 can be formed from a lighter weight material than the top ring 840. The modular nature of the divider top assembly 830 allows the manufacturer to simply and cost-effectively provide the recipient with more color, texture, divider pattern, and graphic options by offering customized cross member portions 850. Because the golf bag 10, 1010 can be assembled almost fully without the cross member portion 850 of the divider top 830, the supplying company can pre-assemble bags with the top ring 840 and later secure the customized cross member portion 850 into the top ring 840, as described in the methods section below.

2. Cover Over Cross Members of Divider Top

Figure 82:
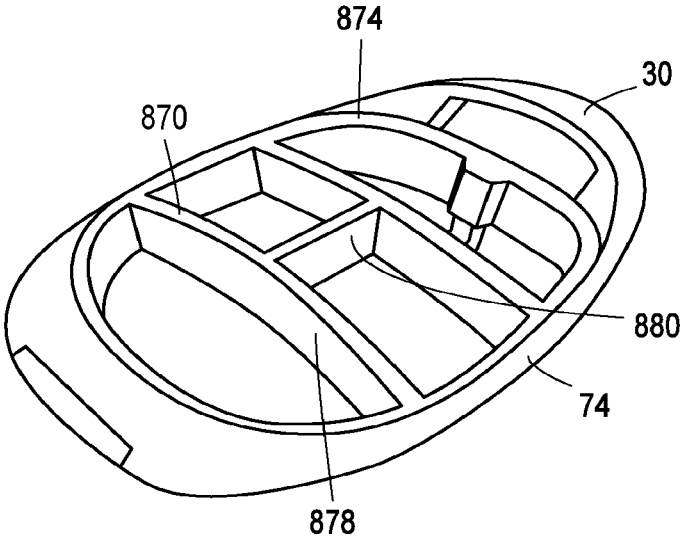
FIG. 82 is a perspective view of a cover assembled to a divider top.
Figure 83:
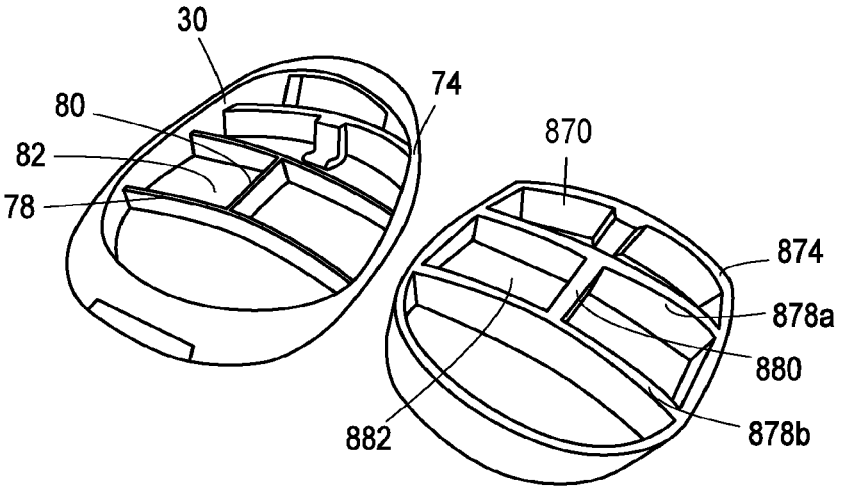
FIG. 83 is a perspective view of the cover and the divider top of FIG. 82 separated from each other.
Figure 84:
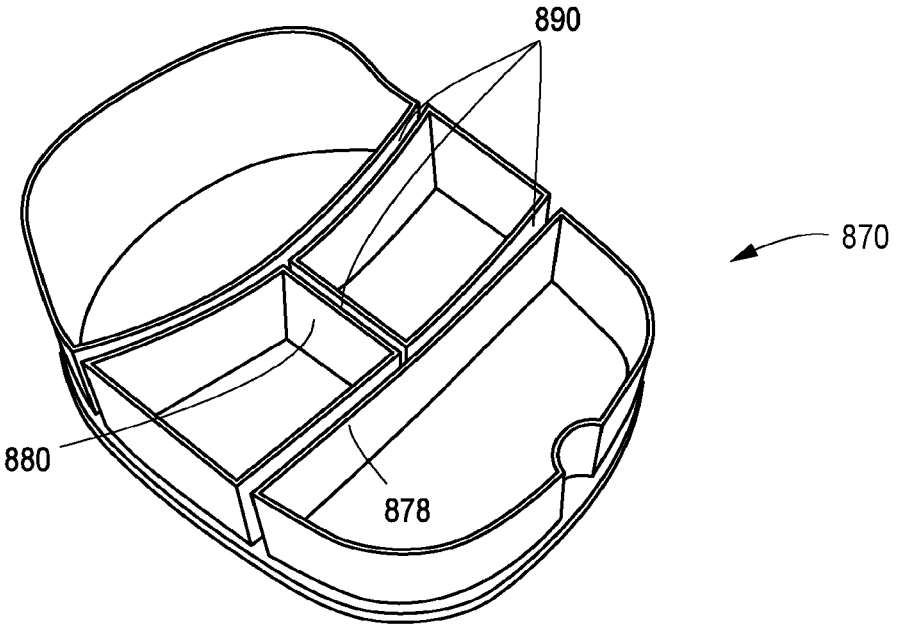
FIG. 84 is a bottom view of the cover of FIG. 82.

FIGS. 82-84 illustrate another embodiment of the divider top 30, 1030, wherein a cover 870 can be fitted over the cross members 78 and the intermediate member 80. The cover 870 provides protection for the cross members 78 and any golf clubs that impact the divider top 30, 1030 upon insertion into the golf bag 10, 1010. The cover 870 further allows color customization of the divider top 30, 1030. Embodiments of the divider top 30, 1030 comprising one or more intermediate members can also comprise a cover 870, but only the embodiment comprising one intermediate member 80 is illustrated for the purposes of this description.

The cover 870 can be a one piece system allowing for easy one step assembly with the divider top 30. This is opposed to having to wrap a flap 90 around each cross member 878 and intermediate member 880 of the divider top 30. In some golf bags, the divider sleeve 46, 1046 comprises one or more flaps 90 that serve the dual purpose of securing the divider sleeve 46, 1046 to the divider top 30, 1030 and providing protection to the cross members 78, 878, 1078 of the divider top 30, 1030. The cover 870 simply requires the assembler to place the cover 870 over the cross member 878 and the intermediate member 880. Additionally, the cover 870 can provide more opportunities for customization in color, texture or graphics, and has potential to provide greater protection to the golf clubs than the flap 90 system.

The cover 870 can be fastened or glued to the divider top 30 and can include a cover outer ring 874, which can follow the same contour as the outer ring 74 of the divider top 30. Further, the cover outer ring 874 can have a smaller perimeter than the perimeter of the outer ring 74 such that, when assembled, the outer surface of the cover outer ring 874 is adjacent to the inner surface of the outer ring 74. The cover 870 further includes at least one cross member cover 878 extending across a portion of the cover outer ring 874 to define a plurality of cover apertures 882 and corresponding with the at least one cross member 78 of the divider top 30. In some embodiments, referring to FIG. 83, a plurality of cross member covers 878*a*, 878*b* extend across portions defined by the cover outer ring 874, and at least one intermediate member cover 880 extends between the cross member covers 878*a*, 878*b* to define cover apertures 882 corresponding with the divider apertures 82. Referring to FIG. 84, when viewed from below, the cross member covers 878 and the intermediate member cover 880 include channels 890 such that, when assembled, the cross members 78 and the intermediate member 80 fit inside the channels 890.

In other embodiments, the cover 870 can include cross member cover 878 and at least one intermediate member cover 880 and be devoid of the cover outer ring 874. In these or other embodiments, when viewed from below, the cross member cover 878 and intermediate member cover 880 can include channels 890 such that, the cross member 78 and the intermediate member 80 can fit in inside the channels 890. When assembled, the cross member cover 878 and intermediate member cover 880 can cover the cross member 78 and the intermediate member 80 while leaving the outer ring 74 of the divider top 30 exposed.

In other embodiments, the cover 870 can include a cover outer ring 874 and be devoid of cross member covers 878 and intermediate member cover 880. In these or other embodiments, when viewed from below, the cover outer ring 874 can include a channel 890 such that, outer ring 74 can fit in inside the channel 890. When assembled, the cover outer ring 874 can cover the outer ring 74 while leaving the member covers 878 and intermediate member 880 of the divider top 30 exposed.

In some embodiments, the channel 890 can be filled with a glue or epoxy securing the cover 870 to the divider top 30 when assembled. In other embodiments, the cover 870 can be secured to the divider top 30 by any suitable mechanism. For example, the cover 870 can be secured to the divider top 30 by threaded mechanisms, snap fit mechanisms, hook and loop mechanisms (VELCRO®), rivets, latch mechanisms, buckle mechanisms, clipping mechanisms, strap mechanisms, pin mechanisms or any other suitable mechanism.

In some embodiments, the cover 870 can be the same color as the divider top 30. In other embodiments, the cover 870 can be a color different than the divider top 30. In other embodiments, the cover 870 can be blue, green, yellow, orange, red, purple, white, black, grey, gold or any other suitable color.

3. Divider Top Material

The divider top 30, 1030 is preferably made of polypropylene or other thermoplastic polymers for flexibility, strength, and light weight construction. Specifically, the divider top 30, 1030 can be formed from a glass-filled polymer or any other suitable plastic. In some embodiments, the divider top 30, 1030 can be formed from multiple materials, including but not limited to a glass-filled polymer, polypropylene, or any other thermoplastic polymer.

For the modular divider top 830 embodiment, the top ring 540 can be formed from a material similar to the materials that the divider top 30, 1030 can be formed from. Also, in the modular divider top 830 embodiment, the material cross member portion 850 can be formed from ethylene-vinyl acetate (hereafter "EVA"), Croslite™ (Crocs™, Boulder, Colo.), polyurethane (hereafter "PU"), silicone, or any other suitable material. EVA provides a non-toxic, tough, low density option that would lower the weight of the modular divider top assembly 830. Croslite™ (Crocs™, Boulder, Colo.) provides impact-absorbing properties along with UV resistance and low density. Silicone provides a non-reactive, easy to manufacture option that is resistant to extreme environments. In some embodiments, the molded divider top 830 comprises multiple materials. The pliable nature of some materials requires that extra support be provided either through a multi-material construction of the cross member portion 850 of the modular divider top 830, or through additional support from the top ring 540, such as full beams for interior supports instead of ribs. The material of the cross member portion 850 can reduce the overall weight of the golf bag divider.

In the embodiment having the cover 870, the cover 870 can be made of any material having soft and light-weight properties. The cover can comprise an open-cell, closed cell foam, or any other suitable material. For example, the cover can comprise a material such as PU foam, polyethylene foam, EVA foam, Croslite™ (Crocs™, Boulder, Colo.), reticulated polyurethane foam, polyethylene plastic, polyurethane plastic, polypropylene plastic, polycarbonate plastic, rubber, silicone, or any other suitable material. Further, in some embodiments, the cover 870 can include additional padding or padded materials. The embodiment of the divider top 30 with the cover 870 can be lighter in weight than a flap system comprising conventional fabrics, meshes, or fillers.

A. Base

The golf bag 10, 1010 can further comprise a base 34, 1034 that forms a foundation of the golf bag 10, 1010. Typically, the base 34, 1034 engages one or more stays 39, 1039 and a flat 14, 1014 of the golf bag 10, 1010. FIGS. 4, 119, and 120 illustrate, at least in part, embodiments of a golf bag base 34, 1034 which are referred to for reference in the following description. The base of the golf bag 10, 1010 can comprise a bottom face 38, 1038 for retaining the clubs and contacting the ground, a lip 72, 1072 to engage the flat 14, 1014, and one or more stay receiving channels 174, 1174*b* to assist in holding the golf bag 10, 1010 upright. The lip 72, 1072 extends away from the bottom face 38, 1038 and defines a perimeter (or circumference) of the base 34, 1034. In some embodiments, the base 34, 1034 can further comprise a means of engaging a stand assembly system for a carry bag. In some embodiments of the golf bag 10, 1010, the base 34, 1034 can comprise a base assembly, having two portions that engage via a snap fit connection, as described below.

The base 34, 1034 further comprises a base stay receiving channel 174, 174*b* which is configured to receive a base stay hinge 170, 1744, which connects the stay 39, 1039 to the base 34, 1034. Typically, the base stay receiving channel 174, 174*b* is located on an interior surface of the outer ring 74, 1074 and positioned adjacent to the back side of the golf bag 10, 1010. Some embodiments of the base 34, 1034 can also comprise one or more base stay hubs for directly receiving secondary stays. These stay hubs can be located on external surface of the outer ring 74, 1074.

The base 34, 1034 comprises an flat attachment mechanism for securing the flat 14, 1014 to the base 34, 1034. This flat attachment mechanism can comprise attachment apertures, snap buttons, surfaces or slots to engage self-fastening connection members 50 of the flat 14, 1014 or other suitable connection means. In most embodiments, the flat attachment mechanism is integral with or located on the lip 72, 1072 of the base. In some embodiments, the flat attachment mechanism for securing the flat 1014 to the base 1034 includes a plurality of attachment apertures 1728 on the lip 1072 (shown in FIG. 119). The attachment apertures 1728 are positioned about the perimeter (or the circumference) of the lip 1072. Each attachment aperture 1728 is configured to receive a fastener to facilitate attachment of the flat 1014 to the lip 1072, and more specifically attachment of the flat 1014 to the base 1034. Attachment of the flat 14, 1014 to the base 34, 1034 is discussed in additional detail below.

Furthermore, the base 34, 1034 can comprise a divider attachment mechanism for securing the divider sleeve 46, 1046 to the base 34, 1034. The divider attachment mechanism can comprise attachment apertures, snap buttons, snap clips, other snap fit connection mechanisms, surfaces or slots to engage self-fastening connection members of the divider sleeve 46, 1046 or other suitable connection means.

Figure 5:
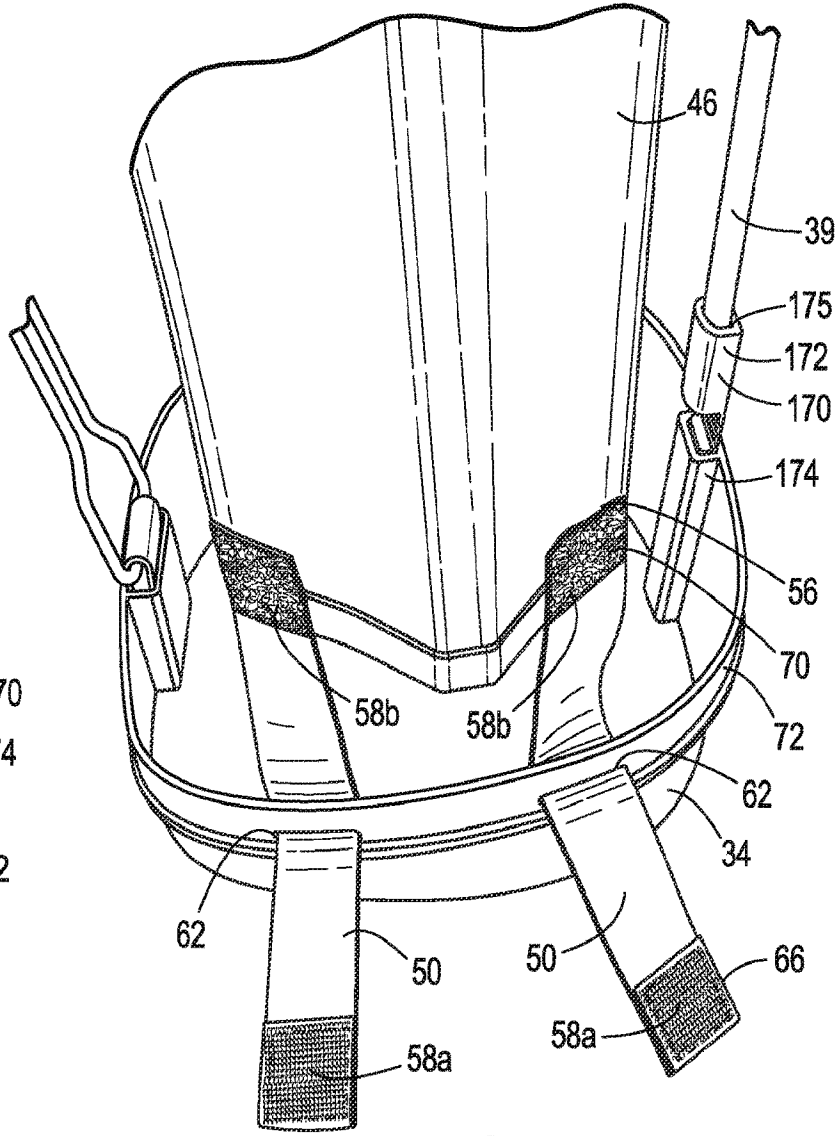
FIG. 5 is a perspective view of the portion of the golf bag of FIG. 4, illustrating the connection members unfastened to depict aspects of self-fastening engagement.

For one embodiment of the divider attachment mechanism, illustrated for example in FIGS. 4 and 5, the base 34, 1034 comprises a plurality of slots 62 for the divider sleeve 46. The plurality of slots 62 are provided through the lip 72 and about a perimeter of the base 34. Each slot of the plurality of slots 62 is configured to receive a respective connection member 50, as described in more detail below (in the connection members section). For another embodiment of the divider attachment mechanism, illustrated for example in FIGS. 119, 120, and 86, the bottom face 38, 1038 includes a plurality of divider attachment apertures 1732. The divider attachment apertures 1732 extend through the bottom face 38, 1038. Each divider attachment aperture 1732 is configured to receive a fastener to facilitate attachment of a divider sleeve 1046 to the bottom face 38, 1038, and more specifically attachment of the divider sleeve 1046 to the base 1034. In other embodiments of the divider attachment mechanism, the divider sleeve 46, 1046 is directly sewn to the base 34, 1034. Other embodiments of the divider attachment mechanism, are illustrated and described in more detail below with the respect to the divider sleeve 46, 1046 connection.

1. Base Assembly (Two-Piece Snap Together Base)

In some embodiments, the base 34, 1034 can comprise a two-piece snap together base assembly. The following description refers to FIGS. 77-81, which illustrate a first embodiment of the base assembly 900 in a carry bag, and FIGS. 91 and 92, which illustrate a second embodiment of the base assembly 1900 in a cart bag.

Figure 77:
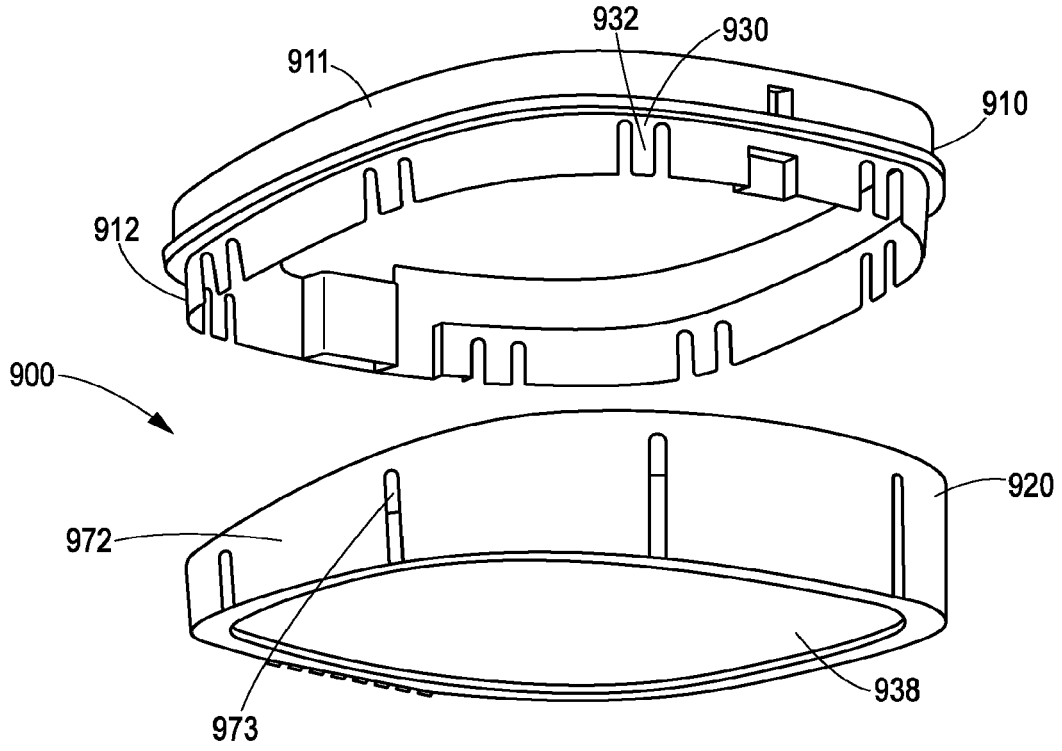
FIG. 77 is a perspective view of a two-piece base assembly system.
Figure 91:
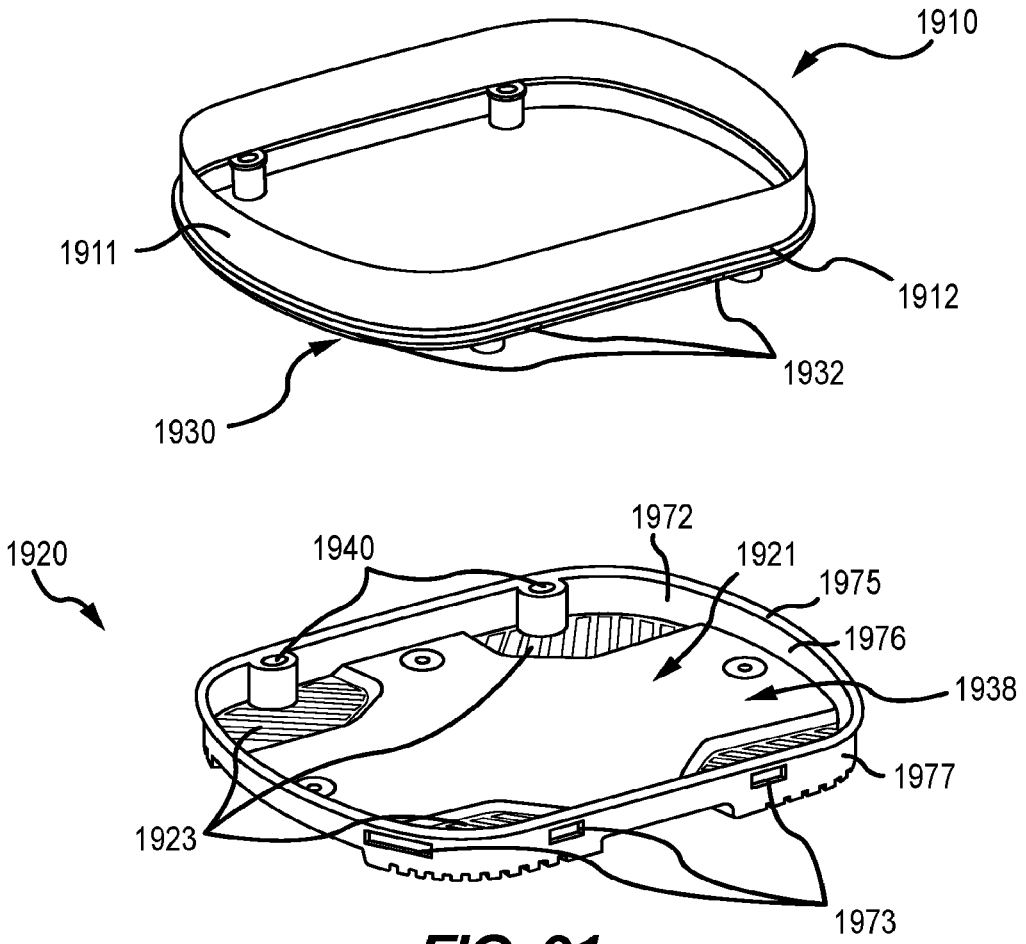
FIG. 91 is an exploded view of another embodiment of a base assembly system.

Referring to FIGS. 77 and 91, the base assembly 900, 1900 can include a ring portion 910, 1910 and a base portion 920, 1920. The ring portion 910, 1910 includes a top end 911, 1911 configured to couple with the flat 14, 1014 and a bottom end 912, 1912 including a plurality of snap tabs 930, 1930. Each snap tab 930, 1930 comprises a protruded surface 932, 1932 positioned on the outer surface and configured to couple with the base portion 920, 1920. The base portion 920, 1020 includes a flat bottom surface 938, 1938 and a vertical lip 972, 1972 that defines the perimeter of the base assembly 900, 1900 and extends upward from the bottom surface 938, 1938. The vertical lip 972, 1972 includes a plurality of slots 973, 1973. Each slot 973, 1973 is configured to receive a corresponding protruded surface 932, 1973 when the base assembly 900, 1900 is in an assembled position.

Figure 78:
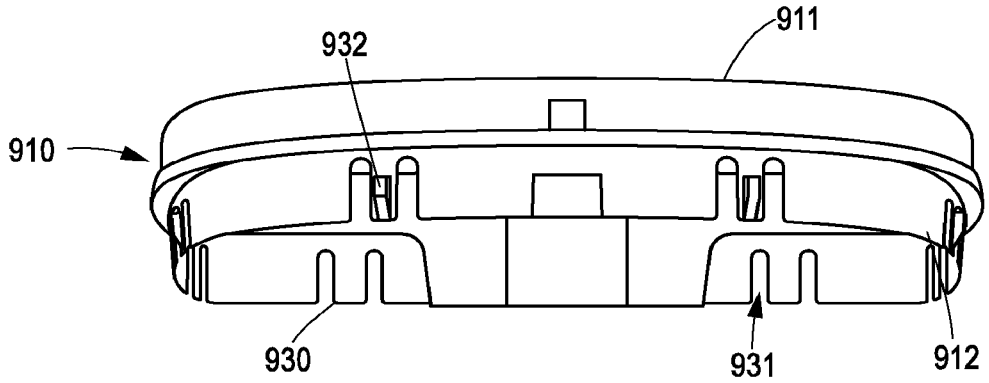
FIG. 78 is front view of a ring portion of the two-piece base assembly system of FIG. 77.

Referring to FIGS. 78 and 91, the ring portion 910, 1910 of the base assembly 900, 1900 can comprise a top end 911, 1911 having a first diameter and a bottom end 912, 1912 having a second diameter. In many embodiments, the first diameter is greater than the second diameter. The first diameter can be equal to the diameter of the vertical lip 972, 1972 such that, when the ring portion 910, 1910 is assembled to the base portion 920, 1920 the bottom end 912, 1912 fits inside the vertical lip 972, 1972 and the top end 911, 1911 rests on top of the vertical lip 972, 1972. In other embodiments, the second diameter can be greater than or the same as the first diameter. For example, in some embodiments, the second diameter is greater than the first diameter such that, when the ring portion 910, 1910 is assembled to the base portion 920, 1920 the bottom end 912, 1912 fits outside the vertical lip 972, 1972 and the top end 911, 1911 rests on top of the vertical lip 972, 1972.

The ring portion 910, 1910 can comprise any suitable shape. In the illustrated embodiments, when viewed from above, the ring 910, 1910 has a square shape with rounded corners. In other embodiments, the ring can be rectangular, triangular, circular or any other suitable shape corresponding with the base portion 920, 1920.

Referring specifically to the embodiment of FIG. 77-81, the bottom end 912 of the ring portion 910 comprises a plurality of snap tabs 930. Each snap tab 930 is defined by a pair of cutouts 931 extending upward from the bottom end 912 of the ring portion 910. The cutouts 931 allow the snap tabs 930 to bend when being assembled to the base portion 920. In some embodiments, each snap tab 930 may be defined by a single cut out 931 extending upward from the bottom end 912 of the ring portion 910. In other embodiments, the cut outs 931 may extend downward from the top end 911 of the ring portion 910. In another embodiment, the snap tabs 930 may extend outward from the bottom end 912 of the ring portion 910.

Figure 79:
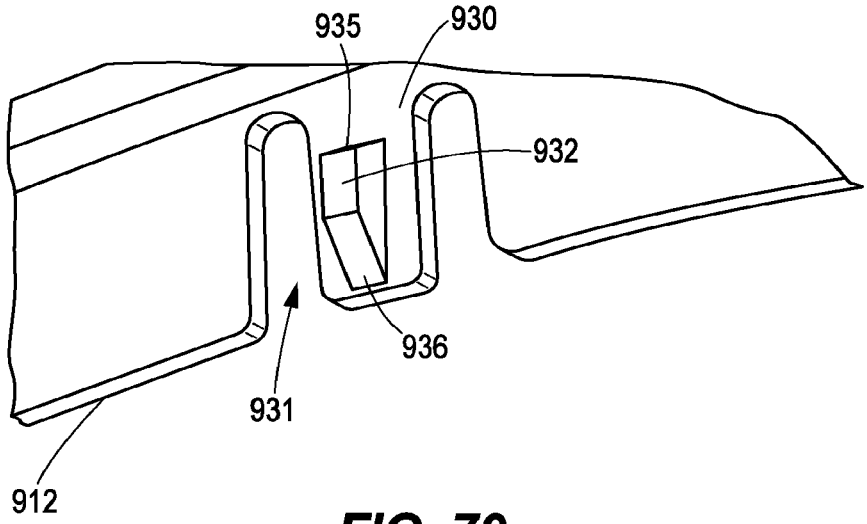
FIG. 79 is a perspective view of a snap tab of the ring portion of FIG. 78.

Referring to FIG. 79, each snap tab 930 has a protruded surface 932 positioned on the outer surface of the snap tab 930. In some embodiments, the protruded surfaces 932 can have a first end 935 forming a 90 degree step with the outer surface of the snap tab 930 and a second end 936, which tapers to the outer surface of the snap tab 930. In other embodiments, the protrusions can include a height, which remains constant, increases, or decreases from the first end 935 to the second end 936. Further, the protruded surfaces 932 can comprise a width or a length, which increases, decreases, or remains constant from the first end to the second end.

In the illustrated embodiment, the protruded surfaces 932 comprises a rectangular shape. In other embodiments, the protruded surfaces 932 can comprises any shape such as, triangular, circular, trapezoidal or any other suitable shape. Further, the protruded surfaces 932 can comprise any portion of the snap tab 930 outer surface. In many embodiments, the protruded surfaces 932 comprise ¾ of the outer surface of the snap tabs 930. In other embodiments, the protruded surfaces 932 can comprise 20%, 30%, 40%, 50%, 60%, 70%, 80%, or 90% of the outer portion of the snap tabs 930. For example, the protruded surfaces 932 can comprise between 20%-50%, 40%-70%, or 50%-90% of the outer portion of the snap tabs 930.

Figure 92:
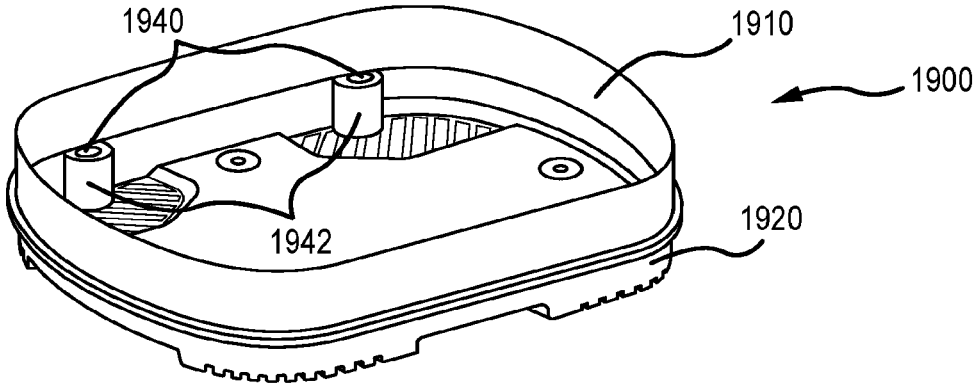
FIG. 92 is a top perspective view of the base assembly system of FIG. 91.

In the illustrated embodiment of FIGS. 91 and 92, the ring portion 1910 does not comprise cutouts, so the snap tabs 1930 are defined as the sections of the bottom end 1912 of the ring portion 1910 that comprise protruded surfaces 1932. These protruded surfaces 1932 extend adjacent from the bottom perimeter of the bottom end 1912 of the ring portion 1910 towards the top end 1911 of the ring portion 1910. The protruded surfaces 1932 are angled outward from a surface of the ring portion 1910. The snap tabs 1930 are designed as snap fit connections to engage slots 1973 of the vertical lip 1972 of the base portion 1920.

In the illustrated embodiments of FIGS. 79 and 91, the snap tabs 930 have a rectangular shape, when the base assembly 900 is viewed from a side view. In other embodiments, the snap tabs 930 can have any shape. For example, the snap tabs 930 can have a triangular, circular, trapezoidal, or any other suitable shape.

Figure 80:
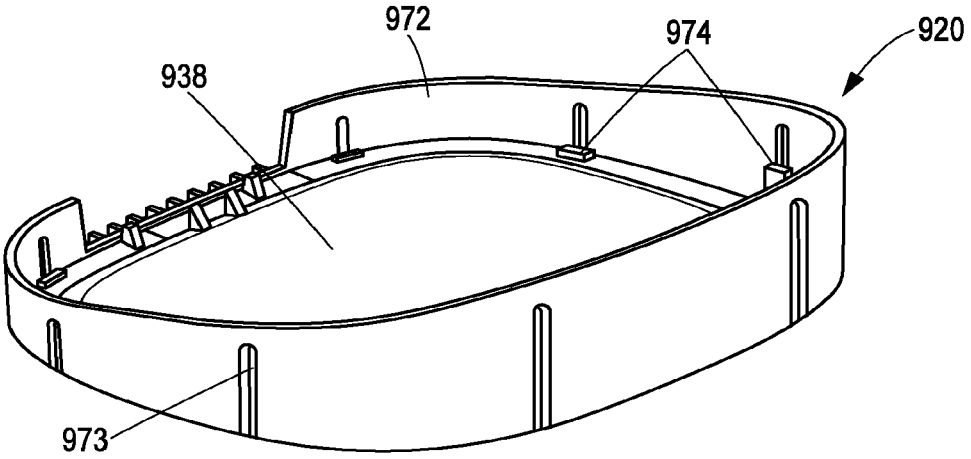
FIG. 80 is a perspective view of a base of the two piece base assembly system of FIG. 77.

Referring to FIGS. 80 and 91, the base portion 920, 1920 of the base assembly 900, 1900 includes a bottom surface 938, 1938 and a vertical lip 972, 1972 extending outwardly from the perimeter of the flat bottom surface 938, 1938. The vertical lip 972, 1972 can comprise a plurality of slots 973, 1973 configured to receive the protruded surfaces 932, 1932 positioned on the snap tabs 930, 1930. The plurality of slots 973, 1973 can comprise 2, 3, 4, 5, 6, 7, 8, 9, 10, or more slots. In the embodiment of FIGS. 77-81, each slot 973 begins from the bottom of the vertical lip 972 and extends a portion of the way to the top of the vertical lip 972. The base portion 920 includes a cover 974 positioned on the interior of the vertical lip 972 covering a portion of the slot 973. The cover 974 extends a portion of the way up the slot such that, the bottom surface of each snap tab 930 is abutted with the top surface of each corresponding cover 974 when the base assembly 900 is in an assembled position.

In the embodiment of FIGS. 91 and 92 (base assembly 1900), the vertical lip 1972 of the base portion 1920 further comprises a channel 1975 for receiving the bottom end 1912 of the ring portion 1910. An inner wall 1976 and an outer wall 1977 of the channel 1975 help align and secure the ring portion 1910 to the base portion 1920. The inner wall 1976 and outer wall 1977 of the channel 1975 further adds structural rigidity to the two-piece base assembly 1900. In most embodiments, when the base portion 1920 is assembled to ring portion 1910, the bottom end 1912 of the ring portion 1910 fits inside the channel 1975 of the vertical lip 1972 of the base portion 1920. In other embodiments, when the base portion 1920 is assembled to the ring portion 1910, the bottom end 1912 of the ring portion 1910 fits outside the vertical lip 1972 of the base portion 1920. In yet other embodiments, when the base portion is assembled to the ring portion, the bottom end of the ring portion fits against an inner side of the vertical lip of the base portion, similar to the embodiment of FIGS. 77-81. In the embodiments where the bottom end of the ring portion fits outside or against an inner side of the vertical lip, the vertical lip does not comprise a channel 1975. In the embodiment of FIGS. 91 and 92, the slots 1973 are apertures in the outer wall 1977 of the channel 1975 of the vertical lip 1972. In this embodiment, when the base portion 1910 is engaged with the ring portion 1910 of the base assembly 1900, the snap tabs 1930 are visible through the slots 1973.

In the illustrated embodiments, the slots comprise a rectangular shape. In other embodiments, the slots can comprise any shape when viewed from exterior of the base portion. For example, the slots can be triangular, circular, trapezoidal or any other suitable shape corresponding with the shape of the protruded surfaces on the snap tabs.

Figure 81:
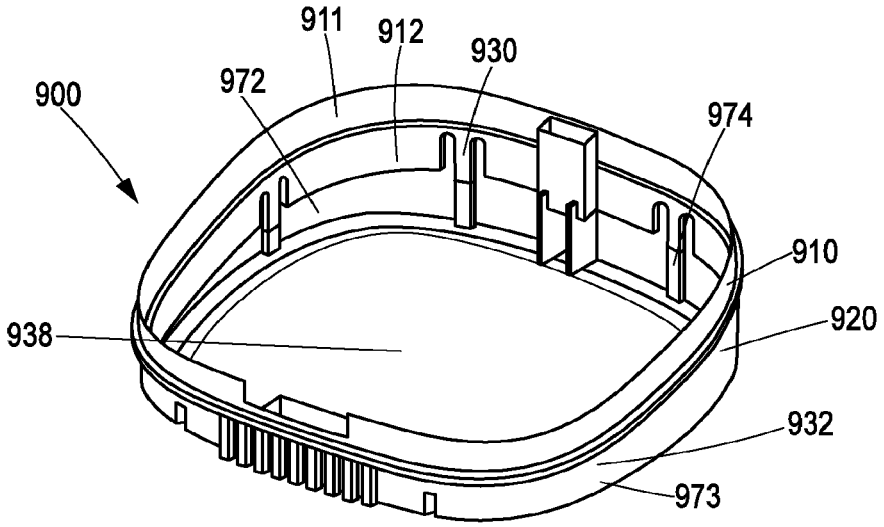
FIG. 81 is a perspective view of the assembled two piece base assembly system of FIG. 77.

Referring to FIG. 81 and FIG. 92, the base assembly 900, 1900 in its assembled position is illustrated. To assemble the base assembly 900, 1900 the snap tabs 930, 1930 of the ring portion 910, 1910 are aligned with the slots 973, 1973 of the base portion 920, 1920 and the ring portion 910, 1910 is then pressed into the base portion 920, 1920. In the embodiment of FIGS. 77-81, the bottom of the snap tabs 930 will abut with the top surface of the cover 974. Any embodiment of the base assembly can further include any of the divider sleeve connection members 50, 50*c*, described below, that couple the divider sleeve 46 to either the ring portion or the base portion.

The flat bottom surface 938, 1938 of the base portion 920, 1920 can comprise a raised section, such as raised section 1921 of FIGS. 91 and 92. The raised section 1921 of the bottom surface 938, 1938 can be roughly cross-shaped, leaving four recessed sections, such as recessed section 1923, where the bottom surface 938, 1938 is not raised. The recessed sections 1923 extend lower than the raised section 1921 of the bottom surface 938, 1938 on an external surface of the base 34, 1034 to form four protrusions. In some embodiments, the recessed sections 1923 comprise ridges, bumps, channels, grooves, or other grip and roughness features. These features improve durability and prevent the recessed sections 1923 from slipping on the ground. In other embodiments, the raised section 1921 can be circular, ovular, triangular, rectangular, diamond, or any other suitable shape. In some embodiments, the recessed sections 1923 are at least partially constructed from a material different than the material of the bottom surface 938, 1938.

The base assembly 900, 1900 can further comprise a base stay receiving channel (similar to 174, 174*b* described above for the base 34, 1034) integral with an internal side of the top end 911, 1911 of the ring portion 910, 1910. In some embodiments, the ring portion 910, 1910 of the base assembly 900, 1900 further comprises a plurality of stay ports (similar to the plurality of stay ports described above for the base 34, 1034) integral with the ring portion 910, 1910 for receiving one or more secondary stays.

The two-piece base assembly 900, 1900 allows for a more efficient assembly of the golf bag 10, 1010 as compared to a system have a one piece base 34, 1034. The ring portion 910, 1910 can be coupled to the flat via a snap fit connection, stitches, pins, buttons, clamps, zippers or any other suitable mechanism. The base assembly 900, 1900 provides access to the interior of the flat 14 via the opening in the bottom of the ring portion 910, 1910. This allows for an easier coupling process, as opposed to coupling the flat 14, 1014 to the base 34, 1034 by entering through the top portion of the golf bag 10, 1010. Coupling of the divider sleeve 46 to the base portion 920, 1920 can be completed prior to the coupling of the base portion 920, 1920 and the ring portion 910, 1910. This provides easy access to the interior of the base portion 910, 1910, allowing for an easier manufacturing process as opposed to attaching the divider sleeve 46 to the base portion 920, 1920 by entering through the top of the golf bag 10, 1010.

B. Divider Sleeve Attachment Mechanisms

The golf bag 10, 1010 can comprise a divider sleeve 46, 1046 for preventing entanglement of grips and shafts of the different golf clubs when they are inserted into the golf bag 10, 1010. The divider sleeve 46, 1046 can attach to the divider top 30, 1030 at one end and either the base 34, 1034 or the flat 14, 1014 at the other end of the divider sleeve 46,

1046. The divider sleeve 46 can be attached to the divider top 30, 1030, to the base 34, 1034, and/or the flat 14, 1014 via an attachment mechanism such as attachment apertures, snap buttons, other snap fit connections, self-fastening connection members of the divider sleeve 46, or other suitable connection means.

1. Divider Sleeve to Divider Top Attachment Mechanism

Figure 9:
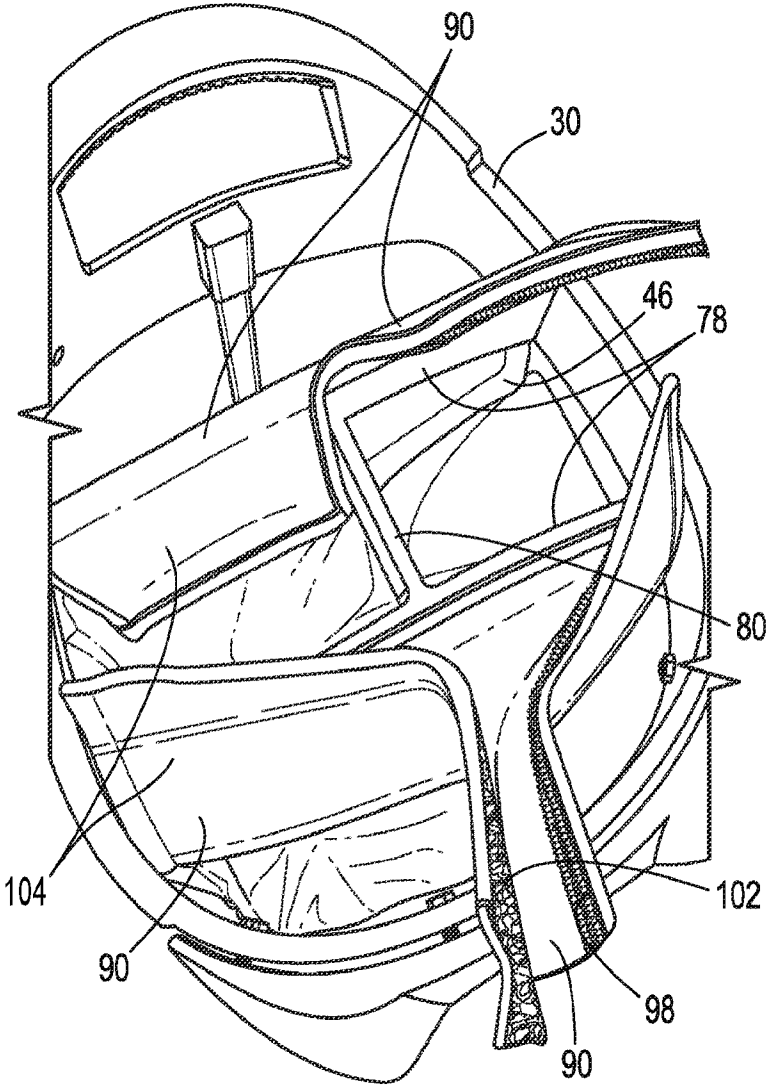
FIG. 9 is a perspective view of a portion of the golf bag of FIG. 7, illustrating a portion of the divider sleeve coupling to a portion of the divider top by a self-fastening engagement.
Figure 10:
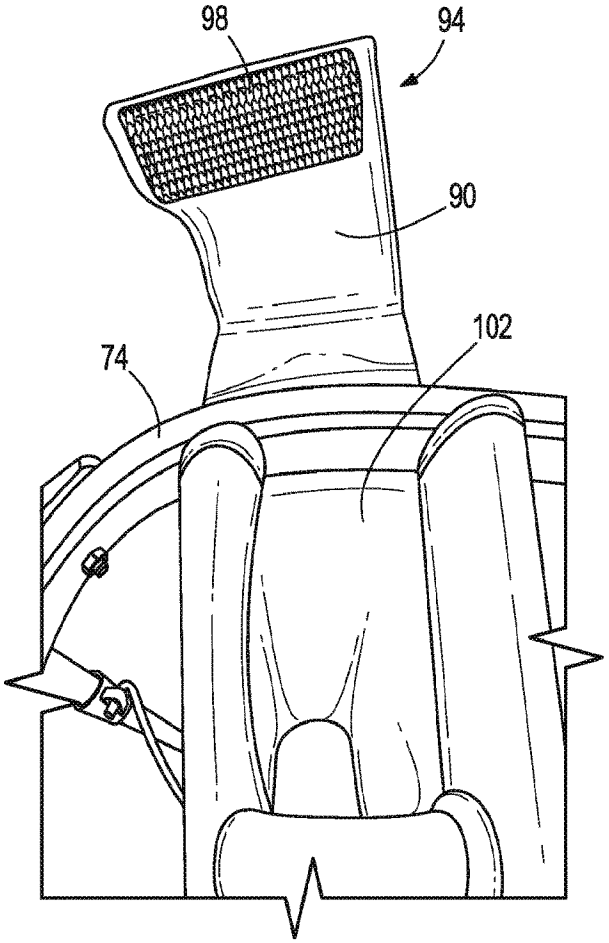
FIG. 10 is a perspective view of a portion of the golf bag of FIG. 7, illustrating a portion of the divider sleeve coupling to a portion of the outer ring of the divider top by a self-fastening engagement.

Referring now to FIGS. 9 and 10, in one embodiment, the divider sleeve 46 attaches to the divider top 30 by a self-fastening engagement. The referenced figures are provided for purposes of illustration, and aspects of the base 34 and divider sleeve 46 disclosed herein may be incorporated into a base 34, 1034 and divider sleeve 46 of any size or type. An end of the divider sleeve 46 opposite the connection member 50 end includes a plurality of flaps 90. The flaps 90 may be integrated into the divider sleeve 46 and each includes a self-fastener 94, illustrated as a hook-and-loop fastener. As shown in FIG. 10, the self-fastener 94 includes a first self-fastening portion 98 separated from a second self-fastening portion 102. The first and second self-fastening portions 98, 102 are provided on the same side of the flap 90, and separated by a distance sufficient for the flap 90 to wrap around a portion of the divider top 30. The first and second self-fastening portions 98, 102 are illustrated as respective hook 98 and loop 102 portions of the hook-and-loop fastener. However, in other embodiments, any suitable self-fastener 94 may be used, including a button and button hole, a hook-and-eye closure, or a snap fastener. In addition, in other embodiments the first self-fastening portion 98 may be the hook or loop portion of the fastener, while the second self-fastening portion 102 is the other of the loop or hook portion of the fastener. As illustrated in FIG. 9, the flaps 90 that wrap around the cross members 78 and the intermediate member 80 include additional padding or padded material 104 to protect the golf clubs from damage by rubbing against the cross members 78 or intermediate member 80. While the flaps 90 that wrap around a portion of the outer ring 74 are shown without additional padding or padded material, in other embodiments the flaps 90 may include such additional padding or padded material.

In some embodiments of the golf bag 10, 1010, the divider sleeve 46 comprises a flap, similar to the one described above, that wraps around a portion of the divider top 30, 1030 and is sewn to itself to secure it around the divider top 30, 1030. In these embodiments, stitching replaces the hook-and-loop fastener, which can simplify the manufacturing process in some instances.

2. Divider Sleeve to Base Attachment Mechanism (Connection Members)

In some embodiments, the attachment mechanism between the divider sleeve 46 and the base 34, 1034 comprises a plurality of connection members. For the purposes of this disclosure, carry bag 10, specifically as depicted in FIGS. 4 and 5, is used to illustrate this feature, but it is understood that the attachment mechanism can be incorporated into any class, type, or size of golf bag. In the illustrated embodiment of bag 10, a plurality of connection members 50, and more specifically four connection members 50, couple the divider sleeve 46 to the base 34. In other embodiments, two, three, or five or more connection members 50 may be used to couple the divider sleeve 46 to the base 34. The connection members 50 are preferably formed of a flexible, elastic, stretchable material, such as elastic webbing, to form a flexible and/or elastic connection between the divider sleeve 46 and the base 34. In other embodiments, any suitable material may be used that is sufficiently flexible and/or elastic to allow the connection members 50 to function in accordance with operation of the internal sub-assembly 42 disclosed herein. In addition, an end 56 of the connection member 50 is attached to the divider sleeve 46 (shown in FIG. 5). The end 56 is illustrated as attached to the divider sleeve 46 by stitching, however in other embodiments the end 56 may be attached by adhesive, rivets, or any other known or future developed attachment suitable to maintain the connection between the end 56 and the divider sleeve 46 while allowing the connection members 50 to function in accordance with operation of the internal sub-assembly 42 disclosed herein.

Referring now to FIGS. 4 and 5, in a first embodiment each connection member 50 is in self-fastening engagement while coupling the divider sleeve 46 to the base 34 by a self-fastener 58. As shown in FIG. 5, a first portion of the self-fastener **58*a* is spaced from a second portion of the self-fastener 58*b*. Both portions of the self-fastener 58*a*, 58*b* are provided on a same side of the connection member 50. This allows each connection member 50 to be received by a slot 62 in the base 34 (shown in FIGS. 4 and 5), and then self-fastened by connecting the portions of the self-fastener 58*a*, 58*b* (shown in FIG. 4). Stated another way, after the connection member 50 is received by the slot 62, a first portion 66 of the connection member 50 fastens to a second portion 70 of the connection member 50 to form a self-fastening connection. The self-fastening connection allows each connection member 50 to wrap around a portion of the base 34 to couple the divider sleeve 46 to the base 34. The plurality of the slots 62 provided about the perimeter of the base 34 are each configured to receive a respective connection member 50. While the self-fastener 58 is illustrated in the form of a hook and loop fastener (e.g., VELCRO®), in other embodiments any suitable self-fastener 58 may be used, including a button and button hole, a hook-and-eye closure, or a snap fastener. In addition, in other embodiments the first portion of the self-fastener 58*a* may be the hook or loop portion of the fastener, while the second portion of the self-fastener 58*b* is the other of the loop or hook portion of the fastener. In other embodiments, the first portion 66 of the connection member 50 fastens to the second portion 70** in a permanent or semi-permanent arrangement (e.g. through the use of an adhesive or similar material).

3. Alternate Embodiments Divider Sleeve to Base Attachment Mechanism (Connection Members)

Figure 6A:
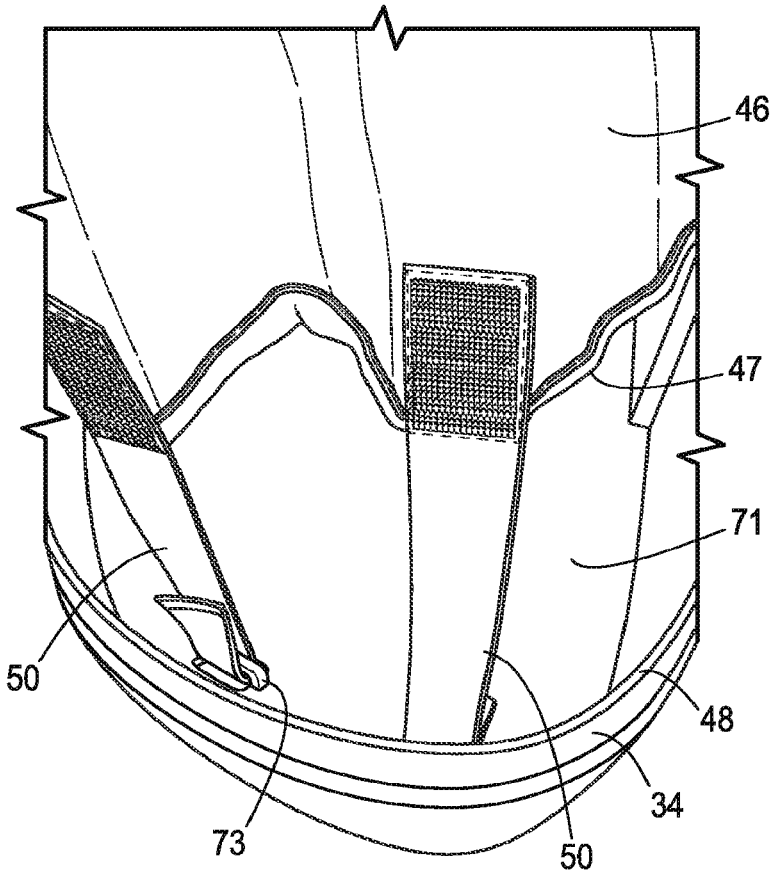
FIG. 6A is a perspective view of a portion of the base of the golf bag of FIG. 2 illustrating an alternative connection between a divider sleeve and the base when the golf bag is in a carrying configuration with legs retracted.

FIG. 6 illustrates an alternate embodiment of the divider sleeve 46 to base 34 attachment mechanism. This alternative embodiment of the self-fastening engagement of each connection member 50 that couples the divider sleeve 46 to a base 34 that does not have slots in the lip 72 the base 34. Rather, the connection members 50 engage a portion of the bottom 71 of base 34 to couple the divider sleeve 46 to the base 34. Specifically, the portion of the bottom 71 includes a plurality of connection portions 73, with each connection portion 73 being defined by two slots or apertures (not shown) formed through the bottom 71 of the base 34. Each connection member 50 wraps around a respective connection portion 73 and forms a self-connection by hook and loop fastener (VELCRO®). In the illustrated golf bag 10, four connection members 50 couple the divider sleeve 46 to the base 34.

Figures 6B, 6C:
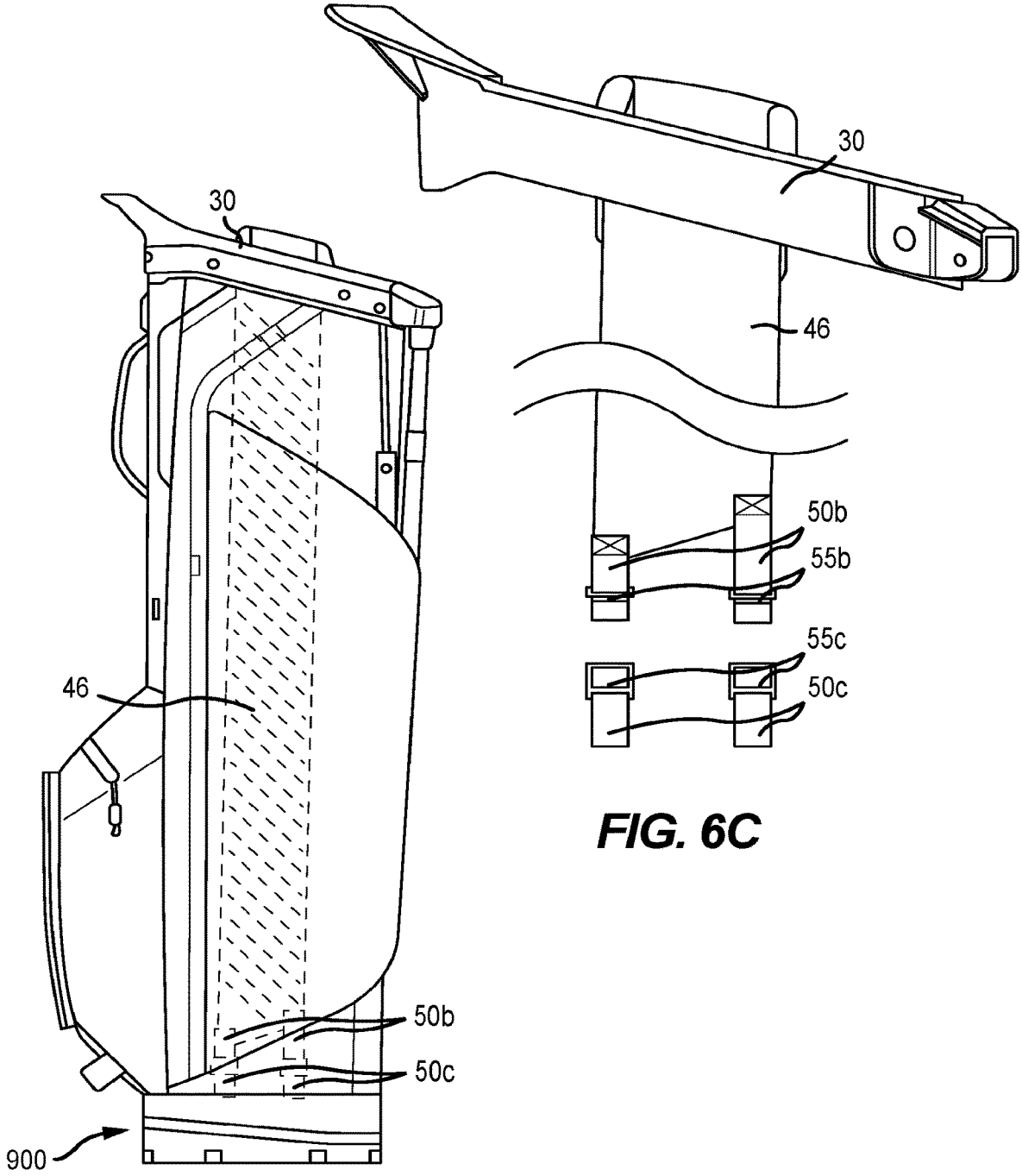
FIG. 6B is a side, x-ray view of a golf bag, similar to the golf bag of FIG. 1A, having a divider sleeve that is snap-connected or clipped onto the base.
FIG. 6C is a close-up side view of a sub-assembly of the golf bag of FIG. 6B.

FIG. 6B illustrates another alternate embodiment of the divider sleeve 46 to base 34 attachment mechanism. The divider sleeve 46 comprises connection members **50*b* having snap fasteners or clips 55*b* at the end of each connection member 50*b*. This snap fastener embodiment is described with respect to the base assembly 900 comprising a ring portion 910 and a base surface portion 920, as illustrated in FIGS. 77-81 and described above, but can also be used with other embodiments of the base 34, 1034. The base 34 of the golf bag 10, 1010 comprises a ring portion 910, a base surface portion 920 that snaps onto the ring portion 910, and flexible connection members 50***c* that connect to the ring portion 910. The flexible connection members 50*c* of the base ring portion 910 have snap fasteners or clips 55*c* that engage with the snap fasteners or clips 55*b* of the divider sleeve 46 connection members 50*b*. The base ring portion 910 can be sewn or otherwise permanently attached to the bag flat 14, as described in detail above. The two-piece, snap together base assembly 900 allows the for the fasteners or clips 55*b*, 55*c* to be easily connected before the base surface portion 920 is snapped onto the base ring portion 910. Using snap fasteners or clips 55*b*, 55*c* to connect the divider sleeve 46 to the base 34, 1034 eliminates the need for slots in the base 34, 1034. In other variations of this embodiment, the connection members 50*c* of the base are attached to the base surface portion 920.

In other embodiments, not illustrated, a one-piece base can be comprise flexible connection members (similar to 50*c*) and snap fasteners or clips (similar to 55*c*). This base is connected to the flat of the golf bag before the divider sleeve is attached to the base. The divider sleeve, which comprises connection members (similar to 50*b*) and snap fasteners or clips (similar to 55*b*) can be connected to the divider top. The snap fasteners or clips of the base and divider sleeve allow the assembler to easily connect the divider sleeve to the base.

C. Stay

The golf bag 10, 1010 can comprise one or more stays 39, 1039, 1039*a*, 1039*b*, (hereafter 39, 1039) that connect the base 34, 1034 and the divider top 30, 1030. The one or more stays 39, 1039 provide rigidity to the golf bag 10, 1010 when it is in a deployed configuration. The one or more stays 39, 1039 can be pivotably connected to the base 34, 1034 and/or the divider top 30, 1030 via hinges. The one or more stays 39, 1039 and/or the hinges can be engaged with the base 34, 1034 and/or the divider top 30, 1030 through one or more snap fit connections. Top and base stay hinges 162, 170 permit the divider top 30, 1030 and base 34, 1034 to fold or collapse towards the stay 39, 1039. In sub-assemblies comprising the divider top 30, 1030, the base 34, 1034, and one or more stays 39, 1039, the hinges 162, 170 allow the sub-assembly to collapse for shipping or storage.

Figure 22:
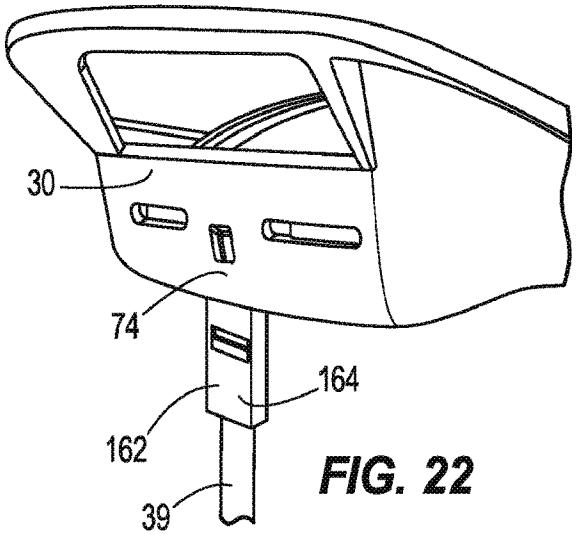
FIG. 22 is a perspective view of the top stay hinge of FIG. 21, with the top stay hinge connected to a first end of the stay and in a second configuration.
Figure 24:
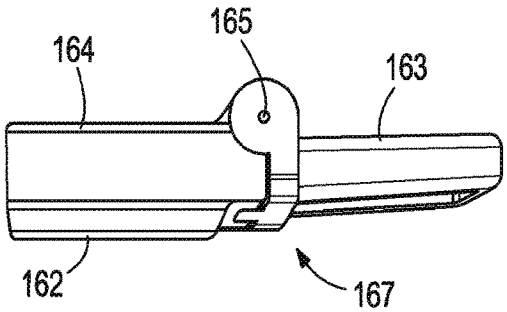
FIG. 24 is a perspective view of the top stay hinge of FIG. 23 in a second, unhinged position.
Figure 21:
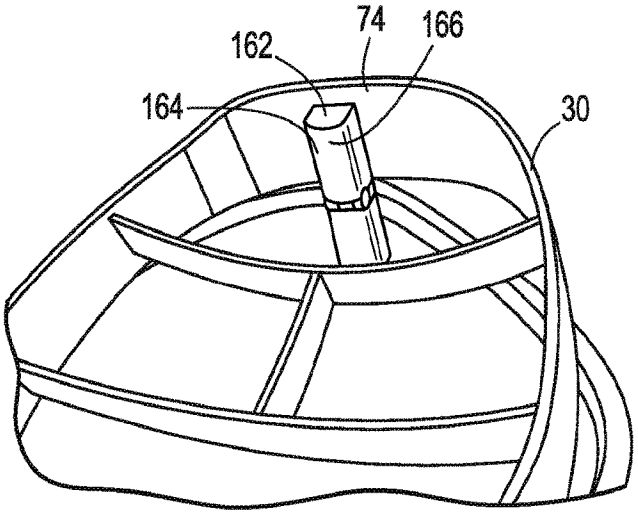
FIG. 21 is a perspective view of a top stay hinge with the stay removed and in a first configuration.
Figure 23:
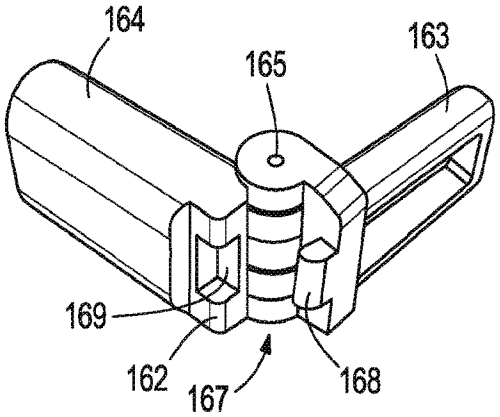
FIG. 23 is a perspective view of a top stay hinge in a first, hinged position for use in the golf bag of FIG. 1.
Figure 25:
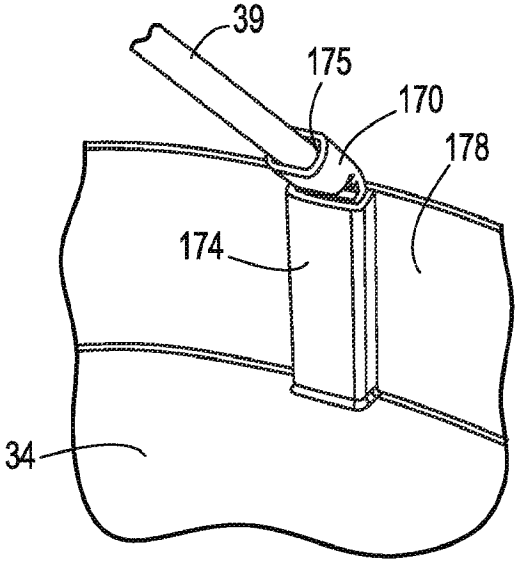
FIG. 25 is a perspective view of a base stay hinge connected to a second end of the stay.

FIGS. 21-29 illustrate a snap fit sub-assembly for the pivoting stay 39 (see FIG. 2). FIGS. 21-22 illustrate a first or top stay hinge 162 pivotally connected to the divider top 30. Referring to FIGS. 25-26, the top stay hinge 162 includes a first portion or first arm 163 pivotably connected to a second portion or second arm 164 by a joint 165. The first arm 163 is connected to the divider top 30 (shown in FIG. 21), while the second arm 164 is connected to the stay 39 (shown in FIG. 22). For example, the first arm 163 can be received in a corresponding channel (not shown) in the divider top 30, while the second arm 164 can define a channel or sleeve portion 166 that receives a first or top end of the stay 39.

Figure 29:
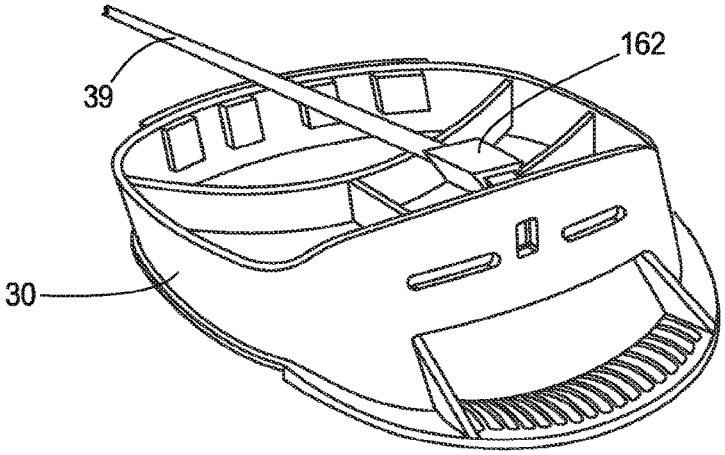
FIG. 29 is a perspective view the top stay hinge of FIG. 21, with the top stay hinge connected to a first end of the stay.

The top stay hinge 162 pivots at the joint 165 between a first position (shown in FIG. 23) where the first and second arms 163, 164 are arranged at an angle to each other, and a second position (shown in FIG. 24) where the first and second arms 163, 164 form a straight angle to each other (e.g. 180 degrees) or are generally collinear. In some embodiments, first and second arms 163, 164 are angled at a maximum between 170 and 190 degrees. The first and second arms 163, 164 can be angled relative to each other by 30 to 40 degrees, 35 to 45 degrees, 40 to 50 degrees, 45 to 55 degrees, 50 to 60 degrees, 60 to 70 degrees, 70 to 80 degrees, 80 to 90 degrees, 90 to 100 degrees, 100 to 110 degrees, 110 to 120 degrees, 120 to 130 degrees, 130 to 140 degrees, 140 to 150 degrees, 150 to 160 degrees, 160 to 170 degrees, 170 to 180, or 180 to 190 degrees. The top stay hinge 162 pivots approximately ninety degrees (90°), from a position where the second arm 164 approximately perpendicular to a portion of the outer ring 74 (as illustrated in FIG. 29) to a position where the second arm 164 is approximately parallel to the portion of the outer ring 74 (as illustrated in FIG. 22).

To limit overextension of the top stay hinge 162 during the transition from the first position (which occurs when the golf bag 10 is collapsed) to the second position (which occurs when the golf bag 10 is deployed), the top stay hinge 162 includes a hinge limit 167. In the illustrated embodiment, the hinge limit 167 includes a hinge projection 168 (positioned on one of the first or second arm 163, 164) received by a notch 169 (positioned on the other of the second or first arm 163, 164). When rotating the top stay hinge 162 from the first position (shown in FIG. 23) to the second position (shown in FIG. 24), the notch 169 receives the projection 168 when the top stay hinge 162 reaches the second position. Portions of the first and second arms 163, 164 then contact each other, further limiting rotation or pivoting of the top stay hinge 162. The hinge limit 167 assists with preventing the divider top 30 from overextending during self-assembly.

Figure 26A:
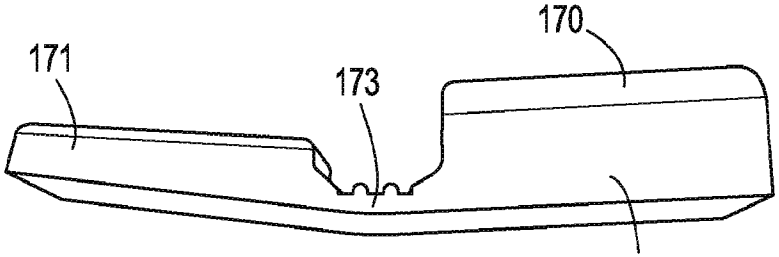
FIG. 26A is an elevation view of a side of a base stay hinge for use in the golf bag of FIG. 1A, according to an embodiment.
Figure 26B:
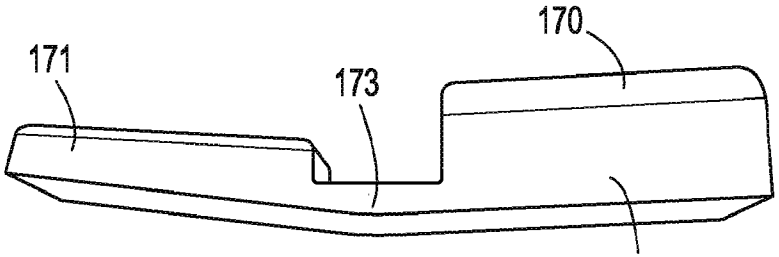
FIG. 26B is an elevation view of a side of a base stay hinge for use in the golf bag of FIG. 1A, according to an embodiment.
Figure 27A:
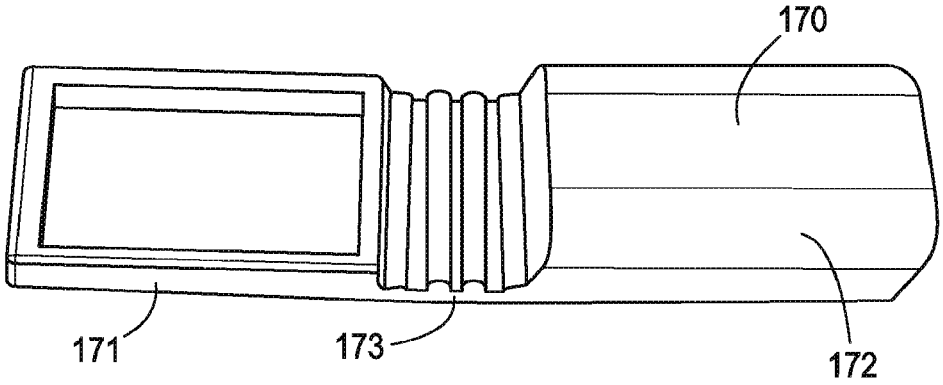
FIG. 27A is an elevation view of a top of the base stay hinge of FIG. 26A.
Figure 27B:
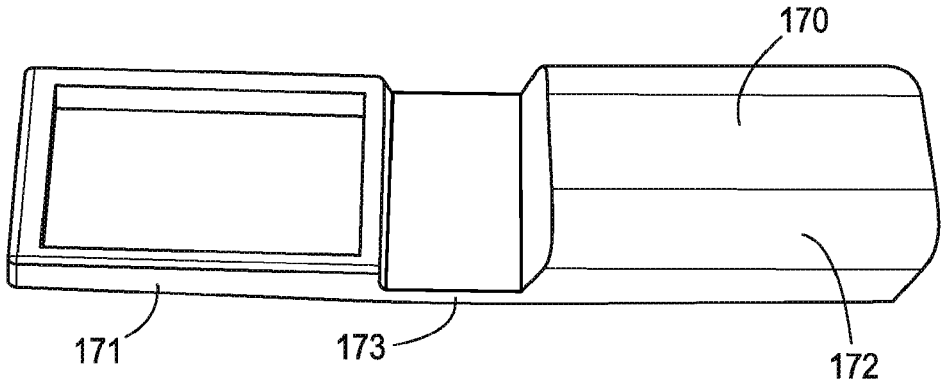
FIG. 27B is an elevation view of a top of the base stay hinge of FIG. 26B.
Figure 28A:
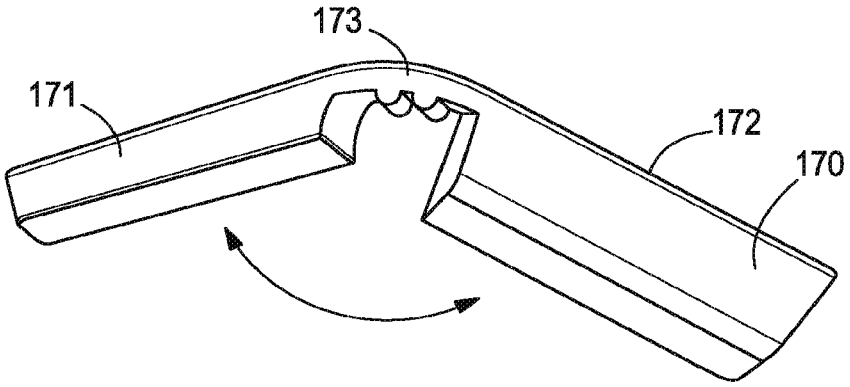
FIG. 28A is an elevation view of a side of the base stay hinge of FIG. 26A, illustrating the flexing of the hinge arms.
Figure 28B:
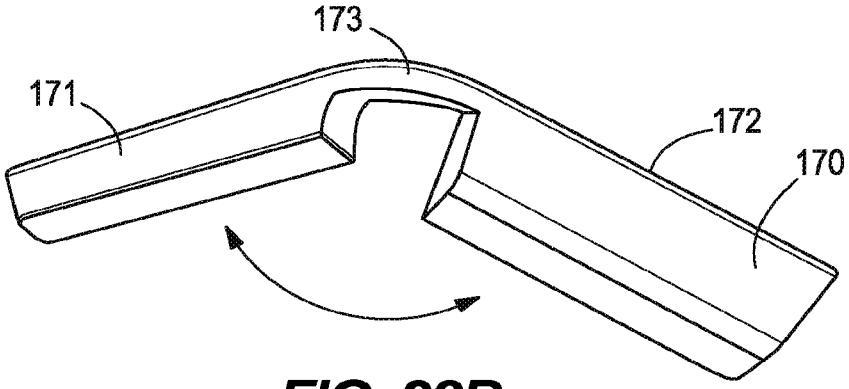
FIG. 28B is an elevation view of a side of the base stay hinge of FIG. 26B, illustrating the flexing of the hinge arms.

FIG. 25 illustrates a second or bottom or base stay hinge 170 pivotally connected to the base 34. As illustrated in FIGS. 26A-28B, the base stay hinge 170 includes a first portion or first arm 171 that is flexibly connected to a second portion or second arm 172 by a spring or biasing portion 173. The first arm 171 is connected to the base 34, while the second arm 172 is connected to the stay 39. For example, the first arm 171 can be received or engages with a stay receiving channel 174 defined by the base 34 (shown in FIGS. 4-5 and 25), while the second arm 172 can define a channel 175 that receives a portion of the stay 39 (shown in FIGS. 5 and 25). As shown in FIG. 28, the hinge 170 flexes at the biasing portion 173. This permits the first and second arms 171, 172 to flex in relation to each other. In some embodiments, the biasing portion 173 can comprise protrusions or ridges that stiffen the biasing portion 173, as shown in FIGS. 26A, 27A, and 28A. In other embodiments, the biasing portion 173 comprises a smooth surface, as shown in FIGS. 26B, 27B, 27C, and 28B. In turn, the components attached to the first and second arms 171, 172 (e.g., the base 34 and the stay 39, respectively), flex or pivot in relation to each other.

The base stay hinge 170 facilitates pivoting of the base 34 about the stay 39 to convert the golf bag 10 from the collapsed state to the deployed state. In some embodiments, first and second arms 171, 172 are angled with respect to each other at a maximum between 170 and 190 degrees. The first and second arms 171, 172 can be angled relative to each other by 30 to 190 degrees. For example, the first and second arms 171, 172 of the base stay hinge 170 can be angled relative to each other by 30 to 40 degrees, 35 to 45 degrees, 40 to 50 degrees, 45 to 55 degrees, 50 to 60 degrees, 60 to 70 degrees, 70 to 80 degrees, 80 to 90 degrees, 90 to 100 degrees, 100 to 110 degrees, 110 to 120 degrees, 120 to 130 degrees, 130 to 140 degrees, 140 to 150 degrees, 150 to 160 degrees, 160 to 170 degrees, 170 to 180, or 180 to 190 degrees. In one embodiment, the base stay hinge 170 is configured to pivot up to approximately ninety degrees (90°), from a position approximately perpendicular to a portion of a side wall 178 of the base 34 to a position approximately parallel to the portion of the side wall 178 of the base 34. In some embodiments, the stay hinges 162, 170 are flexibly pivotable rather than mechanically pivotable.

In embodiments of a golf bag having a stand assembly, the base stay hinge 170 can also assist with tilting the stay 39 about the base 34 as the golf bag 10 transitions from a first configuration (see FIG. 3 with the legs 40 retracted) to a second configuration (see FIG. 2 with the legs 40 extended) during use. In some embodiments, the first and second arms 171, 172 of the base stay hinge 170 can be angled relative to each other by 120 to 150 degrees when the golf bag 10 is in an extended configuration. For example, in an extended configuration, the first and second arms 171, 172 of the base stay hinge 170 can be angled relative to each other by 120 to 130 degrees, 130 to 140 degree, 140 to 150 degrees, 150 to 160 degrees, or 160 to 170 degrees. In some embodiments, the first and second arms 171, 172 of the base stay hinge 170 can be angled relative to each other by 170 to 190 degrees when the golf bag 10 is in an retracted configuration. For example, in a retracted configuration, the first and second arms 171, 172 of the base stay hinge 170 can be angled relative to each other by 170 to 180, 175 to 185, or 180 to 190 degrees.

The snap fit sub-assembly allows the stay 39 to interconnect the divider top 30 and the base 34 by snap fit connection, while also allowing portions of the sub-assembly (e.g. the divider top 30, the base 34, and the stay 39) to be pivoted flat for more cost effective shipping by reducing packaging volume. The stay hinges 162, 170 allow the divider top 30 and the base 34 to pivot about the stay 39 from a position approximately perpendicular to the stay 39 (such as when the legs 40 are retracted for a stand bag, or in a cart bag), to a position approximately parallel to the stay 39 (as shown in FIG. 29). As a result of the configuration illustrated in FIG. 29, the divider top 30 is offset from the stay 39 and is in a plane generally parallel to the plane of the stay 39. Though not illustrated, the base 34 is also offset from the stay 39 and is in a plane generally parallel to the plane of the stay 39, with the base 34 and divider top 30 being approximately parallel or approximately in the same plane.

In another embodiment of the snap fit sub-assembly for the pivoting stay 39, illustrated in FIG. 117-120, the sub-assembly comprises a first or top stay hinge 1740 a second or base stay hinge 1744. The top stay hinge 1740 can be similar to either the top stay hinge 162 or the base stay hinge 170. The base stay hinge 1744 can be similar to either the top stay hinge 162 or the base stay hinge 170. In short, any suitable hinge design can be implemented in order to allow bending or rotation at either end of the pivoting stay 39. In some embodiments, the top and bottom stay hinges may be integrally formed with the stay 39.

D. Flat

The golf bag 10, 1010 further comprises a flat 14, 1014 which can be provided tubular or rectangular with sides that fasten to form a tubular shape. The flat 14, 1014 forms sides of a body of the golf bag 10, 1010. The flat 14, 1014 extends between the divider top 30, 1030 and the base 34, 1034. The flat 14, 1014 can act as a framework that contains golf clubs within the golf bag 10, 1010. In some embodiments, the flat 14, 1014 can be snap fit onto the sub-assembly 42, 1042 of the golf bag 10, 1010. At least a portion of the flat 14, 1014 can be sewn onto the sub-assembly 42, 1042. At least a portion of the flat 14, 1014 can be riveted onto the sub-assembly 42, 1042. Various embodiments of the golf bag 10, 1010 comprise different combinations of methods for connecting the flat 14, 1014 to the sub-assembly 42, 1042, described below.

In some embodiments, the flat 14, 1014 can be provided as a tubular unit designed to slide over and snap onto a divider top 30, 1030. In other embodiments, the flat 14, 1014 is provided as an open (rather than tubular) unit, such as the flat 14 illustrated in FIGS. 30 and 31. The open flat 14, 1014 can be assembled into a tubular configuration via stitching or a fastener, such as a zipper or a snap fit connection. In some embodiments, the flat 14, 1014, provided either tubular or open, can be secured to the divider top 30, 1030 and/or the base 34, 1034 with molded snap tree members.

The flat 14, 1014 is generally formed of a single material, or two or more materials, with the pockets 18, 1018, the handle 22, 1022, and the shoulder strap 24, 1024 attached thereto. The pockets 18, 1018 can be separate and detachable from the flat 14, 1014. For example, each pocket 18, 1018 may be connected to the flat 14, 1014 by a removable attachment, such as by snap fit buttons, hook and loop connectors (e.g. VELCRO®), or one or more zippers, as described below. The removable pockets 18, 1018 allow for custom configuration or reconfiguration of different pocket 18, 1018 sizes, number, or locations on the flat 14, 1014.

1. Flat to Divider Top or Base Attachment Mechanism Via Snap Fit Connectors

Figure 30:
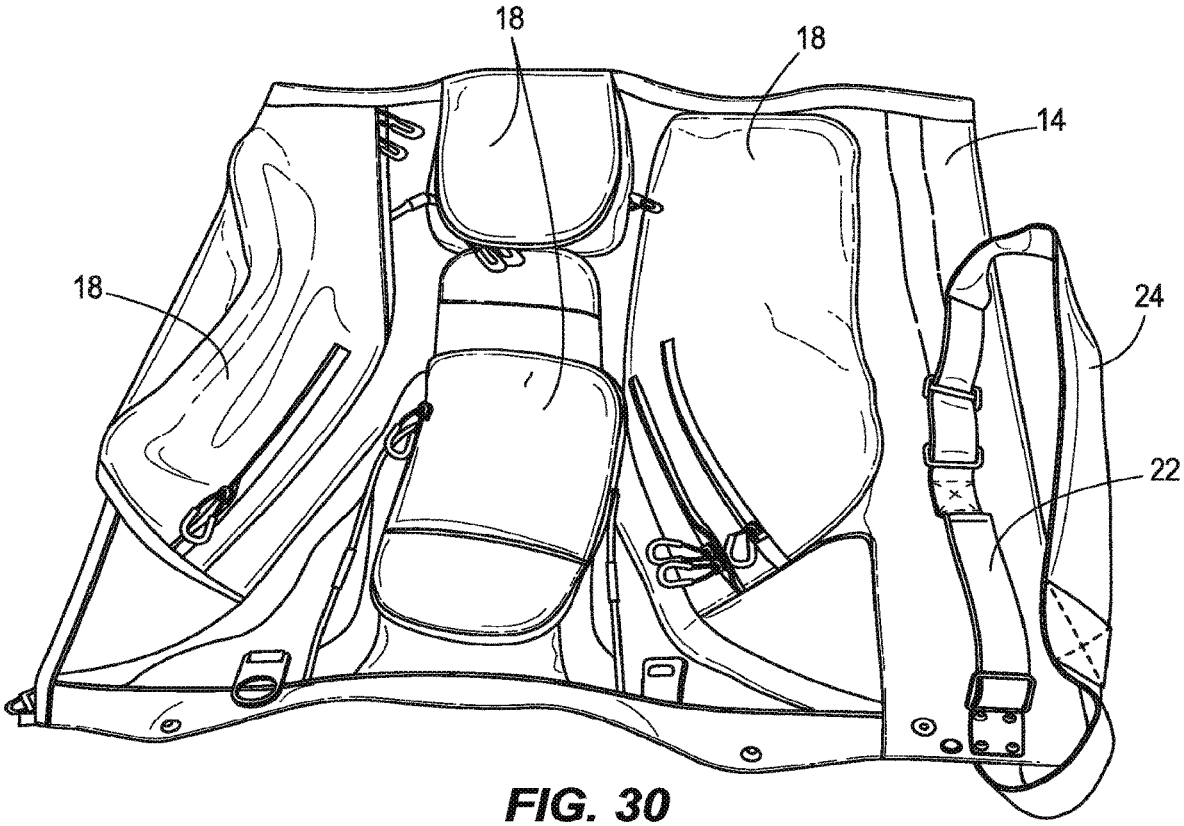
FIG. 30 is a perspective view of an exterior of the flat of the golf bag of FIG. 1.
Figure 31:
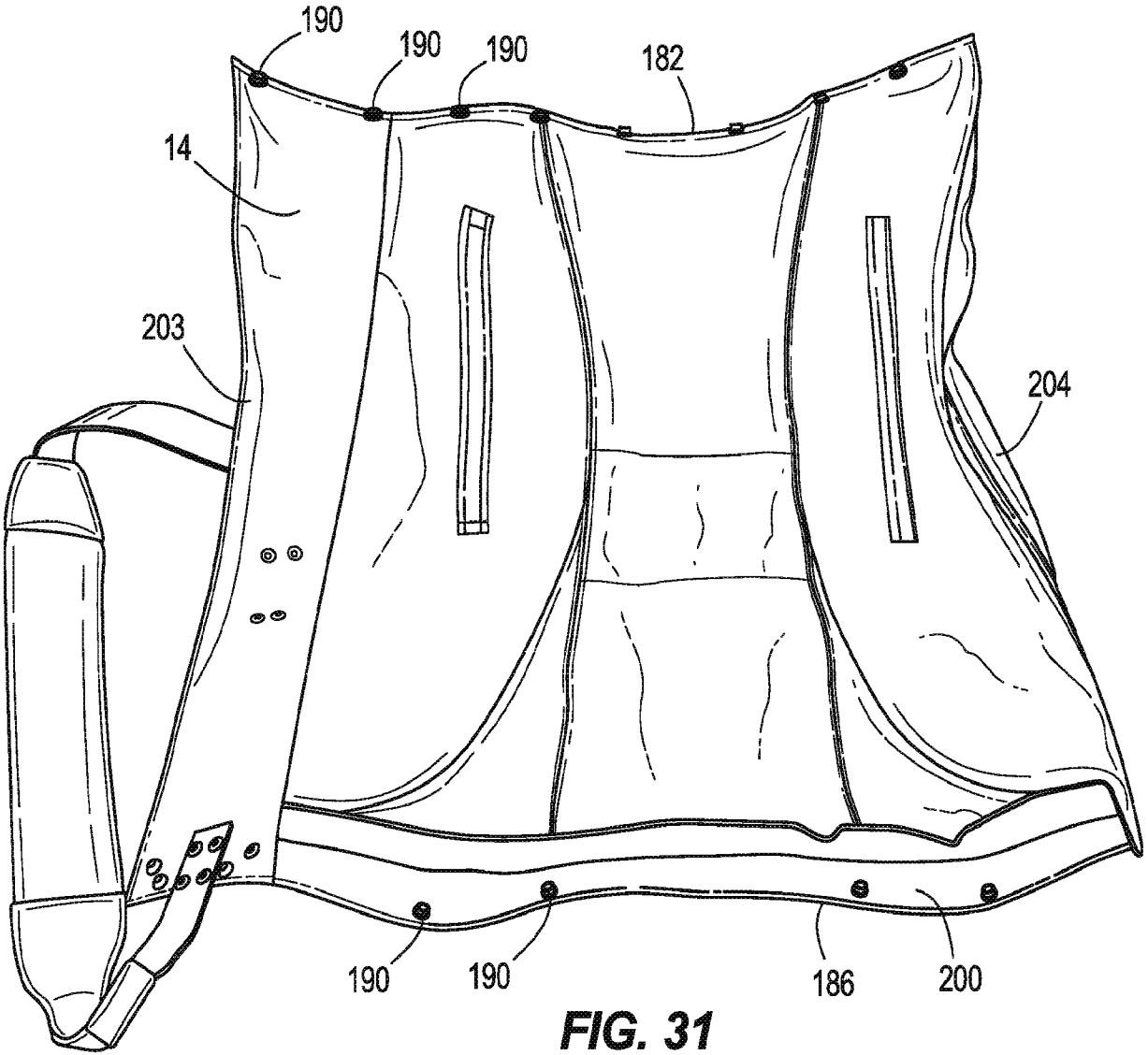
FIG. 31 is a perspective view of an interior of the flat of the golf bag of FIG. 1.

FIGS. 30-31 illustrate an open flat 14 that forms a snap fit connection with a sub-assembly during assembly to form the golf bag 10. FIG. 30 illustrates an exterior or first side of the flat 14. FIG. 31 illustrates an interior or second side of the flat 14. The flat 14 includes a bottom or base end 182 and a top end 186. Both ends include a plurality of snap fit connectors 190, illustrated as male or female snap fit buttons 190, for engagement with respective snap fit connectors 194 provided on the divider top 30 and base 34 of the sub-assembly, illustrated in FIG. 47 as female or male snap fit buttons 194. The plurality of snap fit connectors 190 on the flat 14 and the respective snap fit connectors 194 on the divider top 30 and base 34 allow for reduced assembly times over golf bags without snap fit connectors. Furthermore, the snap fit connectors 190, 194 eliminate the need for tools and equipment that is necessary for riveting or sewing the flat onto the divider top 30 and/or base 34.

2. Flat to Divider Top Attachment Mechanism Via Snap Fit Collar

Figure 93A:
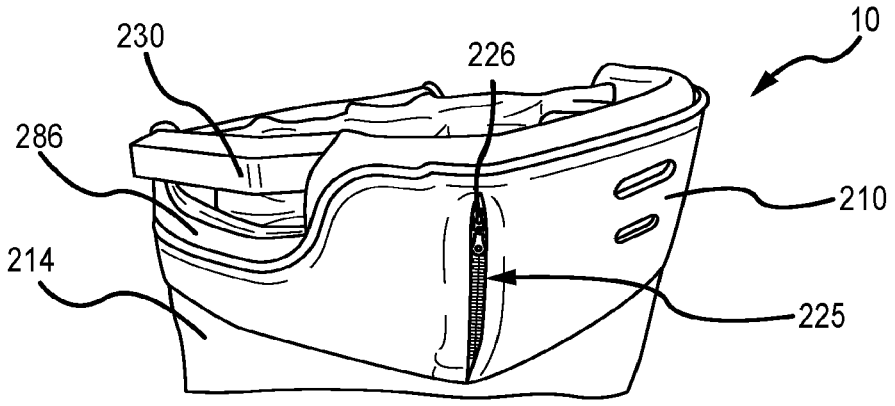
FIG. 93A is a perspective view of an embodiment of a snap-together collar system.
Figure 93B:
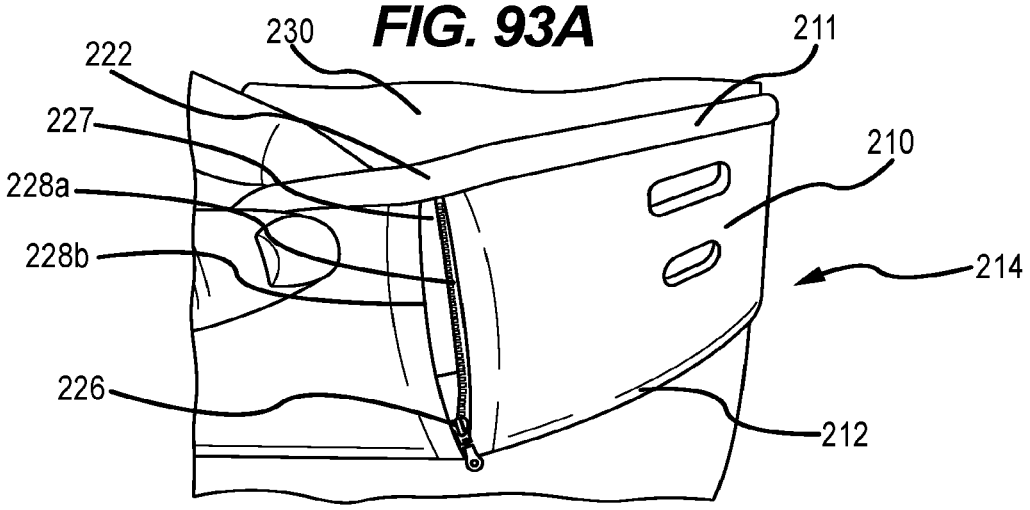
FIG. 93B is a perspective view of the snap-together collar system of FIG. 93A, with the zipper open.
Figure 93C:
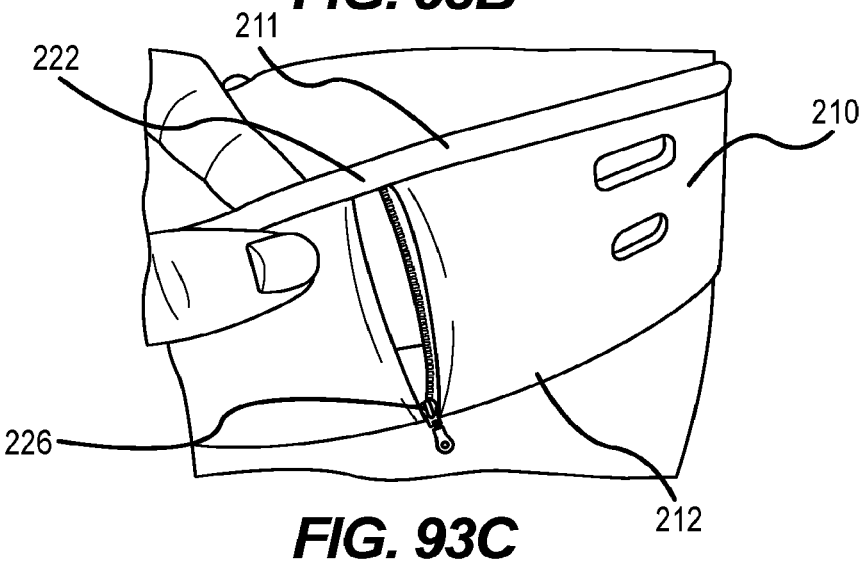
FIG. 93C is a perspective view of the snap-together collar system of FIG. 93A, with the zipper open and the elastic stretched.
Figure 94A:
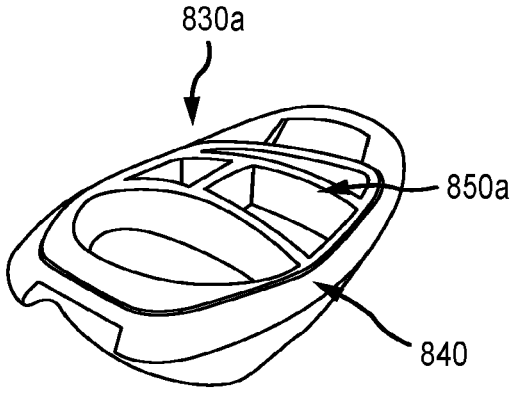
FIG. 94A is a perspective view of an embodiment of an assembled modular divider top.
Figure 94B:
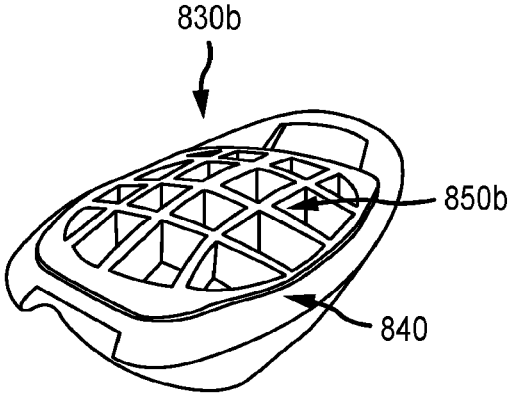
FIG. 94B is a perspective view of an embodiment of an assembled modular divider top.
Figure 95:
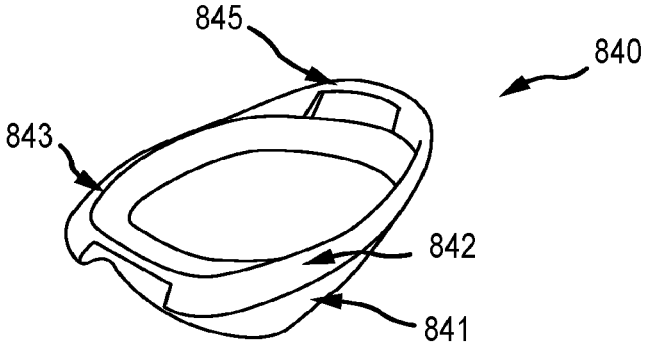
FIG. 95 is a perspective view of the top ring of the modular divider top.

A tubular flat 14, 1014 can also be connected via a snap fit connection to a sub-assembly. Referring to FIGS. 93A-93C, in one embodiment of the golf bag 10, the golf bag 10 comprises at least a divider top 230, similar to divider top 30, and a tubular golf bag flat 214, similar to flat 14, having a top end 286, similar to the top end 186 of flat 14. The flat 214 comprises a flexible collar 210. The flexible collar 210 allows the tubular flat 214 to slide around and overlap the divider top 230 of the golf bag 10 during assembly. The collar 210 of the bag flat 214 comprises one or more reinforced walls 216, snap connectors 224, an elastic portion 222, and a zipper 225 to ease the assembly process. The divider top 230 comprises a molded body and a fabric cover having external snap connectors 234. The snap connectors 224 on the collar 210 of the bag flat 214 engage the snap connectors 234 of the divider top 230 to attach the bag flat 214 to the divider top 230. The reinforced walls 216 of the collar 210 of the bag flat 214 provide some rigidity to the bag flat 214. The elastic portion 222 of the bag flat collar 210 connects two of the reinforced walls 216, giving the bag flat 214 the flexibility needed for assembly of the snap connectors 224, 234. The zipper 225 of the bag flat collar 210 allows flexibility during assembly, but is closed in the final steps of assembly in order to hold the bag flat 214 snuggly against the divider top 230 in the finished bag.

The collar 210 of the bag flat 214 can comprise one or more reinforced walls 216. In most embodiments, when the bag flat 214 is engaged with the divider top 230, the walls of the collar 210 of the bag flat 214 lie adjacent and generally parallel to sides of the divider top 230. The reinforced walls 216 provide some rigidity to the bag flat 214. In many embodiments, these walls 216 can be flat sheets that comprise a wall width 218 and a wall height 220. For each wall 216, the wall width 218, as measured parallel to a base of the bag and along the bottom of the reinforced wall 216, is approximately the same as a width of a side of the divider top 230 that corresponds to the respective collar wall 216. In this way, the collar 210 of the bag flat 214 hugs the outside surface of the divider top 230. The height 220 of the bag flat collar 210 walls can vary. For instance, in some embodiments, the wall on a back side of the bag flat 214 has a height that is greater than the height of the wall of a front side of the bag flat 214. In some embodiments, the walls 216 corresponding to a left side and a right side of the bag flat collar 210 can have varying heights 220 across the width 218 of each respective section, as illustrated in FIG. 1. The walls 216 of the flexible collar 210 can be formed from a material such as an open cell foam, such as a sponge, or a closed cell foam, such as a Crocslite™ (Crocs™, Boulder, Colo.) material. Alternately, the walls 216 of the collar 210 can be formed from a molded thermoplastic material, such as silicone, or another type of thermoplastic elastomer.

The walls 216 of the collar 210 can be encased in a mesh cover. The mesh cover secures the walls 216 together. The mesh cover 216 comprises fabric or mesh panels to cover an inside and an outside layer of each wall 216. The mesh cover further comprises an edging that encircles a top 211 and a bottom 212 edge of the collar 210 of the bag flat 214. The zipper 225 of the collar 210 can form a connection between two walls 216 of the collar 210 of the bag flat 214. In some embodiments, the zipper 225 can be positioned between a back wall and a side wall of the collar 210. The zipper 225 can extend from the bottom edge 212 to a top edge 211 of the collar 210. The zipper 225 can comprise a first row 228*a* and a second row 228*b* of zipper teeth, a zipper car 226, and a zipper garage 228. The first row of zipper teeth 228*a* runs approximately vertically along an edge of a collar wall 216. The second row of zipper teeth 228*b* runs approximately vertically along an edge of an adjacent collar wall 216. The zipper car 226 can be attached to the rows of zipper teeth 228, such that the zipper 225 is closed when the car 226 is adjacent the top edge 211 of the collar 210 and the zipper 225 is open when the car 226 is adjacent the bottom edge 212 of the collar 210 of the flat 214. The zipper 225 does not fully disconnect the collar sections, but rather the zipper 225 provides flexibility that enables the collar 210 to stretch when the zipper 225 is open. The expansion of the collar 210 when the zipper 225 is open allows the collar 210 of the bag flat to slide onto the desired portion of the divider top 230 during assembly.

One section of the top mesh edging comprises an elastic portion 222 that bridges between the two collar walls 216 comprising the first 228*a* and second 228*b* zipper teeth rows. When the zipper 225 is open, the elastic portion 222 can stretch to expand the collar 210. Contrarily, when the zipper 225 is closed, the elastic portion 222 cannot be stretched, and the collar 210 of the flat 214 is more rigid. When the zipper 225 is closed, the zipper car 226 is housed inside a zipper garage 227 adjacent the top edge 211 of the flat 214.

The bag flat 214 further comprises snap connectors 224 on an inside surface of the collar 210. The snap connectors 224 correspond to snap connectors 234 on the outer surface of the divider top 230. The location of the snap connectors 224 on the collar 210 determines where the bag flat 214 is situated with respect to the divider top 230 during assembly. The bag flat snap connectors 224 can be anchored to the corresponding snap connectors 234 of the divider top 230. In some embodiments, the snap connectors 224 on the collar 210 of the bag flat 214 are located approximately half way between the top 211 and bottom 212 edges of the collar 210. In other embodiments, the snap connectors 224 are located a fixed distance from the bottom edge 212 of the collar 210. In some embodiments, the snap connectors 224 are equally spaced around the inside surface of the collar 210 of the flat 214. The snap connectors 224, 234 can be button snaps or any other suitable type of snap-connector.

Figure 32:
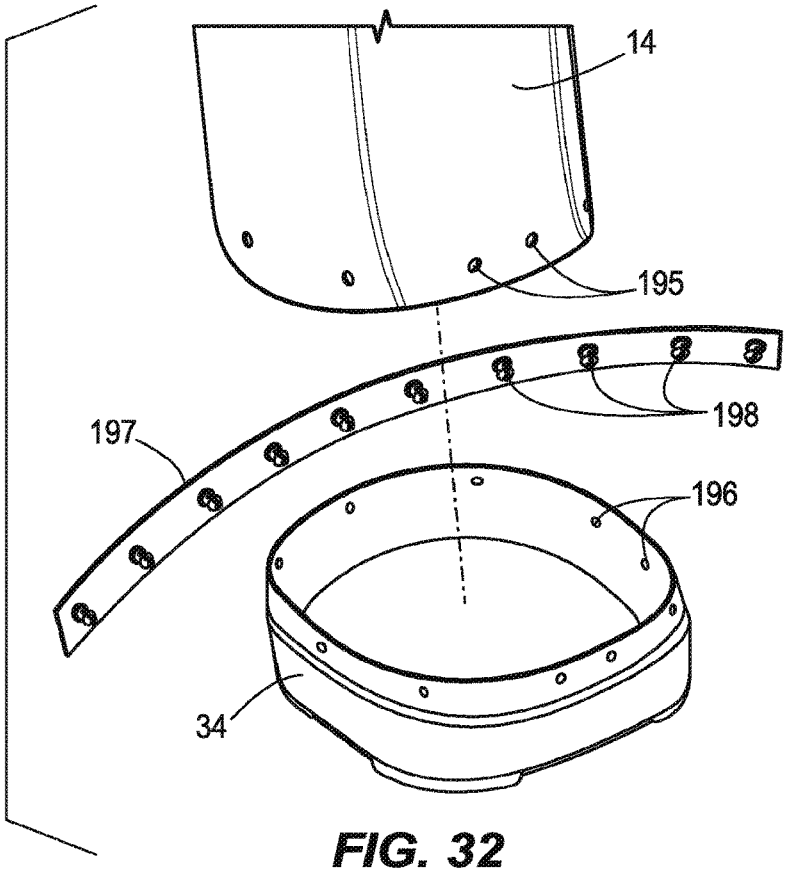
FIG. 32 is a perspective view of an alternative snap-fit attachment between the flat and base by a plurality of snap trees molded onto a strip of flexible material.
Figure 33:
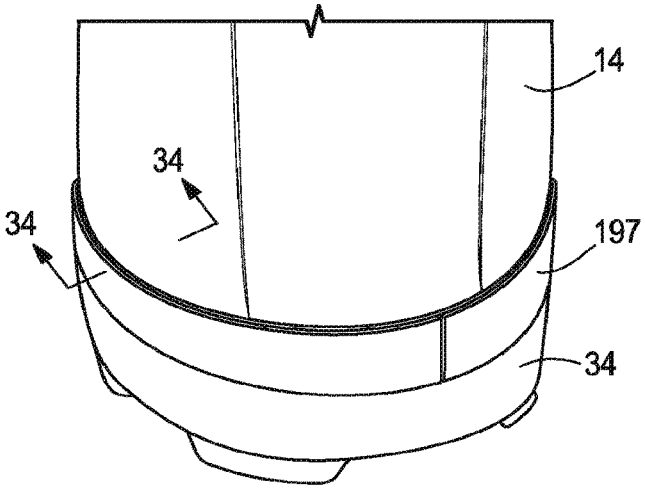
FIG. 33 is a perspective view of the alternative snap-fit attachment between the flat and base of FIG. 32, illustrating the strip of flexible material connecting the flat and the base.
Figure 34:
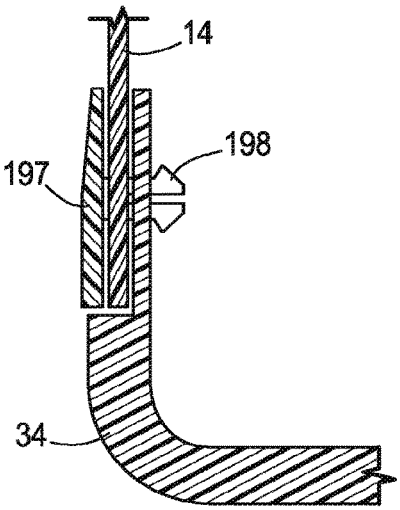
FIG. 34 a side view of a portion of the alternative snap fit attachment between the flat and base of FIG. 32, taken along line 34-34 of FIG. 33 and illustrating a single snap tree received by corresponding holes in the flat and the base.

3. Flat to Divider Top or Base Attachment Mechanism Via Alternate Snap Fit Connection The flat 14, 1014 of the golf bag 10, 1010 can attach via alternative means and designs. One such alternative snap fit connection between the flat 14 and the divider top 30 and/or base 34 is illustrated in FIGS. 32-34. The embodiment of the flat 14 includes a plurality of die cut holes 195 around the perimeter, while the embodiment of the base 34 includes a corresponding plurality of die cut holes 196 around the perimeter. The die cut holes 195 of the flat 14 and the die cut holes 196 of the base 34 are positioned in alignment, and a strip 197 of flexible molded snap trees or snap tree members 198 engages the aligned die cut holes 195, 196, with each aligned hole 195, 196 of the flat 14 and the base 34 receiving a single tree 198 (see FIG. 34). While FIGS. 32-34 illustrate an alternative snap-fit connection between the flat 14 and the base 34, the same alternative snap-fit connection may be used between the flat 14 and the divider top 30. In still other embodiments, the flat 14 may form a snap-fit attachment with the sub-assembly 42 by a hook and loop fastener (e.g. VELCRO®), hook and hook fastener, buttons, or any other suitable snap-fit fastener or securing assembly.

Alternate embodiments, such as a golf bag with a two-piece base, comprise a flat 14 that is directly sewn or otherwise connected to the base and divider top and therefore does not have a snap-fit connection.

The flat 14 also includes a reinforcing ring 200 at the top end 186 to provide additional reinforcement and rigidity around the divider top 30 (see FIG. 31). In embodiments of a golf bag having a stand assembly, the flat 14 may also include a plurality of windows, such as windows 428 of flat 414 in FIGS. 101-104, that respectively allow anchors 122 of a leg mounting bracket 30 to protrude through, exposing the anchors 122 to facilitate the snap-fit and pivotal connection with the legs 40. This permits the flat 14 to be interchangeable between a cart bag sub-assembly and a carry (or stand) bag sub-assembly.

The flat 14 includes a seam 202 (see FIG. 52) that is defined by a first seam edge 203 opposite a second seam edge 204 (see FIG. 31). The first seam edge 203 is sewn to the second seam edge 204 to create a tubular outer shell of the golf bag. In other embodiments of the sub-assembly 42, the seam edges 203, 204 of the flat 14 are connected by a single zipper, two zippers, a hook and loop fastener (VELCRO®), mounting tracks with a tongue that fits within associated rails, snap fit buttons, or any other suitable snap-fit fastener or securing assembly. In one construction, a single zipper attaches the edges 203, 204 at a middle portion of the flat 14, with the top and/or bottom of the flat 14 secured with snap fit buttons, a hook and loop fastener (VELCRO®), etc. In another construction, two zippers connect two separate seams of the flat 14 to the sub-assembly 42. In yet another embodiment the flat 14 may be split apart into multiple portions that attach to the sub-assembly 42 by snap-fit attachment. An advantage of a single seam, however, is easier waterproofing of the flat 14, and a single attachment line for wrapping the flat 14 around the sub-assembly 42.

E. Pockets of Flat

In addition to attachment mechanisms, seams, and other features, the flat 14, 1014 can further comprise one or more pockets 18, 1018 for storing apparel, golf equipment, golf accessories, and/or other personal items. The pockets 18, 1018 of the flat 14, 1014 may vary in size and shape, depending on the desired function of the pocket 18, 1018. The pockets 18, 1018 can include one or more pockets commonly referred to as "apparel pocket(s)", "ball pocket(s)", or "accessory pocket(s)." Some pockets 18, 1018 are constructed or sewn into the flat 14, 1014, making them non-detachable. Some pockets 18, 1018 are removable or configured to be coupled to the flat 14, 1014, making them attachable or detachable (hereafter "detachable"). These detachable pockets can be attached to the golf bag 10, 1010 during a second stage of the manufacturing process. The flat 14, 1014 can comprise one, two, three, four, five, six, seven, eight, nine, or ten pockets 18, 1018. In some embodiments, one or more of the pockets 18, 1018 may be located on top of, in front of, or within another pocket. One or more of the pockets 18, 1018 may comprise an opening without a closing feature. One or more of the pockets 18, 1018 may comprise an opening having a closing feature, such as a zipper, a snap fit connection, a fastener, a button, or a magnet. Certain pocket embodiments are described in detail below.

1. Detachable Pockets

Figure 108:
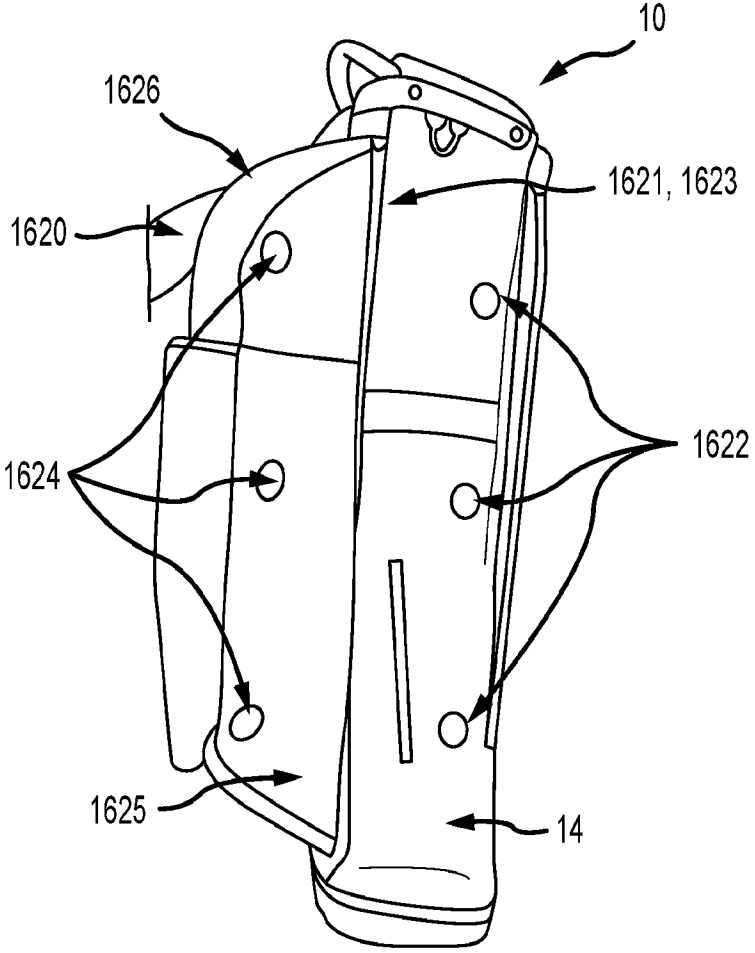
Figure 107:
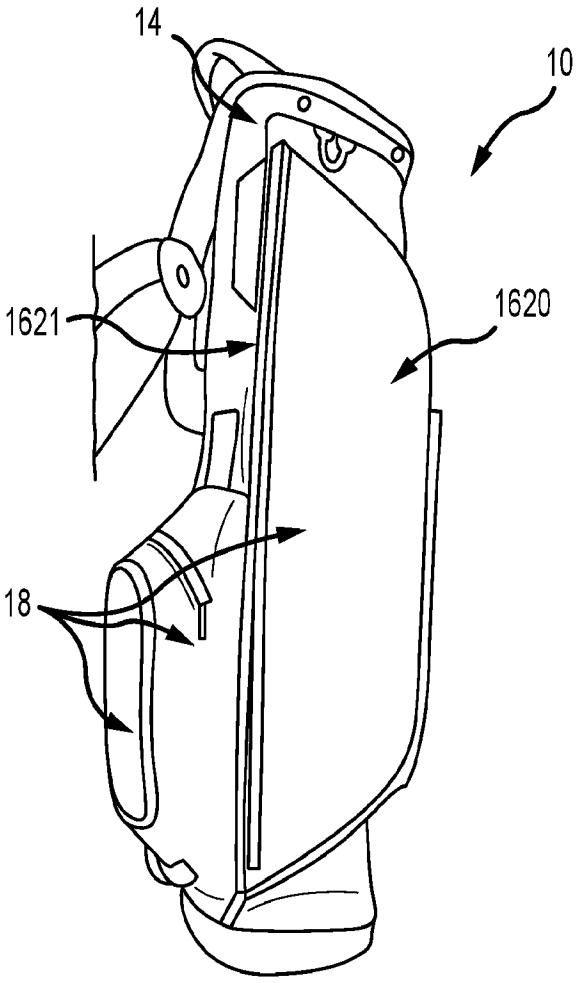
Figure 109:
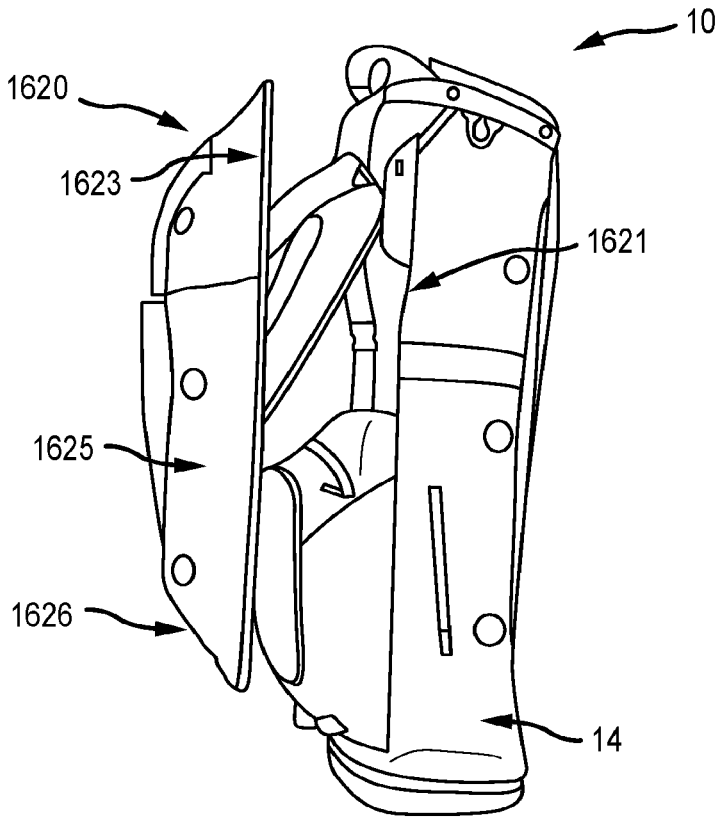

One possible embodiment of the golf bag flat 14, 1014 incorporates one or more customizable, detachable (or removable) golf bag pockets. FIGS. 107-109 illustrate a golf bag 10 having a removable golf bag pocket. This removable pocket can be associated with golf bag 10, golf bag 1010, or any other golf bag. Customization of golf bags is currently a time consuming process. Including removable golf bag pockets as an option on a golf bag allows the producer to quickly customize a golf bag. In addition, the removable pocket reduces shipping costs by making the golf bag shippable in parts, thus lowering shipping volume. Although the following description illustrates only a removable apparel pocket 1620, it should be understood that other pockets can include a similar removable design. For instance, a carry bag 10 can comprise a removable ball pocket (on the back side 12 of the golf bag), a removable accessory pocket (on a right side of the golf bag, as depicted in FIG. 1B), or other pockets.

In some embodiments, as illustrated in FIGS. 107-110, the pockets 18 can be manufactured separately from the bag flat 14, wherein the pockets 18 can be attached and detached to the bag flat 14. In other embodiments, some of the pockets can be manufactured integrally with the bag flat 14, while remaining pockets can be detachable. In some embodiments, the golf bag 1010 can comprise 1 detachable pocket, 2 detachable pockets, 3 detachable pockets, 4 detachable pockets, 5 detachable pockets, or any number of detachable pockets. The embodiment of FIG. 107 illustrates a carry bag 10 with one removable pocket 1620. In embodiments having detachable pockets 1620, the bag flat 14 can further comprises a first receiving mechanism 1621, and a second receiving mechanism 1622, wherein the first and second receiving mechanism are configured to receive, and secure the detachable pockets. The first and second receiving mechanisms can be zipper teeth, VELCRO®, snap buttons, snap fit connectors, apertures, recesses, ties, or any other appropriate attachment receiving mechanism.

When the detachable pockets of the golf bag are positioned to be attached onto the bag flat, the detachable pockets comprise a surface adjacent to the bag flat 1625, and a perimeter 1626 of the surface adjacent to the bag flat. The detachable pockets 1620 can further comprise a first attachment mechanism 1623, and a second attachment mechanism 1624. The first and second attachment mechanism can be located on the perimeter and/or surface adjacent to the bag flat 1625. The first attachment mechanism 1623 is configured to be received by the first receiving mechanism 1621 of the bag flat, and the second attachment mechanism 1624 is configured to be received by the second receiving mechanism 1622 of the bag flat.

In many embodiments as illustrated in FIGS. 107-109, the first attachment mechanism 1623 can be a zipper, and the second attachment mechanism 1624 can be VELCRO®, and accordingly, the first receiving mechanism 1621 can be zipper teeth, and the second receiving mechanism 1622 can be VELCRO® as well. In other embodiments, the first and second attachment mechanisms can be zippers, VELCRO®, snap buttons, buttons, fasteners, ties, hooks, buckles, or any other appropriate attachment mechanism that allows for detachability of the detachable pockets 1620. In consideration of the aforementioned, references of the first attachment mechanism 1623 will be referred to as a zipper hereafter, references of the second attachment mechanism 1624 will be referred to as VELCRO® hereafter, references of the first receiving mechanism 1621 will be referred to as zipper teeth hereafter, and references of the second receiving mechanism 1622 will be referred to as VELCRO® hereafter.

As illustrated in FIGS. 108 and 109, the zipper 1623 of the detachable pockets can extend along at least one side of the perimeter 1626 along the seams. In other embodiments, the zipper 1623 of the detachable pockets 1620 can extend along the entire perimeter 1626 along the seams of the surface adjacent the bag flat 14. The zipper 1623 of the detachable pockets align, and mate with the zipper teeth 1621 of the bag flat. The zipper 1623 functions as an alignment feature to orientate the detachable pockets 1620 correctly in relation to the bag flat 14. The zipper 1623 further functions as the main attachment mechanism to secure the detachable pockets 1620 onto the bag flat 14. In some embodiments the zipper 1623 can be a single continuous zipper extending along a portion of the perimeter, while in other embodiments, the zipper 1623 can be multiple discontinuous zippers along a portion of the perimeter.

Figure 110:
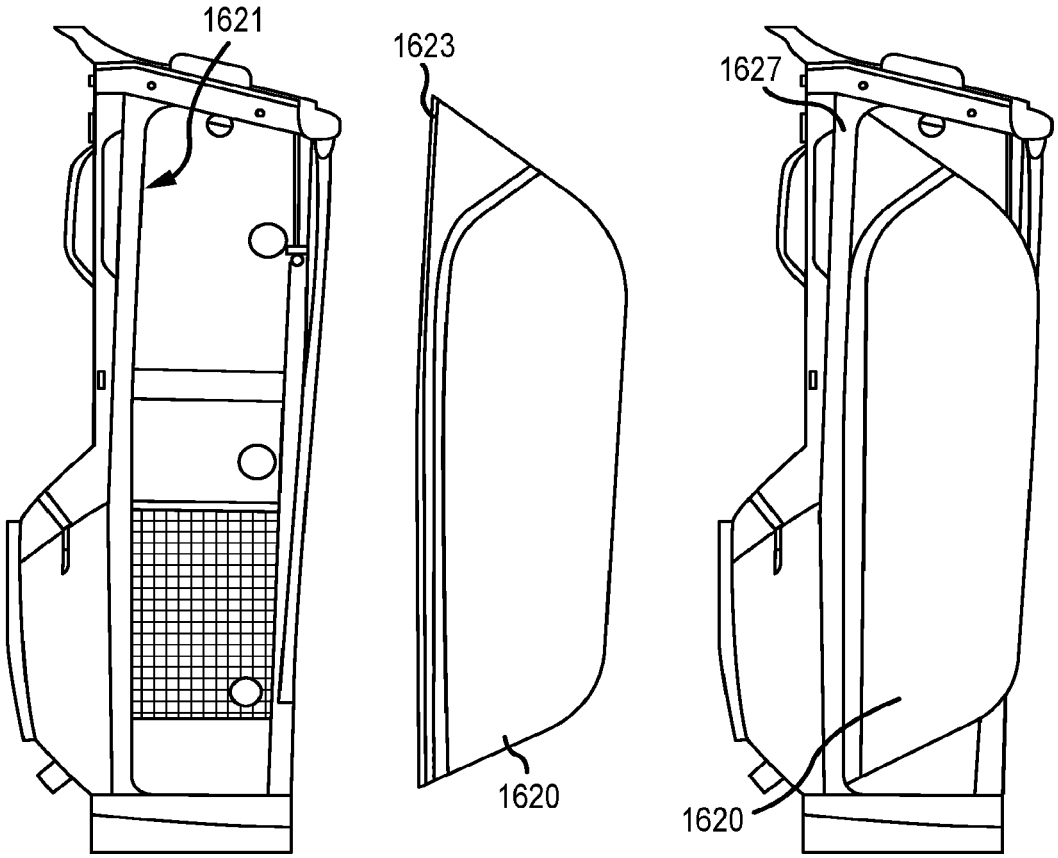
Figure 111:
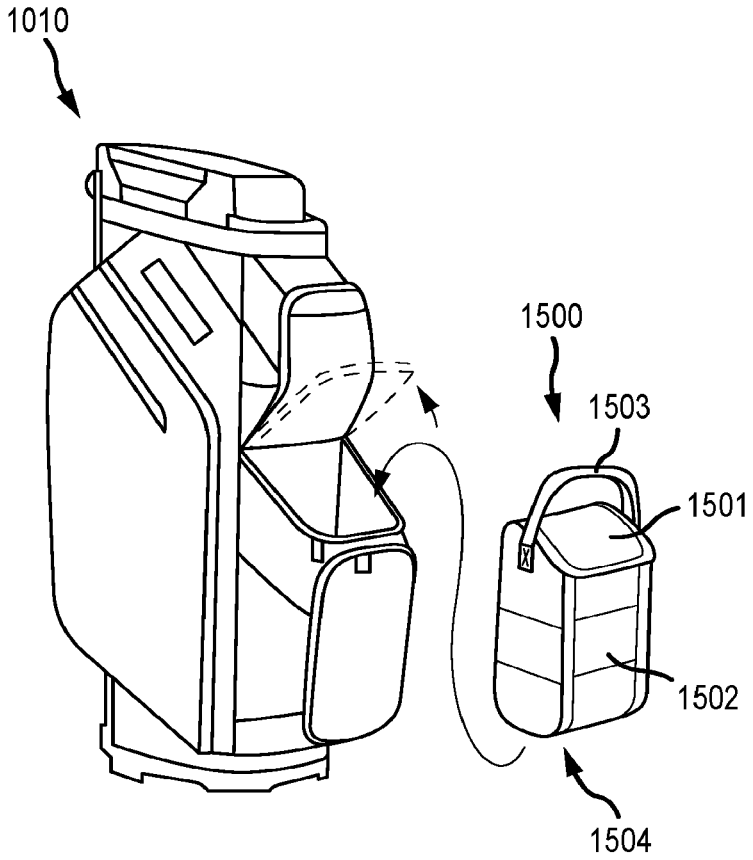
Figure 112:
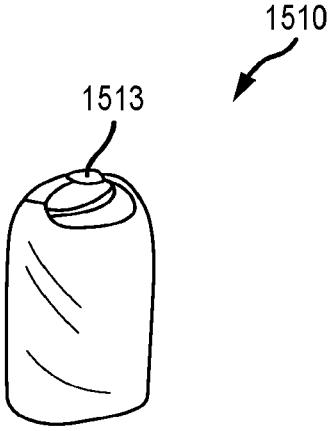

As illustrated in FIG. 110, in some embodiments, the receiving zipper teeth 1621 can be concealed from view under a lip 1627 of the golf bag flat 14. The lip 1627 also conceals the zipper 1623 of the detachable pocket 1620 when the detachable pocket 1620 is attached to the golf bag 10. In these embodiments, the pocket 1620, when attached, appears permanently attached to the bag, but functionally the pocket 1620 is removable. The lip 1627 gives the golf bag a clean look without sacrificing adaptability and manufacturing efficiency.

As illustrated in FIGS. 108 and 109, the VELCRO® 1624 of the detachable pockets can be positioned on the surface adjacent to the bag flat 14, proximal a portion of the perimeter void of a zipper. In other embodiments, the VELCRO® 1624 can be positioned anywhere on the surface adjacent the bag flat 14. The VELCRO® 1624 of the detachable pockets align, and mate with the VELCRO® 1624 of the bag flat 14. The VELCRO® 1624 of the detachable pockets 1620 acts at a secondary securing measure to keep the detachable pockets stationary against the bag flat, thereby preventing the detachable pockets from swaying when the golf bag is in motion. In many embodiments, the VELCRO® 1624 can be circular patches on the surface adjacent the bag flat. In other embodiments, the VELCRO® 1624 can be triangular patches, square patches, octagonal patches, any polygonal shaped patches, or a single continuous long strip. In some embodiments, there can be one patch/strip, two patches/strips, threes patches/strips, four patches/strips, five patches/strips, or six patches/strips.

2. Detachable Pocket Alternate Attachment Mechanism

In other embodiments, not illustrated, the detachable pocket can comprise a first attachment mechanism similar to the first attachment mechanism 1623 of the detachable pocket 1620, described above. The detachable pocket can further comprise a second attachment mechanism located at adjacent a base end of the golf bag. In this embodiment, the second attachment mechanism comprises a receiving portion and a core portion. The core portion is attached to the flat of the golf bag. The receiving portion is attached to the detachable pocket. A channel of the receiving portion is configured to receive the core portion to secure the detachable pocket to the flat. In yet other embodiments, not illustrated, the second receiving mechanism of the flat and the second attachment mechanism of the removable pocket comprise snap fit connector elements or clips.

3. Detachable Pocket Customization

The detachable pockets 1620 and bag flat 14 can be manufactured in multiple different colors. This allows manufacturers to stock multiple colors of bag flats 14 and detachable pockets 1620 to combine for specific color schemes based on the customized order. The detachable pockets 1620 further simplify the customized logo process due to the size difference. Incorporating a customized logo (e.g., school mascot/school name) onto a golf bag is much easier on a detachable pocket 1620 than on a pocket permanently attached to a golf bag. The process of screen printing or embroidering a logo onto an item is faster and easier on a small item, such as a pocket, than on a large, bulky item, such as a golf bag.

The ability to combine any colored detachable pocket with any colored bag flat 14, in combination with the simplified customized logo process, can reduce the turnaround time on custom bag orders from approximately 90-180 days to approximately 30-45 days. Reducing the turnaround time by half or more increases customer satisfaction. Further, golf bags with detachable pockets can be packaged in a separately smaller volume package, thereby decreasing the overall volume size of the package housing the golf bag. The two separate smaller volume packages combined will have a lower shipping cost compared to singular large volume packages housing golf bags with permanently attached pockets. Reduced shipping costs for the customer further increases customer satisfaction. Further still, the detachable pockets can simplify inventory within the warehouses by pocket type and/or by color, thus increasing the organization of the warehouse, and assembly.

4. Quick-Access Pocket (in-Play Pocket)

Figure 105A:
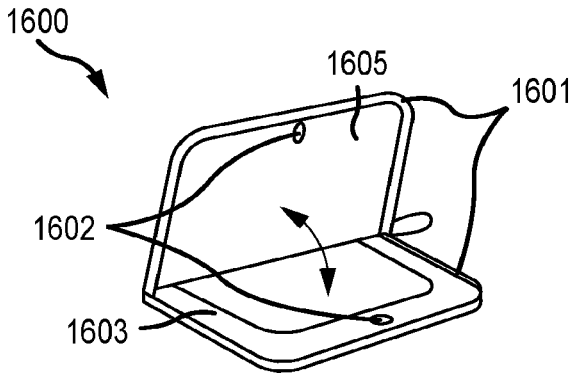
FIG. 105A is a perspective view of an embodiment of a golf bag easy-access/zippered pocket, in an open configuration.
Figure 105B:
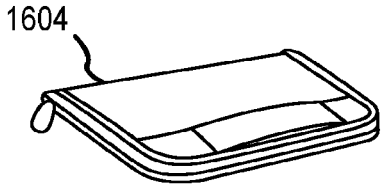
Figure 106:
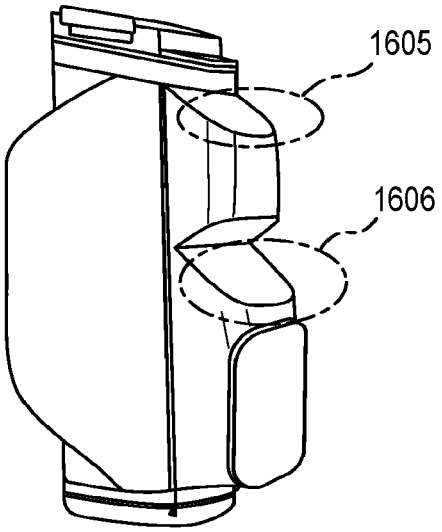

The flat 14, 1014 can further comprise a quick-access pocket for storing small accessories, such as golf tees or golf balls, that a player might want access to during a round of golf. FIGS. 105A-106 illustrate a golf bag having a quick-access pocket 1600 (the quick-access pocket may also be referred to as an "in-play pocket," "a quick-access zippered pocket," or a "magnetic zippered pocket"). This quick-access pocket 1600 can be associated with golf bag 10, golf bag 1010, and/or any other suitable golf bag. The quick-access pocket 1600 can be similar to one or more pockets 18 of golf bag flat 14, 1014. The golf bag quick access pocket 1600 includes a zipper 1601 and a magnet feature 1602. This pocket will function as a quick access pocket during play, but can be securely shut by the zipper 1601 during transportation or for longer duration travel use. The magnet feature 1602 can be used to hold a pocket lid 1605 closed during golf play, but allows for quick opening of the lid when needed. The golf pocket 1600 further comprises a stiff lip 1603 around the inside of the opening of the pocket for ensuring items do not fall out during play and for improving the structural integrity of the pocket.

The quick-access pocket 1600 serves two separate functions. One function is to hold items in the golf bag while in transport or storage, and another function is to hold items during play. The zipper 1601 satisfies the first (transportation/storage) function. The magnet feature 1602 and the stiff lip 1603 satisfy the second (quick access) function.

The quick access pocket 1600 can be used to secure items inside the golf bag 10. The pocket 1600 can have various body shapes and sizes. The pocket lid 1605 covers the opening of the pocket 1600. In the illustrated embodiment of FIGS. 105A-106, the pocket opening comprises a hinge side 1604 where the lid 1605 connects to the body and three sides that allow access to the pocket 1600 when the lid 1605 is open. The lid 1605 can contain polyethylene to increase stiffness. The lid 1605 can include other suitable materials.

The features that secure items inside the pocket 1600 include the zipper 1601, the magnet 1602, and the stiff lip 1603 around the inside of the opening. The zipper 1601 circumscribes the outside of the opening along the three sides that allow pocket access. The zipper 1601 connects the lid 1605 to the body of the pocket and thereby can enclose all stored items as well as the magnet feature 1602 and the stiff lip 1603 feature. The magnet feature 1602 includes an upper magnet and a lower magnet. The upper magnet is embedded into the lid 1605 of the pocket 1600 corresponding to the lower magnet which is embedded in the stiff lip 1603. The upper magnet connects with the lower magnet when the lid 1605 is shut. The stiff lip 1603 runs along the inside of the three sides that allow access to the pocket. The stiff lip 1603 extends from these three sides of the opening towards the center of the pocket opening. The stiff lip 1603 can extend various lengths from the sides, such as between 0.5 inch and 2 inch. The stiff lip feature 1603 contributes to the structural integrity of the golf pocket and houses the lower magnet. The lip 1603 also provides a platform for the lid 1605 to rest against when the lid is closed. The stiff lip 1603 can be composed of polyethylene or another suitable material.

Combining the zipper 1601 with the magnet feature 1602 and the stiff lip 1603 allows the cost to be lower than the cost for existing quick access pockets which use multiple magnets for secure storage. Incorporating the zipper 1601 and limiting the number of magnets lowers the cost of the final product and provides a more reliable method of securing the pocket 1600 shut.

The quick access pocket 1600 invention can be used in conjunction with various golf bag designs. The pocket 1600 can be located on the upper portion of the bag or on a lower portion of the golf bag. FIG. 106 illustrates a first possible location 1606 and a second possible location 1607 for the quick-access pocket 1600.

5. Shoe Pocket

Figure 35:
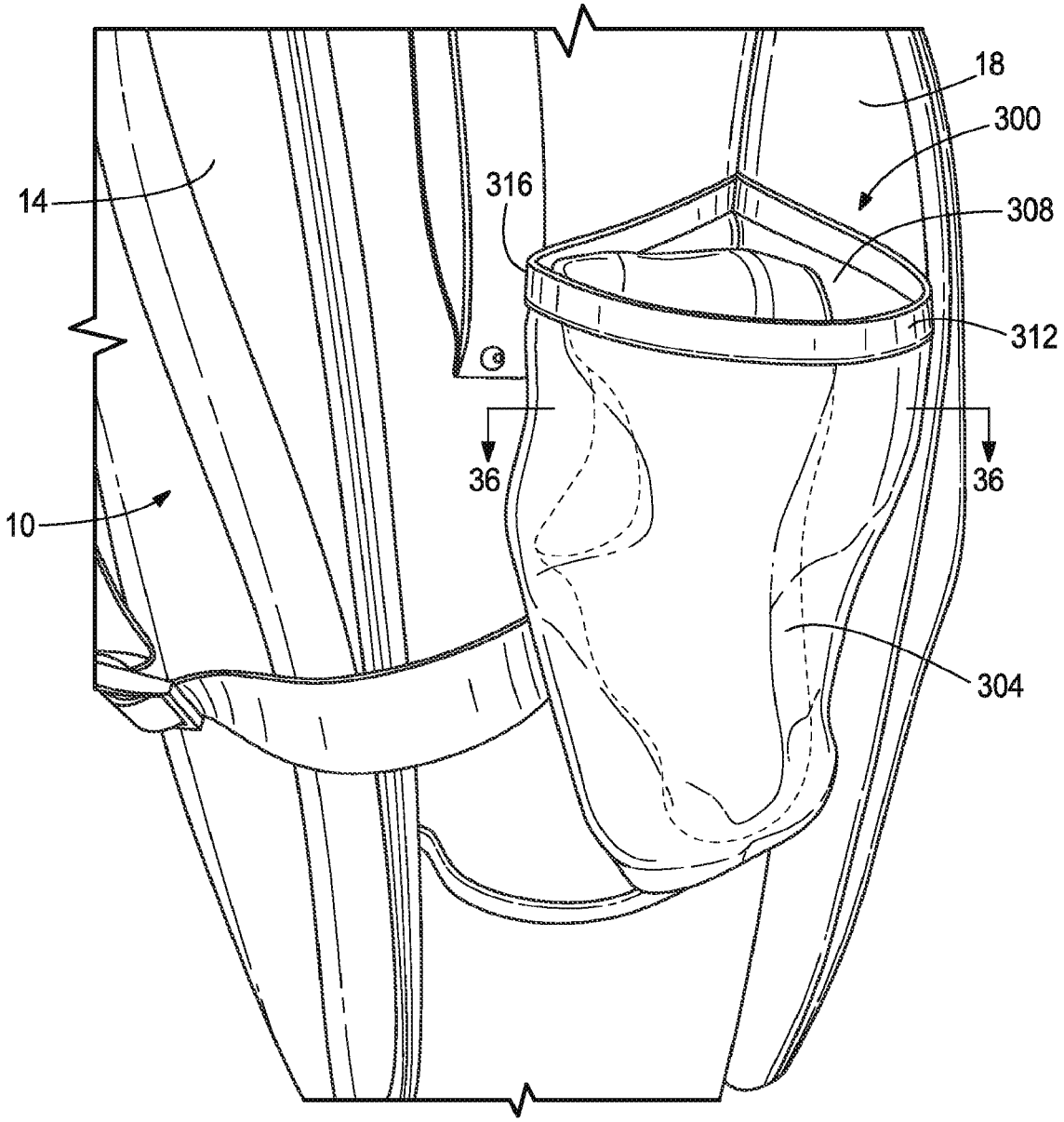
FIG. 35 is a perspective view of an embodiment of a deployable pocket assembly for a golf bag, the pocket assembly shown in a deployed configuration and containing a shoe.

Some embodiments of the golf bag flat 14, 1014 can include a deployable shoe pocket assembly for storing a pair of shoes. When not in use, the shoe pocket can be stored in a concealed compartment within the golf bag. FIGS. 35-46 illustrate a deployable shoe pocket assembly 300 that is attached to the golf bag 10. The shoe pocket assembly 300 is deployable between a deployed (or first) configuration (shown in FIGS. 35-36) and a stored (or second) configuration (shown in FIG. 37). Referring specifically to FIG. 35, the shoe pocket assembly 300 includes a shoe pocket 304 that defines a compartment 308 configured to receive a shoe (or a pair of shoes). One end of the shoe pocket 304 defines an opening 312 to provide access to the compartment 308. The perimeter of the opening 312 can be formed of an elastic material 316 that is biased inward, causing the opening 312 to constrict in its relaxed position. This facilitates retention of a shoe (or shoes) received by the shoe pocket 304, while also reducing the size of the shoe pocket 304 when not in use.

Figure 36:
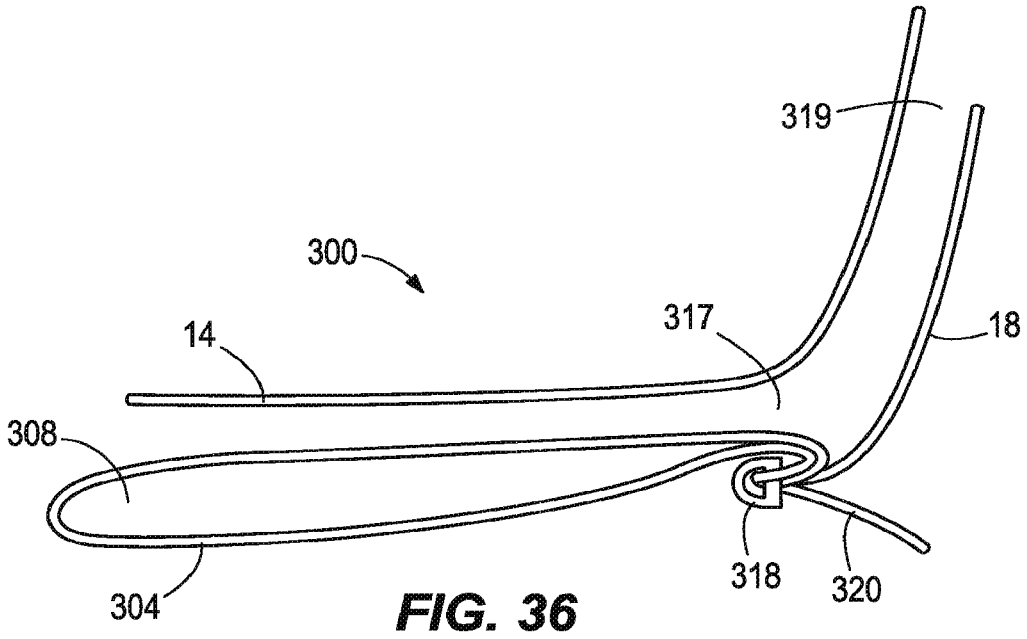
FIG. 36 is a top down view of the deployable pocket assembly of FIG. 35 in a deployed configuration, taken along line 36-36 of FIG. 35, and showing a shoe pocket with the shoe removed.

FIG. 36 illustrates the shoe pocket 304 in the deployed configuration. The pocket 18 can be attached to the flat 14 along a seam (or other suitable fastener). A portion of the seam can define an access port 317 to a storage channel 319 that is partially defined by the flat 14 and partially defined by the pocket 18 (see FIGS. 36 and 37). The shoe pocket 304 is attached to the pocket 18 by a fastener 318 (e.g., a clip, stitching, etc.) at a gusset 320. The gusset 320 can be positioned at an edge of the pocket 18 or at any other suitable portion of the pocket 18. In other embodiments, the shoe pocket 304 can be attached to a portion of the flat 14 (e.g., at a gusset on the flat 14, etc.).

Figure 37:
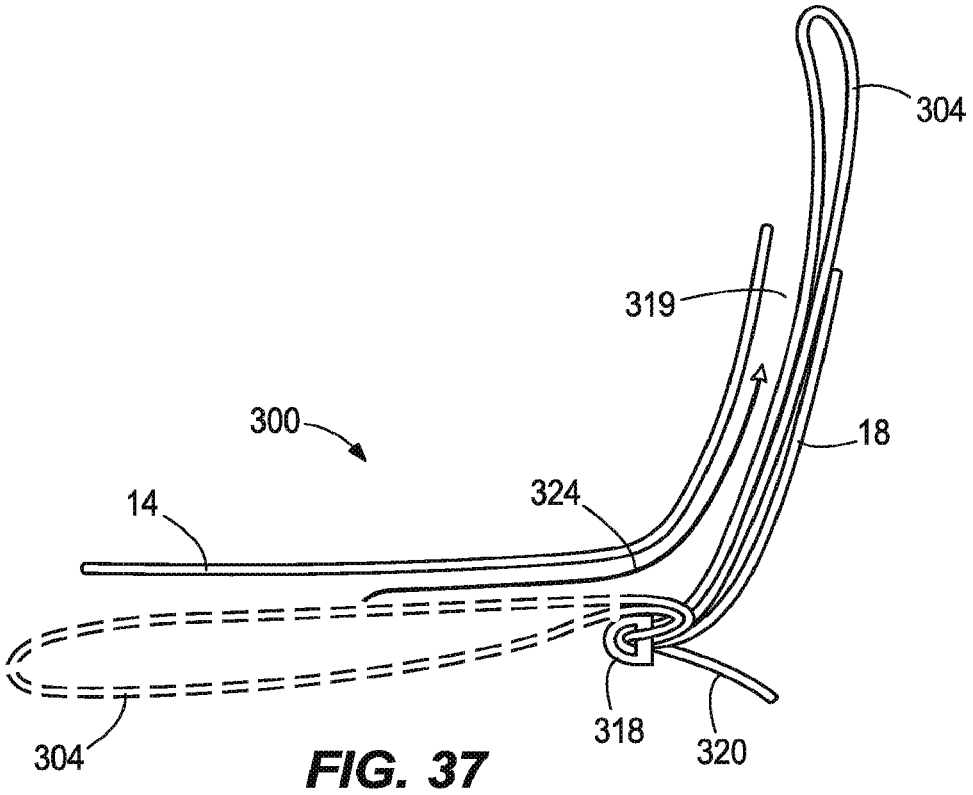
FIG. 37 is a top down view of the deployable pocket assembly of FIG. 35, showing the shoe pocket in the stored configuration in solid lines and in the deployed configuration in broken lines.

FIG. 37 illustrates the shoe pocket 304 in the stored configuration. In this configuration, the shoe pocket 304 is positioned into the storage channel 319 (the shoe pocket 304 is shown in broken lines in the deployed configuration), as indicated by arrow 324. Accordingly, this allows a user to selectively deploy the shoe pocket 304 to store a shoe or shoes, and then retract the shoe pocket 304 into the stored configuration when not in use.

Figure 39:
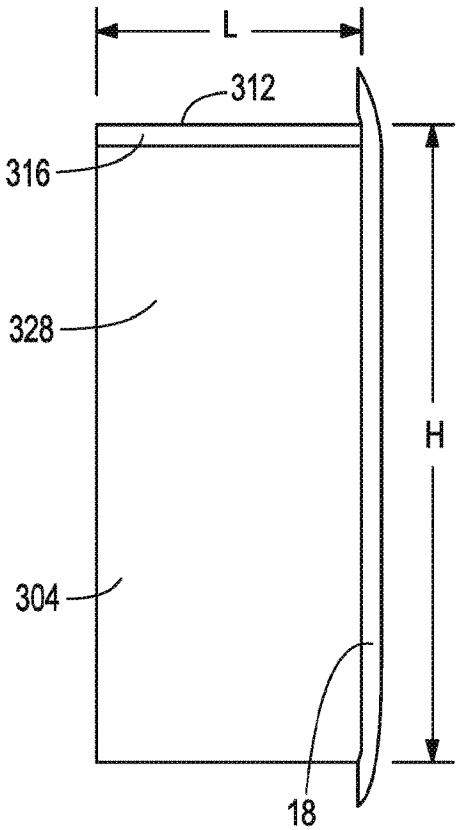
FIG. 39 is a side view of a shoe pocket assembly, according to an embodiment.
Figure 38:
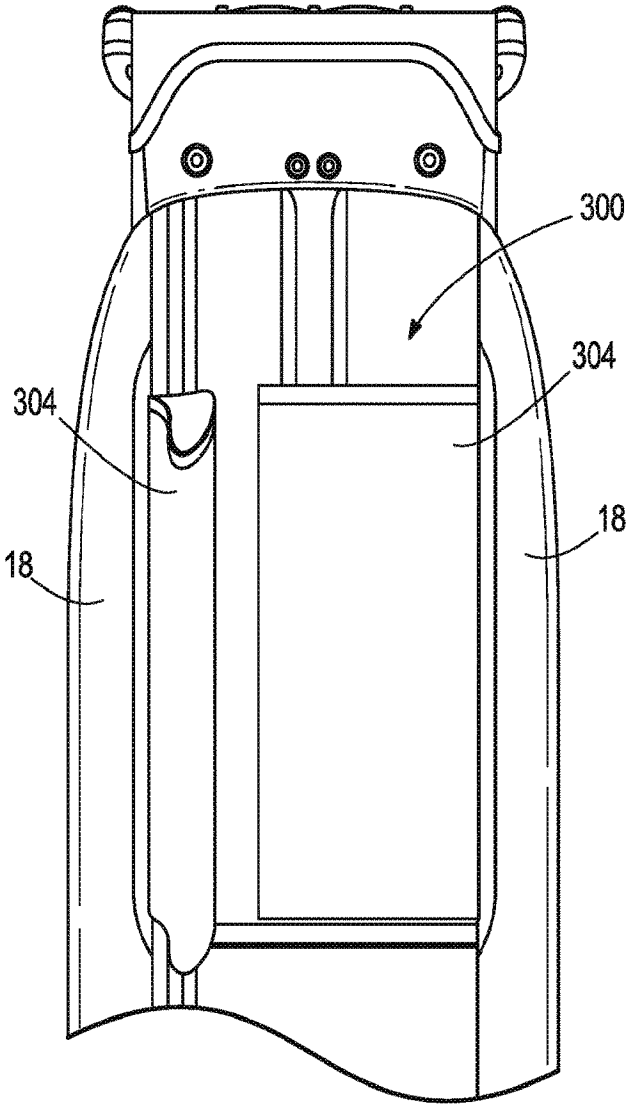
FIG. 38 is a perspective view of the golf bag of FIG. 35 illustrating two shoe pockets in the deployed configuration.
Figure 40:
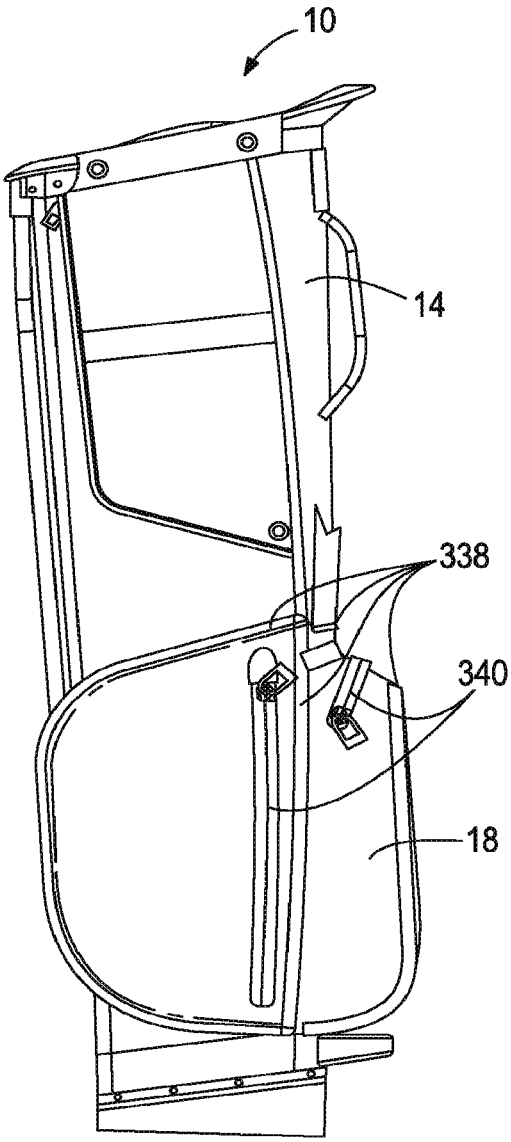
FIG. 40 is a side view of a first side of another embodiment of a golf bag.
Figure 41:
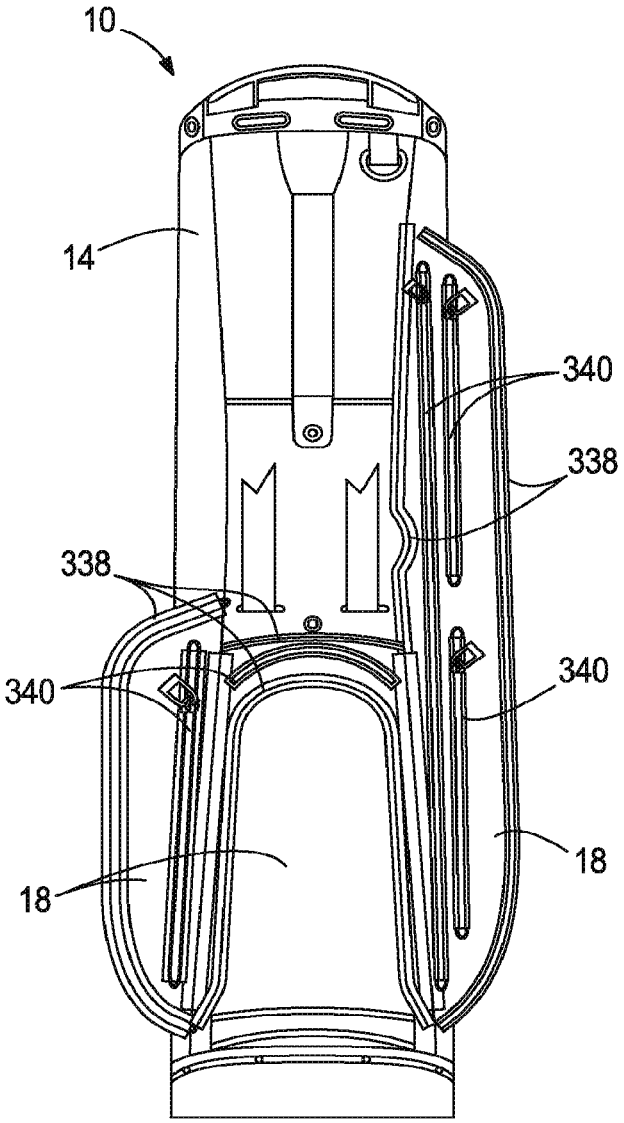
FIG. 41 is a side view of a second side (back side) of the golf bag of FIG. 40.
Figure 42:
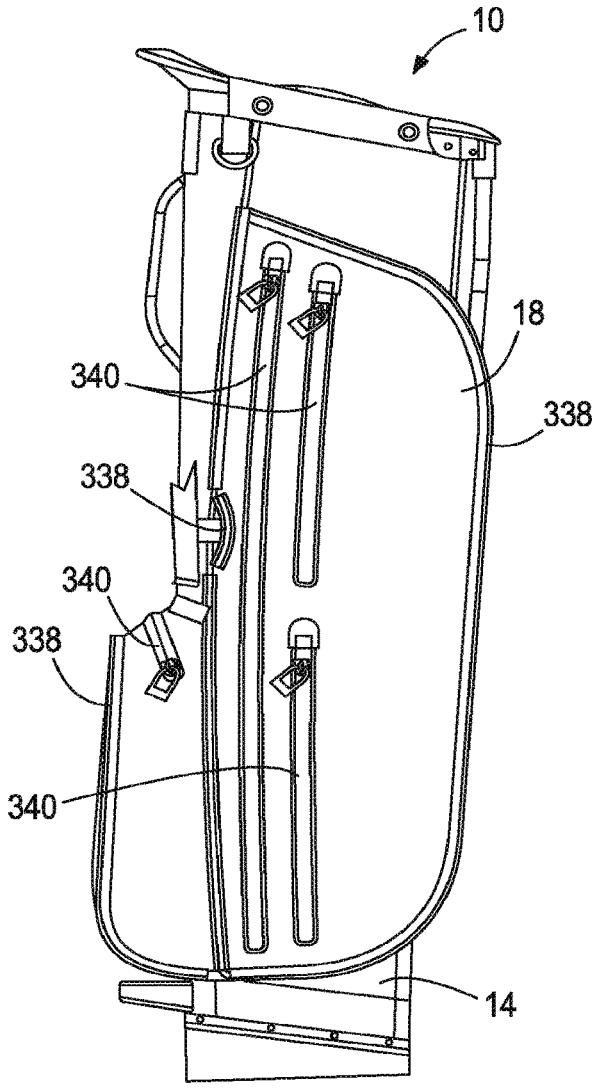
FIG. 42 is a side view of a third side of the golf bag of FIG. 40, opposite the first side.
Figure 43:
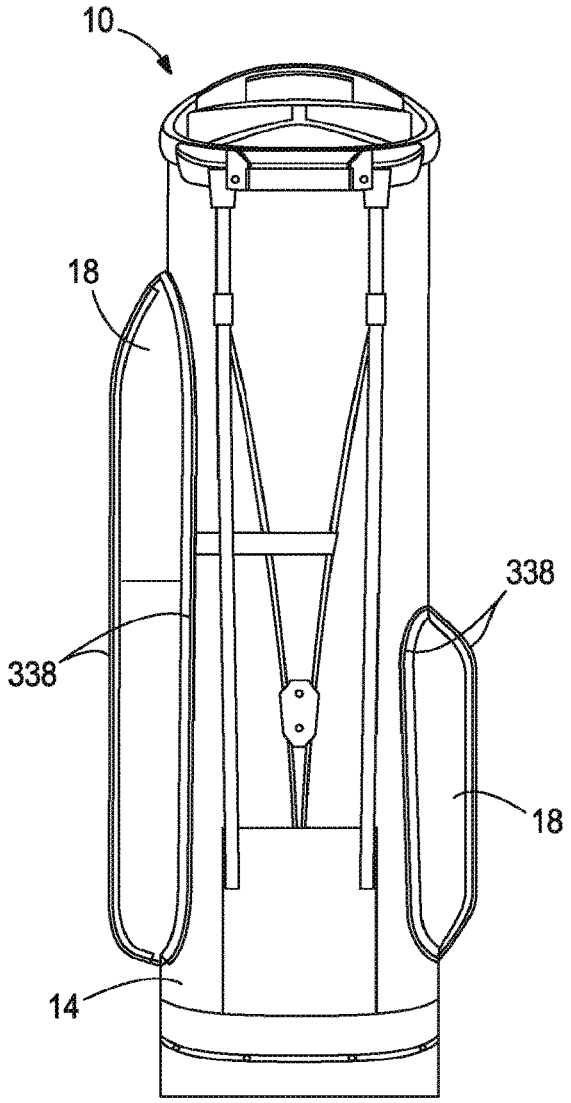
FIG. 43 is a side view of a fourth side (front side) of the golf bag of FIG. 40, opposite the second side.
Figure 44:
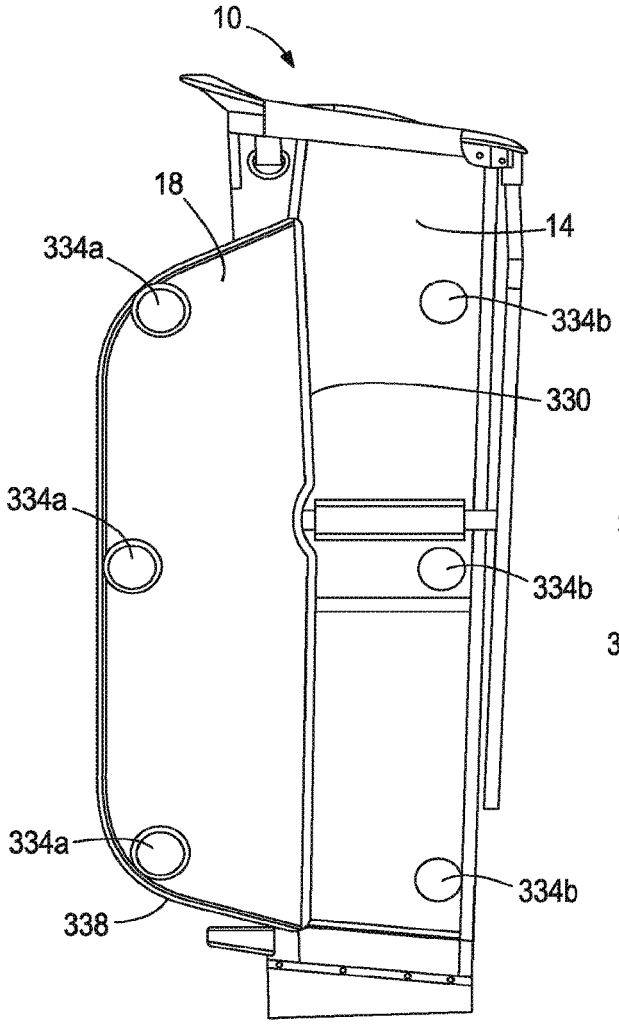
FIG. 44 is a side view of the golf bag of FIG. 40 with the pocket pivoted along a seam.
Figure 45:
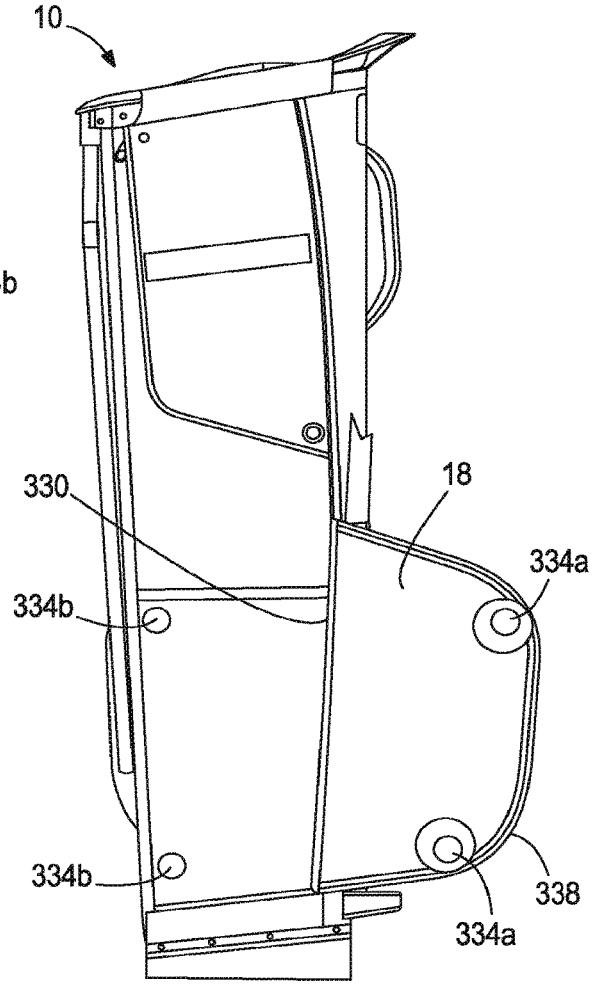
FIG. 45 is a side view of the golf bag of FIG. 40 with the pocket pivoted along a seam.
Figure 46:
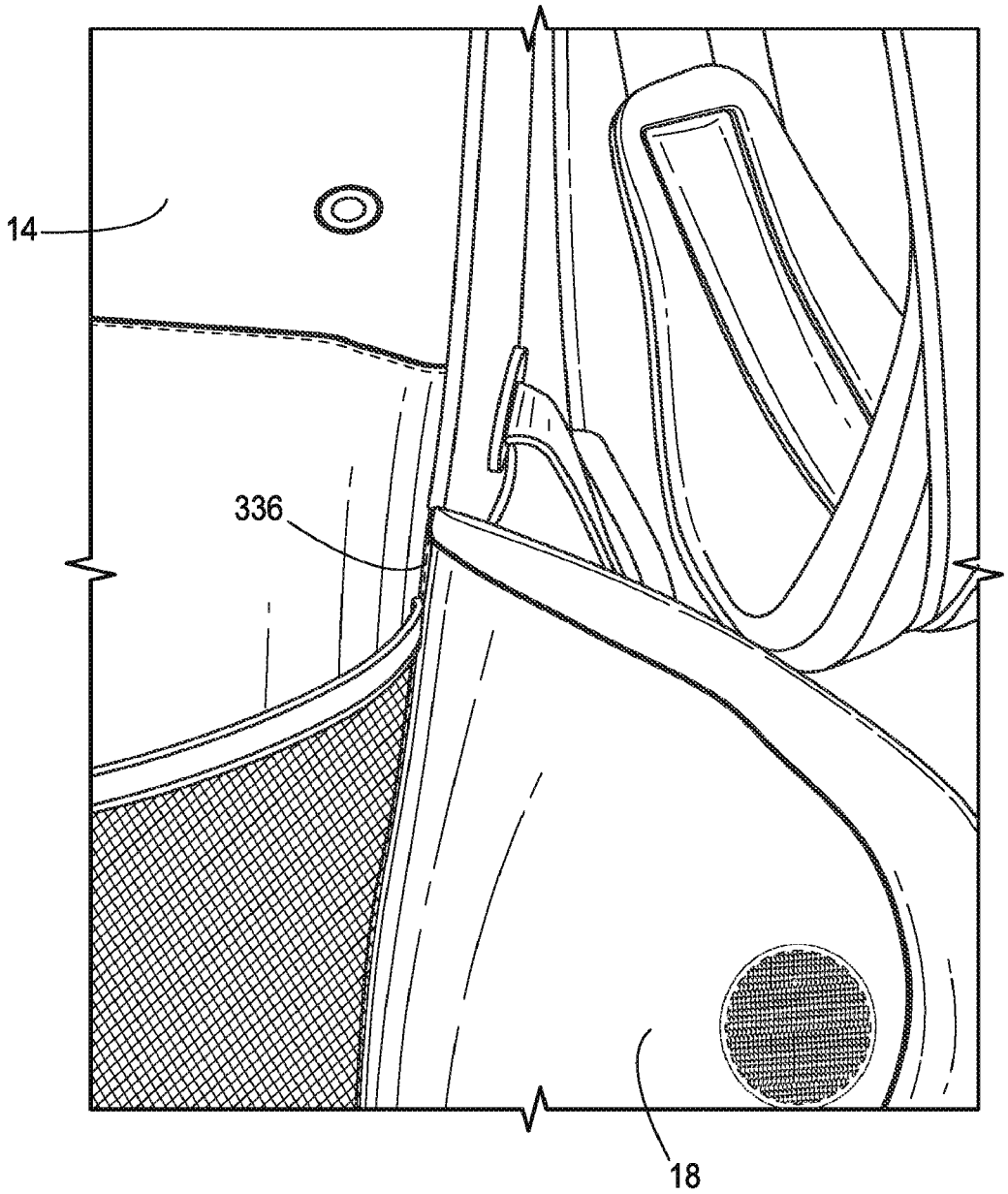
FIG. 46 is a perspective view of the golf bag of FIG. 40 illustrating the seam between the pocket and the flat that receives a waterproofing treatment.

In the illustrated embodiment, the shoe pocket assembly 300 is positioned on a side of the golf bag 10 opposite the handle 22 and/or straps 24 (e.g., a "belly" side of the golf bag 10). In other embodiments, the shoe pocket assembly 300 can be positioned at any suitable location on the golf bag 10. Further, the illustrated embodiment shows a single shoe received in the shoe pocket 304. Accordingly, the shoe pocket assembly 300 can include two shoe pockets 304 to accommodate a pair of shoes, as illustrated in FIG. 38. In the embodiment illustrated in FIG. 38, the shoe pockets 304 are attached to separate pockets 18. However, in other embodiments the shoe pockets 304 can both be attached to a single pocket 18. As shown in FIG. 39, each shoe pocket 304 is formed of an elastic or stretch mesh material 328. In other embodiments, the shoe pocket 304 can be formed of any suitable material (e.g., nylon, polyester, etc.). In addition, each shoe pocket 304 is sized to receive and carry a shoe. The shoe pocket 304 can have a height H of approximately thirty (30) centimeters, and a length L of approximately seventeen and a half (17.5) centimeters, which defines a perimeter of the opening 312 of approximately thirty-five (35) centimeters. In other embodiments, the shoe pocket 304 can be any suitable size to carry one shoe, or sized to carry a pair of shoes. The shoes received in the shoe assembly 300 can include any suitable shoes (e.g., golf shoes when the golf bag 10 is being transported away from a golf course, street shoes when the golf bag 10 is being transported on or around the golf course, etc.).

6. Cooler Bag Pocket

In some embodiments of the golf bag 10, 1010, the flat comprises a pocket for storing a removable cooler bag. FIG. 109*a* illustrates an embodiment of the golf bag comprising a pocket for accepting a removable cooler bag 1500. This removable cooler bag 1500 can be associated with golf bag 10 and/or golf bag 1010. The removable cooler bag 1500 can be included in the sub-assembly golf bag package, or the cooler bag can be supplied separately to the user. The removable cooler bag 1500 is designed to fit into a compartment of the golf cart/carry bag 10. The removable cooler bag 1500 can be either insulated and fully sealed or fully sealed with no insulation. Internal pockets that fit standard re-freezable gel ice packs can be built into the inside of the bag.

The cooler bag can be uniquely shaped to fit inside existing cart bags or carry bags. FIG. 109*b* includes an illustration of a second embodiment 1510 of the cooler bag 1500. In the second embodiment, the removable cooler bag can comprise a single bag entity with a latch handle 1513. In the first embodiment 1500, the cooler bag can have multiple coupled components, such as a lid 1501, a main bag body 1502, a handle 1503, and a rigid base 1504. Insulation can be included on the inside of the main bag body 1502.

The handle 1503 either rigid or flexible, is included on the cooler bag for easy removal of the cooler bag from the pocket of the cart/carry bag. The cooler bag can incorporate a rigid lid or flexible lid flap 1501. Other methods of sealing the bag can include rolling the bag material and clamping the rolled material together, such as is seen in many waterproof camping bags. The clamping mechanism 1513 can comprise a clasp, a plastic buckle, or any other suitable mechanism. The base 1504 of the cooler bag can include a rigid plastic component for added durability. This reinforcing component for the base can be adhered externally to the bottom of the cooler bag, or it can be secured inside the bottom of the cooler bag. The removable cooler bag can be made from flexible plastic material that is water resistant. The handle, clamp, lid, and base can be made from plastic or other suitable materials.

The purpose of the cooler bag 1500 is to improve the convenience of transporting beverages and food items in a golf bag while playing a round of golf. The added insulation in the walls of the cooler bag and the full seal keep beverages cold longer. The removable cooler bag allows for easy packing and cooling of beverages at home before reaching the golf course. The cooler bag also isolates the beverages and food items from the rest of the golf bag, which helps avoid soiling the golf bag.

F. Waterproofing

The golf bag 10, 1010 can be waterproof. FIGS. 40-46 illustrate an embodiment of the golf bag 10 that includes waterproofing to reduce water penetration into one or more compartments of the golf bag 10. For example, pockets 18 can be manufactured out of a coated polyester material, and more specifically a double coated polyester material. As an example, the coating for the polyester can be a polyester-polyurethane resin coating and/or a polyurethane resin coating. Coated polyester advantageously does not shrink in high temperature weather conditions (e.g., above ninety degrees Fahrenheit, etc.). The pockets 18 can be manufactured, coated, and then attached to the flat 14 (e.g., sewn, etc.). The pockets 18 can having binding edges 338 that give shape to the pockets 18. With additional reference to FIGS.

44-45, once the pockets 18 are attached to the flat 14, the securement points 330 (e.g., seams, etc.) can be coated with the waterproofing. The pockets 18 can be selectively coupled to the flat 14 at an edge opposite the securement point 330 by a plurality of complementary fasteners 334*a*, 334*b* (e.g., hook and loop fasteners, etc.). The fasteners 334*a*, 334*b* (shown in FIGS. 44-45) and/or an edge of the pockets 18, or a seam 336 where each pocket 18 connects to the flat 14 (shown in FIG. 46), or a zipper 340 or other access opening to each pocket 18 (shown in FIGS. 40-45) can be coated with the waterproofing. The waterproofing reduces penetration of water or other liquids into the treated pockets 18 or portions of the flat 14, which assists in keeping items stored within the pockets 18 dry in adverse weather conditions or inadvertent exposure to water (e.g., positioning the golf bag 10 near an irrigation head, etc.). Referring to Table I, the golf bag 10 having waterproofing, as described herein, resulted in an overall reduction in water retention of approximately 26%-73%, and a reduction in water detection in the pockets 18 of approximately 6%-44%, compared to various commercial waterproof golf bags.

TABLE I

WATER RETENTION AND DETECTION OF VARIOUS WATERPROOF GOLF BAGS

| | WATER RETENTION (GALLONS) | PERCENT POSITIVE WATER DETECTION IN POCKETS |
|---|---|---|
| GOLF BAG 10 HAVING WATERPROOFING | 0.023 | 0.0 |
| COMMERCIAL WATERPROOF GOLF BAG 1 | 0.085 | 6.3 |
| COMMERCIAL WATERPROOF GOLF BAG 2 | 0.031 | 6.3 |
| COMMERCIAL WATERPROOF GOLF BAG 3 | 0.049 | 43.8 |

G. Sub-Assembly

The sub-assembly 42, 1042 can comprise one or more of: the base 34, 1034, divider top 30, 1030, divider sleeve 46, 1046, one or more stays 39, 1039, and flat 14, 1014. Table II below lays out the composition of various example sub-assembly embodiments. It should be understood that the base 34, 1034, the divider top 30, 1030, the one or more stays 39, 1039, and the flat 14, 1014 can comprise more than one piece each, as described in depth below. Therefore, in Table I the inclusion of a component in a sub-assembly can represent inclusion of one or more pieces of said component. For example, sub-assembly embodiment VI can comprise only a ring portion of a two-piece snap together base, along with the divider top, the divider sleeve, and the flat.

The sub-assembly 42, 1042 can comprise any combination of the base 34, 1034, divider top 30, 1030, divider sleeve 46, 1046, one or more stays 39, 1039, and flat 14, 1014. The sub-assembly 42, 1042 is not limited to the embodiments disclosed in Table II. Sub-assemblies 42, 1042 formed from the interchanging of different components can offer benefits for specific embodiments of the golf bag 10, 1010. For instance, a sub-assembly 42, 1042 having a base, a stay, and a divider top (such as sub-assembly VII in Table II) can eliminate the step of inserting a stay during a second manufacturing stage. However, a sub-assembly 42, 1042 having a divider top, a base, and a flat (such as sub-assembly V) requires insertion of one or more stays, but the eliminates the need for riveting or otherwise securing the flat to the divider top or base during the second manufacturing stage. Thus, the components of a sub-assembly can be interchanged or varied to complement a specific golf bag design or cater to the limitations of a manufacturing site (i.e. the available equipment).

TABLE II

SUB-ASSEMBLY EMBODIMENTS

| | Sub-Assembly Embodiment | | | | | | | |
|---|---|---|---|---|---|---|---|---|
| Component | I | II | III | IV | V | VI | VII | VIII |
| Divider top | x | x | x | x | x | x | x | x |
| Divider sleeve | x | x | x | x | | x | | x |
| Base | | x | x | x | x | x | x | x |
| Stay(s) | | | x | | | | x | x |
| Flat | | | | x | x | x | | x |

II. Carry Golf Bag and Sub-Assembly of Carry Bag

The golf bag can be a carry bag 10. FIGS. 1-90, 94A-104, and 107-110 illustrate features and embodiments of a golf bag that can be associated with a carry type golf bag. The carry bag 10 can incorporate the components discussed above. In addition, a carry bag 10 can further include a stand assembly, and one or more straps. The stand assembly allows the carry bag to be used in a retracted configuration or an extended configuration. The term "retracted configuration" refers to a state wherein the stand assembly is held (or retracted) against the flat of the carry bag (the retracted configuration is also called a "first configuration"). The term "extended configuration" refers to a state wherein the stand assembly is deployed and supports the carry bag in a stable position (the extended configuration is also called a "free-standing configuration," a "tripod configuration," or a "second configuration").

As described above, the carry bag 10 can comprise the following components: (1) a base 34, (2) a divider top 30, (3) a divider sleeve 46, (4) a stay 39, and (5) a flat 14. The carry bag 10 can further comprise a stand assembly 26 and one or more straps 24. As described above, the carry bag 10 can be formed from a sub-assembly 42 comprising one or more of: the base 34, divider top 30, divider sleeve 46, stay 39, and flat 14. The stand assembly 26 is configured to couple to the sub-assembly 42. In some embodiments, the stand assembly 26 is configured to couple to the divider top 30 and the base 34. The one or more straps 24 engage a portion of the flat 14 and couple to the divider top 30.

Figure 1A:
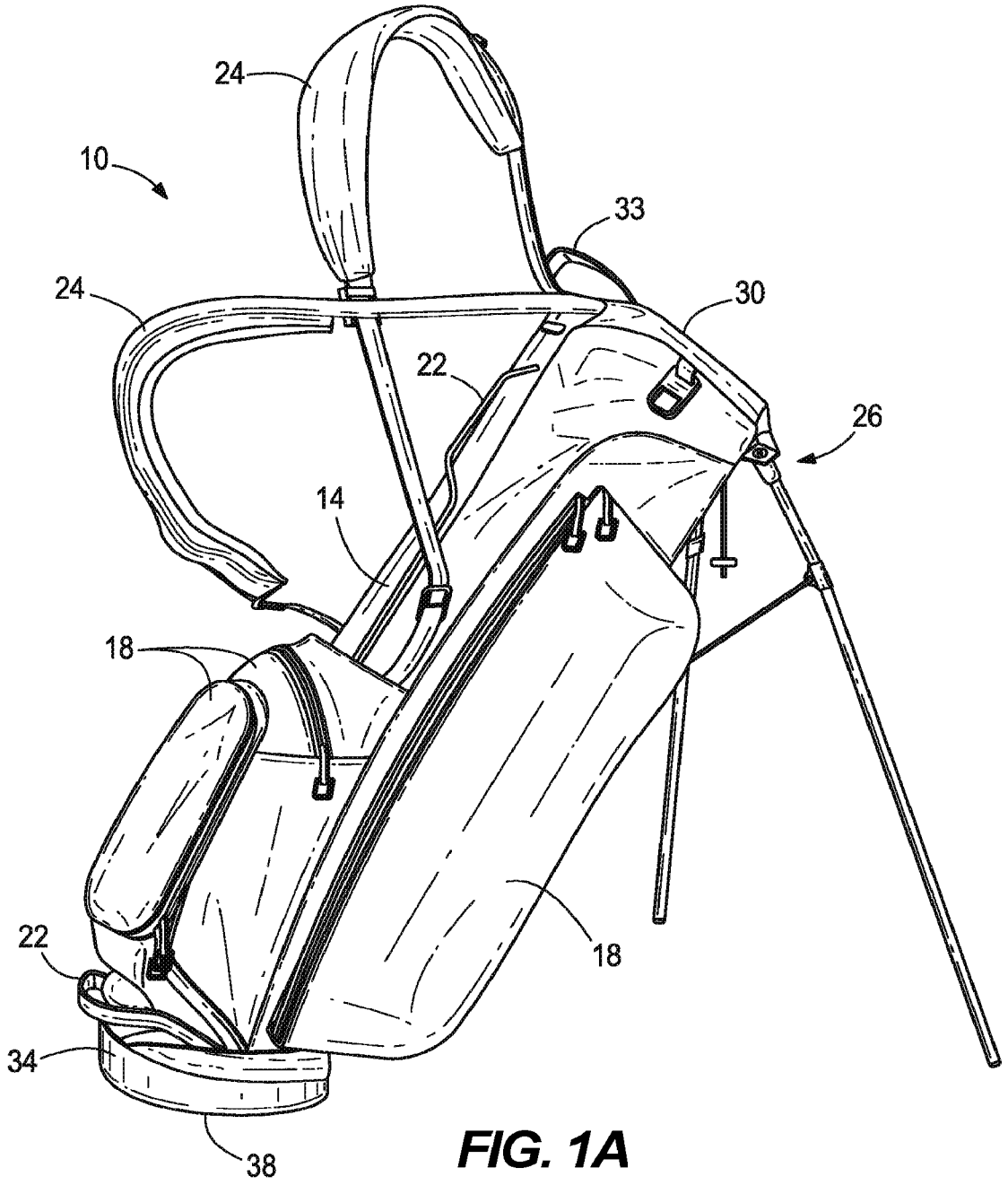
FIG. 1A is a perspective view of a first side of a golf bag having a stand assembly in a deployed, tripod configuration.
Figure 1C:
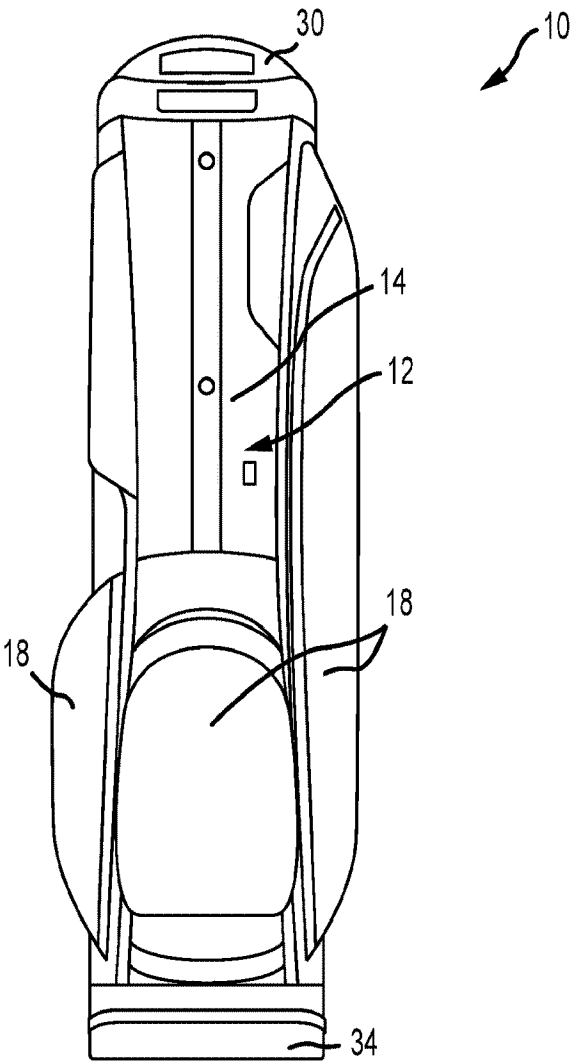
FIG. 1C is a front view of the golf bag of FIG. 1B.
Figure 1B:
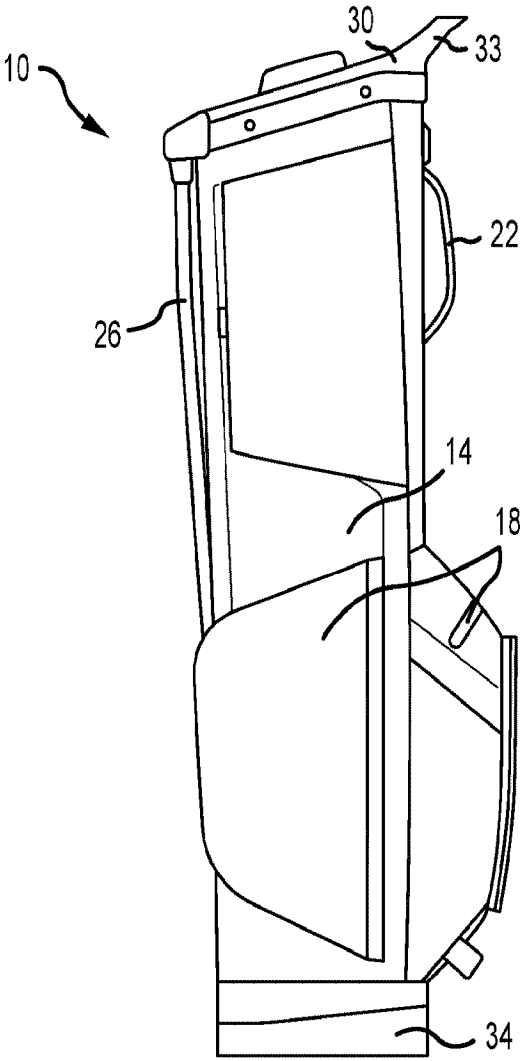
FIG. 1B is a left side view of the golf bag of FIG. 1A, in a retracted configuration, without straps.
Figure 1E:
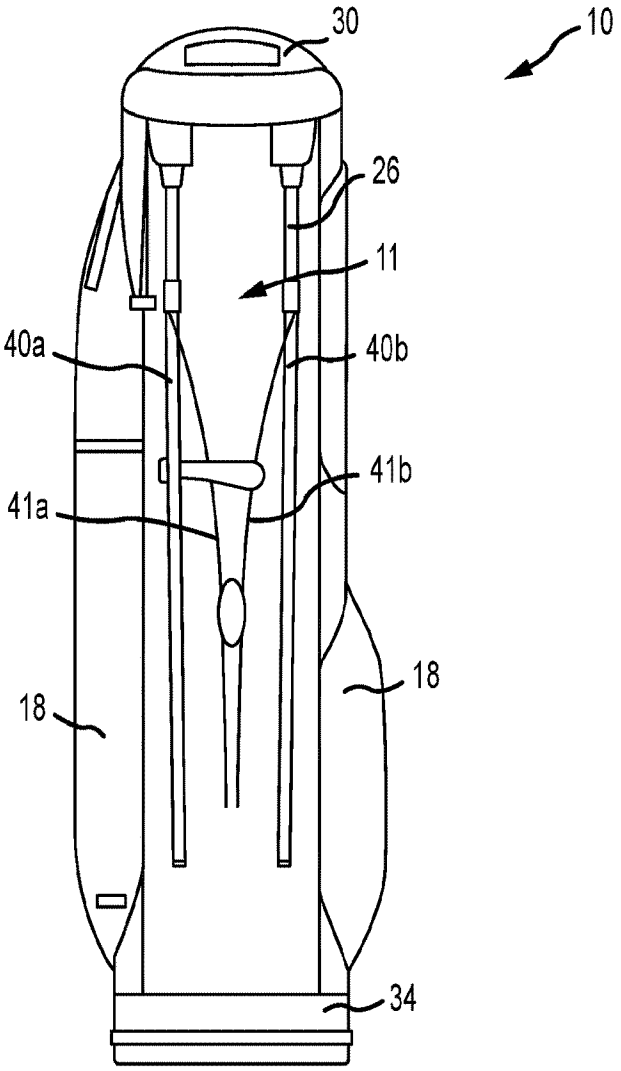
FIG. 1E is a rear view of the golf bag of FIG. 1B.
Figure 1D:
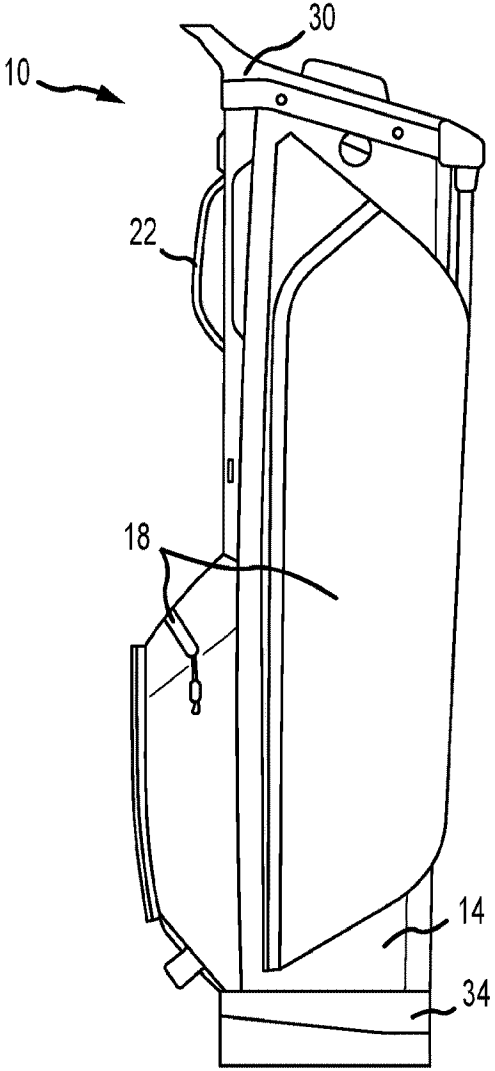
FIG. 1D is a right side view of the golf bag of FIG. 1B.

FIG. 1A illustrates the carry bag 10 in an extended configuration. FIGS. 1B, 1C, 1D, and 1E illustrate the carry bag 10 in a retracted configuration without straps. The golf bag 10 includes a flat 14 or a flat that includes a plurality of pockets 18 for storing golf accessories (e.g. golf balls, golf tees, a golf glove, rain gear and other apparel, etc.). The golf bag 10 also includes a plurality of handles 22 and a shoulder carry strap 24 that facilitate grasping and/or carrying of the bag 10. A stand assembly 26 is pivotally connected to the golf bag 10 at a divider top 30 by a leg mounting bracket 32 (shown in FIGS. 2-3). The divider top 30 includes an additional handle 33 to assist with carrying the golf bag 10. Opposite the divider top 30 is a base 34. In the illustrated extended configuration, the stand assembly 26 is deployed, the flat 14 tilts about the base 34 towards the stand assembly 26. This allows a bottom face 38 of the base 34 to maintain contact with a surface upon which the bag 10 is deployed, increasing bag 10 stability while in the tripod configuration.

FIGS. 2 and 3 depict the golf bag 10 with the flat 14 removed. Referring to FIG. 2, a stay 39 extends from the divider top 30 to the base 34. The stand assembly 26 is provided on an opposite side of the bag 10 from the stay 39. The stand assembly 26 includes a pair of legs 40*a*, 40*b* that are pivotably connected to the leg mounting bracket 32. A spring 41 is coupled to the base 34, and includes spring members 41*a*, 41*b*. The spring members 41*a*, 41*b* extend from the base 34 to connect to respective legs 40*a*, 40*b*. In some embodiments, the spring members 41*a*, 41*b* connect to the respective legs 40*a*, 40*b* via a bracket, such as bracket 600 described below with reference to FIGS. 74 and 75.

FIGS. 2 and 3 also illustrate an internal sub-assembly 42 according to a first embodiment. The sub-assembly 42 includes the divider top 30 and the base 34. In addition, a divider sleeve 46 is coupled to the divider top 30 and extends away from the divider top 30 towards the base 34. The divider sleeve 46 has a generally box-like shape, but in other embodiments may be any suitable or desired shape. Referring to FIG. 4, when the bag 10 is in the retracted configuration (i.e. the stand assembly 26 is retracted, as shown in FIG. 3), the divider sleeve 46 does not extend entirely to the base 34. An end or bottom edge 47 of the divider sleeve 46 is spaced from a top lip or edge 48 of the base 34. A plurality of connection members 50 are connected to the divider sleeve 46, and more specifically connected adjacent the end 47 of the divider sleeve 46 closest the base 34. The connection members 50 couple the divider sleeve 46 to the base 34. When the divider sleeve 46 is coupled to the base 34, a gap or opening or space 54 exists having a first distance D1 that varies about a perimeter of the divider sleeve 46 defined by the end 47, as shown in FIG. 4. The gaps 54 are each generally defined by the divider sleeve 46 (or the edge 47 thereof), two adjacent connection members 50, and the base 34 (or the top lip 48 thereof).

A. Carry Bag: Retracted and Extended Configurations of Stand Assembly

Figure 11:
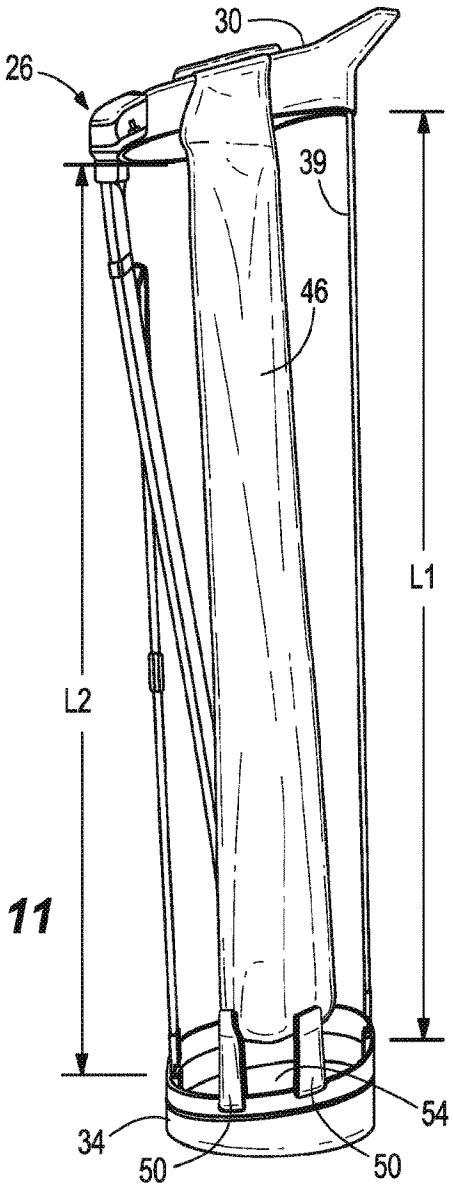
FIG. 11 is a side view of the golf bag sub-assembly of FIG. 3.

In use, the carry bag 10 typically begins in the retracted configuration with the stand assembly 26 retracted. As illustrated in FIG. 11, in the retracted configuration, the stay 39 extends between the divider top 30 and the base 34 at a first length or distance L1. The divider sleeve 46 extends away from the divider top 30 at a second length or distance L2, with the second length L2 of the divider sleeve 46 being generally less than the first length L1 of the stay 39. The connection members 50 are also generally taut or have little slack between the divider sleeve 46 and the base 34. In this retracted configuration, the gap 54 between the divider sleeve 46 and the base 34 provides sufficient space or room between the divider sleeve 46 and the base 34 to allow a golfer to freely insert and remove one or more golf clubs from the golf bag 10.

The golfer will typically transition the golf bag 10 from the retracted configuration (first configuration) to the extended configuration (second configuration), deploying the stand assembly 26 when setting the golf bag 10 down. The golfer places the base 34 on a support surface with the bottom face 38 resting on the support surface. The golfer then applies a downward force on the divider top 30. By applying the downward force, the spring 41 pivots about the base 34 and pushes the legs 40*a, b* away from the bag 10. Concurrently, the stay 39 tilts about the base 34 sub-assembly towards the stand assembly 26. This also tilts the sub-assembly 42 towards the stand assembly 26, as shown in FIG. 2. It should be appreciated that while the stay 39 tilts about the base 34, the stay 39 maintains a constant distance L1 between the divider top 30 and the base 34 in both the retracted configuration and the extended configuration, while the divider sleeve 46 moves closer to the base 34 in the extended configuration than in the retracted configuration.

Figure 12:
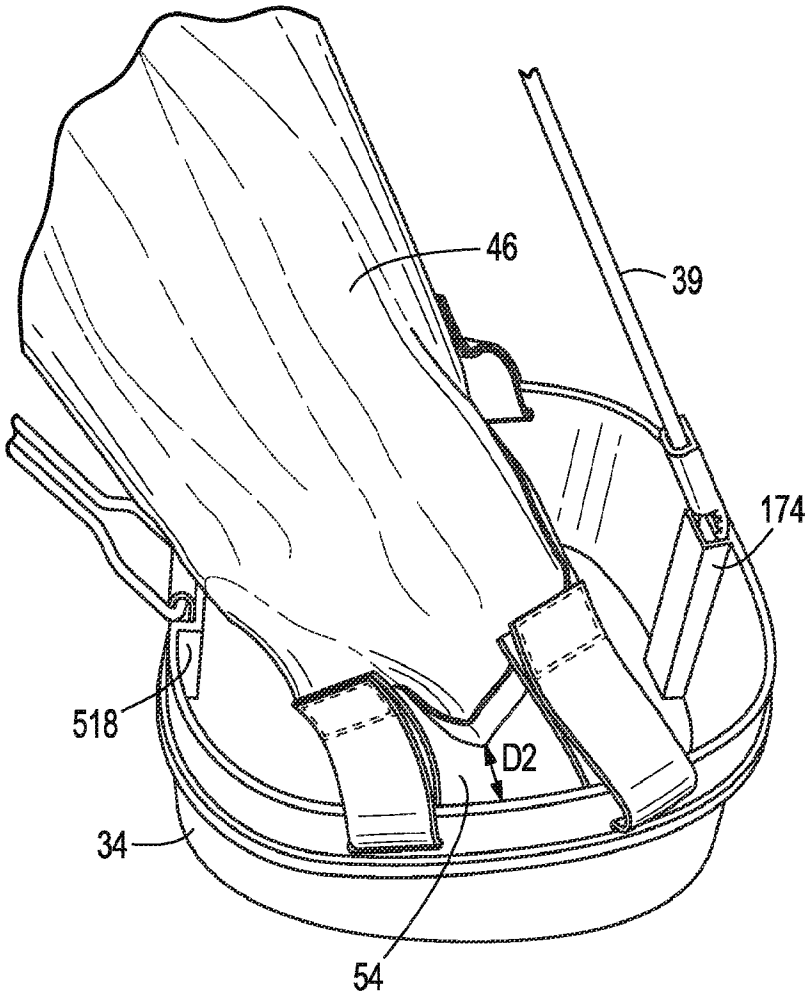
FIG. 12 is a partial perspective view of the golf bag sub-assembly of FIG. 2, taken along line 12-12 of FIG. 2.

Once in the extended configuration with the stand assembly 26 deployed, the sub-assembly 42 advantageously improves the golfer's experience with the golf bag 10 by reducing bunching or gathering of the divider sleeve 46 near the base 34, improving golf club insertion and removal from the golf bag 10. Referring to FIG. 12, the gaps 54 between the divider sleeve 46 and base 34 are each reduced to a second, non-zero distance D2, which is less than a respective first distance D1. The gaps 54 provide adequate spacing for the divider sleeve 46 to pivot about the base 34 between the retracted configuration (FIGS. 3 and 11) and the extended configuration (FIGS. 2 and 12) while limiting excess material that can lead to undesirable bunching or gathering of the divider sleeve 46 near the base 34.

B. Carry Bag: Snap-Fit Features

Referring now to FIGS. 13-29, aspects of a snap fit sub-assembly are disclosed in additional detail. FIGS. 13-20 illustrate components of a snap fit stand assembly 26 (shown in FIGS. 2-3). It should be understood that the following snap fit features may be partially, fully, or not included in various embodiments of the carry bag. The snap fit connections incorporated into the carry bag 10 can include press fit connections, male or female snap fit buttons, or other snap fit connections, as defined above. Some components of the carry bag comprise snap fit connections that comprise angled protruded surfaces that engage apertures by sliding and snap fitting into the apertures. Other components comprise snap fit connections that comprise slots or grooves that engage one or more protrusions. Some components having snap fit connections further comprise interlocking and/or abutting surfaces to provide support and alignment for the connection.

1. Carry Bag: Snap Fit Leg Mounting Bracket

Figure 13:
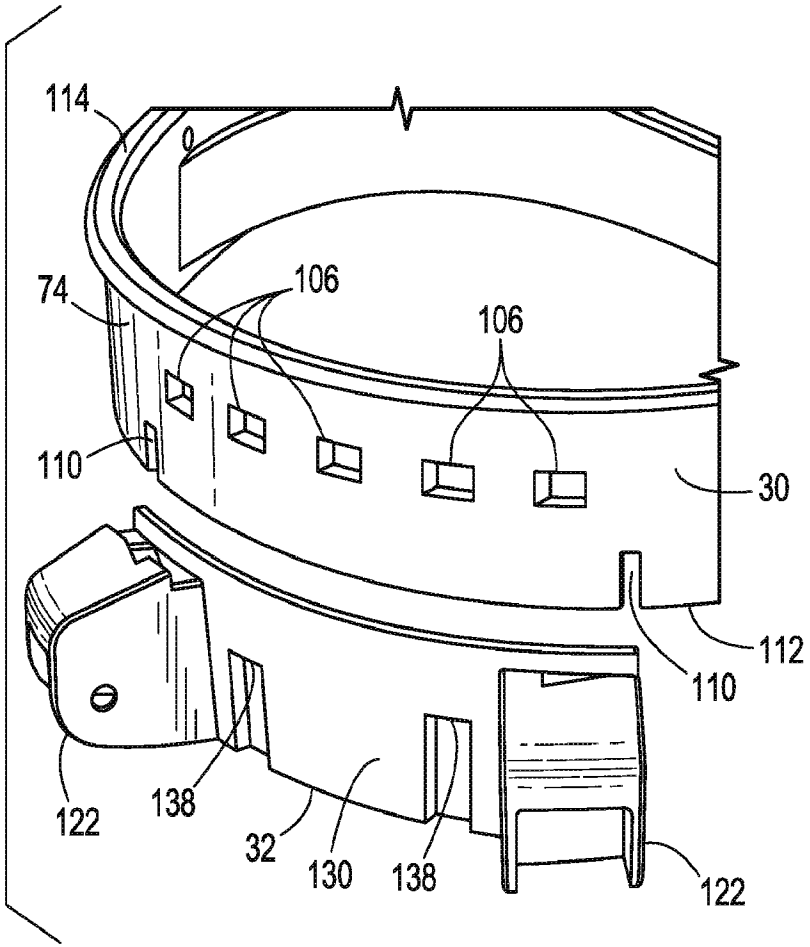
FIG. 13 is a perspective view of a front side of a leg mounting bracket separated from a divider top of the golf bag of FIG. 1.

The carry bag 10 can comprise a leg mounting bracket. The leg mounting bracket can be a snap fit leg mounting bracket. As illustrated in FIG. 13, in one embodiment, the divider top 30 of the carry bag 10 can be formed with a plurality of apertures 106 through the outer ring 74, in order to accommodate a snap fit leg mounting bracket 32. The outer ring 74 also includes a plurality of alignment slots 110 provided on a first edge 112, and a rim 114 provided on an edge opposite the first edge 112 that preferably extends around the periphery of the ring 74.

Figure 15:
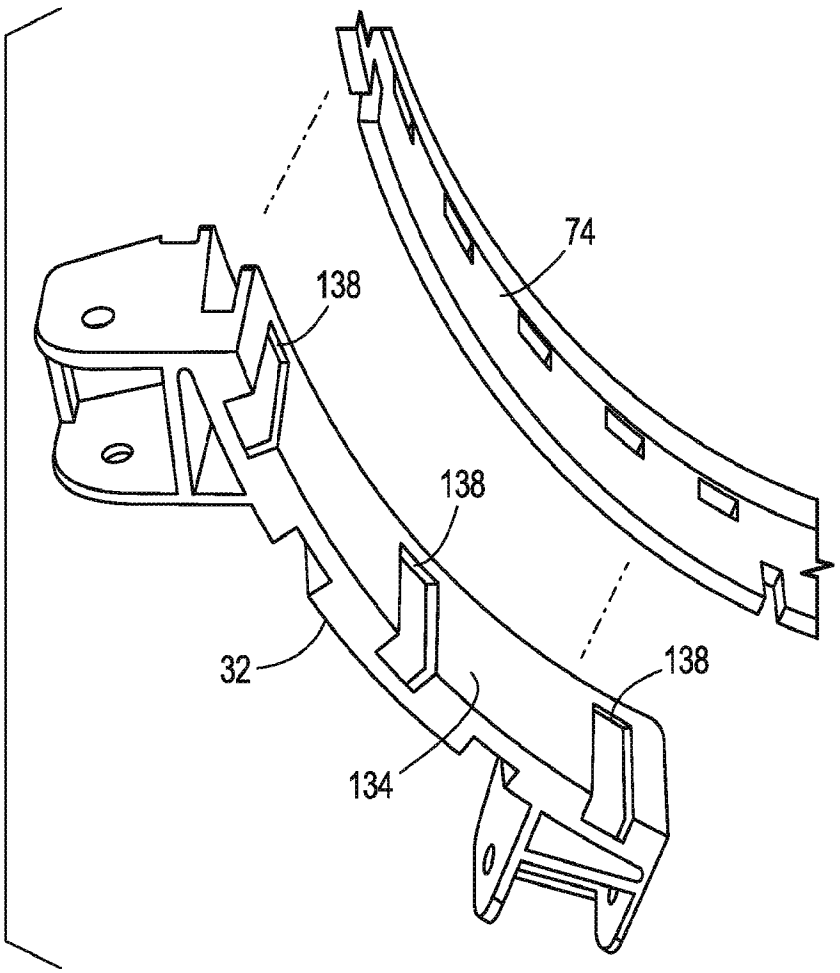
FIG. 15 is a rear perspective view of the leg mounting bracket separated from the divider top of FIG. 13.
Figure 14:
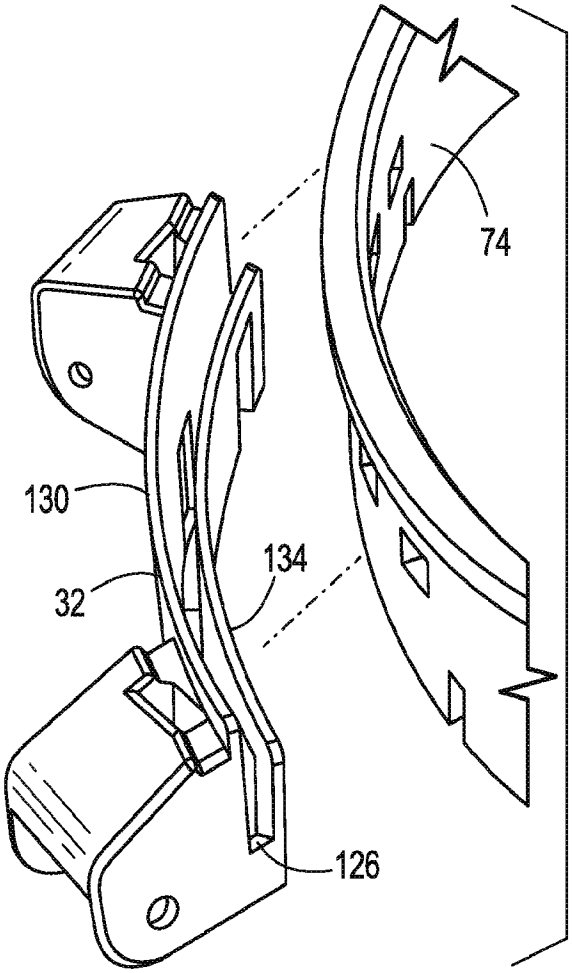
FIG. 14 is a side perspective view of the leg mounting bracket separated from the divider top of FIG. 13.

As shown in FIGS. 13-15, the leg mounting bracket 32 includes a plurality of leg anchors 122 and a mounting portion or channel 126 (shown in FIG. 14). The mounting channel 126 is defined by a front portion 130 and a back portion 134 of the bracket 32. A plurality of snaps or snap members or retention members 138 project from the front and back portions 130, 134 into the channel 126. The channel 126 also includes a plurality of alignment ribs (not shown) that facilitate alignment of the leg mounting bracket 32 with the outer ring 74 of the divider top 30. In the illustrated embodiment, five total snaps 138 are shown, with two projecting from the front portion 130 and three projecting from the back portion 134. In other embodiments, any preferred number of snaps 138 may be used, and the snaps 138 may project into the channel 126 from only the front portion 130, only the back portion 134, or any suitable combination of the front and back portions 130, 134.

The leg mounting bracket 32 generally has an angle of curvature (shown in FIG. 14) that is arcuate or curved, and is complimentary to the outer ring 74 of the divider top 30 to facilitate snap-fit connection of the leg mounting bracket 32 to the divider top 30. The leg mounting bracket 32 may have a linear shape that is complementary to the outer ring of the divider top 30. To form the snap-fit connection, the leg mounting bracket 32 is positioned to receive the first edge 112 of the outer ring 74 into the mounting channel 126. The leg mounting bracket 32 is adjusted about the outer ring 74 until the alignment ribs (not shown) of the leg mounting bracket 32 are received by respective alignment slots 110. Once received, the leg mounting bracket 32 receives the outer ring 74, with each snap 138 engaging (or being received by) a respective aperture 106 of the outer ring 74 to form the snap-fit connection. The rim 114 prevents over insertion of the outer ring 74 into the leg mounting bracket 32, while providing additional structural support for the leg mounting bracket 32 during operation of the golf bag 10.

It should be appreciated that in other embodiments the orientation of the leg mounting bracket 32 in relation to the divider top 30 is not limited to engagement from below the divider top 30, and engagement from any other direction may be suitable. In addition, while the snap-fit connection is illustrated as an engagement of snaps 138 with apertures 106, any other suitable mechanical connection that counteracts and supports forces from the stand assembly 26 and locks the leg mounting bracket 32 to the divider top 30 to form a secure, structural connection may be implemented.

Figure 16:
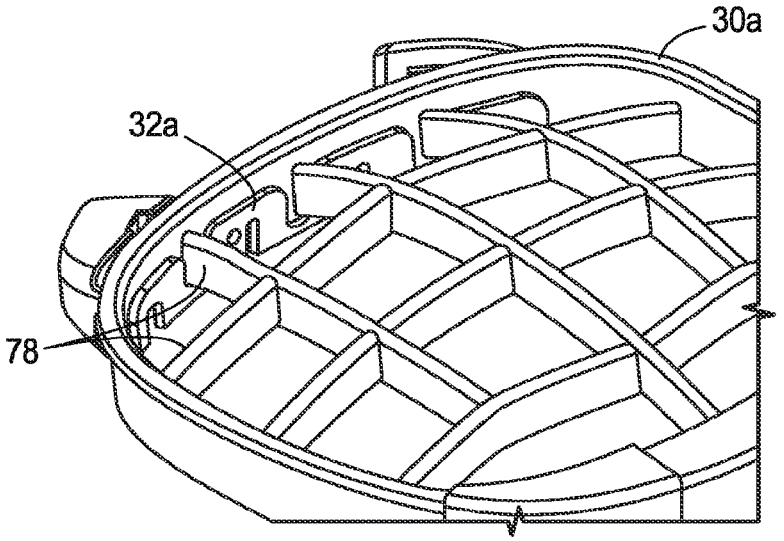
FIG. 16 is a perspective view of an alternative divider top.
Figure 17:
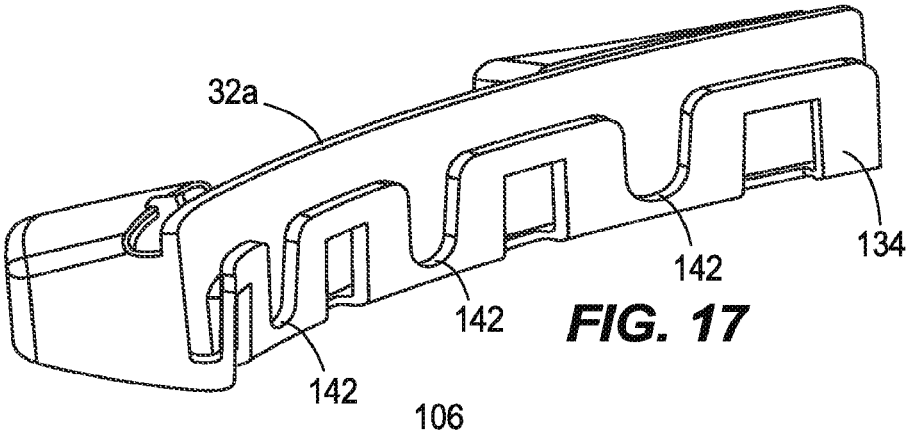
FIG. 17 is a rear perspective view of an alternative leg mounting bracket for use with the divider top of FIG. 16.
Figure 18:
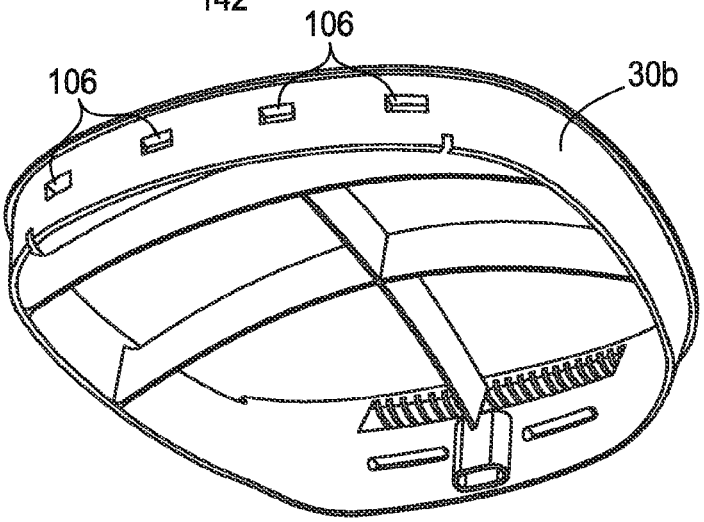
FIG. 18 is a bottom perspective view of an alternative divider top.

FIGS. 16-17 illustrate an alternative embodiment of a divider top 1030 with a leg mounting bracket 32*a*. In this embodiment, the leg mounting bracket 32*a* is engaged with the divider top 1030 through a snap fit (or press fit) connection. In this embodiment, troughs or channels 142 are provided in the back portion 134. The troughs 142 are provided to fit around cross members 78 that define divider sections in the divider top 1030 (or intermediate members 80 as shown in FIG. 8). The troughs 142 also may act as an additional alignment aid to properly align the leg mounting bracket 32*a* with the divider top 1030 for snap fit connection (as disclosed in association with leg mounting bracket 32). FIG. 18 illustrates an additional alternative embodiment of a divider top 30*b* having four apertures 106 for engaging an embodiment of the leg mounting bracket 32, 32*a*.

2. Carry Bag: Leg Mounting Bracket with Troughs

Figure 101A:
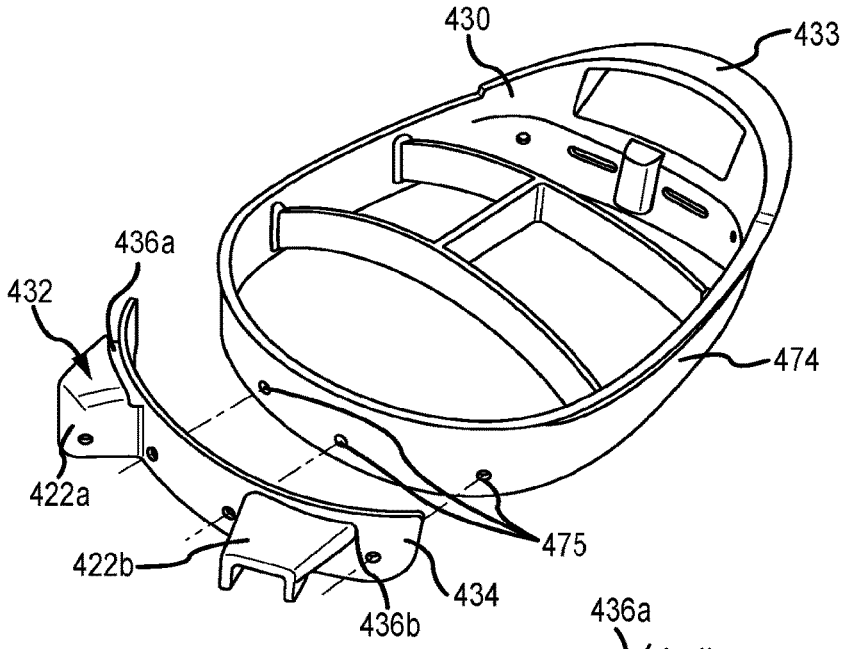
FIG. 101A is a perspective view of a front side of a leg mounting bracket separated from a divider top, according to an embodiment.
Figure 101B:
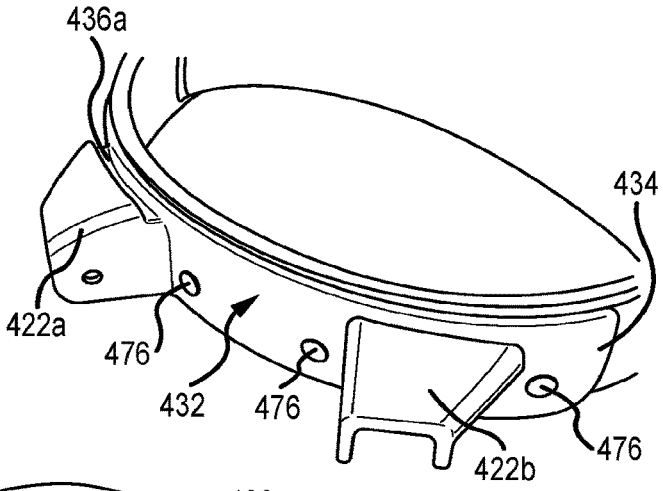
FIG. 101B is a close up perspective view of the leg mounting bracket of FIG. 101A connected to the divider top of FIG. 101A.
Figure 102:
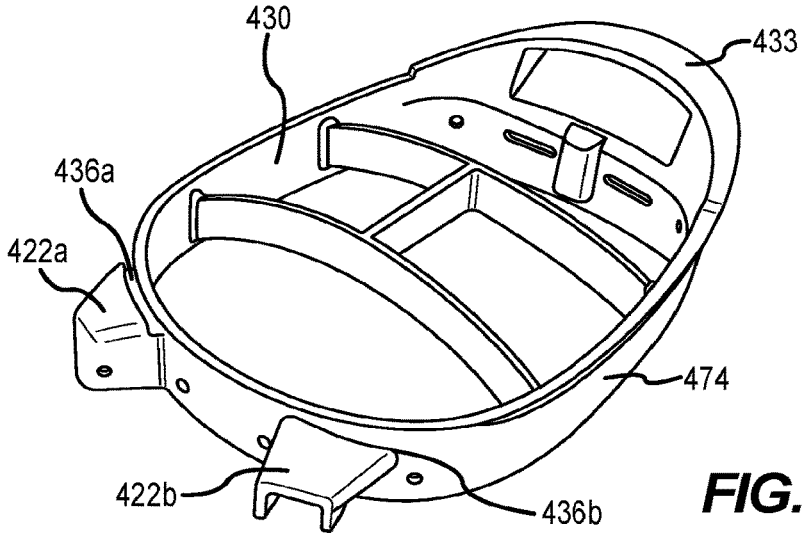
FIG. 102 is a perspective view of an integrally molded divider top and leg mounting bracket.

Some embodiments of the carry bag 10 comprise an alternate embodiment of a snap fit mounting bracket 432. FIGS. 101A-104 illustrate leg mounting bracket 432 that comprises a trough or channel 436*a*, 436*b* along each leg anchor 422*a*, 422*b* for receiving a bag flat 414, similar to bag flat 14. The troughs 436*a*, 436*b* on each leg anchor 422*a*, 442*b* align and assist in securing the bag flat 414 to the divider top 430. As illustrated in FIGS. 101A and 101B, the leg mounting bracket 432 comprises a mounting portion 434 and a plurality of leg anchors 422*a*, 422*b*. However, this embodiment of the leg mounting bracket 432 does not comprise a channel, such as channel 126 in FIG. 414, for engaging a divider top or snap connectors. Rather, the leg mounting bracket 432 can be secured via rivets 476, adhesives, or other fastening mechanisms to the divider top 430. The leg mounting bracket 432 is attached to the outside surface of the outer ring 474 of the divider top 430. The mounting portion 434 of the leg mounting bracket 432 generally has an angle of curvature that is arcuate or curved, and is complimentary to the outer ring 474 of the divider top 430. The curvature of the mounting portion 434 allows the leg mounting bracket 432 to be engaged with the divider top 430. As illustrated in FIG. 102, in some embodiments, the leg mounting bracket 432 is integrally formed with the divider top 430.

Figure 104:
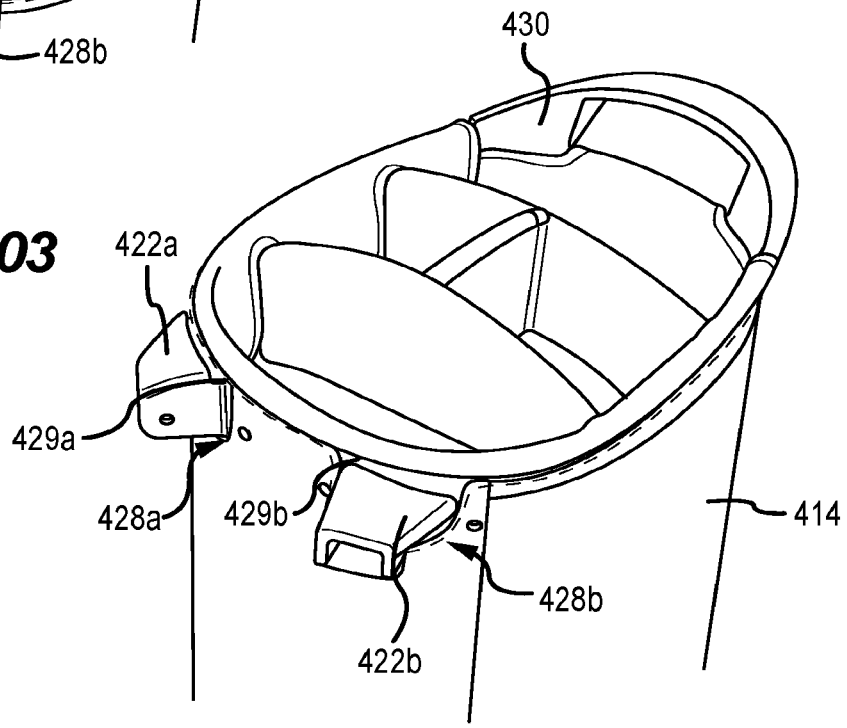
FIG. 104 is a perspective view of the leg mounting bracket and divider top of FIG. 103 with the flat fully attached.

In some embodiments, as depicted in FIGS. 103-104, the leg mounting bracket 432 is attached over the flat 414. FIG. 103 illustrates how the divider top 430 can be inserted into the flat 414. FIG. 104 illustrates the divider top 430 engaged with the bag flat 414. The divider top 430 can be riveted to the flat 414 below a handle on the back side 12 of the carry bag 10. At the front 11 of the carry bag 10, the flat 414 can be held up by its engagement with the leg anchors 422*a*, 422*b* of the divider top 430.

The bag flat 414 that engages the leg mounting brackets 432 comprises two windows 428*a*, 428*b* that allow the leg anchors 422*a*, 422*b* to extend through the bag flat 414. The windows 428*a*, 428*b* are each surrounded by a binding edge 429*a*, 429*b*, respectively. The binding edge 429*a*, 429*b* falls into the trough 436*a*, 436*b* of the leg mounting bracket 432 and holds the flat 414 in the desired position relative to the divider top 430. Since the leg anchors 422*a*, 422*b* hold the flat 414 to the divider top 430 at the front (or belly) side 11 of the bag, other securing mechanisms, such as rivets or self-fastening connectors like VELCRO®, are no longer necessary for securing the flat 414 at the front side 11 of the bag. Eliminating the need for riveting or otherwise securing the flat 414 to the divider top 430 reduces assembly steps and necessary manufacturing equipment. Therefore, the assembly time and the overhead of the manufacturing process can both be reduced. Furthermore, compared to embodiments that previously employed VELCRO®, the leg mounting bracket 432 with the troughs 436*a*, 436*b* results in a much cleaner finish.

The leg mounting bracket 432 further increase the quality of the final product by preventing the bag flat 414 from slipping down from the divider top 430. In some golf bags, the flat is secured to the divider top via hook-and-loop connectors (such as VELCRO®). Although these embodiments have the advantage of eliminating riveting, the flat of these golf bags sometimes sags down below the level on the divider top that the flat is designed to engage. The misaligned flat can cause issues such as cinching or hindering of straps that run through apertures in both the flat and the divider top. Providing windows 428*a*, 428*b* on the flat 414, wherein the windows 428*a*, 428*b* engage troughs 436*a*, 436*b* of the leg mounting bracket 432, eliminates the potential misalignment issue encountered with certain bag flats. In some embodiments, the flat 414 is riveted onto the divider top 430 at a side opposite the leg mounting bracket 432. The rivets provide support to the flat 414 at the side that is not held up by the windows 428*a*, 428*b* and leg mounting bracket 432. In other embodiments, a snap fit connection can be used to support the flat 414 at the side that is not held up by the windows 428*a*, 428*b* and leg mounting bracket 432.

After assembly of the bag flat 414 and the leg mounting bracket 432, the leg anchors 422*a*, 422*b* are exposed, but the mounting portion 434 is hidden underneath the flat 414. In addition to securing the bag flat 414 onto the golf bag 10 at the correct position, hiding the mounting portion 434 of the bracket 432 underneath the flat 414 improves the aesthetics of the golf bag 10 by making it appear more unified and seamless.

3. Carry Bag: Material of the Leg Mounting Bracket

Because the leg mounting bracket 32, 432 acts as a hinge point between the legs 40 and the bag portion, it is preferably made of glass-filled nylon for strength. As described above, the divider top 30, 430 typically comprises a flexible and lightweight material. In one embodiment, the snap-fit connection maintains the respective material properties of the divider top 34 and the leg mounting bracket 32, while allowing the components to act as a unified part. Providing the divider top 30, 430 and the leg mounting bracket 32, 432 separately and formed of different materials allows for each component to be tailored to have specific, desired material properties. For example, the divider top 30, 430 can comprise a material that is lighter in weight than the bracket material, resulting in weight savings for the overall carry bag 10. For further example, the leg mounting bracket 32, 432 can be formed of a material that is stronger than the material of the divider top 30, 430, resulting in a durable connection for the legs 40. Having the divider top 430 and the leg mounting bracket 432 as separate components allows different materials to be selected for each component depending on the desired material properties. However, integrally forming the divider top 30, 430 and the leg mounting bracket 32, 432 can simplify the manufacturing process, reduce required assembly steps, and improve quality. An integrally-formed divider top 30, 430 and bracket 32, 432 comprises a lightweight and strong material, such as a glass-filled polymer or fiber-reinforced polymer.

Both the integrally-formed embodiment and the separate component embodiment of the divider top 30, 430 and leg mounting bracket 32, 432 have benefits that can be leveraged based on the design parameters and cost limitations of the carry bag. For example, the weight of the material may be critical for a Sunday carry bag because the bag is intended to be lightweight and simple. For this type of carry bag, an integrally formed divider top formed from a high-quality, low-density material could be preferable over a separate divider top and mounting bracket, despite the added cost of the high-strength material.

4. Carry Bag: Leg Connection

The stand assembly 26 of the carry bag 10 can include legs 40 connected to the leg mounting bracket 32. As described above, the leg mounting bracket 32 can be engaged or integral with the divider top 30. The legs 40 can be connected to the leg mounting bracket 32 via a leg connection mechanism, such as leg end caps that receive the legs 40 and rotate relative to the leg mounting bracket. The various snap fit leg connection mechanisms can have components that comprise protruded surfaces or elements that slide to press fit and locks (or snaps) into corresponding slots, apertures, or grooves in corresponding features. In some embodiments, the leg connection mechanism can be designed with features that allow for self-assembly by the recipient, as described below.

Figure 19:
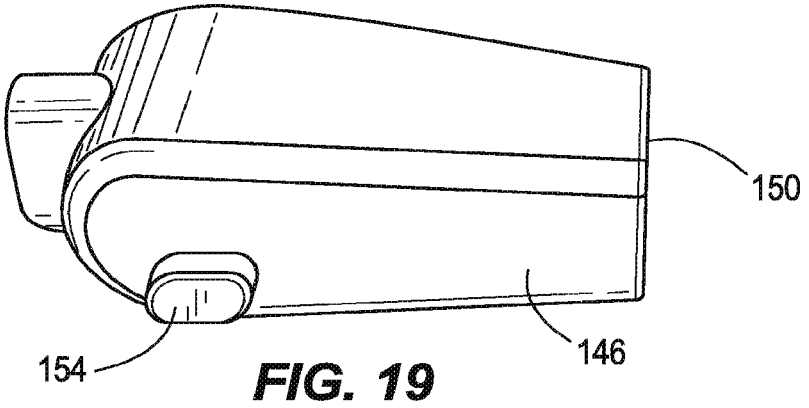
FIG. 19 is a perspective view of an end cap, according to an embodiment.
Figure 20:
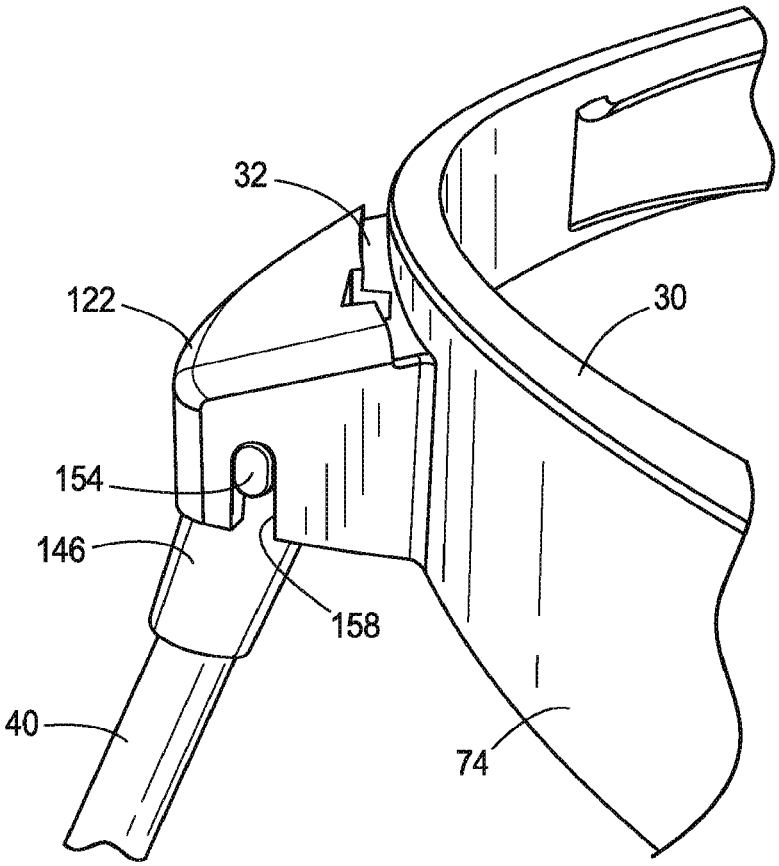
FIG. 20 is a perspective view of a portion of the divider top of the golf bag of FIG. 1, with the leg mounting bracket in snap fit connection with the divider top, the end cap attached to a leg and received by a leg anchor of the leg mounting bracket.

FIGS. 19-20 illustrate a snap fit connection between each leg 40 and the leg mounting bracket 32. Referring to FIG. 19, an end cap 146 includes a leg connection end 150, which connects to a leg 40 by a permanent attachment, for example, adhesive or a mechanical connection. The end cap 146 also includes opposing protrusions 154. As illustrated in FIG. 20, each protrusion 154 is received in a respective slot 158 of a leg anchor 122 to form a snap fit connection between the end cap 146 (and each associated leg 40) and the leg mounting bracket 32. In addition, the engagement of the protrusions 154 with the slots 158 permits each associated leg 40 to pivot in relation to the respective leg anchor 122 about a pivot axis that extends through the opposing protrusions 154. In particular, this allows the legs 40 to pivot between the retracted configuration and the extended tripod configuration. In other embodiments, the slot 158 may be replaced with an aperture or any other suitable connection that provides both a snap fit retention and pivoting connection between each leg 40 and the leg mounting bracket 32/divider top 30.

5. Carry Bag: Alternate Embodiment of Leg Connection (Self-Assembly)

Figure 57:
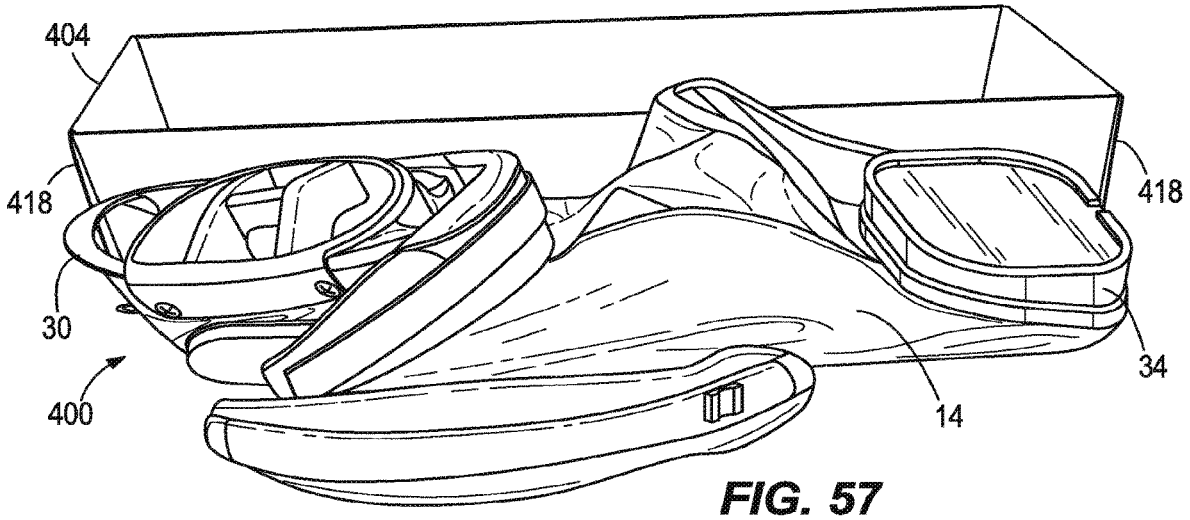
FIG. 57 is a perspective view of a golf bag in a collapsed, partially assembled state as contained during shipment.
Figure 58:
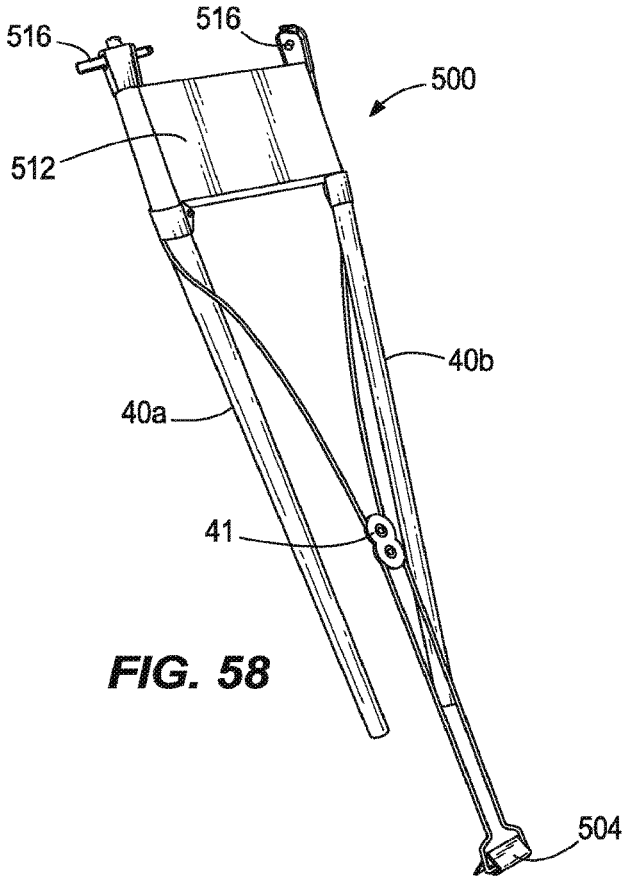
FIG. 58 is a perspective view of an embodiment of a self-assembly system for assembling the golf bag of FIG. 57.
Figure 61:
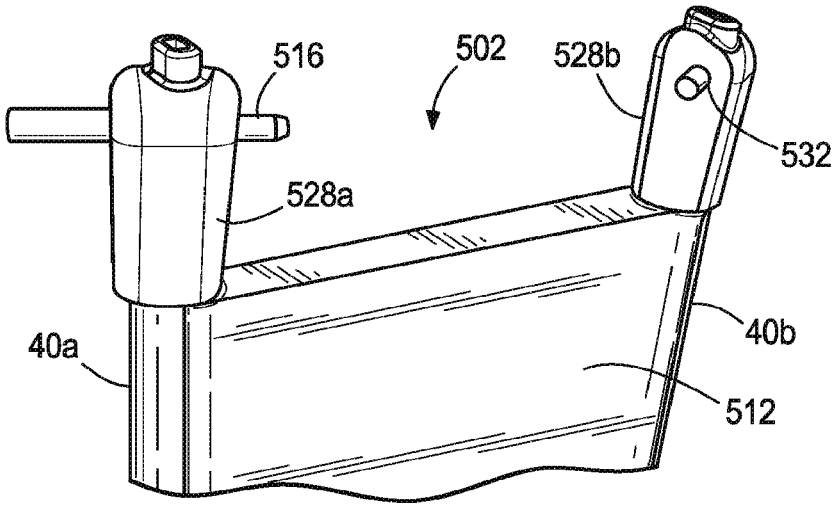
FIG. 61 is a perspective view of a portion of a leg self-assembly system, specifically end caps connected to respective legs and having removable pins for connecting the legs to a mounting bracket of the golf bag of FIG. 57.
Figure 62:
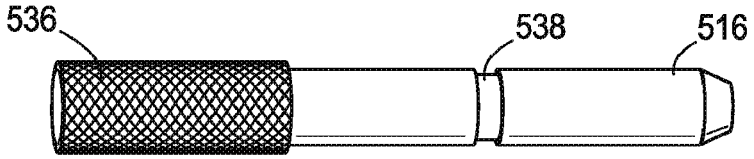
FIG. 62 is an elevation view of a pin illustrated in FIG. 61.

In the carry bag, the leg connection between the leg mounting bracket and the set of legs can be designed to easily snap or lock into an assembled configuration without the use of tools. FIGS. 61-67 illustrate a leg self-assembly system 502, which is a portion of a stand assembly. With reference to FIG. 61, the system 502 includes end caps 528*a*, 528*b* connected to each respective leg 40*a*, 40*b*. Each end cap 528 includes an aperture or pin aperture 532 configured to receive a pins 516. As shown in FIG. 62, each pin 516 includes an end or portion having a surface texture or roughness 536 to assist with grasping the pin 516 during removal and/or installation. The portion having the surface texture 536 can also have a larger cross sectional diameter than the remainder of the pin 516 to prevent over insertion during installation. Each pin 516 can also include a circumferential groove 538. The groove 538 can optionally receive or engage a projection or member (not shown) in the end cap 528 or mounting bracket 32 (shown in FIG. 66) to provide an indication of proper insertion and/or assist with retaining the pin 516 following self-assembly. In the illustrated embodiment, each pin 516 is positioned in an end cap 528*a*, 528*b* either during shipping or when the leg self-assembly system 502 is removed from the box 404. In other embodiments, the pins 516 may be stored or contained in a box in any suitable manner (e.g., contained in packaging within the box, such as a sealed plastic bag, etc.). FIGS. 57-58 illustrate a self-assembly kit 400 along with a box 404 and a leg self-assembly system 502. The leg self-assembly system 502 is configured to fit within the box 404 along with assembly kit 400.

Figure 63:
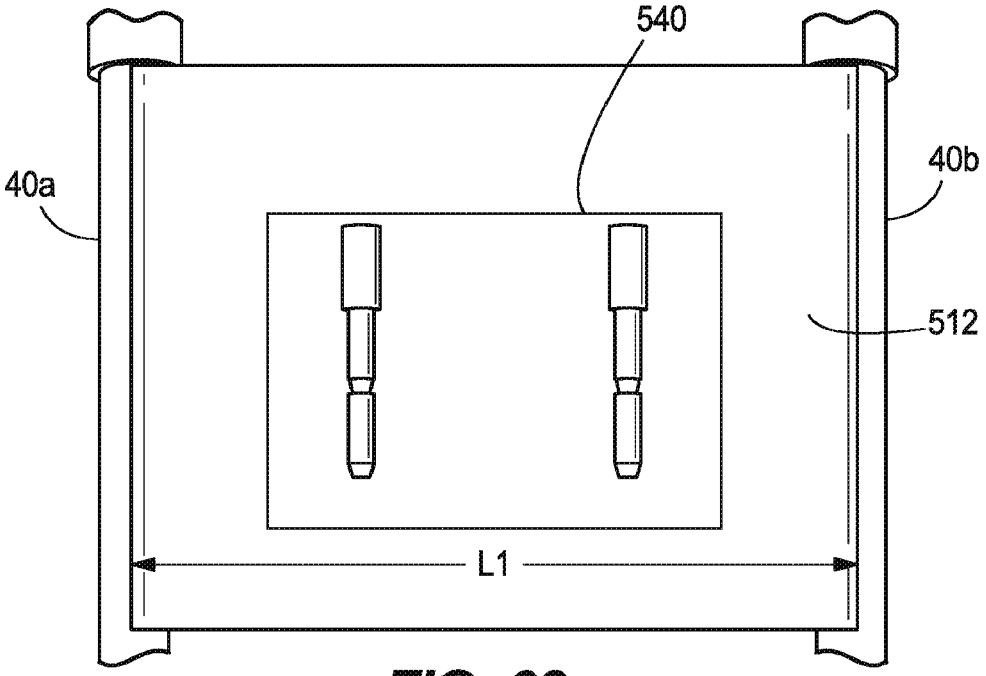
FIG. 63 is an elevation view of an alignment aid removably connected to the legs, along with two removable pins.
Figure 65:
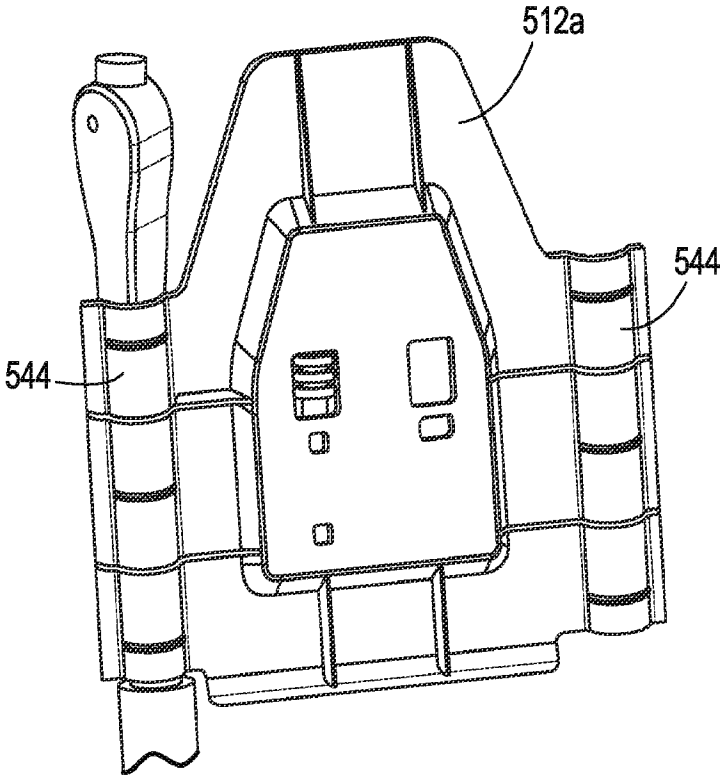
FIG. 65 is a perspective view of a second side of the alignment aid of FIG. 64.
Figure 64:
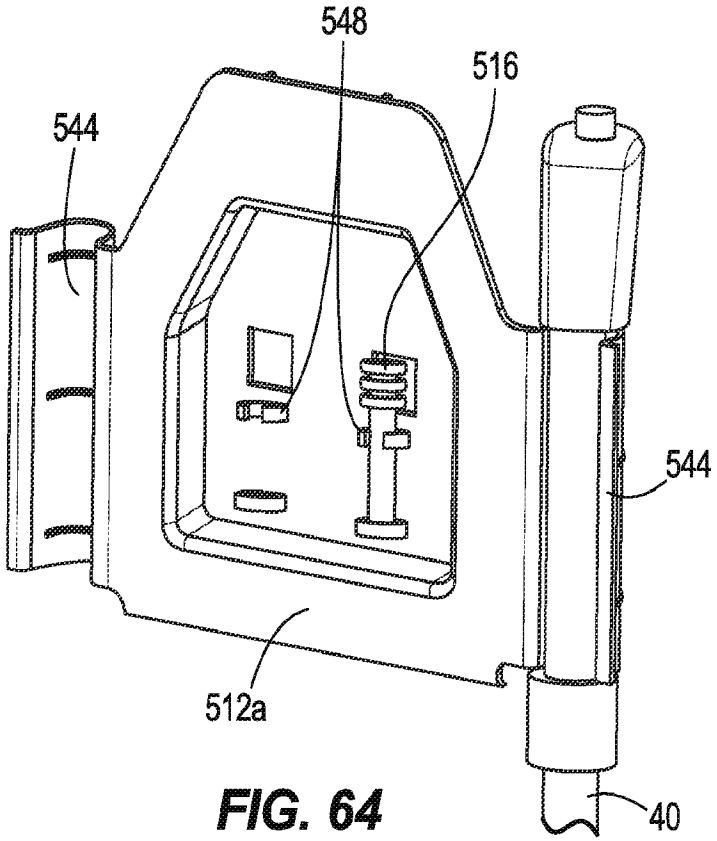
FIG. 64 is a perspective view of a first side of an alternative embodiment of the alignment aid illustrating one leg attached and one pin attached for purposes of illustration.

FIG. 63 illustrates the alignment aid 512 connected to the legs 40*a, b*. The alignment aid 512 has a length L1 that, when attached to the legs 40*a, b*, positions the legs 40*a, b* a predetermined distance apart to facilitate engagement with the mounting bracket 32 (shown in FIG. 66). After installation of the legs 40*a, b* with the mounting bracket 32, the alignment aid 512 is removed from the legs 40*a, b*. To inform the recipient of the intended removal after installation, the alignment aid 512 can include a second indicia or instructions 540 directing the recipient to remove the alignment aid 512 after self-assembly. In the illustrated embodiment, the alignment aid 512 is constructed of paper or cardboard and removably attached to the legs 40*a, b* by an adhesive tape. In other embodiments, the alignment aid 512 can be any suitable structure or formed of any suitable material that facilitates alignment of the legs 40*a, b* with the mounting bracket 32. For example, FIGS. 64-65 illustrate an alternative embodiment of the alignment aid 512*a*. The alignment aid 512*a* includes a pair of arcuate leg supporting channels 544 that each carry a respective leg 40 (e.g., legs 40*a, b*) by an interference or friction fit. The alignment aid 512*a* can also include one or more pin supporting channels or prongs 548 that each retain a respective pin 516. The alignment aid 512*a* forms snap-fit connections with the legs 40 and pins 516, facilitating organized storage of the legs 40 and pins 516 during shipping, and easy removal of the legs 40 and pins 516 during (and following) assembly. The illustrated alignment aid 512*a* is formed of plastic, but in other embodiments may be constructed of any suitable material.

Figure 66:
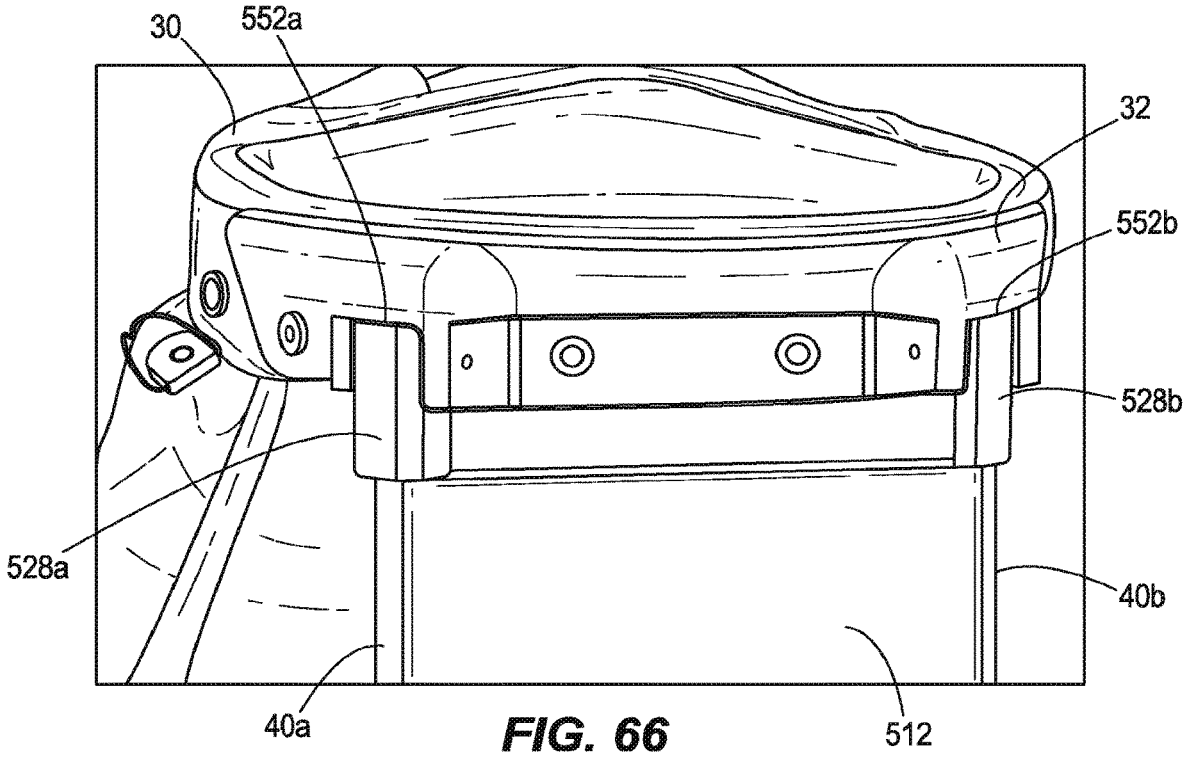
FIG. 66 is a perspective view of a portion of the leg self-assembly system of FIG. 58, the leg self-assembly system aligned with and received by the golf bag mounting bracket during assembly.

Now referring to FIG. 66, the alignment aid 512 is illustrated during assembly of the legs 40*a*, 40*b* to the mounting bracket 32 on the divider top 30. The mounting bracket 32 defines mounting channels 552*a*, 552*b* configured to receive a corresponding leg 40*a*, 40*b* by the end cap 528*a*, 528*b*. The length L1 (shown in FIG. 63) of the alignment aid 512 is such that the distance between the end caps 528*a*, 528*b* matches the distance between the mounting channels 552*a*, 552*b*. This allows the recipient to easily, and simply align and insert the end caps 528*a*, 528*b* into the mounting channels 552*a*, 552*b*.

Each channel 552*a*, 552*b* also includes opposing apertures (not shown) on sides of the channel 552*a*, 552*b*. The opposing apertures align with the pin aperture 532 (shown in FIG. 61) through each end cap 528*a*, 528*b* when the end cap 528*a*, 528*b* is received by the respective channel 552*a*, 552*b*. When in alignment, the pin 516 can be inserted by the recipient to connect and retain the legs 40*a*, 40*b* to the mounting bracket 32. The alignment aid 512 assists with aligning the opposing apertures (not shown) with the pin aperture 532 (shown in FIG. 61) to facilitate insertion of the pin 516 by the recipient. In addition to connecting the legs 40*a*, 40*b* to the mounting bracket 32, each pin 516 defines a pivot axis about which the legs 40*a*, 40*b* pivot in relation to the mounting bracket 32 (e.g., to facilitate pivoting of the legs 40*a*, 40*b* between the first configuration where the stand assembly 26 is retracted, and the second configuration where the stand assembly 26 is extended).

Figure 67:
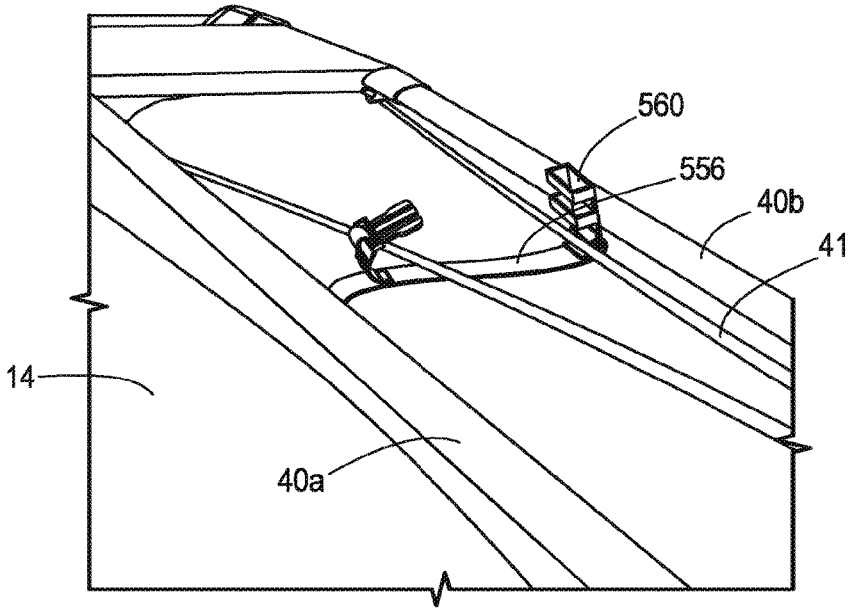
FIG. 67 is a perspective view of a portion of the golf bag of FIG. 57 illustrating a strap surrounding a portion of the spring and in an unlatched configuration.
Figure 69:
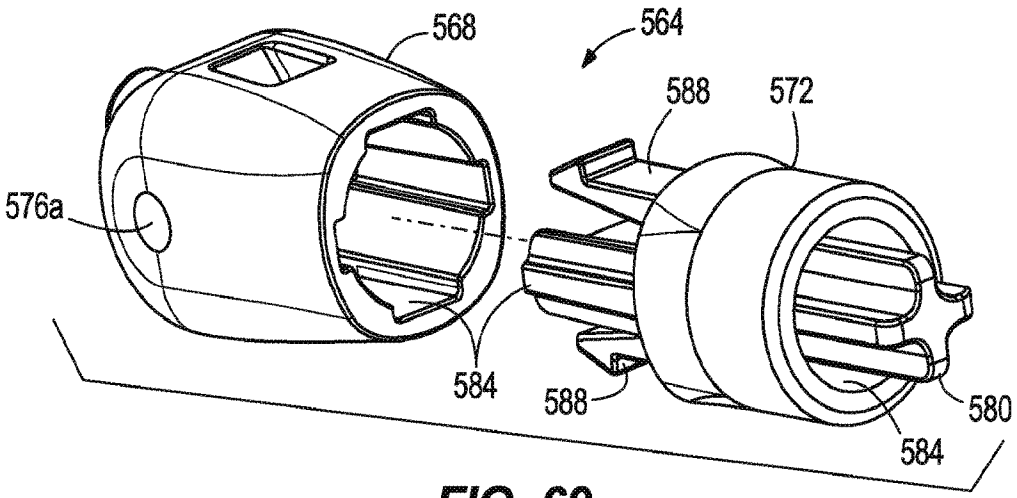
FIG. 69 is a perspective view of a first side of the multi-component end cap of FIG. 68 showing a first piece separated from a second piece.
Figure 70:
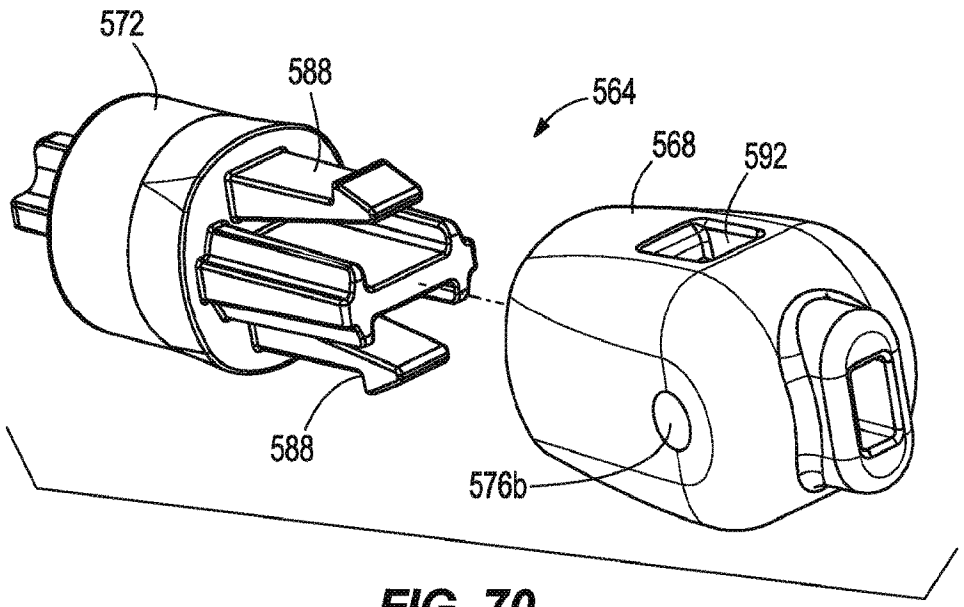
FIG. 70 is a perspective view of a second side of the multi-component end cap of FIG. 69.
Figure 68:
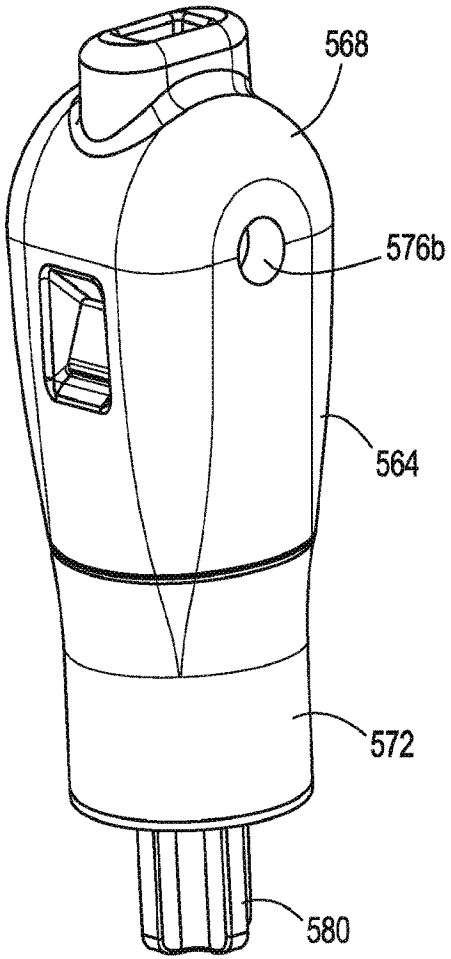
FIG. 68 is a perspective view of a multi-component end cap for use with the leg self-assembly system of FIG. 58.
Figure 72:
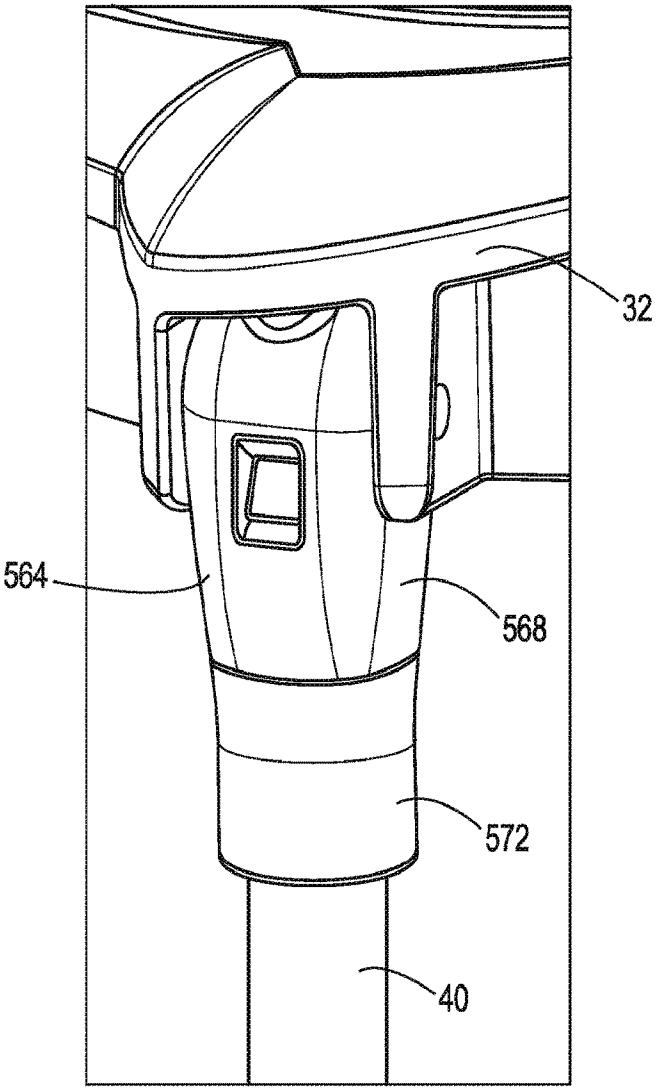
FIG. 72 is a perspective view of the multi-component end cap of FIG. 68, illustrating the completed self-assembly of the leg attached to a leg mounting bracket.
Figure 71:
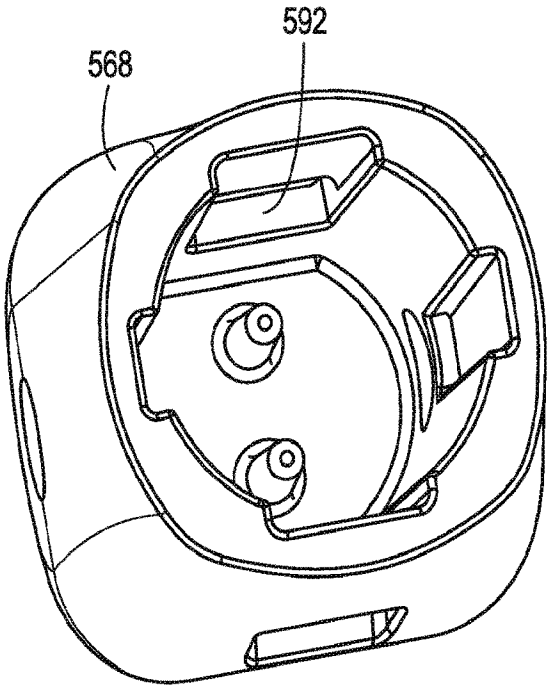
FIG. 71 is a perspective view of the first piece of the multi-component end cap of FIG. 69, illustrating an interior having a detent for retaining the second piece.

Following assembly of the legs 40*a*, 40*b* to the mounting bracket 32, the recipient can attach a strap 556 around a portion of the spring 41. As illustrated in FIG. 67, the strap or gravity strap 556 is attached to the flat 14 of the golf bag 10 and includes a latch assembly or buckle 560 to facilitate self-attachment of the strap 556. The length of the strap 556 can be adjusted based on user preference. By extending the strap 556 around the spring 41, the strap 556 assists with constraining the legs 40*a*, 40*b*, by the spring 41, when the golf bag 10 is carried by a user (e.g., a user is carrying the golf bag 10 by shoulder straps 24). This constraint assists with limiting the legs 40*a*, 40*b* from hanging or extending away from the golf bag 10 (i.e. the constraint assists with maintaining the legs 40*a*, 40*b* in the first, retracted configuration when the golf bag 10 is carried).

In other embodiments of the stand assembly, the stand assembly can comprise components similar to the legs 40*a*, 40*b*, spring 41, mounting bracket 32 having mounting channels 552*a*, 552*b* and end caps 528*a*, 528*b*, and pins 516 of the leg self-assembly system 502. The stand assembly eliminates the self-assembly features such as the alignment aid 512, thereby saving materials while also retaining sufficient components for the leg assembly to be used by an assembler to construct the carry bag.

6. Carry Bag: Second Alternate Embodiment of Leg Connection

Figure 88:
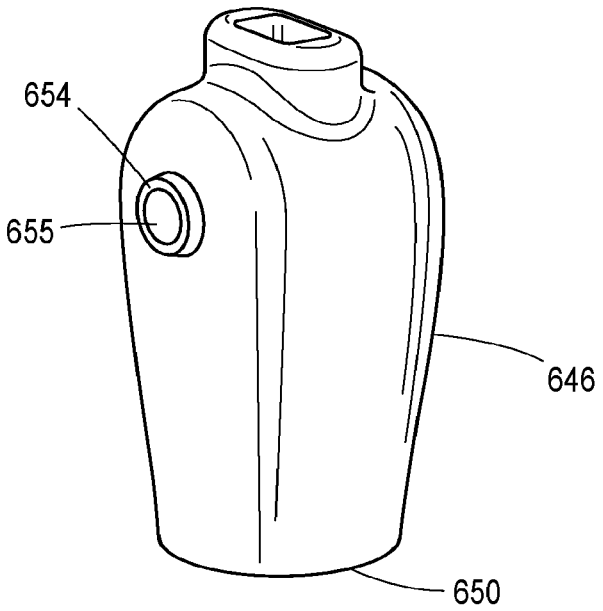
FIG. 88 is a perspective view of another embodiment of an end cap.
Figure 89:
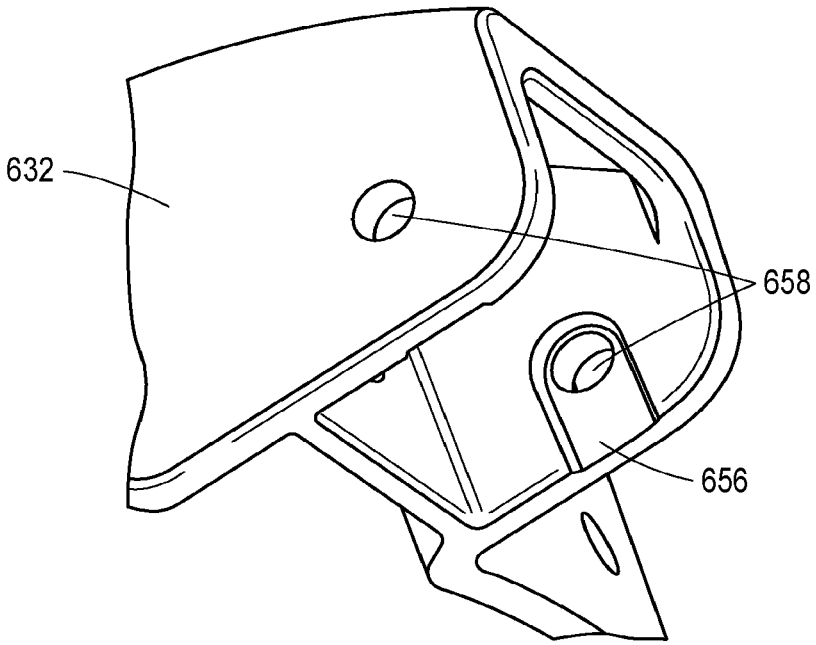
FIG. 89 is a perspective view of another embodiment of a mounting bracket.
Figure 90:
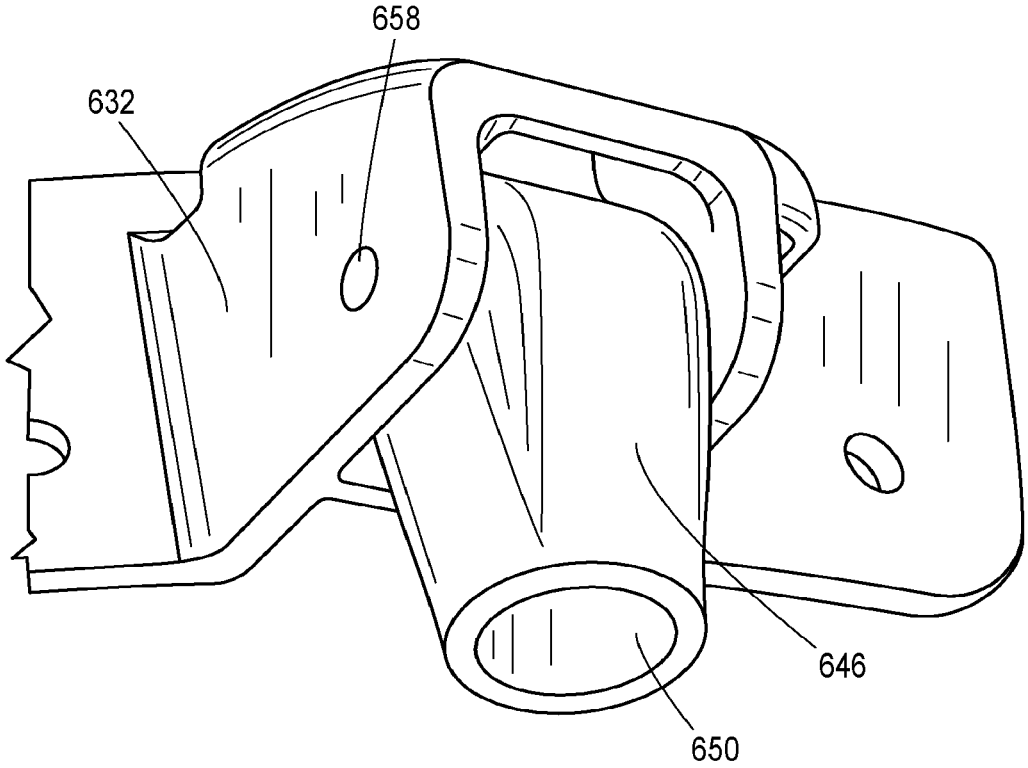
FIG. 90 is a perspective view of the end cap from FIG. 88 and the mounting bracket of FIG. 89 in an assembled position.

Another embodiment of the leg connection can comprise a pair of leg end caps with protrusions (ears) that align with the corresponding leg mounting bracket. FIGS. 88-90 illustrate an embodiment of an end cap 646 and mounting bracket 632. Referring to FIG. 88, the end cap 646 is similar to end cap 146. End cap 646 includes a leg connection end 650, which connects to a leg 40 by a permanent attachment. End cap 646 also includes opposing protrusions 654 similar to end cap 146, except that protrusions 654 include openings 655 extending through the center of the protrusions 654. The protrusions slide into grooves 656 of leg mounting bracket 632, which helps align the end cap 646 with the leg mounting bracket 632. Alignment of the end cap 646 with the leg mounting bracket 632 assures that the openings 655 of the end cap 646 align with slots 658 of the leg mounting bracket 632 to allow insertion of a pin or axle for rotation. In some embodiments, the protrusions 654 extend up to 0.05 inches outward from the end cap 646. In other embodiments, the protrusions 654 can extend 0.01, 0.02, 0.03, 0.04, 0.05, 0.06, 0.07, 0.08, 0.09, or 0.10 inches from the surface of the end cap 646 in an outward direction. Further, in some embodiments, the protrusions 654 can be round and have a diameter between 0.24 and 0.28 inches. In other embodiments, the protrusions 654 can have a diameter of 0.24, 0.25, 0.26, 0.27, or 0.28 inches.

Referring to FIG. 89, the mounting bracket 632 is similar to the mounting bracket 32 except the slots 658 of mounting bracket 632 do not extend all the way to the bottom of the mounting bracket 632. Instead, the slots 658 of the mounting bracket 632 are configured to be the same size as the openings 655 of the end cap 646. In some embodiments, the openings 655 of the end cap 646 and the slots 658 of the mounting bracket 632 can have a diameter between 0.15 in and 0.25 in. In other embodiments, the openings 655 and the slots 658 can have a diameter of 0.15, 0.16, 0.17, 0.18, 0.19, 0.2, 0.21, 0.22, 0.23, 0.24, or 0.25 inches. In many embodiments, the slots 658 can have a diameter of 0.01 inches greater than the diameter of the openings 655. The mounting bracket 632 also includes grooves 656 configured to receive the protrusions 654 of the end cap 646 and guide the end cap 646 into a position wherein the openings 655 of the end cap 646 are aligned with the slots 658 of the mounting bracket 632. Referring to FIG. 90, the end cap 646 and the mounting bracket 632 is displayed in an assembled position. A pin (not shown) can be threaded or positioned through the opening 655 and the slot 658 on one side of the assembly, and extend through the opening 655 and slot 658 on the other side of the assembly, locking the leg 40 and end cap 646 to the mounting bracket 632. In addition, the engagement of the pin with the slots 158 and the openings 655 permits each associated leg 40 to pivot in relation to the respective mounting bracket 632 about a pivot axis that extends through the center of the pin. In particular, this allows the legs 40 to pivot between the retracted configuration and the extended configuration.

7. Carry Bag: Third Alternate Embodiment of Leg Connection

Yet another embodiment of the leg connection can comprise a multi-component end cap. This leg connection embodiment allows one component (or piece) of the leg end cap to be initially rotatably connected to the leg mounting bracket. A second component (or piece) is initially fixed to a leg of the stand assembly. The leg can be quickly engaged (snap fit) with the leg mounting bracket by pressing the second component into the first component. This assembly step is fast, does not require tools, and does not require skilled labor.

Referring now to FIGS. 68-72, another alternative embodiment of the end cap 528 for use with the leg self-assembly system 502 is illustrated. In this embodiment, the end cap 528 is a multi-component end cap 564 that interconnects by a snap-fit. By using the end cap 564, the leg self-assembly system 502 eliminates the need for the pins 516.

FIGS. 68-72 illustrate an embodiment of the multi-component end cap 564. The end cap 564 includes a first piece or first portion 568 and a second piece or second portion 572. When used in the leg self-assembly system 502, the first piece 568 is pre-attached to the mounting bracket 32, for example by opposing apertures 576*a, b* that define a pivot axis to allow the legs 40 to extend between the first and second configurations. The second piece 572 is pre-attached to each leg 40, for example each leg 40 can receive a projection 580 that extends from the second piece 572. Further, each leg 40 can be partially received by a recess 584 defined by the second piece 572. While the projection 580 is illustrated as having a cross sectional shape of a cross or plus-sign, in other embodiments the projection 580 can have any suitable shape to facilitate engagement with a leg 40. In addition, while the illustrated embodiment of the second piece 572 provides a friction or interference fit with a leg 40, any suitable connection or engagement sufficient to retain each leg 40 with each second piece 572 may be used.

To attach each leg 40 to the mounting bracket 32 during self-assembly, the recipient connects the second piece 572 to the first piece 568. To facilitate the connection, the multi-component end cap 564 includes a snap fit assembly 584 (shown in FIG. 69). In the illustrated embodiment, the second piece 572 includes at least one flexible catch 588 (shown in FIGS. 69-70) sized to engage and be retained by associated detents 592 positioned within the first piece 568 (shown in FIGS. 70-71). Once the first piece 568 and the second piece 572 are attached by the snap fit assembly 584, the legs 40 are attached to the mounting bracket 32 (see FIG. 72).

8. Carry Bag: Bracket for Leg Spring

In addition to the leg mounting bracket, the leg connection mechanism, and the legs, the stand assembly 26 of the carry bag 10 can further comprise a spring 41 that engages the base 34 and the legs 40. A bracket connects the spring 41 to the legs 40. The spring 41 assists in the extension and retraction of the legs when the carry bag 10 is transitioned between the extended and retracted configurations.

Figure 75:
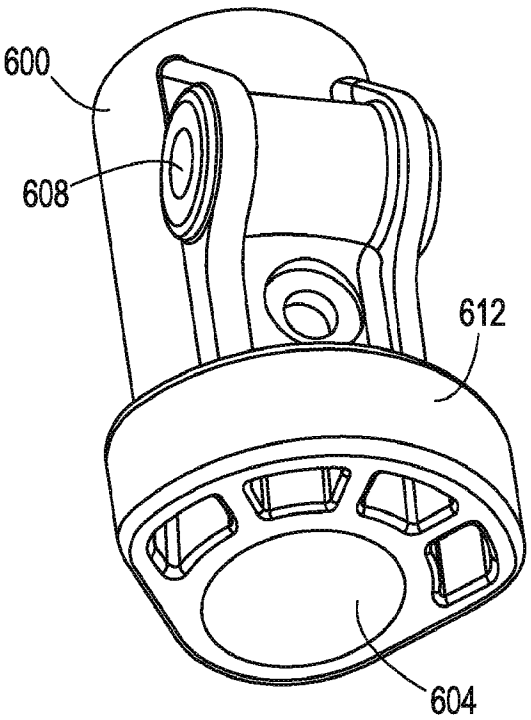
FIG. 75 is a second perspective view of the bracket of FIG. 73.
Figure 74:
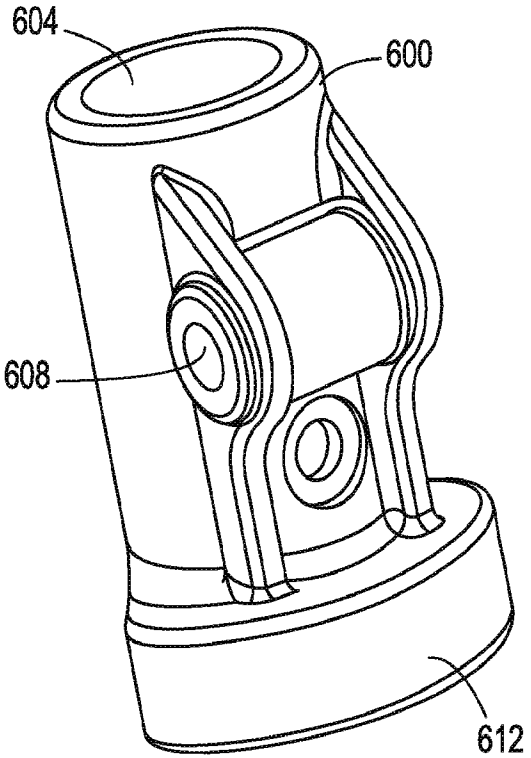
FIG. 74 is a first perspective view of the bracket of FIG. 73.
Figure 73:
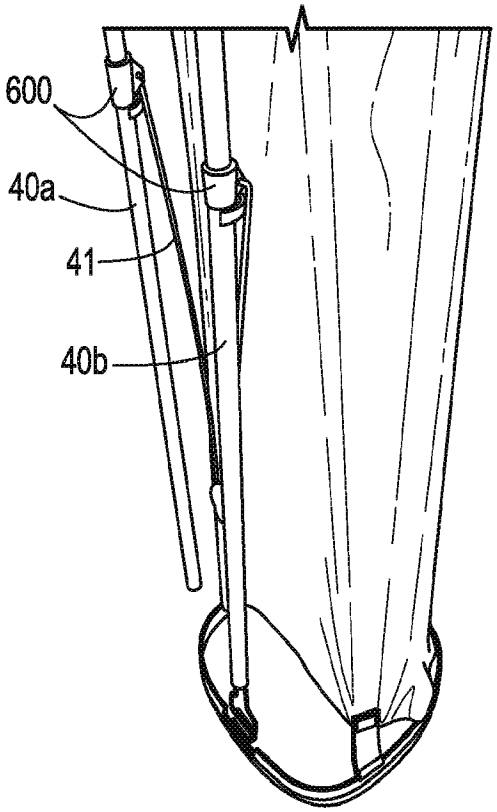
FIG. 73 is a perspective view of a portion of the golf bag of FIG. 57 illustrating a bracket connecting the spring to each leg.

FIGS. 73-75 illustrate an example of an embodiment of a bracket 600 (also called spring-to-leg bracket) that attaches the spring 41 to each leg 40*a*, 40*b*. The bracket 600 includes a leg receiving channel 604 configured to receive the leg 40*a* or 40*b*, facilitating mounting of a bracket 600 on each respective leg 40*a*, 40*b*. The bracket 600 also includes a spring receiving channel 608 configured to receive a portion of the spring 41, attaching the spring 41 to each leg 40*a*, 40*b*. In the illustrated embodiment, the spring receiving channel 608 is offset from and approximately perpendicular to the leg receiving channel 604. The bracket 600 includes an arcuate projection or bumper 612 on an outer surface of the bracket 600. As shown in FIG. 36, the bumper 612 separates the legs 40*a*, 40*b* from the spring 41, and more specifically allows the legs 40*a*, 40*b* to be offset from the spring 41 and the flat 14 (not shown in FIG. 73, but shown in FIG. 1). By positioning the legs 40*a*, 40*b* as offset from the spring 41 by the bumper 612 on each bracket 600, the legs 40*a*, 40*b* do not become entangled with the spring 41 during deployment of the legs 40*a*, 40*b* from the retracted configuration to the extended configuration.

C. Carry Bag: Flat

As discussed above, the carry bag 10 can comprise a flat. Some variations of the flat 14 that are specific to the carry bag 10 are described below.

1. Carry Bag: Inflatable Hip Pad and Inflatable Shoulder Pad

Figure 85:
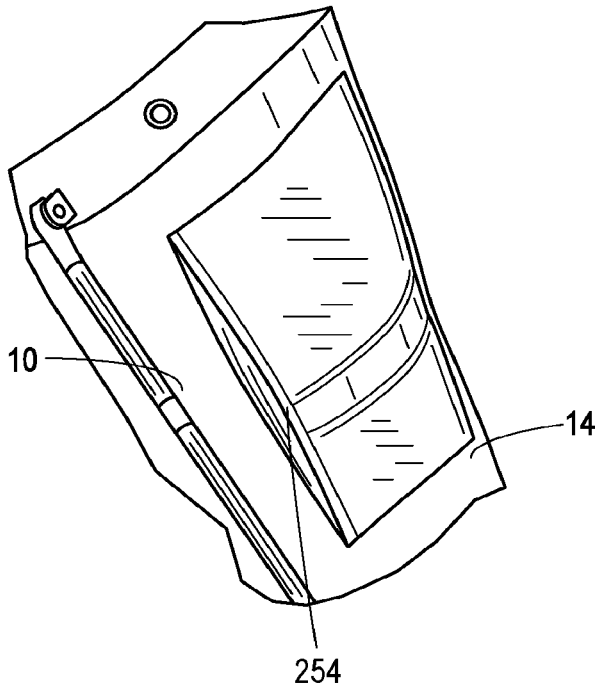
FIG. 85 is a perspective view of a pocket on a golf bag for an inflatable hip pad.
Figure 86:
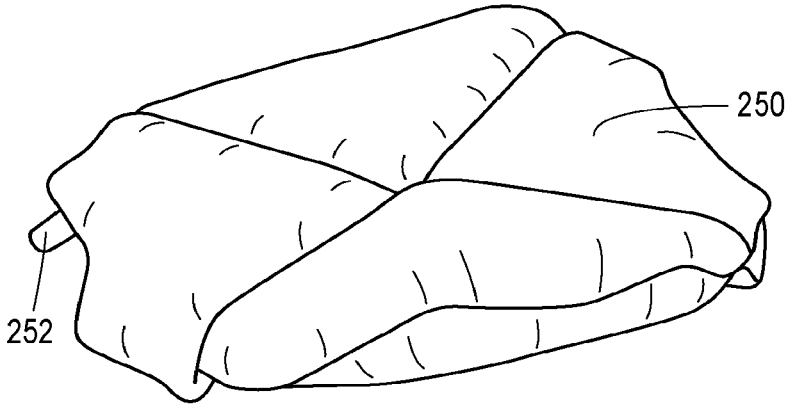
FIG. 86 is a perspective view of an embodiment of an inflatable hip pad.

Referring to FIGS. 85 and 86, the flat 14 can also include an inflatable hip pad 250. The inflatable hip pad 250 can be positioned along any portion of the flat 14 wherein the bag might rest on the users back or hip. The flat 14 can include a pocket 1020 configured to receive the inflatable hip pad 250. In many embodiments, the inflatable hip pad 250 and the flat 14 can be permanently coupled by sewing, welding or any other suitable permanent coupling method. In other embodiments, the inflatable hip pad 250 can be inserted in the pocket 1020 and the pocket can be sealed by means of a zipper, a snap fit mechanism, a hook and loop fastener or any other suitable sealing method. The inflatable hip pad 250 further includes a nozzle 252 to allow the user to deflate or inflate the inflatable hip pad 250 with air. The pocket 1020 can be configured such that, the nozzle 252 is accessible to the user from outside the flat 14. The nozzle 252 can be positioned such that it does not contact the users back or hip when carrying the bag 10.

The inflatable hip pad 250 can comprise an inner inflatable compartment contained by an outer shell. The inner inflatable compartment can be a single large compartment or can comprise a plurality of apertures extending through the inflatable hip pad 250 creating a series a sectioned inflatable compartment. The inflatable hip pad 250 further comprises a nozzle 252. In many embodiments, the nozzle 252 is a twist lock nozzle. In other embodiments, the nozzle 252 may be any type of nozzle. For example, the nozzle 252 can be a spring loaded nozzle, a capped nozzle, a push pull nozzle or any other suitable inflation valve. In the illustrated embodiment, referring to FIG. 86, the nozzle 252 can be welded into the seam of the inflatable hip pad 250. In other embodiments, the nozzle 252 can be welded on the outer surface of the inflatable hip pad 250.

The inflatable hip pad 250 allows the user to inflate the hip pad 250 to a desired amount of cushion, as opposed to hip pads having a pre-determined amount of filler defined during the manufacturing process. Additionally, because the hip pad 250 is inflated with air it does not flatten out or compress over time as a conventional foam hip pad may. Further, by using air as the filler material for the inflatable hip pad 250 it can be lighter than a conventional hip pad comprising foam or some other higher density material as a filler, thereby providing weight savings to the overall golf bag.

Figure 87:
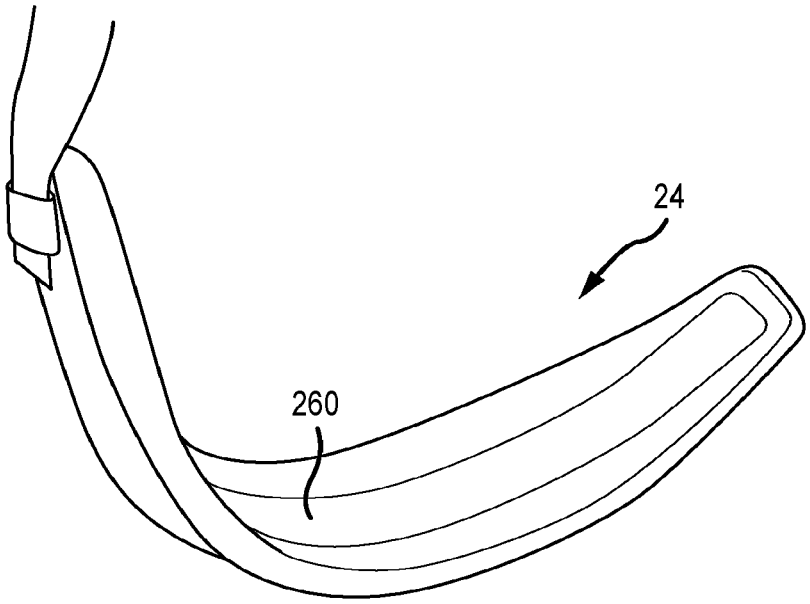
FIG. 87 is a perspective view of a shoulder strap.

In some embodiments, referring to FIG. 87, an inflatable shoulder pad can be included in the shoulder straps 24. The inflatable shoulder pad is similar to the inflatable hip pad 250 except that the size is adjusted to fit within the shoulder straps 24. Similar to the inflatable hip pad 250 the inflatable shoulder pad 260 comprises a nozzle, similar to nozzle 252, which can be configured to fit through the shoulder strap 24 such that it is easily accessible to the user. The nozzle will be positioned on the shoulder strap 24 such that it does not contact the user's shoulder. The inflatable shoulder pad 260 can also comprise an inflatable pocket, similar to the inflatable pocket 254 for the inflatable hip pad 250. In some embodiments the inflatable pocket for the inflatable shoulder pad 260 is more elongate than the hip pad inflatable pocket 254.

2. Carry Bag: Removable Strap Connection

A number of types of buckles, clips, or connections can be used for connecting straps to carry bags. Some straps 24 are permanently attached to the carry bag 10 for simplicity of design, aesthetic purposes, and durability. Other straps 24 are releasably attached to the carry bag 10 to allow customization, alteration of strap configuration, and simplicity in manufacturing. The carry bag 10 can comprise a removable strap connection mechanism for securing or releasing a strap from the carry bag 10. The removable strap connection mechanism described below retains some of the advantages of a permanently attached strap while simultaneously allowing easy and non-destructive strap removal. The removable strap connection mechanism 350, illustrated in FIGS. 145A-148, can (1) hold the strap at a predetermined angle, (2) support a wide strap, (3) minimize the offset distance between the bag and the strap, and (4) support significant weight. The minimized offset distance gives the connection mechanism a low-profile structure that can further improve the aesthetics of the bag.

As illustrated in FIG. 145A, the removable strap connection mechanism 350 comprises a receiving portion 360 and a core portion 380. The receiving portion 360 slides over the core portion 380 and snaps into place via locking features of the receiving and core portions 360, 380. Typically, the receiving portion 360 is connected to a strap 354 of the golf bag 10 and the core portion 380 is connected to a body of the golf bag 10. The strap connection mechanism 350 allows for the strap 354 to maintain its orientation with respect to the golf bag 10 when the golfer lets go of the strap 354. The strap connection mechanism 350 can hold the end of the strap 354 at a predetermined angle from a back surface 12 of the golf bag 10. Additionally, the strap connection mechanism 350 allows a wide strap 354 to be secured to the golf bag 10 in a manner that prevents undesired twisting of the strap 354. The strap connection mechanism 350 further provides a low-profile, unobtrusive, and aesthetically clean means of attaching the strap 354 to the golf bag body. Finally, the strap connection mechanism 354 can withstand a load between 15 and 70 pounds, making it useful for high load-bearing applications.

The following description is directed to the illustrated embodiment of FIGS. 145A-148, but should be understood to include other embodiments of the invention. The removable strap connection mechanism 350 for the carry bag 10 comprises a receiving portion 360 coupled to a strap 354 and a core portion 380 coupled to a bag body portion, such as the flat 14 or divider top 30. The receiving portion 360 comprises a strap attachment tab 365, a first arcuate arm 366 extending from the strap attachment tab 365, a second arcuate arm 367 extending from the strap attachment tab 365, and a channel 364 formed between the first and second arcuate arms 366, 367. The core portion 380 comprises a bag attachment tab 385 and a core 384 extending from the bag attachment tab 385. The strap attachment tab 365 of the receiving portion 360 engages a strap 354 of the carry bag 10. The bag attachment tab 385 of the core portion 380 connects to a body of the carry bag 10. However, in other embodiments, the receiving portion 360 is connected to the body and the core portion 380 is connected to the strap 354.

The first and second arcuate arms 366, 367 of the receiving portion 360 are integrally formed with the strap attachment tab 365. The first and second arcuate arms 366, 367 together form a portion of a roughly cylindrical channel 364 having an inner diameter 370 and an outer diameter 371. The inner diameter 370 can range from 0.10 to 0.45 inch. For example, the inner diameter 370 can range from 0.10 to 0.15 inch, 0.15 to 0.20 inch, 0.20 to 0.25 inch, 0.25 to 0.30 inch, 0.30 to 0.35 inch, 0.35 to 0.40 inch, or 0.40 to 0.45 inch. The outer diameter 371 can range from 0.20 to 0.55 inch. For example, the outer diameter 371 can ranged from 0.20 to 0.25 inch, 0.25 to 0.30 inch, 0.30 to 0.35 inch, 0.35 to 0.40 inch, 0.40 to 0.45 inch, 0.45 to 0.50 inch, or 0.50 to 0.55 inch.

The first and second arcuate arms 366, 367 can comprise a thicknesses ranging from 0.10 to 0.20 inch or 0.15 to 0.25 inch. The receiving portion 360 further comprises an opening 368 located opposite the strap attachment tab 365 and between an end of the first arcuate arm 366 and an end of the second arcuate arm 367. As seen in FIG. 146, the receiving portion 360 further comprises a first side 361 and a second side 362. The first and second arcuate arms 366, 367 extend between the first and second sides 361, 362. The receiving portion 360 further comprises an end wall at a second side 362 of the receiving portion 360. The end wall connects the first and second arcuate arms 366, 367 and acts like a stopper at one end of the channel 364. The first side 361 of the receiving portion channel 364, opposite the end wall, comprises an opening 369 for receiving the core 384 of the core portion 380.

The receiving portion 360 comprises a width 356, defined between the first side 361 and the second side 362 of the receiving portion 360 (i.e. parallel with the channel 364). The width 356 of the receiving portion 360 can range between 0.5 and 4.0 inches. For example, the width 356 of the receiving portion 360 can range between 0.5 and 1.6 inches, 1.2 and 1.8 inches, 1.4 and 2.0 inches, 1.6 and 2.2 inches, 1.8 and 2.4 inches, 2.0 and 2.6 inches, 2.2 and 2.8 inches, 2.4 and 3.0 inches, 2.6 and 3.2 inches, 2.8 and 3.4 inches, or 3.0 and 3.6 inches.

The receiving portion 360 further comprises a locking feature, not illustrated. The locking feature can comprise a groove or a protrusion corresponding to a respective locking feature (e.g. a corresponding protrusion or groove) of the core portion 380. The locking feature of the receiving portion can be located at any suitable location along the width 356 of the receiving portion 360. The locking feature of the receiving portion 360 can be disposed on an inner surface of the first and second arcuate arms 366, 367. In some embodiments, the locking feature comprises a button release tab rather than a protrusion or groove.

The core portion 380 is integrally formed with the bag attachment tab 385. The core 384 of the core portion 380 comprises a generally cylindrical shape having a core diameter 390. The core diameter 390 can range from 0.10 to 0.45 inch. For example, the core diameter 390 can range from 0.10 to 0.15 inch, 0.15 to 0.20 inch, 0.20 to 0.25 inch, 0.25 to 0.30 inch, 0.30 to 0.35 inch, 0.35 to 0.40 inch, or 0.40 to 0.45 inch. The core 384 further comprises a first end 381 and a second end 382. The core portion 380 further comprises a locking feature, not illustrated, that engages the locking feature of the receiving portion 360 when the core 384 is inserted into the channel 364 of the receiving portion 360. The core portion locking feature is disposed on an outer surface of the core 384. In embodiments where the receiving portion locking feature is a groove, the core portion locking feature can be a protrusion sized to engage the groove. In embodiments where the receiving portion locking feature is a protrusion, the core portion locking feature can be a groove sized to receive the protrusion. As mentioned above, in some embodiments, the locking feature can comprise a button release tab rather than a protrusion or groove.

A width 357 of the core portion 380 is defined between the first end 381 and the second end 382 of the core 384. The width 357 of the core 384 can range between 1.0 and 3.0 inches. For example, the width 357 of the core 384 can ranged between 1.0 and 1.6 inches, 1.2 and 1.8 inches, 1.4 and 2.0 inches, 1.6 and 2.2 inches, 1.8 and 2.4 inches, 2.0 and 2.6 inches, 2.2 and 2.8 inches, or 2.4 and 3.0 inches. In many embodiments, the core width 357 is less than the width 356 of the receiving portion 360. Since the end wall of the receiving portion 360 takes up a portion of the width 356 of the receiving portion 360, the core width 357 must be less than the receiving portion width 356 in order for the end of the core 384 to lie flush with the first side 361 of the receiving portion 360. The removable strap connection mechanism 350 comprises a width that matches the width 357 of the receiving portion 360.

In some alternate embodiments, the channel 364 of the receiving portion 360 can comprise a shape that is not cylindrical. For instance, the internal shape of the receiving portion 360 can be roughly square, triangular, trapezoidal, teardrop, or any other suitable shape. The core 384 of the core portion 380 can comprise a shape that corresponds to the channel 384 of the receiving portion 360.

The strap attachment tab 365 can comprise a slot for receiving a strap 354 of the carry bag 10. The slot is located adjacent an end of the strap attachment tab 365 opposite the connection between the strap attachment tab 365 and the arcuate arms 366, 367 of the receiving portion 360. In other embodiments, the strap attachment tab 365 does not comprise a slot but rather comprises a material that can be permanently sewn into the strap 354. Similarly, the bag attachment tab 385 can comprise a portion opposite the connection between the bag attachment tab 385 and core 384 of the core portion 380. This section of the bag attachment tab 385 can be sewn into the body of the carry bag 10. In other embodiments, the bag attachment tab 385 comprises a slot for receiving a strap 354 that is sewn to the body of the carry bag 10. In yet other embodiments, the bag attachment tab 385 can be integrally formed with an element of the bag body, such as a divider top 30. In some embodiments, the bag attachment tab 385 is integrated into a bracket that snaps onto, is riveted onto, or is adhered to the divider top 30 of the carry bag 10. The bag attachment tab 385 is secured to the bag body such that it does not flex greatly with respect to the bag body.

To engage the core portion 380 with the receiving portion 360, (1) the core 384 of the core portion 380 is aligned with the first end opening 369 of the receiving portion 360, (2) the bag attachment tab 385 of the core portion 380 is aligned with the opening 368 between the first and second arcuate arms 366, 367 of the receiving portion 360, (3) the core 384 of the core portion 380 is slid into the channel 364 of the receiving portion 360 and the bag attachment tab 385 of the core portion 380 is received into the opening 368 between the first and second arcuate arms 366, 367 of the receiving portion 360, and (4) the core portion 380 is fully engaged with the receiving portion 360 when the locking features of the core 384 and the channel 364 snap into a locked configuration and the core 384 contacts the end wall of the receiving portion 360. Some extra force is required to engage the locking features. In embodiments having a button release locking mechanism, the core portion 380 similarly can snap into a locked configuration. When the core 384 is engaged with the channel 364, the first and second arcuate arms 366, 367 of the receiving portion 360 almost fully encase the core 384 of the core portion 380. The end wall of the receiving portion 360 prevents the core 384 from extending too far through the channel 364. The ends of the first and second arcuate arms 366, 367 of the receiving portion 360 lie adjacent the bag attachment tab 385 of the core portion 380. Due to this structural configuration, the receiving portion 360 is inhibited from rotating about the core 384 of the core portion 380. Consequently, the strap attachment tab 365 of the receiving portion 360 is prevented from pivoting with respect to the core 384 or the bag attachment tab 385 of the core portion 380.

In the illustrated embodiment of FIG. 148, the strap attachment tab 365 and the bag attachment tab 385 are approximately coplanar (angled 180 degrees from each other) when the core portion 380 is engaged with the receiving portion 360. In other embodiments, the bag attachment tab 385 is integrally attached to the core portion 380 at an angle, such that when the core portion 380 is engaged with the receiving portion 360, the bag attachment tab 385 can be angled between 75 and 180 degrees from the strap attachment tab 365. For example, the bag and strap attachment tabs 385, 365 can be angled with respect to each other by 180 degrees (coplanar), 175 degrees, 170 degrees, 165 degrees, 160 degrees, 155 degrees, 150 degrees, 145 degrees, 140 degrees, 135 degrees, 130 degrees, 125 degrees, 120 degrees, 115 degrees, 110 degrees, 105 degrees, 100 degrees, 95 degrees, 90 degrees, 85 degrees, 80 degrees, 75 degrees, or any other suitable angle. FIG. 2 illustrates one embodiment of the core portion 380, wherein the bag attachment tab 385 is angled roughly 90 degrees from the core 384. The rigid angle at which the strap attachment tab 365 is held helps the strap 354 of the carry bag 10 to stand up (retain its orientation) when the carry bag 10 is laid down on its belly (front side 11).

The receiving portion 360 and the core portion 380 can be formed from a metal, such as an aluminum alloy, a zinc alloy, a steel, or another suitable metal, or from a molded polymeric material. In some embodiments, the receiving portion 360 and strap attachment tab 365 are integrally cast from a metal material. In these embodiments, the core portion 380 and bag attachment tab 385 are integrally molded from a polymeric material. In other embodiments, the receiving portion 360 and strap attachment tab 365 are integrally cast from a metal material, and the core 384 and bag attachment tab 385 are integrally cast form a metal material. In embodiments where the bag attachment tab 385 is formed from metal, the bag attachment tab 385 typically comprises a slot for receiving a strap member that secures the bag attachment tab 385 to the carry bag 10.

The rigid strap connection mechanism 350 places the strap 354 in a position that sticks up at an angle from the back 12 of the carry bag 10 when the carry bag 10 is placed belly-down on the ground. The stand-up strap 354 allows a user to pick up the bag 10 with minimal bending. The removable strap connection mechanism 350 can also secure a wide strap 354 to the carry bag 10 in a manner that prevents unwanted twisting of the strap 354. Due to the large width of the strap connection mechanism 350, the entire end of a wide strap 354 can be secured directly to the bag 10 without any need for first tapering the strap 354. In many conventional bags, wide straps must be tapered to a smaller width before being secured to a buckle and connected to a bag. This smaller width portion of the strap, along with the small width of the buckle, allows the strap to twist upside down or to other unwanted configurations.

Furthermore, if conventional buckles are designed large enough to accommodate a wide strap, the buckle proportionally increases in length, resulting in a large offset distance between the bag and the strap. These large conventional buckles not only change the aesthetics of the bag but also alter the feel of the strap with their rigid and bulky structure. The removable strap connection mechanism 350 provides connection over a large surface area (due to the large width), which reduces the amount of stress placed on the mechanism at each point along the connection mechanism 350. The channel 364 and core 384 structure of the connection mechanism 350, along with the width, allows the offset distance between the strap 354 and the bag 10 to be minimized. The offset distance between an end of the strap 354 and a portion of the back side 12 of the bag 10 can range between 0.2 and 1.0 inch. For example the offset distance can range between 0.2 and 0.4 inch, 0.3 and 0.5 inch, 0.4 and 0.6 inch, 0.5 and 0.7 inch, 0.6 and 0.8 inch, 0.7 and 0.9 inch, or 0.8 and 1.0 inch. The offset distance can be less than 1.0 inch, less than 0.8 inch, less than 0.7 inch, less than 0.6 inch, less than 0.5 inch, less than 0.4 inch, less than 0.3 inch, less than 0.2 inch, or less than 0.1 inch. In one example embodiment, the offset distance is between 0.2 and 0.5 inch. The minimal offset distance contributes to a low-profile and unobtrusive look.

The strap connection mechanism 350 can withstand the load of a bag 10, including its contents, having a mass between 15 and 70 lbs. For example, the strap connection mechanism 350 can withstand the load of a bag 10 having a mass between 15 and 20 lbs, 20 and 30 lbs, 20 and 40 lbs, 30 and 40 lbs, 40 and 50 lbs, 50 and 60 lbs, 10 and 30 lbs, 20 and 50 lbs, 30 and 60 lbs, or 40 and 70 lbs. In some embodiments, the removable strap connection mechanism 350 can withstand a load of a bag 10, including its contents, of between 15 and 35 lbs. The mixture of structural and material properties of the removable strap connection 350 allow the mechanism to bear more weight than prior art connectors. The material properties of the receiving portion 360 can provide rigidity that prevents the first and second arcuate arms 366, 367 of the receiving portion 360 from deforming. This rigidity is crucial for retaining the core portion 380 within the receiving portion 360.

Furthermore, the removable strap connection mechanism 350 allows easy alteration of the straps 354 on a carry bag 10. For instance, the shoulder strap can be removed to change the golf bag strap or to convert from a single strap to a dual strap bag. In this example, the strap connection mechanism 350 can comprise two core portions 380 on the carry bag 10 to provide two options for where to attach the single strap 354, allowing versatile strap configurations. In other embodiments, disengaging the strap 354 from the carry bag 10 is desirable to allow the user to flatten the strap 354 against the body of the bag 10 for storage. The removable strap connection mechanism 350 also allows for space-efficient shipping of the carry bag 10. In some carry bags, the removable strap connection mechanism 350 can be employed on both ends of the one or more straps 354, so that the straps 354 can be completely removed from the bag 10 if desired. This allows for easy customization of the strap color or other properties at a late stage in the bag manufacturing process. The removable strap connection mechanism 350 offers functionality, connection strength, and quality that provide customization, collapsibility, ergonomic handling, improved aesthetics, and other advantages over prior art strap-to-bag connection mechanisms.

D. Carry Bag: Self-Assembly Kit

As discussed above, the carry bag 10 components can be assembled into a sub-assembly 42. The sub-assembly 42 can comprise any variation of components. The sub-assembly 42 can be collapsible. Furthermore, the sub-assembly 42, can be used to construct the carry bag 10. In some embodiments, as described below, the sub-assembly 42 is provided as part of a self-assembly kit 400. The carry bag self-assembly kit 400 results in reduced costs for the recipient as a consequence of the reduced shipping volume and the reduced labor costs for the supplying company.

Referring now to FIGS. 54-72, an embodiment of a sub-assembly for the collapsible carry bag 10 is described and illustrated in the context of a self-assembly kit 400 (shown in FIG. 57). The kit 400 includes the golf bag 10 and a self-assembly system 700 that allows a recipient to assemble the golf bag 10 upon receipt.

Figure 54:
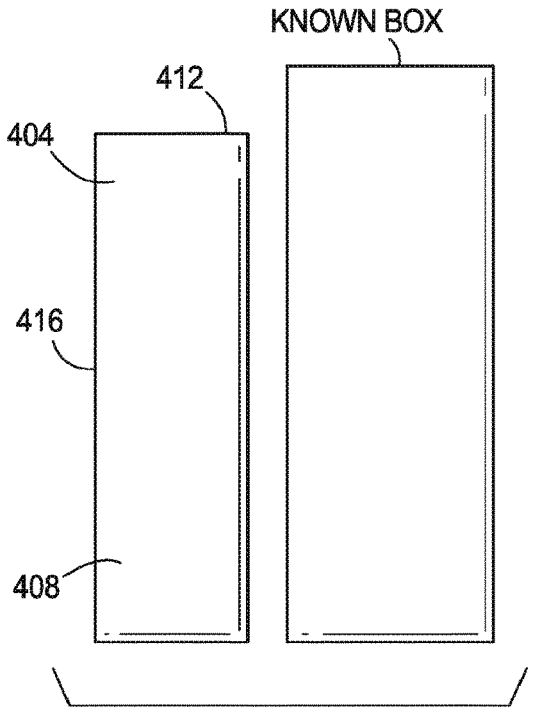
FIG. 54 is an elevation view of a top face of a box for use in shipping a disassembled golf bag and associated self-assembly system, the box positioned next to a larger known box showing the top face and that is used for shipping an assembled golf bag.
Figure 55:
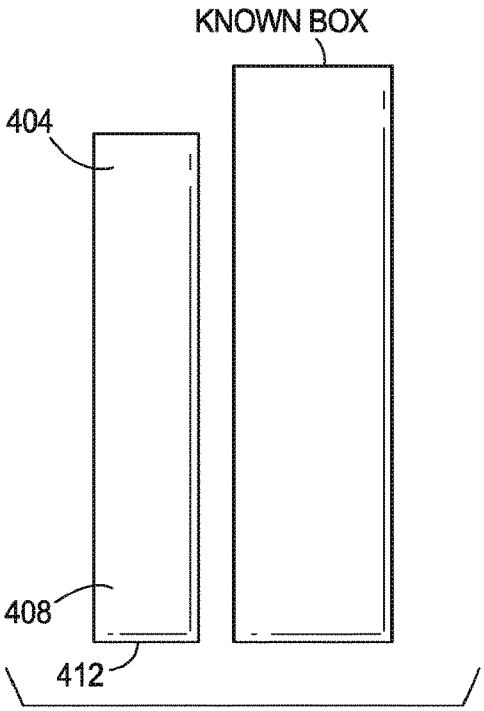
FIG. 55 is an elevation view of a side face of the box of FIG. 54, the box positioned next to a larger known box showing the side face and that is used for shipping an assembled golf bag.

As illustrated in FIGS. 54-55, the self-assembly kit 400 includes a box or container or shipping package 404 that is used to ship the golf bag 10 in a partially assembled state. The box 404 includes a top or face side 408 that can be integrally formed with a flap or flap portion 412. The face side 408 is connected to a portion of the box 404, and more specifically to a side of the box, by a fold 416. The face side 408 defines a portion of the outer surface of the box 404, while also providing access to the interior of the box 404 by pivoting about the fold 416. The flap portion 412 defines an engagement surface to facilitate closure of the box 404. The engagement surface can include one or more tabs (not shown) that can be received by a respective slot 418 (shown in FIG. 57) that is defined by a portion of the box 404 separate from the face side 408 and the flap 412 (e.g., the slots can be defined by one or more sides of the box 404, etc.). It should be appreciated that the tab and slot closure is provided for purposes of a closure illustration, and any closure suitable for engaging the face side 408 and/or the flap portion 412 with a portion of the box 404 may be implemented.

The box 404 of the self-assembly kit 400 is shown in FIGS. 54-55 next to a known box currently used for shipping a fully assembled golf bag. The comparison is illustrative of the reduced size of the box 404 in relation to the known box. More specifically, the box 404 has a volume of approximately 2,040 cubic inches ($in^3$), while the known box has a volume of approximately 5,190 cubic inches ($in^3$). While the volumes of the boxes are approximate, the box 404 has approximately 60% less volume than the known box. The box 404 has a reduced size and a reduced volume over known boxes, with the volume reduction ranging from approximately 15% to approximately 70%, and more specifically from approximately 25% to approximately 65%, and more specifically from approximately 35% to approximately 60%, and more specifically exceeding 50% from known boxes used for shipping assembled golf bags.

Figure 56:
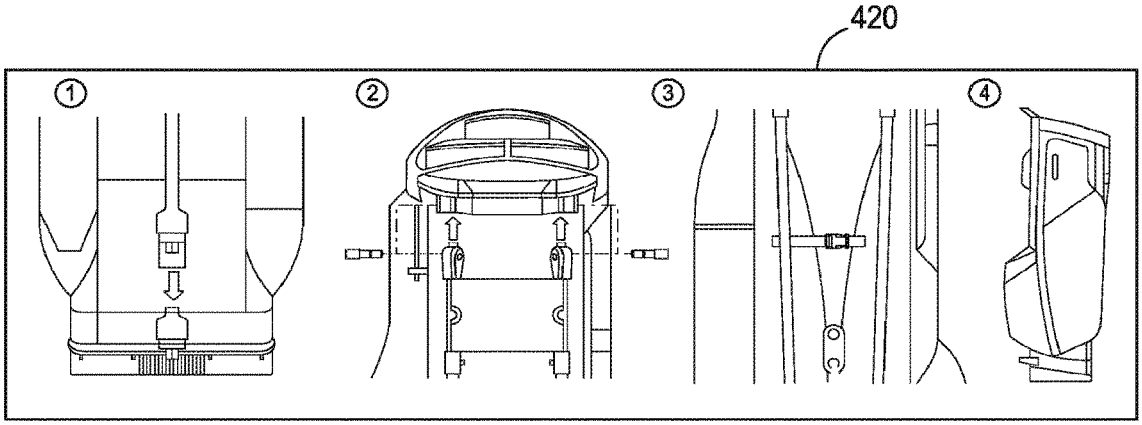
FIG. 56 is an elevation view of indicia printed on a portion of the box of FIG. 54, the indicia illustrated as assembly instructions.

To provide guidance to a recipient with regard to self-assembly of the golf bag 10, the box 404 can include indicia 420. As illustrated in FIG. 56, the indicia 420 include instructions for assembling the golf bag 10. The assembly instructions can include one or more illustrations or detailed figures to provide guidance and/or illustrate each assembly step. In the illustrated embodiment of the box 404, the indicia 420 is printed on the inside of the face side 408 (i.e. when the box 404 is closed, the indicia 420 faces the interior of the box 404) and oriented such that when a recipient pivots the face side 408 about the fold 416 to open the box, the indicia 420 faces the recipient in a readable orientation. While the indicia 420 is disclosed as printed on the box 404, in other embodiments the indicia 420 may be separately included in the box (e.g., as an instruction manual, etc.).

FIG. 57 illustrates the golf bag 10 in a first, partially assembled, collapsed state or configuration. The golf bag 10 is shipped in this state in the box 404. In FIG. 57, the golf bag 10 is shown removed from the box 404 and includes the divider top 30, the base 34, and the stay 39 (shown in FIG. 22). The flat 14 is attached to the divider top 30 and to the base 34. The golf bag 10 is collapsed with the divider top 30 and the base 34 each pivoted about the stay 39. In the illustrated embodiment, the divider top 30 and the base 34 are each pivoted towards each other about the stay 39 approximately ninety degrees. In other examples of embodiments, the divider top 30 and the base 34 can each be pivoted about the stay 39 at any angle suitable to collapse the golf bag 10 for shipment in the box 404.

In addition to the collapsible golf bag 10, the kit 400 includes the self-assembly system 500. The self-assembly system 500 includes one or more components of the golf bag 10 assembled by the recipient.

With reference to FIG. 58, a first example of an embodiment of the self-assembly system 500 is illustrated. The illustrated system 500 can include a spring self-assembly system 501 (shown in FIG. 59) and a leg self-assembly system 502 (shown in FIG. 61 and described above). The system 500 in FIG. 58 includes a portion of the stand assembly 26, and more specifically the legs 40*a, b* and the attached spring 41. The spring 41 includes a connector 504 having a base engaging hook 508 (shown in FIG. 59). In some embodiments, the system 500 also includes an alignment aid 512 that assists a recipient with aligning the legs

40*a, b* with the mounting bracket 32 (shown in FIG. 66) for attachment. The system 500 further includes rod pins or pins 516 for pivotably attaching the legs 40*a, b* to the mounting bracket 32.

Figure 59:
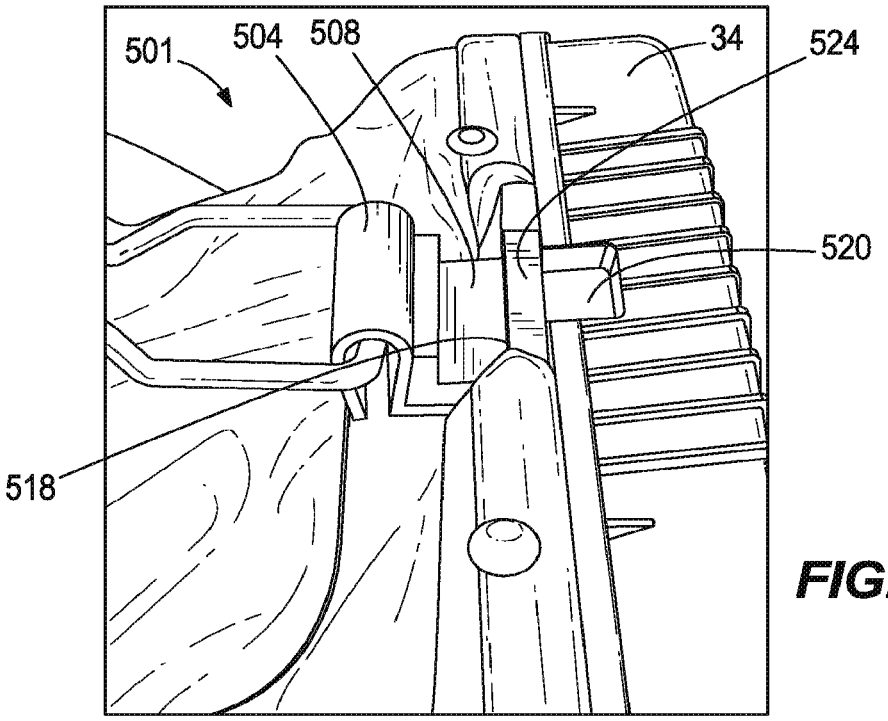
FIG. 59 is a perspective view of a connector for a stand assembly spring, and a portion of the base that engages the connector to facilitate self-assembly.
Figure 60:
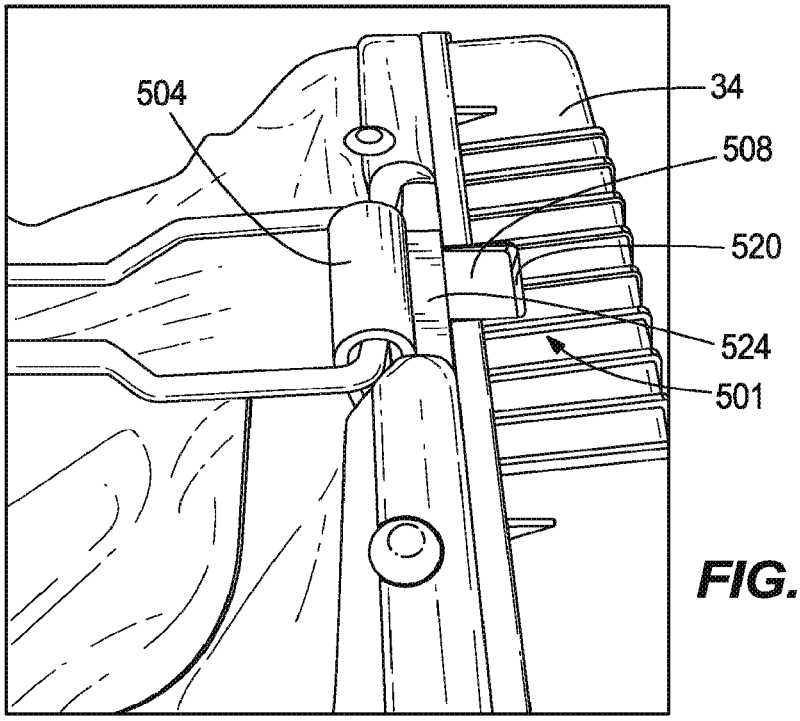
FIG. 60 is a perspective view of the connector of FIG. 59 shown engaging the base after self-assembly.

FIGS. 59-60 further illustrate the spring self-assembly system 501. The system 501 includes the connector 504 that facilitates self-assembly of the spring 41 and the base 34. With reference to FIG. 59, the base engaging hook 508 on the connector 504 includes a channel or hook portion (not shown) configured to receive or otherwise engage a portion of the base 34. In the illustrated embodiment, the base 34 defines a spring receiving slot or channel similar to channel 174 (shown in FIG. 25). The channel receives or engages with a portion of the connector 504. An aperture or window 520 is defined by a portion of the base 34, and more specifically a portion of the spring receiving slot 518 in the base 34. A portion of the perimeter of the aperture 520 is defined by a member or cross member 524 configured to be received within a gap or slot of the connector 504. To facilitate self-assembly, the recipient positions the connector 504 in the spring receiving slot 518. The recipient then engages the connector 504 with the base 34, allowing the base engaging hook 508 to receive the member 524. Once received, the base engaging hook 508 is received by the aperture 520, which is shown in FIG. 60. This forms the self-assembly connection between the connector 504 and the base 34, and more broadly between the spring 41 and the base 34. It should be appreciated that the self-assembly connection can be removable to allow disengagement or withdrawal of the connector 504 from the base 34. For example, the connection can be removed in order to replace a damaged portion of the stand assembly 26 (e.g., a broken leg 40, a broken spring 41, etc.) by a replacement self-assembly system 500.

III. Cart Bag

Another embodiment of a collapsible golf bag or a golf bag assembled from a sub-assembly can function as a cart bag 1010. Cart bags known in the art are typically larger than carry bags since the weight of the bag can be greater than one that will be carried by the golfer. Also, cart bags generally lack a shoulder strap and a stand assembly for propping up the bag since the cart bag will be stored on a golf cart during play. The functional requirements of the cart bag 1010 prompt certain differences in design from a typical carry bag. Some components of the cart bag 1010 are similar to the corresponding components of the carry bag 10. For example, the cart bag 1010 comprises a divider top 1030, a base 1034 or a base assembly 1900, and a flat 1014 that can be similar to the divider top 30, base 34 or base assembly 900, and flat 14, of the carry bag 10 described above. The cart bag 1010 further comprises a plurality of stays that connect the divider top 1030 to the base 1034.

The cart bag 1010, described below, comprises components that are designed to collapse for shipping and/or allow for quick assembly. Some components of the cart bag 1010 comprise snap fit features or connections that simplify and speed up the assembly process. The snap fit features or connections allow the cart bag 1010 to be assembled in a more efficient and ergonomic manner, which reduces production time and saves on skilled labor costs. Furthermore, the collapsible design of the cart bag 1010 embodiments describe herein, allow the cart bag 1010 to easily be transported between manufacturing sites.

Figure 114:
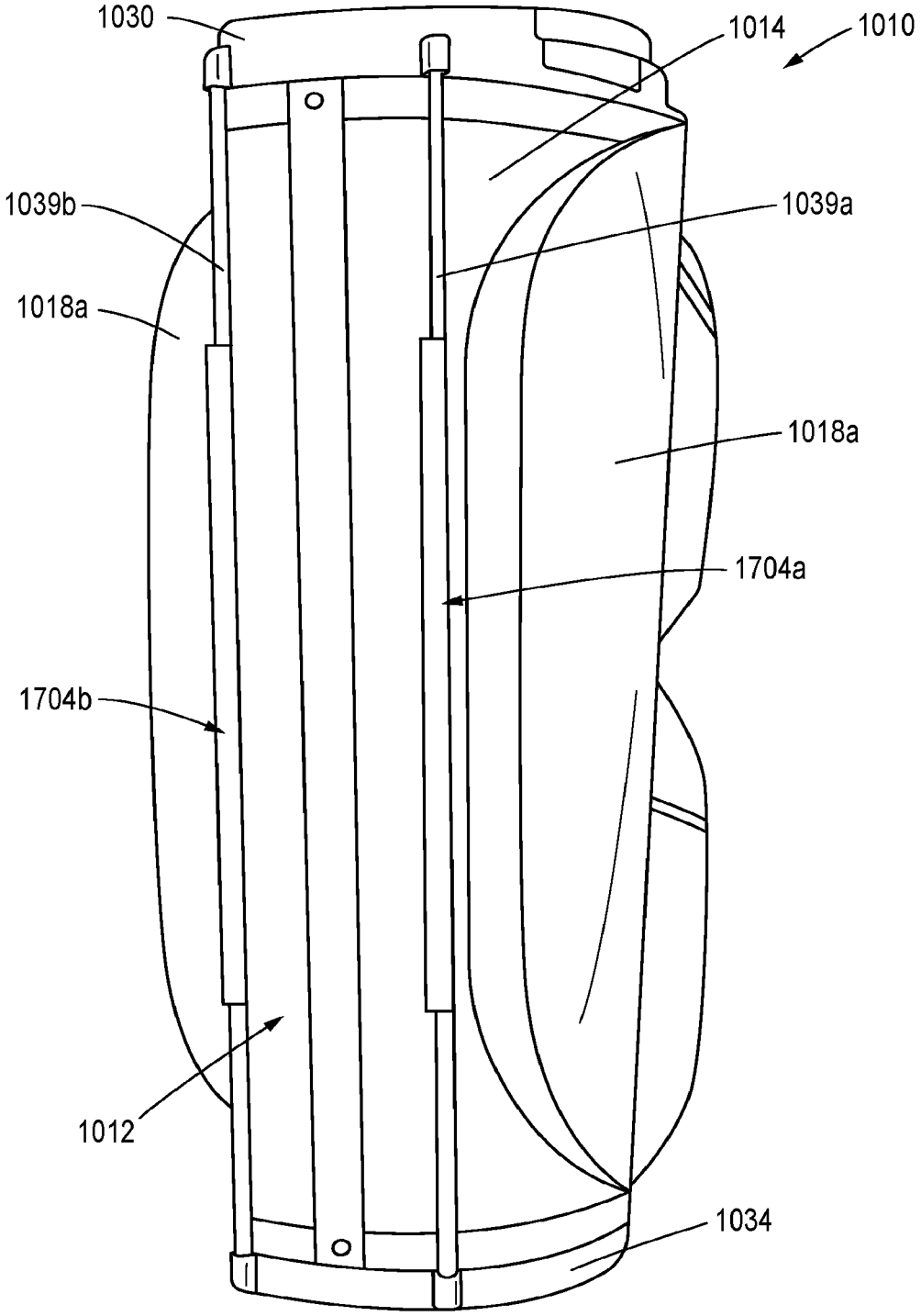

FIGS. 113-135 illustrate an example of an embodiment of a cart bag 1010. The cart bag 1010 has similarities to the carry bag 10, with like numbers used to identify like components. With reference to FIGS. 113-114, the cart bag 1010 includes the flat 1014. A plurality of pockets 1018 are attached to the flat 1014. The pockets include a plurality of side pockets 1018*a* and a plurality of front pockets 1018*b*. In other embodiments, the flat 1014 can include at least one side pocket 1018*a* and at least one front pocket 1018*b*. The cart bag 1010 also includes a divider top 1030 and a base 1034. A plurality of stays 1039 extend from the divider top 1030 to the base 1034. The plurality of stays include a first stay 1039 (shown in FIG. 113), a second stay 1039*a* (shown in FIG. 114), and a third stay 1039*b* (shown in FIG. 114).

The first stay 1039 is pivotally coupled to the divider top 30*c*, and pivotally coupled to the base 1034. The second and third stays 1039*a*, 1039*b* are each coupled to the divider top 1030 at a first end and to the base 1034 at a second end, opposite the first end. The first stay 1039 is shown in FIG. 113 to illustrate the positioning of the stay 1039 when the cart bag 1010 is in an operational configuration. However, it should be appreciated that the first stay 1039 is not generally visible to a user of the golf bag 1010, as the first stay 1039 is positioned on an interior side of the flat 1014 (i.e., the first stay 1039 is covered by the flat 1014). The second and third stays 1039*a*, 1039*b* shown in FIG. 114 are coupled to the flat 1014. More specifically, the flat 1014 includes a plurality of elongated pockets 1704*a*, 1704*b* (or longitudinal pockets 1704*a*, 1704*b*). Each pocket 1704*a*, 1704*b* defines a channel or passage (not shown) that is configured to receive one of the stays 1039*a*, 1039*b*. Each pocket 1704*a*, 1704*b* is coupled to the flat 1014 (e.g., by stitching, etc.), with the first pocket 1704*a* receiving the second stay 1039*a*, and the second pocket 1704*b* receiving the third stay 1039*b*. The first stay 1039 is positioned on a back side 1011 of the golf bag 1010, while the second and third stays 1039*b*, 1039*c* are positioned near (or on) a belly side 1012 (or a front side) of the golf bag 1010. More specifically, the second and third stays 1039*b*, 1039*c* are proximate the belly side 1012 by flanking the belly side 1012 (discussed further in association with FIG. 122). In other embodiments, the first stay 1039 can be positioned on the belly side 1012, while the second and third stays 1039, 1039*b* can be positioned on the back side 1011. In yet other embodiments, the first, second, and third stays 1039, 1039*a*, 1039*b* can be positioned at any suitable spaced relationship on any suitable side of the cart bag 1010 (e.g., back side 1011, belly side 1012, or either side positioned between back and belly sides 1011, 1012, etc.) to provide suitable support for the cart bag 1010.

Referring now to FIGS. 115-116, a sub-assembly 1042 is illustrated in an assembled configuration. The divider top 30*c*, the base 1034, and the plurality of stays 1039, 1039*a*, 1039*b* collectively define the sub-assembly 1042.

A. Cart Bag: Divider Top

The cart bag 1010 can comprise a divider top 1030 that provides structure to the cart bag 1010 and apertures allowing separation of golf clubs that are inserted into the cart bag 1010. The divider top 1030 of the cart bag 1010 can include the features described above. The divider top 1030 of the cart bag 1010 is shown in detail in FIGS. 117-118. The plurality of handles 1033*a*, 1033*b* are formed with or otherwise connected to the divider top 30*c*. The handles 1033*a*, 1033*b* are positioned on Opposing sides of the divider top 30*c*. The divider top 1030 can comprise any number of divider apertures 1082. In the illustrated embodiment of the cart bag divider top 30*c*, the cross members 114 and intermediate members 80 together define fifteen total divider apertures 1082 (shown in FIG. 122). With specific reference to FIGS. 115 and 117, at least one of the divider apertures 1082 can be a putter well 1716. In the illustrated embodiment the putter well 1716 is generally larger than the other divider apertures 1082. In other embodiments, the putter well 1716 can be any suitable size relative to the other divider apertures 1082.

The divider top 1030 can be connected to the flat 1014 in any manner described above. However, the illustrated embodiment of the cart bag 1010, the flat 1014 is secured to the divider top 1030 via snap fit connectors. Referring back to FIGS. 117-118, the outer ring 74 includes a plurality of attachment apertures 1720. The attachment apertures 1720 are positioned about a circumference (or perimeter) of the outer ring 74. Each attachment apertures 1720 is configured to receive a fastener or a snap fit connector to facilitate attachment of the flat 1014 to the outer ring 74, and more specifically attachment of the flat 1014 to the divider top 30*c*. Attachment of the flat 1014 to the divider top 1030 is discussed in additional detail below.

The divider top 1030 also includes a plurality of top stay hubs 1724. As illustrated in FIGS. 117-118, the outer ring 74 includes a first top stay hub 1724*a* and a second top stay hub 1724*b* (shown in FIG. 118). The first and second top stay hubs 1724*a*, 1724*b* have substantially the same design, and are in a spaced relationship on the outer ring 74. In the illustrated embodiment, the first and second top stay hubs 1724*a*, 1724*b* are positioned on opposing sides of the belly side 1012 of the divider top 30*c*. However, in other embodiments, the first and second top stay hubs 1724*a*, 1724*b* can be positioned at any suitable location on the outer ring 74 (e.g., on opposing sides of the back side 1011 of the divider top 30*c*, etc.). In addition, in other embodiments, the outer ring 74 can include a single top stay hub 1724, or three or more top stay hubs 1724. Each top stay hub 1724*a*, 1724*b* receives the respective top end (or first end) of the stay 1039*a*, 1039*b*. More specifically, the first top stay hub 1724*a* receives a top end of the second stay 1039*a*, while the second top stay hub 1724*b* receives a top end of the third stay 1039*b*.

B. Cart Bag: Base

The cart bag 1010 can further comprise a base 1034. The base 1034 provides a support structure for the cart bag 1010 and connects to one or more of the plurality of stays 1039, 1039*a*, 1039*b*, the flat 1014, and the divider sleeve 1046. The base 1034 of the cart bag 1010 can include the features described above. One embodiment of the base 1034 of the cart bag 1010 is shown in detail in FIGS. 119 and 120. In addition to the features described above, the illustrated base 1034 also includes a plurality of base stay hubs 1736. The lip 1072 includes a first base stay hub 1736*a* and a second base stay hub 1736*b* (shown in FIG. 120). The first and second base stay hubs 1736*a*, 1736*b* have substantially the same design, and are in a spaced relationship on the lip 72. In the illustrated embodiment, the first and second base stay hubs 1736*a*, 1736*b* are positioned on opposing sides of the belly side 1012 of the base 1034 (see FIG. 120). However, in other embodiments, the first and second base stay hubs 1736*a*, 1736*b* can be positioned at any suitable location on the lip 1072 (e.g., on opposing sides of the back side 1011 of the divider top 30*c*, etc.). In addition, in other embodiments, the lip 1072 can include a single base stay hub 1736, or three or more base stay hubs 1736. Each base stay hub 1736*a*, 1736*b* is generally aligned (or vertically aligned) with the corresponding top stay hub 1724*a*, 1724*b*, as each base stay hub 826*a*, 826*b* receives the respective bottom end (or second end) of the stay 1039*a*, 1039*b*. More specifically, the first base stay hub 1736*a* receives a bottom end of the second stay 1039*a*, while the second base stay hub 1736*b* receives a bottom end of the third stay 1039*b*.

Referring back to FIG. 115, the first stay 1039 includes a first stay hinge 1740 (or a top stay hinge 1740) and a second stay hinge 1744 (or a base stay hinge 1744). The first and second stay hinges 1740, 1744 are the same construction as the base stay hinge 170 (shown in FIGS. 26-28). In other embodiments, the first and second stay hinges 1740, 1744 can both be the stay hinge 162 (shown in FIGS. 23-24), or can each be one of the stay hinge 162 or the stay hinge 170 (e.g., the first stay hinge 1740 can be the hinge 170, while the second stay hinge 1744 can be the hinge 162, etc.). The first stay hinge 1740 is coupled to a first end of the stay 1039, and received by a stay receiving channel 1174*a* (shown in FIG. 121) defined by the divider top 30*c*. The second stay hinge 1744 is coupled to a second end of the stay 1039 that is opposite the first end. The second stay hinge 1744 is received by a stay receiving channel 174*b* (shown in FIGS. 116 and 120) defined by the base 1034. The first stay hinge 1740 facilitates tilting (or pivoting) of the divider top 1030 relative to the stay 1039, while the second stay hinge 1744 facilitates tilting (or pivoting) of the base 1034 relative to the stay 1039. The stay 1039 has a generally square (or rectangular) cross-section, while the stays 1039*a*, 1039*b* have a generally circular cross-section. In other embodiments, each stay 1039, 1039*a*, 1039*b* can have any suitable shaped cross-section (e.g., square, circular, rectangular, hexagonal, octagonal, triangular, etc.).

In the illustrated embodiment, the stay receiving channels 174*a*, 174*b* are positioned on an interior side of the respective divider top 1030 or base 1034, while the stay hubs 1724*a*, 1724*b*, 1736*a*, 1736*b* are positioned an exterior side of the respective divider top 1030 or base 1034. As illustrated in FIGS. 118 and 121, the stay receiving channel 1174*a* is positioned on an interior side of the outer ring 74 (see FIG. 121), while the top stay hubs 1724*a*, 1724*b* are positioned on an opposite, exterior side of the outer ring 74 (see FIG. 118). As illustrated in FIG. 120, the stay receiving channel 174*b* is positioned on an interior side of the lip 72, while the base stay hubs 1736*a*, 1736*b* are positioned on an opposite, exterior side of the lip 72. In other embodiments, the stay receiving channels 174*a*, 174*b* can be positioned on an exterior side of the respective lip 1072 or outer ring 74, while the stay hubs 1724, 1724*b*, 1736*a*, 1736*b* can be positioned on an interior side of the respective lip 1072 or outer ring 74. In yet other embodiments, the stay receiving channels 174*a, b* and stay hubs 1724*a*, 1724*b*, 1736*a*, 1736*b* can be positioned on an interior side of the respective lip 1072 or outer ring 74, or on an exterior side of the respective lip 1072 or outer ring 74.

1. Cart Bag: Two-Piece Snap Together Base

In some embodiments, the cart bag 1010 comprises a two-piece snap together base assembly 900 similar to the snap together base assembly described above. Referring to FIGS. 91 and 92, a base assembly 900 for a cart bag is illustrated. In some embodiments, the cart bag 1010 base assembly 900 is formed such that the bottom end 912 of the ring portion 910 further comprises a plurality of stay ports 940. The ring portion 910 can comprise two, three, four, five, six, seven, eight, or more stay ports 940. In the illustrated embodiment, the ring portion 910 comprises four stay ports 940. The plurality of stay ports 940 respectively receive the bottom end of each of the stays of the plurality of stays. In the illustrated embodiment, the plurality of stay ports 940 attach to an internal side of the base ring 910 of the base assembly 900. In some embodiments, the plurality of stay ports 940 attach to an external side of the base ring 910 of the base assembly 900 (similar to stay ports 1736*a*, 1736*b* of FIGS. 119 and 120). The base portion 920 comprises a plurality of port housings 942 that receive the plurality of stay ports 940 when the base portion 920 is engaged with the ring portion 910. In any given embodiment, the base portion's plurality of port housings 942 can comprise the same number of port housings 942 as the number of stay ports 940 on the top ring 910. In other embodiments, the two-piece base assembly 900 of the cart bag can have a stay receiving channel, similar to the one described above. The stay receiving channel can be integrally connected to the ring portion 910.

C. Cart Bag: Stay

As described above, the cart bag 1010 can further include a plurality of stays. In the illustrated embodiments, the cart bag 1010 comprises a first stay 1039, a second stay 1039*a*, and a third stay 1039*b*. The first, second, and third stays 1039, 1039*a*, and 1039*b* connect the divider top 1030 to the base 1034. The divider top 1030 and the base 1034 each comprise stay hubs for receiving the stays 1039, 1039*a*, and 1039*b*. The stay hubs secure the stays 1039, 1039*a*, 1039*b* and provide a rigid structure to the cart bag 1010.

Referring now to FIG. 122, which depicts the divider top 1030 from a top view, the aligned stay hubs 1724*a*, 1736*a*, and 1724*b*, 1736*b* are positioned proximate the belly side 1012 of the sub-assembly 1042, and more specifically flank the belly side 1012 of the sub-assembly 1042. Stated another way, the aligned stay hubs 1724*a*, 1736*a* are positioned on a first side of the respective divider top 1030 or base 1034 closer to the belly side 1012 than the back side 1011. The aligned stay hubs 1724*b*, 1736*b* are positioned on a second side of the respective divider top 1030 or base 1034 closer to the belly side 1012 than the back side 1011, the second side being opposite the first side. This arrangement (or geometry) is conducive to the base 1034 of the golf bag 1010 properly being received by different golf carts (e.g., motorized golf carts, push carts, pull carts, etc.). For example, FIG. 123 is a top down view of an example of a portion of a motorized cart liner 1748 that is configured to receive a golf bag. The illustrated cart liner 1748 is produced for use in a motorized golf cart, but is not intended to be a limiting example. The cart liner 1748 defines a depression 1752, a first arcuate wall 1756, and a second arcuate wall 1760. The arcuate walls 1756, 1760 are on opposing ends (or sides) of the depression 1752, and partially define a golf bag receiving area in the depression 1752. As illustrated in FIG. 124, the base 1034 of the cart bag 1010 is positioned in the depression 1752. The base 1034 is configured to fit between the arcuate walls 1756, 1760. More specifically, the base stay hubs 1736*a*, 1736*b* are positioned to flank the belly side 1012, thus not contacting the cart liner 1748 and allowing the belly side 1012 of the lip 1072 to be received by the first arcuate wall 1756. By positioning the vertically aligned stay hubs 1724, 1736 on the divider top 1030 and base 1034 to flank the belly side 1012, the stay hubs 1724, 1736 do not contact, or otherwise interfere with, the cart liner 1748. This allows the cart bag 1010 to be properly positioned within the cart liner 1748 (or within any suitable golf bag receiving portion of a golf cart).

1. Cart Bag: Top Stay Hub

The divider top 1030 of the cart bag 1010 can comprise one or more top stay hubs for receiving one or more stays 1039, 1039*a*, 1039*b* of the cart bag 1010. FIGS. 125 and 126 further illustrate the top stay hub 1724, and more specifically the second top stay hub 1724*b*. The top stay hub 1724*b* includes a housing 1764. The housing 1764 extends (or projects) away from the outer ring 74 of the divider top 30*c*. The housing 1764 can be molded with (or formed with) the divider top 30*c*. In other embodiments, the housing 1764 can be coupled to the divider top 1030 (e.g., by adhesive, a fastener, etc.). As illustrated in FIG. 126, the housing 1764 comprises a channel 1772 defined by a partial circumference. Further illustrated in FIG. 126, the housing 1764 defines an opening 1768 at the channel 1772. The opening 1768 leads to a channel 1772 (shown in FIG. 126) that is defined by the housing 1764. The channel 1772 extends into the housing 1764 above the opening 1768 to form a recess 1776. The recess 1776 is configured to receive the associated stay 1039*b*. Since the recess 1776 is positioned within the housing 1764, the recess 1776 assists with retaining the stay 1039*b* by defining a step feature. In some embodiments, the opening 1768 in the housing 1764 comprises a width equal to, or bigger than the diameter of the associated stay 1039*b*. The width being equal to, or bigger than the diameter of the associated stay 1039*b* allows the associated stay 1039*c* to easily be positioned within the housing 1764. In other embodiments (not pictured), the partial circumference defining the channel 1772 at the opening 1768 extends further toward the outer ring 74 of the divider top 30*c*, decreasing the width of the opening 1768. In this exemplary embodiment, the width of the opening 1768 is smaller than the diameter of the associated stay 1039*b*. The smaller width of the opening 1768 allows the associated stay 1039*b* to be positioned within the housing 1764, and be retained within the channel 1772 and recess 1776, once positioned into the housing 1764. In other embodiments still, in addition to the recess 1776, the housing 1764 can include a projection 1780 (or bump feature), which is shown in FIG. 126. The projection 1780 can extend from the housing 1764 towards the opening 1768. The projection 1780 can have a sloped (or arcuate) surface to facilitate sliding engagement of the stay 1039*b* with the channel 1772. Once the stay 1039*b* is received by (or positioned in) the channel 1772, the projection 1780 decreases a width of the opening 1768 to be less than a width of the stay 1039*b*. Thus, the projection 1780 can further assist with retaining the stay 1039*b*. The housing 1764 also extends from the outer ring 74 a distance to define a gap 1784 (or flat channel 1784) between the outer ring 74 and the channel 1772. The gap 1784 positions the stay 1039*b* to be offset from the outer ring 74 of the divider top 30*c*. The gap 1784 also provides spacing for positioning of the flat 1014, which is discussed in additional detail below. It should be appreciated that the first top stay hub 1724*a* is substantially the same as the second top stay hub 1724*b*, and as such the first top stay hub 1724*a* incorporates the features discussed above in association with the second top stay hub 1724*b*.

FIG. 127 illustrates an alternative embodiment of a top stay hub 1724*c*. In this embodiment, the top stay hub 1724*c* is coupled to the stay 1039*b* (e.g., by a fastener, adhesive, etc.). The top stay hub 1724*c* defines a projection assembly 1788 that is configured to engage with a corresponding aperture 1792 defined by the outer ring 74 of the divider top 30*c*. The projection assembly 1788 can form a snap-fit in response to being received by the aperture 1792, coupling the stay 1039*b* to the divider top 30*c*. It should be appreciated that the top stay hub 1724*c* can be used in place of one or both of the top stay hubs 1724*a*, 1724*b*.

2. Cart Bag: Base Stay Hub

The base 1034 of the cart bag 1010 can comprise one or more base stay hubs for receiving one or more stays 1039, 1039*a*, 1039*b* of the cart bag 1010. FIGS. 128 and 129 further illustrate the base stay hub 1736, and more specifically the first base stay hub 1736*a*. With reference to FIG. 129, the base stay hub 1736*a* includes a housing 1796. The housing 1796 extends (or projects) away from the lip 1072 of the base 1034. The housing 1796 can be molded with (or formed with) the base 1034. In other embodiments, the housing 1796 can be coupled to the base 1034 (e.g., by adhesive, a fastener, etc.). The housing 1796 defines an opening 1800. The opening 1800 leads to a channel 1804 that is defined by the housing 1796. The channel 1804 extends into the housing 1796 below the opening 1800 to form a recess 1808. The recess 1808 is configured to receive the associated stay 1039*a*. Since the recess 1808 is positioned within the housing 1796, the recess 1808 assists with retaining the stay 1039*a* by defining a step feature. The housing 1796 also extends from the lip 1072 a distance to define a gap 1812 (or flat channel 1812) between the lip 1072 and the channel 1804. The gap 1812 positions the stay 1039*a* to be offset from the lip 1072 of the base 1034. The gap 1812 also provides spacing for positioning of the flat 1014, which is discussed in additional detail below. It should be appreciated that the second base stay hub 1736*b* is substantially the same as the first base stay hub 1736*a*, and as such the second base stay hub 1736*b* incorporates the features discussed above in association with the first base stay hub 1736*a*.

FIG. 130 illustrates the divider sleeve 1046 coupled to the sub-assembly 1042. The divider sleeve 1046 extends from the divider top 30*c*, and couples to the base 1034. More specifically, a plurality of fasteners (e.g., rivets, bolts, etc.) are coupled to the divider sleeve 1046. Each fastener is received by a respective divider attachment aperture 1732 (see FIG. 122) in the bottom face 1038 to couple the divider sleeve 1046 to the base 1034. Each divider attachment aperture 1732 is configured to receive a fastener to facilitate attachment of a divider sleeve 1046 (or divider 1046) to the bottom face 1038, and more specifically attachment of the divider sleeve 1046 to the base 1034. The divider sleeve 1046 can also couple to the divider top 30*c*, as discussed above in association with the divider top 30.

FIGS. 131-134 illustrate the flat 1014 being coupled (or otherwise attached) to the sub-assembly 1042. Referring to FIG. 131, the flat 1014 is coupled to the divider top 1030 by a plurality of fasteners 1816 (e.g., snap buttons, etc.). The flat includes a plurality of first fasteners 1816*a* (e.g., a male portion of a snap button, etc.). The divider top 1030 includes a plurality of second fasteners 1816*b* (e.g., a female portion of a snap button, etc.). Each second fastener 1816*b* is received by (or positioned in) one of the attachment apertures 1720 positioned about the circumference (or perimeter) of the outer ring 74 (shown in FIGS. 117-118). The first and second fasteners 1816*a*, 1816*b* are configured to engage, fastening the flat 1014 to the divider top 30*c*. As shown in FIG. 132, the first and second fasteners 1816*a*, 1816*b* are hidden when the flat 1014 is attached to the divider top 30*c*. The first fastener 1816*a* is coupled to a collar 1824 (e.g., a PE board, a gusset, etc.). The collar 1824 is coupled to the flat 1014 by a binding 1828 (e.g., sewn, etc.) so that the collar 1824 is not exposed (or covered by the flat 1014). Referring back to FIG. 131, the flat 1014 also includes a self-fastener 1820 (e.g., a zipper, etc.) that connects the seam edges 203, 204 of the flat 1014. In the illustrated embodiment, the self-fastener 1820 is a zipper. In other embodiments, the self-fastener 1820 can be any suitable fastener (e.g., a single zipper, two zippers, a hook and loop fastener (VELCRO®), mounting tracks with a tongue that fits within associated rails, snap fit buttons, etc.).

With reference to FIG. 133, the flat 1014 is also coupled to the base 1034 by a plurality of fasteners 1816 (e.g., snap buttons, etc.). The flat includes a plurality of first fasteners 1816*a* (e.g., a male portion of a snap button, etc.), while the base 1034 includes a plurality of second fasteners 1816*b* (e.g., a female portion of a snap button, etc.). Each second fastener 1816*b* is received by (or positioned in) one of the attachment apertures 1728 positioned about the circumference (or perimeter) of the lip 1072 (shown in FIG. 119). The first and second fasteners 1816*a*, 1816*b* are configured to engage, fastening the flat 1014 to the base 1034. As shown in FIG. 134, the first and second fasteners 1816*a*, 1816*b* are hidden when the flat 1014 is attached to the base 1034. The first fastener 1816*a* is coupled to a collar 1824 (e.g., a PE board, a gusset, etc.). The collar 1824 is coupled to the flat 1014 by a binding 1828 (e.g., sewn, etc.) so that the collar 1824 is not exposed (or covered by the flat 1014). Referring back to FIGS. 131 and 133, once the flat 1014 is attached to the divider top 1030 and the base 1034 by the fasteners 1816, the self-fastener can be engaged, connecting the seam edges 203, 204 of the flat 1014, coupling the flat 1014 to the sub-assembly 1042. The flat 1014 is positioned between the divider top 1030 and the top stay hubs 1724*a*, 1724*b*, and between the base 1034 and the base stay hubs 1736*a*, 1736*b*. More specifically, the flat 1014 is positioned in the gap 1784 (or flat channel 1784) between the divider top 1030 and each of the top stay hubs 1724*a*, 1724*b*. The flat 1014 is also positioned in the gap 1812 (or flat channel 1812) between the base 1034 and the base stay hubs 1736*a*, 1736*b*. By positioning the flat 1014 in the associated gaps 1784, 1812, a user can readily install (or remove) the second and third stays 1039*a*, 1039*b* without interference from the flat 1014.

To facilitate user assembly of the golf bag 1010, the bag 1010 is generally provided to the user as illustrated in FIG. 135. The flat 1014 is attached to the sub-assembly 1042 (such as illustrated in FIGS. 131-134). However, the second and third stays 1039*a*, 1039*b* are removed. This allows the divider top 1030 to pivot relative to the first stay 1039, and the base 1034 to pivot relative to the first stay 1039. The flat 1014 can include an elastic material 1832 in the areas that the flat 1014 couples to the divider top 1030 and the base 1034 to facilitate pivotal movement, reduce wear of the flat material, and reduce wrinkling or other undesirable visual tendencies. With the divider top 1030 and the base 1034 pivoted relative to the first stay 1039, the golf bag 1010 is in a partially assembled, collapsed configuration. In the collapsed configuration, the golf bag 1010 can be shipped in the box 44.

To assemble the golf bag 1010, the bag 1010 is removed from the box 44. The user can then pivot the divider top 1030 relative to the first stay 1039 to a deployed position, and pivot the base 1034 relative to the first stay 1039 to the deployed position. To achieve the deployed position, the divider top 1030 and the base 1034 are pivoted away from each other. The user then inserts the second and third stays 1039*a*, 1039*b*. The user can insert each stay 1039*a*, 1039*b* into the respective pocket 1704*a*, 1704*b* (shown in FIG. 114). Each stay 1039*a*, 1039*b* is then inserted into the respective base stay hub 1736. Each stay 1039*a*, 1039*b* is inserted into the corresponding base stay hub 1736*a*, 1736*b* through the opening 1800 and into the recess 1808. Each stay 1039*a*, 1039*b* is then inserted into the corresponding top stay hub 1724*a*, 1724*b*. Each stay 1039*a*, 1039*b* is inserted through the opening 1768, into the channel 1772, and positioned in the recess 1776. With each stay 1039*a*, 1039*b* engaged with both the top and base stay hubs 1724*a*, 1736*a*, and 1724*b*, 1736*b*, the golf bag 1010 is in the deployed configuration (shown in FIG. 113).

FIGS. 136-138 illustrate an alternative embodiment of the golf bag 1010. In this embodiment, the stay 1039 is positioned on the belly side 1012 of the golf bag 1010. The second and third stays 1039*a*, 1039*b* are also coupled to a modular front pocket assembly 1836. To assemble the golf bag 1010, the bag 1010 is removed from the box 44. The user can then pivot the divider top 1030 relative to the first stay 1039 to a deployed position, and pivot the base 1034 relative to the first stay 1039 to the deployed position (shown in FIG. 101). The user then couples the modular front pocket assembly 1836 to the sub-assembly 1042 (on the back side 1011) by engaging the second and third stays 1039*a*, 1039*b* with the top and base stay hubs 1724*a*, 1736*a*, and 1724*b*, 1736*b* as discussed above. In the deployed configuration (shown in FIG. 138), the modular front pocket assembly 1836 covers the self-fastener 1820 (shown in FIG. 137) of the flat 1014.

FIGS. 139-141 illustrate an alternative embodiment of the golf bag 1010. In this embodiment, the stay 1039 is positioned on the belly side 1012 of the golf bag 1010, and the second and third stays 1039*a*, 1039*b* are also coupled to a modular front pocket assembly 1836. In addition, the second and third stays 1039*a*, 1039*b* are coupled to the divider top 1030 (i.e., not removable). To assemble the golf bag 1010, the bag 1010 is removed from the box 44. The user can then pivot the divider top 1030 relative to the first stay 1039 to a deployed position, and pivot the base 1034 relative to the first stay 1039 to the deployed position (shown in FIG. 140). The user then closes at least one first self-fastener 1820 (e.g., a zipper, etc.) (shown in FIG. 140) to fasten the modular front pocket assembly 1836 to the flat 1014. The user also closes a second self-fastener 1840 (e.g., a hook and loop fastener, etc.) to couple the modular front pocket assembly 1836 to the base 1034, resulting in the bag 1010 in a deployed configuration (shown in FIG. 141).

FIGS. 142-143 illustrate an alternative embodiment of the golf bag 1010. In this embodiment, the stay 1039 is positioned on the belly side 1012 of the golf bag 1010, and the modular front pocket assembly 1836 is coupled to the divider top 30*c*. To assemble the golf bag 1010, the bag 1010 is removed from the box 44. The user can then pivot the divider top 1030 relative to the first stay 1039 to a deployed position, and pivot the base 1034 relative to the first stay 1039 to the deployed position (shown in FIG. 143). The user then closes at least one first self-fastener 1820 (e.g., a zipper, etc.) (shown in FIG. 142) to fasten the modular front pocket assembly 1836 to the flat 1014. The user can then insert the second and third stays 1039*a*, 1039*b* into apertures 1844 defined in the divider top 30*c*. The second and third stays 1039*a*, 1039*b* are inserted until they each engage a corresponding aperture (not shown) in the base 1034. Alternatively, the user can insert a putter tube 1848 into the putter well 1716. The putter tube 1848 is inserted until it engages a corresponding aperture (not shown) in the base 1034. Insertion of the second and third stays 1039*a*, 1039*b* or the putter tube 1848 results in the bag 1010 being in a deployed configuration (shown in FIG. 143).

FIG. 144 illustrates an embodiment of the golf bag 1010 with a portion of the flat 1014 removed from the sub-assembly 1042 to illustrate additional features. The divider top 1030 and/or the base 1034 can include an alignment aid 1852 to assist with proper alignment of the flat 1014 on the sub-assembly 1042. The alignment aid 1852 can be an alignment snap button, a molded feature, or any other suitable guide to assist with aligning the flat 1014 relative to the sub-assembly 1042. The flat 1014 can also include a fastener 1856 to assist with coupling the flat 1014 to the divider top 1030 and/or the base 1034. The fastener 1856 can include a hook and loop fastener, with a first portion of the fastener 1856*a* (e.g., the hook, the loop, etc.) positioned on the divider top 1030 and/or the base 1034, and a second portion of the fastener 1856*b* (e.g., the loop, the hook, etc.) positioned on the flat 1014. The fastener 1856 can be hook and loop fastener tape, button snaps, a zipper, or any other suitable fastener. The flat 1014 can also include one or more guide pockets 1860 that are configured to receive the first stay 1039. The guide pockets 1860 can also assist with proper alignment of the flat 1014 relative to the sub-assembly 1042.

IV. Method of Manufacturing a Sub-Assembly

The golf bag 10, 1010 described herein can be manufactured by various methods. As laid out above, the golf bag 10, 1010 comprises at least the base, the divider top, the divider sleeve, the stay, and the flat. Different embodiments of each feature can be combined to form numerous variations of the golf bag 10, 1010. The method of manufacture can vary for different variations of the golf bag 10, 1010. Described below are example methods of manufacturing the golf bag 10, 1010.

One example method comprises ten main steps. In step 1, the base, divider top, divider sleeve, stay, leg/stand assembly, and flat are provided. In step 2, the leg mounting bracket is attached to the divider top, if necessary for the embodiment of the golf bag 10, 1010 being assembled. In step 3, the divider sleeve is attached to the base or flat. In step 4, the stay is attached to the base and the divider top. In step 5, the flat is secured to the divider top. In step 6, the leg assembly is attached to the leg mounting bracket, the divider top, and/or the base, if necessary for the embodiment of the golf bag 10, 1010 being assembled. In step 7, assembly of the divider top and/or base is completed if the embodiment of the golf bag 10, 1010 being assembled comprises a multi-piece divider top and/or base. In step 8, the flat is secured to the base. In step 9, the golf bag is packaged for shipping.

The order of these steps can change based on the configuration of certain features. Additionally, the golf bag 10, 1010 may be packaged and shipped in a partially-assembled state at any time during the manufacturing process. The process can be broken down into a first and second manufacturing stage, wherein the golf bag 10, 1010 is packaged and shipped between locations after the first stage and before the second stage. The aforementioned steps in the manufacturing method can be split in any combination between the first and second manufacturing stages. In some embodiments of the method of making the golf bag 10, 1010, one or more steps are modified or omitted to provide a self-assembly kit as opposed to a fully assembled golf bag 10, 1010. For example, as described above for the self-assembly kit 400, attaching the leg assembly can be omitted from the manufacturing process and done by the recipient. Below, the manufacturing steps are described in more detail.

Providing the base 34 and divider top 30 (step (1)), comprises molding, forming, 3-dimentional printing, casting, or otherwise manufacturing the base 34, 1034 and the divider top 30, 1030. In embodiments wherein the base 34, 1034 and/or divider top 30, 1030 comprise multiple elements, each element must be molded, formed, 3-dimentionally printed, cast or otherwise manufactured separately. In embodiments wherein the base 34, 1034 and/or divider top 30, 1030 comprise snap connectors or other fastening mechanisms, the snap connectors or other fastening mechanisms are provided and attached to the base 34, 1034 and/or divider top 30, 1030. Providing the divider top 30, 1030 can also comprise providing a mesh covering to encase at least a portion of the divider top 30, 1030, such as the cross members 78, 1078. The mesh can be sewn or secured with hook and loop fasteners (such as VELCRO®) to the divider top 30, 1030.

Providing the divider sleeve 46, 1046, stay 39, 1039, leg system 502, and flat 14, 1014 (step (1)), comprises providing fabric, mechanical fasteners, and material for the stay. Fabric is stitched together to form the divider sleeve 46, 1046. The main body of the stay 39, 1039 is molded, cast, 3-dimentionally printed, or otherwise formed. The top and base stay hinges 162 and 170, 1740 and 1744 are also molded, cast, 3-dimentionally printed, or otherwise formed. The top and base stay hinges 162 and 170, 1740 and 1744 are secured, respectively, to the top and bottom of the stay 39, 1039 via adhesion, mechanical snap mechanism, or other suitable connection means. In many embodiments, glue or epoxy is used to adhere the top and base stay hinges 162 and 170, 1740 and 1744 to the main body of the stay to form the stay 39, 1039. Providing the leg system 502 can comprise providing two legs, a spring system 501, end caps 528*a*, 528*b*, and, if necessary, pins 516. The two legs can be molded, wound, layered, cast, or otherwise formed. The end caps 528*a*, 528*b* can be molded, 3-dimentionally printed, cast, or otherwise formed. The pins 516 can be molded, cast, extruded, or otherwise formed. Providing the spring system 501 comprises molding, casting, or otherwise forming spring-to-leg brackets and attaching the brackets to the springs. In order to provide the leg system 502, the spring system 501 is attached to the legs via the spring-to-leg brackets. The components of the leg system 502 can either be provided in an assembled state, in a partially-assembled state, or as packaged individual pieces. The flat 14 is provided by sewing fabric into the desired shape, sewing pockets 18 onto the flat 14, sewing fasteners onto the flat 14, 1014, if necessary, and sewing or securing a semi-rigid material into a portion of the flat 14, 1014.

Attaching the leg mounting bracket 32 to the divider top 30 (step (2)) can comprise riveting the leg mounting bracket 32 onto the divider top 30, snap-fitting the leg mounting bracket 32 on the divider top 30, or adhering the leg mounting bracket 32 onto the divider top 30. Riveting the leg mounting bracket 32 requires aligning the bracket with the correct portion of the divider top 30. In some embodiments, four rivets are inserted to hold the bracket 32 to the top divider 30. One rivet is placed on either side of the leg anchors 122 of the leg mounting bracket 32, and two rivets are placed in between the leg anchors 122. In other embodiments of the method, any numbers of rivets can be used to secure the bracket 32 to the divider top 30. In some embodiments of the golf bag 10, the leg mounting bracket 32 is integrally formed with the divider top 30, therefore this step of connecting the leg mounting bracket 32 is not necessary.

Attaching the divider sleeve 46, 1046 to the divider top 30, 1030 (step (3)) can comprise sewing the divider sleeve 46, 1046 directly onto the divider top 30, 1030. In some embodiments, flaps 90 of the divider sleeve 46, 1046 are wrapped over cross members 78, 1078 of the divider top 30, 1030 and sewn onto the fabric of the overlapping fabric of the divider sleeve 46, 1046. In other embodiments, flaps 90 of the divider sleeve 46, 1046 are wrapped over cross members 78, 1078 of the divider top 30, 1030 in a similar manner, but the flaps 90 secure via a self-securing mechanism such as hook-and-loop fasteners (such as VELCRO®) instead of via stitching.

Attaching the divider sleeve 46, 1046 to the base 34, 1034 (step (4)) can comprise threading the connection members 50 through slots 62 in the base 34, 1034 and securing the self-fastener portions 58*a*, 58*b* of the connection members 50. In other embodiments, attaching the divider sleeve 46, 1046 to the base 34, 1034 can comprise securing connection members 50 of the base 34, 1034 to the respective connection members 50 of the of the divider sleeve 46, 1046. In yet other embodiments, the connection members 50 of the base 34, 1034 and divider sleeve 46, 1046 are snap-connected or clipped together in order to hold the divider sleeve 46, 1046 in the correct position within the golf bag 10, 1010. In other embodiments, the connection members 50 can be secured via stitching (sewing) instead of via fasteners.

Attaching the stay 39, 1039 to the base 34, 1034, the base ring portion 910, the flat 14, and/or the divider top 30, 1030 (step (5)) can comprise securing the stay 39, 1039 top hinge 162, 1740 to the divider top 30, 1030 and the stay base hinge 170, 1744 to the base 34, 1034. The top and base stay hinges 162, 1740 and 170, 1744 are adhered into channels on the divider top 30, 1030 and base 34, 1034, respectively. In other embodiments, the top and base stay hinges 162, 1740 and 170, 1744 can be snap connected into the channels on the divider top 30, 1030 and the base 34, 1034, respectively. In embodiments having a two-part base assembly with a ring portion and a base portion, the stay 39, 1039 is attached to the ring portion before the base portion is snapped onto the ring portion.

Securing the flat 14, 1014 to the divider top 30, 1030 (step (6)), can comprise riveting the flat 14, 1014 to the divider top 30, 1030, attaching the flat 14, 1014 to the divider top 30, 1030 via fasteners (such as snap-fit connectors or hook-and-loop fasteners like VELCRO®), or a combination of riveting and fastening. In some embodiments, the flat 14, 1014 is secured to the divider top 30, 1030 at least partially via structural restraints, such as windows on the flat 14, 1014 that engage channels of the leg mounting bracket 32, which is attached to the divider top 30, 1030. In some embodiments, securing the flat 14, 1014 to the divider top 30, 1030 (step (6)) can further comprise fastening (for example via snap-connectors or clips), sewing, or otherwise securing one or more straps 24 to the divider top 30.

Attaching the leg assembly (step (7)) can comprise sliding or loosely holding the leg assembly within an external loop on the flat, snapping or clipping the spring assembly into the base, aligning the leg end caps within the leg anchors of the leg mounting bracket, and inserting the pins through the leg anchors and leg end caps, until the pins lock or snap into place. In some embodiments, the end caps are multi-component end caps that comprise a first portion initially attached to the leg mounting bracket and a second portion initially attached to the legs. These first and second portions are snapped or clipped into each other to secure the legs into the leg mounting bracket. These embodiments allow the legs to be snapped directly into the leg anchors without pins.

Finishing assembly of the divider top or base (step (8)) is only necessary for embodiments having a divider top with multiple components and/or a base with multiple components. In these embodiments, the components are snap-fit, adhered, or otherwise connected to form the full divider top or base.

Securing the flat 14 to the base 34 (step (9)), can comprise riveting the flat 14 to the base 34, attaching the flat 14 to the base 34 via a mechanical fasteners (such as a snap-fit connection), or a combination of riveting and mechanical fasteners. In some embodiments, the base 34 or a portion of the base 34 is sewn onto the bag flat 14.

Packaging the golf bag for shipping comprises providing a box, inserting air pockets into the golf bag if necessary, collapsing the golf bag or sub-assembly of the golf bag, placing the golf bag or sub-assembly and all necessary components in the box, and closing and securing shut an opening of the box. Air pillows (or pockets) can be inserted into pockets of the flat to preserve the shape of the golf bag pockets. For example, in embodiments with magnetic rimmed pockets, collapsing the golf bag or sub-assembly can skew the alignment of the pocket lid with the pocket body. Placing an air pillow into a golf bag pocket can preserve the original shape and alignment of the pocket. In some embodiments, foam, sponge, paper, bubble wrap, or other suitable packaging materials can be used instead of air pillows. Collapsing the golf bag or sub-assembly can comprise folding, flattening, twisting, or otherwise compressing the golf bag or sub-assembly. The collapsible nature of the golf bag and/or sub-assembly allows the golf bag to be shipped between manufacturing stages in a lower volume box than if the golf bag was fully assembled and not collapsible. The lower volume box reduces shipping costs.

A. Method of Manufacturing Tubular Snap-Fit Top Collar

Referring to FIGS. 93A-93C, manufacturing embodiments of the golf bag having a tubular snap-fit collar 210 requires at least the following steps: (1) opening the zipper 225 of the collar 210, (2) stretching the elastic portion 222 and pulling the bag flat 214 to the desired position on the collar 210, (3) engaging the snap connectors 224 on the bag flat collar 210 with the snap connectors 234 on the divider top 230, and (4) closing the zipper 225 and tucking it into the zipper garage 227.

In order to fit the tubular bag flat collar 210 around the divider top 230, the zipper 225 must be opened to allow the bag flat collar 210 to stretch. The collar 210 of the flat 214 primarily stretches at its top edge (where the elastic portion 222 is located), which allows the collar 210 to be pulled up around the rigid top divider 230. The ability of the collar 210 to stretch also allows the assembler to easily engage the snap connectors 224 on the collar 210 of the bag flat 214 with the respective snap connectors 234 on the divider top 230. Once the collar 210 is secured to the divider top 230 via the snap connectors 224, 234, the zipper 225 is closed to further hold the bag flat 214 in place and prevent it from stretching.

Current manufacturing processes requires riveting the golf bag flat 214 to the golf bag divider top 230. This process can be time consuming and present certain safety hazards. The process of manufacturing and attaching the herein described bag flat 214 reduces the assembly time and eliminates safety hazards related to riveting. Furthermore, it reduces the likelihood of manufacturing errors, because a misplaced rivet is permanent, whereas the snap connectors are aligned correctly prior to the assembly process and cannot be misplaced during assembly. Overall, the PPH of the manufacturing process can be increased by implementing the snap-fit fastener collar 210 and divider top 230.

B. Method of Manufacturing Snap-Fit Assembly

FIGS. 47-53 illustrate a method of snap-fit assembly of an embodiment of the golf bag 10. The embodiment illustrated in FIGS. 47-53 is a cart golf bag, however the method is the same for assembling a carry bag or stand bag unless otherwise noted. It should also be appreciated that FIGS. 47-53 illustrate a sub-assembly 52, which may be the same as sub-assembly 42. The sub-assembly 1052 includes a divider top 37, a base 44, and a divider sleeve 88. The divider top 37 may be the same as the divider top 30, 1030, 30*b*, 830*a*, 830*b* the base 44 may be the same as the base 34, 900 and the divider sleeve 88 may be the same as the divider sleeve 46.

Figure 47:
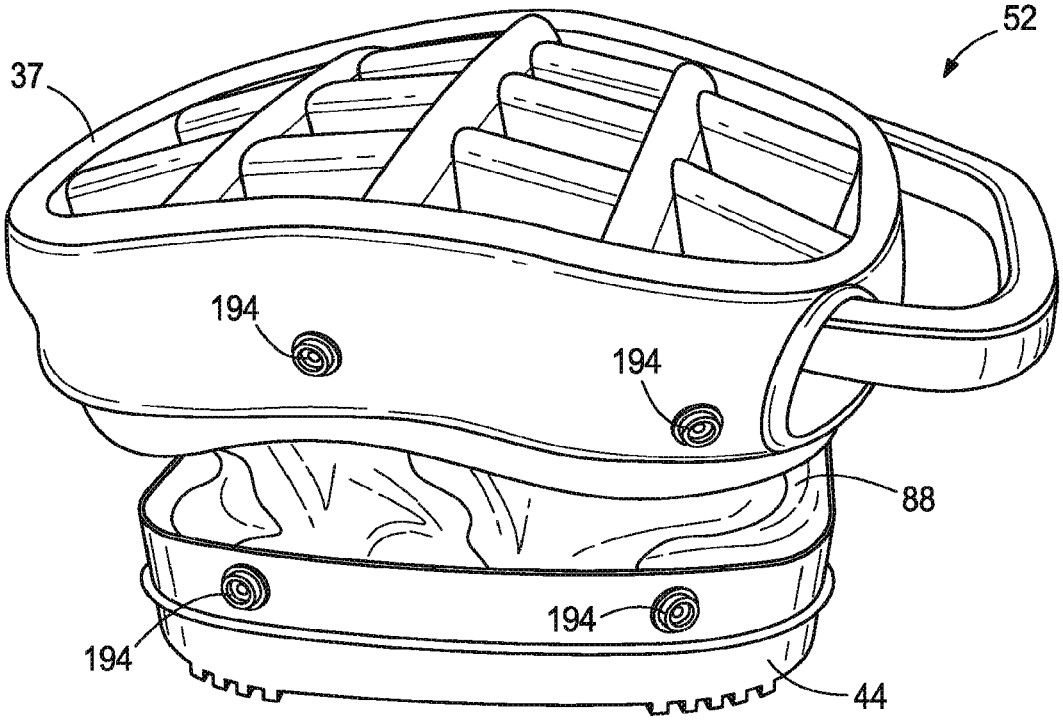
FIG. 47 is a perspective view of an embodiment of a sub-assembly for a golf bag in a collapsed configuration.

Referring to FIG. 47, the sub-assembly 1052 is provided in a collapsed configuration, which is the configuration the sub-assembly 1052 is in when shipped for assembly. In the illustrated collapsed configuration, the divider top 37 and the base 44 are interconnected by the divider sleeve 88, with the divider top 37 and base 44 being offset and in an approximate parallel orientation to each other. Both the divider top 37 and the base 44 have a plurality of snap-fit connectors 194 that connect to the snap-fit connectors 190 on the flat 14. In other embodiments of the sub-assembly 52, such as the sub-assembly 42 illustrated in FIG. 3 for a stand golf bag 10, the collapsed configuration has the divider top 30 and the base 34 interconnected by the stay 39, with the divider top 30 and the base 34 offset from and approximately parallel to the stay 39.

Figure 48:
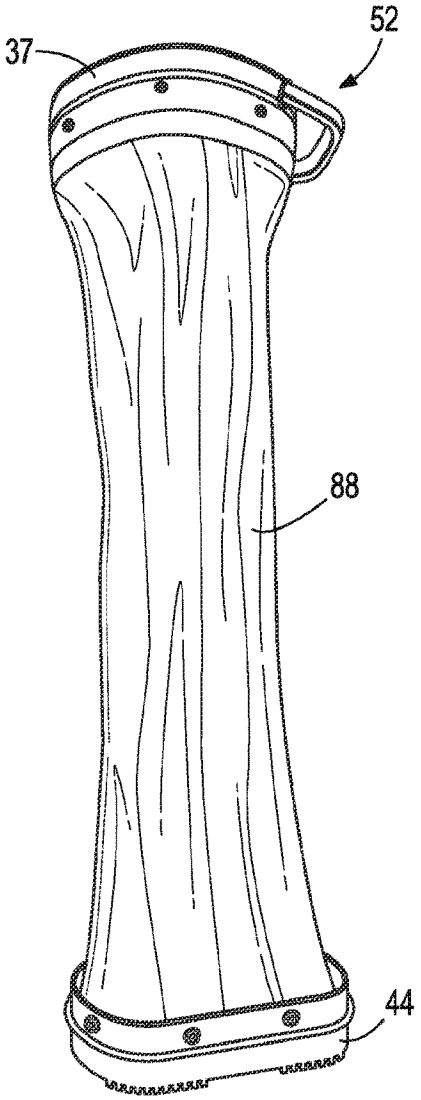
FIG. 48 is a perspective view of the sub-assembly of FIG. 47 in an extended configuration.

Next, as illustrated in FIG. 48, the sub-assembly 1052 is extended or otherwise transitioned to an extended configuration. In the illustrated extended configuration, the divider top 37 is drawn in a direction opposite the base 44, extending the divider sleeve 88. In the extended configuration, the sub-assembly 1052 is prepared for snap-fit attachment with the flat 14. In some constructions, one or more stays 39 may be inserted into the sub-assembly 1052 of the flat 14 to provide additional rigidity and support for the golf bag 10. In other embodiments of the sub-assembly 52, such as the sub-assembly 42 illustrated in FIG. 3 for a stand golf bag 10, the sub-assembly 42 is transitioned to the extended position by pivoting the divider top 30 and the base 34 about the respective stay hinge 162, 170 such that both the divider top 30 and the base 34 are approximately perpendicular or orthogonal to the stay 39 (as shown in FIG. 22). The stand bag sub-assembly 42 has additional assembly steps before snap-fit installation of the flat 14. The leg mounting bracket 32 is attached to the divider top 30 by snap-fit connection (as illustrated in FIGS. 2 and 13-15 and previously described). The spring 41 is also installed into the base 34 (see FIG. 2), and the divider sleeve 46 is attached to the divider top 30 and the base 34 (see FIGS. 2-10). The additional assembly steps for the stand bag sub-assembly 42 are provided for purposes of illustration, and are not limited to the order in which each step is disclosed.

Figure 49:
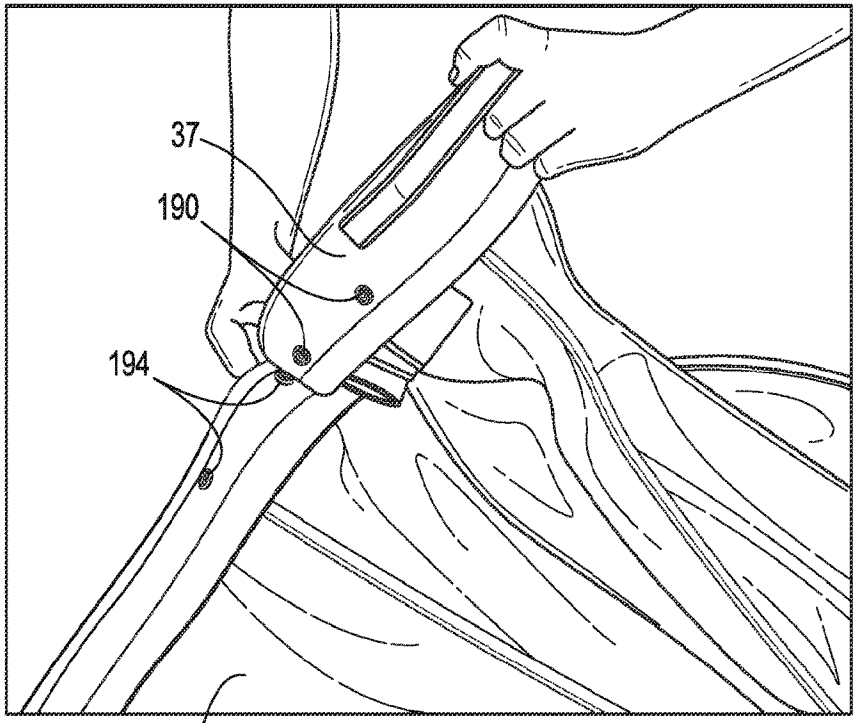
FIG. 49 is a perspective view of the sub-assembly of FIG. 47, illustrating an end of the flat being placed in snap-fit connection with the divider top.

Next, as shown in FIG. 49, the flat 14 is snap-fit connected to the divider top 37. The flat 14 is positioned into a desired or necessary orientation with the sub-assembly 1052 (such as proper positioning of the straps 24 in relation to the divider top 37 and base 44). Each of the plurality of snap-fit connectors 190 on the flat 14 is then placed into snap-fit engagement with a respective one of the plurality of snap-fit connectors 194 on the divider top 37. In the illustrated embodiment, each male or female snap-fit button 190 engages an associated female or male snap-fit button 194. The flat 14 wraps around the outer perimeter of the divider top 37 as the snap-fit connectors 190, 194 are placed in snap-fit engagement.

In some embodiments of the sub-assembly 52, such as the sub-assembly 42 illustrated in FIG. 2 for the stand golf bag 10 of FIG. 1, the leg anchors 122 of the leg mounting bracket 32 are positioned to extend through openings (not shown) in the flat 14 to expose the leg anchors 122 to the exterior side of the flat 14.

Figure 50:
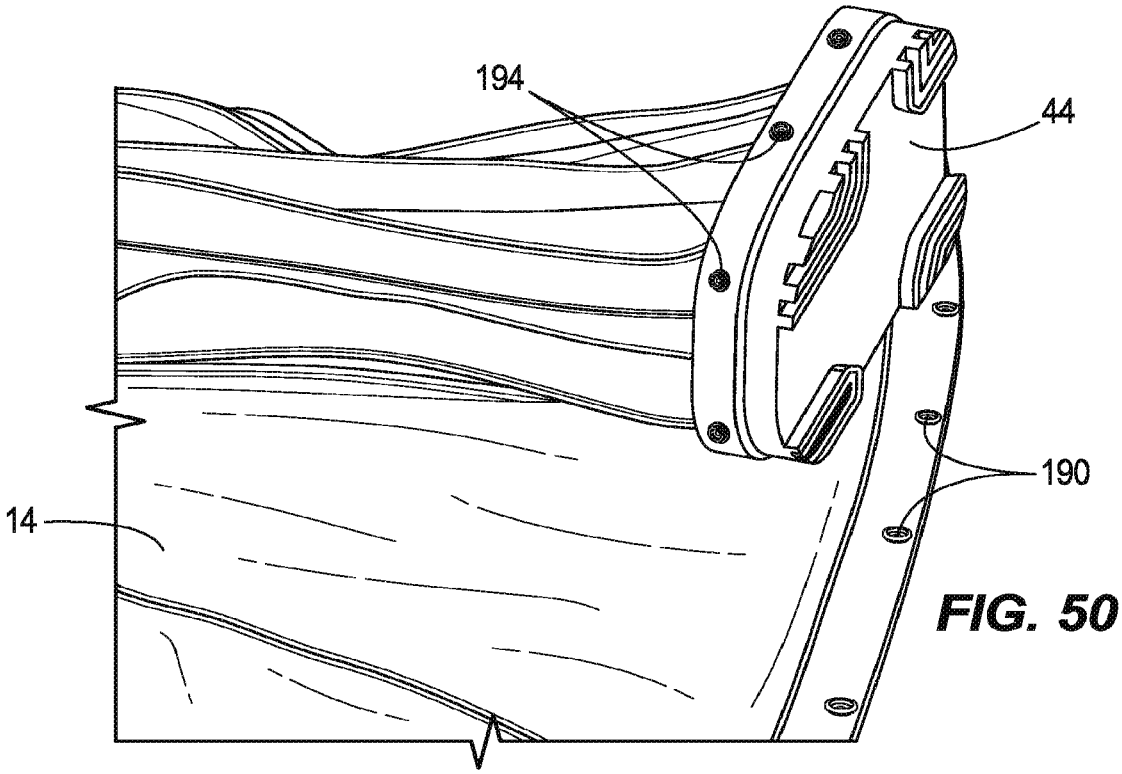
FIG. 50 is a perspective view of the sub-assembly of FIG. 47, illustrating an end of the flat being placed in snap-fit connection with the base.
Figure 51:
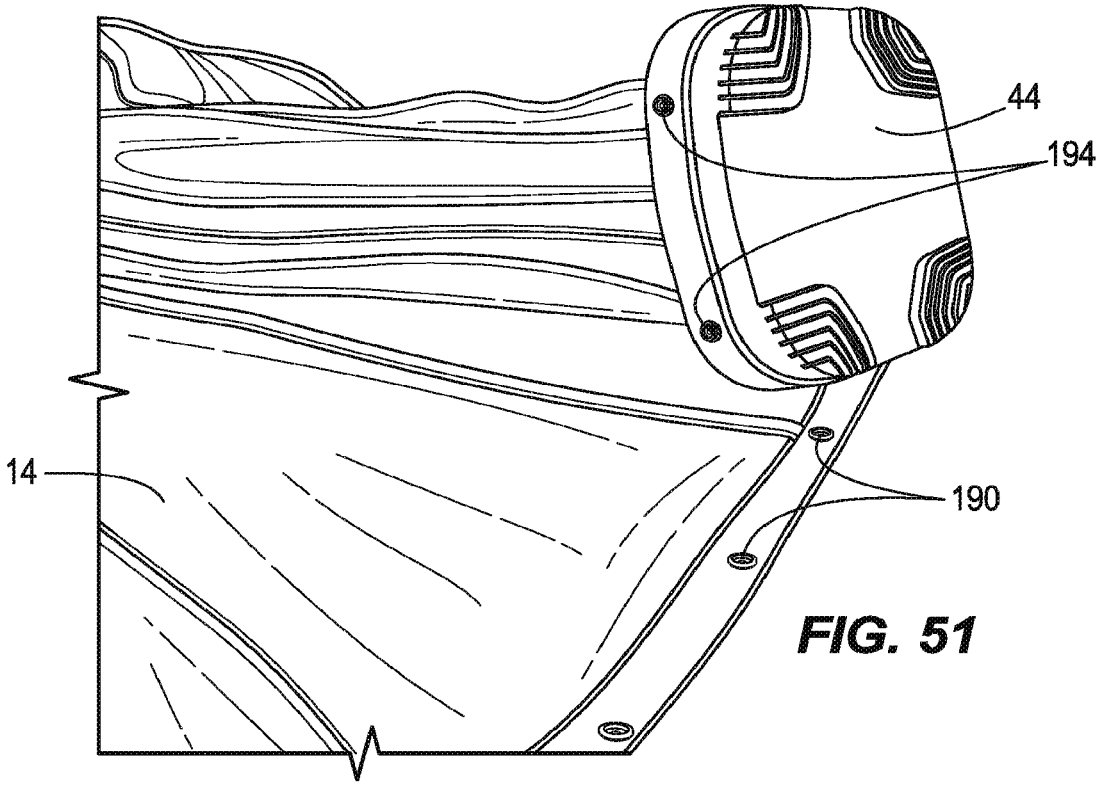
FIG. 51 is a perspective view of the sub-assembly of FIG. 47, illustrating an end of the flat being placed in snap-fit connection with the base and additional snap-fit connections.

As shown in FIGS. 50-51, the flat 14 is then snap-fit connected to the base 44, i.e., each of the plurality of snap-fit connectors 190 on the flat 14 is placed into snap-fit engagement with a respective one of the plurality of snap-fit connectors 194 on the base 44. In the illustrated embodiment, each male or female snap-fit button 190 engages an associated female or male snap-fit button 194. The flat 14 wraps around the outer perimeter of the base 44 as the snap-fit connectors 190, 194 are placed in snap-fit engagement.

Figure 52:
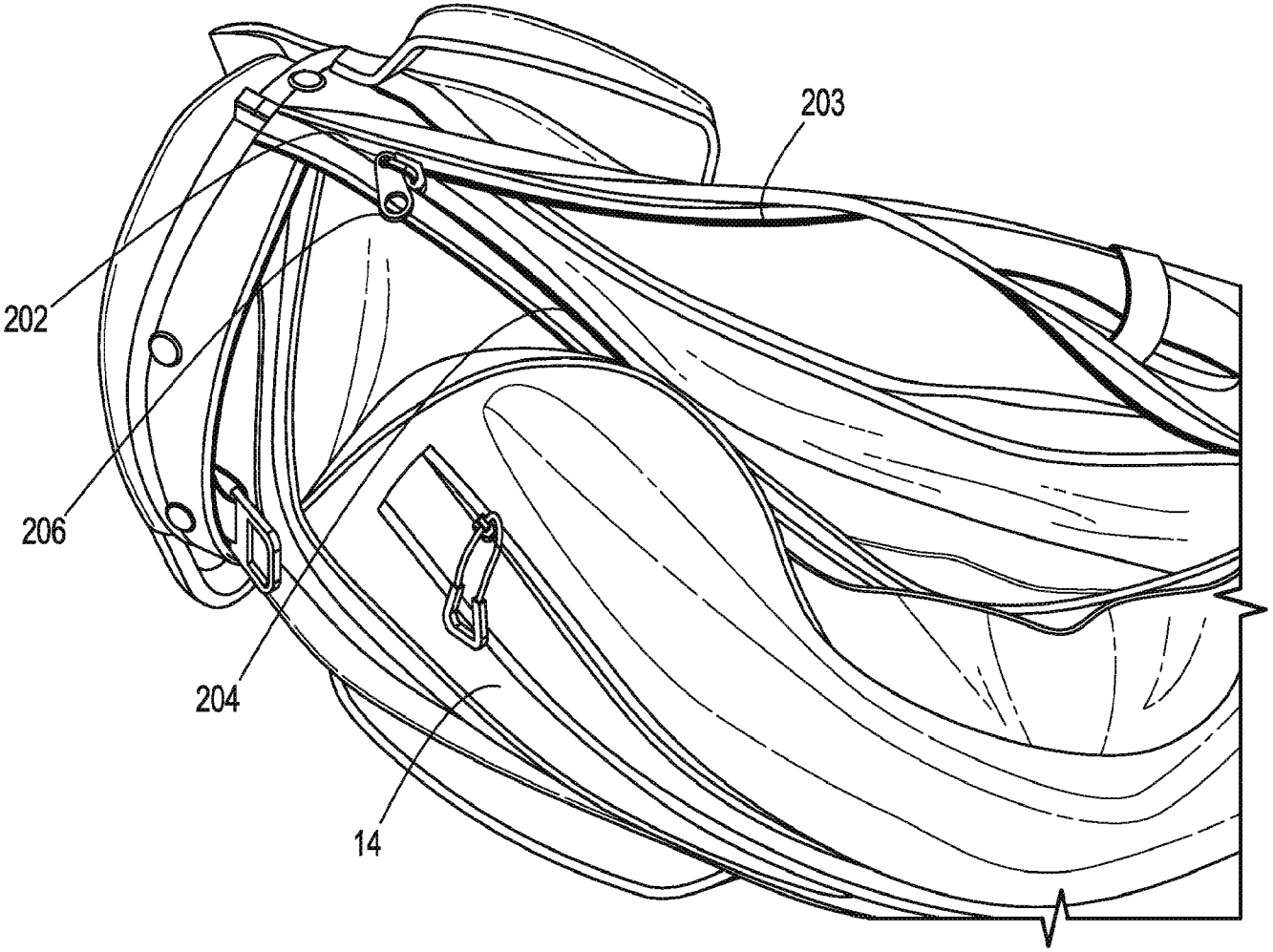
FIG. 52 is a perspective view of the sub-assembly of FIG. 47, illustrating the flat in snap-fit connection with both the divider top and the base, and a seam of the flat being sealed.

Once the flat 14 is placed in snap-fit connection with the divider top 37 and the base 44, the seam 202 of the flat 14 is sealed to complete the snap-fit connection. As shown in FIG. 52, the seam 202 is sealed by closure of a connecting member 206 along the seam edges 203, 204. The connecting member 206 is illustrated as a single zipper 206, however in other embodiments the connecting member 206 may be two zippers, a hook and loop fastener (VELCRO®), mounting tracks with a tongue that fits within associated rails, snap fit buttons, or any other suitable snap-fit fastener or securing assembly, as previously described. As discussed above, the pockets 18 may also be removed and/or adjusted by any previously described snap-fit fastener to allow for custom configuration or reconfiguration of different pocket 18 sizes, number, or locations on the flat 14. In other embodiments of the sub-assembly 52, such as the sub-assembly 42 illustrated in FIG. 2 for the stand golf bag 10 of FIG. 1, the legs 40 are attached by snap-fit and pivotal connection of each end cap 146 with the respective leg anchor 122 of the leg mounting bracket 32. Once the legs 39 are attached, the spring 41 is respectively coupled to each leg 40*a, b* (see FIG. 2).

Figure 53:
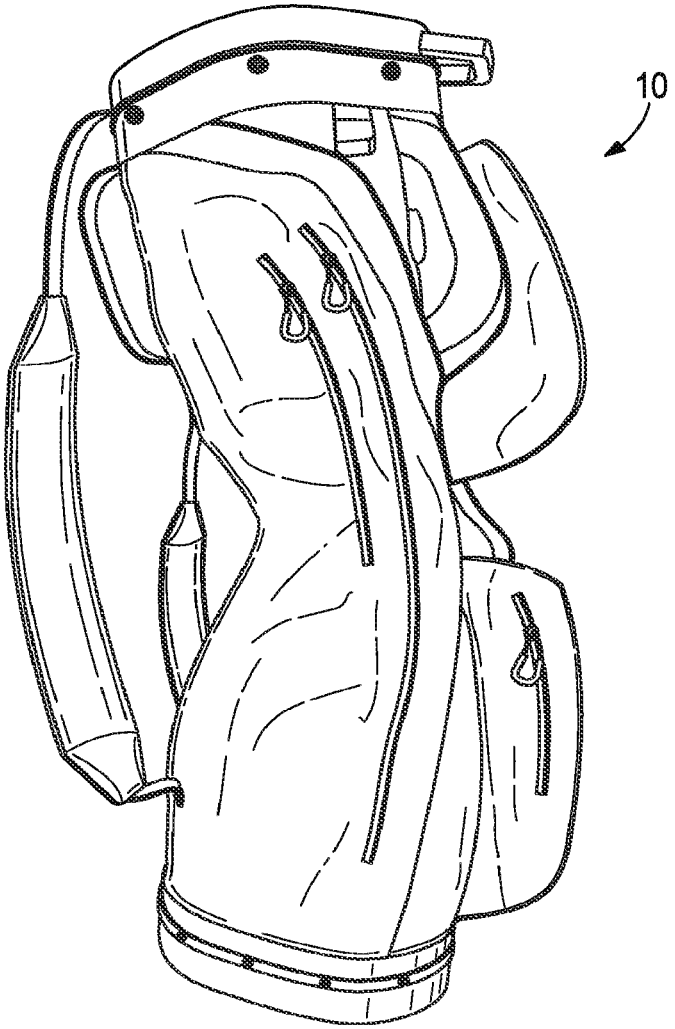
FIG. 53 is a perspective view of the assembled snap-fit golf bag.

After installation of all sub-assembly 1052 components, attachment of the flat 14 to the sub-assembly 52, and sealing of the flat 14 seam 202, the golf bag 10 is assembled (shown in FIG. 53).

C. Method of Manufacturing Golf Bag with Modular Divider Assembly

Traditional methods of assembling a golf bag require first attaching a single divider top element to a bag flat via a plurality of connection members, such as rivets. Since the divider top is attached to the assembly early on in the manufacturing process, the divider top cannot be easily customized at the end of the production process. Therefore, predictions must be made about customer demand of various divider embodiments before the product is produced. This can lead to incorrect production quantity and a lack of flexibility regarding the final product.

By separating the bag divider for a golf bag into two components, which together form a modular divider assembly, the manufacturing of the golf bag is simplified and the customer can easily be supplied with a customized divider. As seen in FIGS. 94A-100, various embodiments of the cross-member portion 850 of the modular divider assembly 830 can be used with the same molded top ring 840. When the golf bag 10 is assembled, the top ring 840 is attached to the golf bag flat 14. The wall of the top ring 840 corresponds to the shape of a main body of the golf bag 10 and extends vertically downward into the flat 14 of the golf bag 10 when assembled. Next, the fabric divider sleeve 46 is attached to the cross-member portion 850. The fabric divider is threaded down through the top ring 840, and the cross-member portion 850 is inserted and fastened into the top ring 840. In some embodiments, the cross-member portion 850 is snapped into the top ring 840. In other embodiments, the cross-member portion 850 is adhered to the top ring 840 using an adhesive, such as glue or epoxy. Finally, the lower end of the divider sleeve 46 is fastened to the base of the golf bag 10. Since the insertion of the cross-member portion 850 into the top ring 840 is one of the last assembly steps for this embodiment of a golf bag, the process of providing a customer with a unique divider is easily incorporated into the golf bag manufacturing process.

D. Method of Manufacturing Golf Bag with Two-Piece Base Assembly

Manufacturing a golf bag 10, 1010 having a two-piece base assembly 900 requires, at least a first and second manufacturing stages. The first stage comprises providing a bag flat, one or more stays 39, a divider top 30, a divider sleeve 46, the base assembly 900, and any other necessary components for the golf bag 10, 1010. During one part of the first stage, the bag flat is engaged with the top end 911 of the ring portion 910. The base assembly 900 provides access to the interior of the flat via the opening in the bottom of the ring portion 910. This allows for easy insertion of the one or more stays, as opposed to coupling the one or more stays to the base by entering through a top portion of the golf bag 10, 1010. The ring portion 910 can be coupled to the flat 14 via stitches, pins, buttons, clamps, zippers or any other suitable mechanisms. The divider sleeve 46 is connected to the divider top 30, 1030 and the base portion 920. The open configuration of the base assembly 900 at this stage allows easy access to both the divider sleeve 46 and the base portion 920, which speeds up and simplifies manufacturing. In golf bags without a two-piece base assembly, attaching the divider sleeve 46 to the base 34, 1034 requires reaching through the top of the golf bag 10, 1010, which is awkward and slow. The base portion 920 of the base assembly 900 is disconnected from the ring portion 910 of the base assembly 900 at the end of the first stage.

The second manufacturing stage comprises, in part, connecting the one or more stays 39 to the ring portion 910 and attaching the base portion 920 to the ring portion 910. To assemble the base assembly 900, the slots 973 of the base portion 920 are aligned with the snap tabs 930 of the ring portion 910, and the base portion 920 is then pressed up into the ring portion 910. The bottom end 912 of the ring portion 910 will fit inside (or next to, in some embodiments) the vertical lip 972 of the base portion 920. The slots 973 will receive the protruded surfaces 932 of the ring portion 910 snap tabs 930.

For the cart bag embodiment, such as is illustrated in FIGS. 91 and 92, when the base portion 920 is attached to the ring portion 910, the plurality of stay ports 940 of the ring portion 910 will fit inside the plurality of port housings 942 of the base portion 920. The base assembly 900 in its assembled position is illustrated in FIG. 2. The two-piece base assembly 900 allows for a more efficient assembly of the golf bag 10, 1010 as compared to a system having a one piece base 34, 1034.

V. Methods of Assembly

A. Sub-Assembly Method

Presented below is a method of assembling a golf bag comprising sub-assembly 42 (which comprises the divider top 30, the divider sleeve 46, and the base 34). The method of assembling the sub-assembly 42 includes providing the base 34, and coupling the divider sleeve 46 to the base 34 by the plurality of connection members 50. The plurality of connection members 50 connected to the divider sleeve 46 are received in their respective slot 62 in the base 34. Each connection member 50 wraps around a portion of the base 34, forming a self-fastening engagement by connecting the first portion 66 of the connection member 50 to the second portion 70 of the connection member 50. The divider sleeve 46 is then coupled to the divider top 30 at an end of the divider sleeve 46 opposite the connection members 50. The divider sleeve 46 includes a plurality of flaps 90 that wrap around a portion of the divider top 30 and form a self-fastening engagement by connection of the first self-fastening portion 98 to the second self-fastening portion 102.

The assembly process further includes assembling the stand assembly 26. The stand assembly 26 comprises a leg mounting bracket, two legs, a spring, a bracket to connect the legs and the spring, and any other necessary connection members such as hinges or pins. A first and second spring member 41*a*, 41*b*, are coupled to the first and second legs 40*a*, 40*b* via brackets, such as bracket 600. The legs 40*a*, 40*b* are inserted through the respective leg receiving channels 604 of each bracket 600. The legs can be secured into the leg receiving channel 604 via adhesive, a press-fit mechanism, any other suitable means of securing. A portion of each spring member 41*a*, 41*b* is then inserted through each spring receiving channel 608 of each bracket 600. In some embodiments, the spring members 41*a*, 41*b* are held into the spring receiving channels 608 in part by the spring's mechanical resistance to lateral stretching of the spring members 41*a*, 41*b*. For example, the spring members 41*a*, 41*b* are stretched apart to allow an end portion of each spring member 41*a*, 41*b* to be inserted in an inward direction through the spring receiving channels 608, as seen in FIGS. 3 and 7. In some embodiments, a rubber stopper (not shown) is adhered to the end of each spring member 41*a*, 41*b* after each spring member is inserted through each spring receiving channel 608.

The stand assembly 26 can be manufactured with any of the leg brackets and/or leg connection systems described above. For example, the stand assembly 26 can be provided as a leg self-assembly system 502 with legs 40*a*, 40*b* that connect to a leg mounting bracket 32 via pins 516. The stand assembly 26 is complete when the legs 41*a*, 41*b* are connected to a leg mounting bracket.

After completion of the sub-assembly 42 and stand assembly 26, a stay is assembled. The stay 39 is assembled by providing and connecting a top stay hinge 162 and a base stay hinge 170 to a main shaft of the stay 39. The top end of the stay shaft is inserted into a second arm 164 of the top stay hinge 162, and the stay shaft is adhered into the top stay hinge 162. The bottom end of the stay shaft is inserted into a second arm 172 of the base stay hinge 170, and the stay shaft is adhered into the base stay hinge 170.

Once the sub-assembly 42 and the stand assembly 26 is manufactured, the golf bag 10 may be manufactured or assembled utilizing the sub-assembly 42. The sub-assembly 42 is inserted into the tubular flat 14, base 34 end first. Once inserted, the sub-assembly 42 base 34 is fastened to the flat 14 by rivets around the perimeter of the base 34. The stay 39 is inserted through a slit (not shown) in the flat 14 where it is inserted at a first end to the divider top 30 and at a second, opposite end to the base 34. The stay 39 may be received in respective stay receiving slots provided in the divider top 30 and base 34. Next, the sub-assembly 42 divider top 30 is fastened to the flat 14 by riveting around the perimeter of the divider top 30. Although the divider top 30 can be fastened to the flat 14 before insertion of the stay 39, it is preferable to insert the stay 39 first to provide rigidity to the bag and assist with alignment of the divider top 30 and the flat 14. Next, the stand assembly 26 is inserted through a portion of the flat 14, where a portion of the stand assembly 26 that includes a pivot for legs 40*a, b* (otherwise known as the leg mounting bracket 32) is coupled to the divider top 30, for example by rivets or other suitable connection members. The stay 39 is connected to the base 34 by inserting a first arm 171 of the base stay hinge 170 into a channel 174 in the base 34 for receiving the base stay hinge 170. In the completed golf bag, a biasing portion 173 of the stay hinge 170 opens towards the center of the golf bag so as to allow the stay 39 to bend towards the stand assembly 26, which is located on the opposite side of the bag from the base-to-stay connection. Finally, the spring 41 connected to each leg 40*a, b* is then connected to the base 34, for example by being inserted into a spring receiving slot in the base 34.

The sub-assembly 42, the flat 14, and the stand assembly 26 can be collapsed for space-efficient shipping, which allows this embodiment of the assembly process to be cost-effectively performed in two different locations and in two stages: (1) providing the sub-assembly 42, flat 14, and stand assembly 26 at the first location, and (2) connecting the sub-assembly 42, flat 14, and stand assembly 26 at the second location.

B. Divider Top Method of Assembly

Presented below is a method of assembling a golf bag similar to the method above, except that the sub-assembly comprises just the divider top and the divider sleeve. Initially, the sub-assembly is formed, the base is connected to the flat, the stay is provided, and the stand assembly is provided. The divider sleeve of the sub-assembly is connected to the divider top via self-fastening connection members or sewn-on connection members. The divider sleeve of the sub-assembly further comprises elastic members sewn onto a bottom end of the divider sleeve. The base is then riveted or sewn to the flat. The stay and the stand assembly are provided similar to the stay and the stand assembly of the example described above.

After these steps, the sub-assembly, the flat and base, and the stand assembly can be shipped in a collapsed configuration to a second location. At the second location, (1) the sub-assembly is inserted into and connected to the flat, (2) the stay is connected to the divider top and base, and (3) the stand assembly is attached to the bag.

The sub-assembly 42 is inserted down, divider sleeve 46 first, into the flat 14. When the sub-assembly 42 is connected to the base 30 and flat 14, elastic members of the divider sleeve 46 are sewn onto a section of the bag flat 14 adjacent the bottom end of the flat 14. The elastic straps allow the sleeve to be secured to the bottom end of the flat 14 without the sleeve 46 material extending into the bottom of the golf bag 10 where it could bunch up when the bag is set down with the legs in an extended configuration. By sewing the divider sleeve 46 to the bag flat 14 via the elastic straps, the step of inserting fasteners (or elastic bands) through slots in the base 30 is eliminated.

In embodiments having one or more shoulder straps 24, the one or more straps 24 are threaded through apertures in the flat 14 and clipped or sewn to sub-assembly 42. The flat 14 is connected to the divider top 30 of the sub-assembly 42 by self-fastening members that fold over edges of the divider top 30 and down into openings of the divider top 30. Next, the stay 39 is inserted down into the flat 14. The top stay hinge 162 of the stay 39 is glued or snap-fit into the divider top 30. The base stay hinge 170 is glued or snap-fit into the base 34.

The stand assembly 42 is connected to the golf bag 10 at the divider top 30 by the leg bracket 32 of the stand assembly 42 and at the base 34 by the spring 41 of the stand assembly. The leg bracket 32 of the stand assembly 42 is riveted onto the divider top 30. In some embodiments, material of the flat 14 is interposed between the leg bracket 32 and the divider top 30. After the leg bracket 32 is riveted onto the divider top 30, a hook-like connector 508 at a bottom end of the spring 41 is snap-fit or clipped into the base 34. Finally, the assembled bag 10 is packaged and shipped, as described above.

C. Assembly at Point of Contact

Presented below is a method of assembling a golf bag comprising two manufacturing stages. The first stage comprises, in part, providing a sub-assembly 42 having a divider top 30, a divider sleeve 46, and a leg mounting bracket 32*a*. Making the sub-assembly 42 includes (1) providing the divider top, (2) coupling the divider sleeve 46 to the divider top by sewing or using self-fastening connection members, and (3) riveting the leg mounting bracket to the divider top. During the first stage, a bag flat, a stand assembly, a stay, and a two-piece snap-together base 900 having a ring portion 910 and a base portion 920 are manufactured as described above. The bag flat was engaged with the top end 911 of the ring portion 910. The base assembly 900 provides access to the interior of the flat via the opening in the bottom of the ring portion 910. The ring portion 910 can be coupled to the flat via stitches, pins, buttons, clamps, zippers or any other suitable mechanisms. The divider sleeve is connected to the top collar and the base portion 920. The open configuration of the base assembly 900 at this stage allows easy access to both the divider sleeve and the base portion 920, which speeds up and simplifies manufacturing. In golf bags without a two-piece base assembly, attaching the divider sleeve to the base requires reaching through the top of the golf bag, which is awkward and slow. The base portion 920 of the base assembly 900 is disconnected from the ring portion 910 of the base assembly 900 at the end of the first stage.

Providing the stand assembly requires providing a spring with a first and second spring member, two legs, two leg end caps, two pins, two leg-receiving brackets, and optionally, an alignment aid. During the first manufacturing stage, the two legs are inserted through the leg-receiving brackets, and the first and second spring members of the spring are attached to the respective brackets. The leg end caps are press fit or adhered to the top of the legs. In embodiments with an alignment aid, the alignment aid is placed between upper sections of the legs to temporarily hold the legs apart. The pins are provided as part of the stand assembly package, but remain disconnected at this stage. Also, during a first manufacturing stage, the ring portion of the base is sewn or otherwise secured to the bag flat. At the end of the first manufacturing stage, the divider sleeve 46, the divider top, and the leg mounting bracket form a sub-assembly, and the ring portion of the base is integral with the bag flat.

At the beginning of a second manufacturing or assembly stage, the sub-assembly is inserted, sleeve end first, down into the bag flat. In embodiments having shoulder straps, the shoulder straps are threaded through apertures in the flat and attached to the sub-assembly via fasteners, such as snap-connectors. Next, divider sleeve connection members having snap fasteners or clips are secured to corresponding connection members, which are attached at the bottom of the flat near the ring portion of the base. The spring of the stand assembly is inserted through a loop of the flat and snapped into a receiving channel on an internal wall of the base ring. In some embodiments designed for self-assembly, the spring of the stand assembly is inserted through the loop of the flat, but not snapped into a receiving channel, allowing the bag to be shipped to the consumer in a volume-efficient collapsed configuration. The leg end caps are aligned with the leg mounting bracket and the pins of the stand assembly are inserted through the leg mounting bracket and the leg end caps to rotatably connect the legs to the sub-assembly of the golf bag. The pins snap into place for easy assembly. In self-assembly embodiments, as mentioned above, the step of aligning the legs and connecting them to the mounting bracket via the pins is eliminated from the second manufacturing stage and left for the consumer to do upon receipt of the product.

A top end of the flat comprises self-fastening connection members, and the second manufacturing stage further comprises wrapping these connection members over the edges of the divider top. This process secures the flat to the divider top. Next, the stay is inserted into the flat 14, where it is snap-fit at a first end to the divider top 30 and at a second, opposite end to the base 34. Connecting the stay 39 to the divider top 30 and the base 34 is done in a manner similar to that described for the sub-assembly method above. Finally, the base portion of the base is snapped onto the ring portion to complete the bag. Waiting to snap on the base portion until the end of the manufacturing process provides easy access to the inside of the tubular flat during the majority of the process. This can increase the speed and ease of assembly. For example, the opening of the base ring allows the assembler to quickly reach a bottom end of the stay to insert it into the base ring.

As mentioned above, this example manufacturing process can be modified to produce a self-assembly golf bag. The self-assembly golf bag is shipped to the consumer in a collapsed configuration in order to reduce shipping costs. Instructions are included to instruct the consumer on how to attach the stand assembly to the golf bag in order to complete the golf bag.

D. Modular Divider Top Assembly

Described below is an embodiment of the method of assembling a golf bag is similar to the method of assembly at the point of contact, above, except that the golf bag has several structural differences: (1) the divider top comprises a modular divider assembly 830 having a top ring 840 and a cross member portion 850, and (2) the divider top and the leg mounting bracket are integrally molded. These structural differences alter the assembly method.

The method of assembly the golf bag comprises two manufacturing stages. The first stage comprises, in part, providing a sub-assembly. Making the sub-assembly includes (1) molding the top ring 840 of the modular divider assembly 830 including the integral leg mounting bracket, (2) separately molding the cross member portion 850, and (3) coupling the divider sleeve 46 to the top ring 840 of the modular divider assembly 830. Integrally molding the leg mounting bracket with the top ring 840 of the divider assembly 830 eliminates the manufacturing step of riveting the leg mounting bracket to the top ring 840, reducing production time. Also, integrally molding the top ring 840 and leg mounting bracket from one material allows the entire molded piece to be formed from a lightweight material. The first stage further includes providing a bag flat, a stay, a two-piece snap-together base assembly 900 comprising a ring portion 910 and a base portion 920, and a stand assembly. The bag flat is attached to the ring portion 910 in a manner similar to the method of assembly at the point of contact, described above. The stand assembly is constructed in a manner also similar to the method of assembly at the point of contact, described above.

The second manufacturing stage is similar to the second manufacturing stage of the method of assembly at the point of contact, described above. In addition, at the end of the second manufacturing stage, the cross member portion 850 of the modular divider assembly 830 is inserted into the top ring 840 of the modular divider assembly 830. In some embodiments of this example method, a final step of the process comprises placing a cross member cover 878 over the cross member portion 850.

E. Integrally Molded Leg Mounting Bracket

Described below is another method of assembly of a golf bag, which is similar to the assembly at the point of contact embodiment of the method, except that the leg mounting bracket is integrally molded with the divider top. The integral molding of the leg mounting bracket and the divider top eliminates the step of riveting on the leg mounting bracket, reducing time and reducing the tools needed for assembly.

F. Method of Self-Assembling from a Golf Bag Kit

Figure 76:
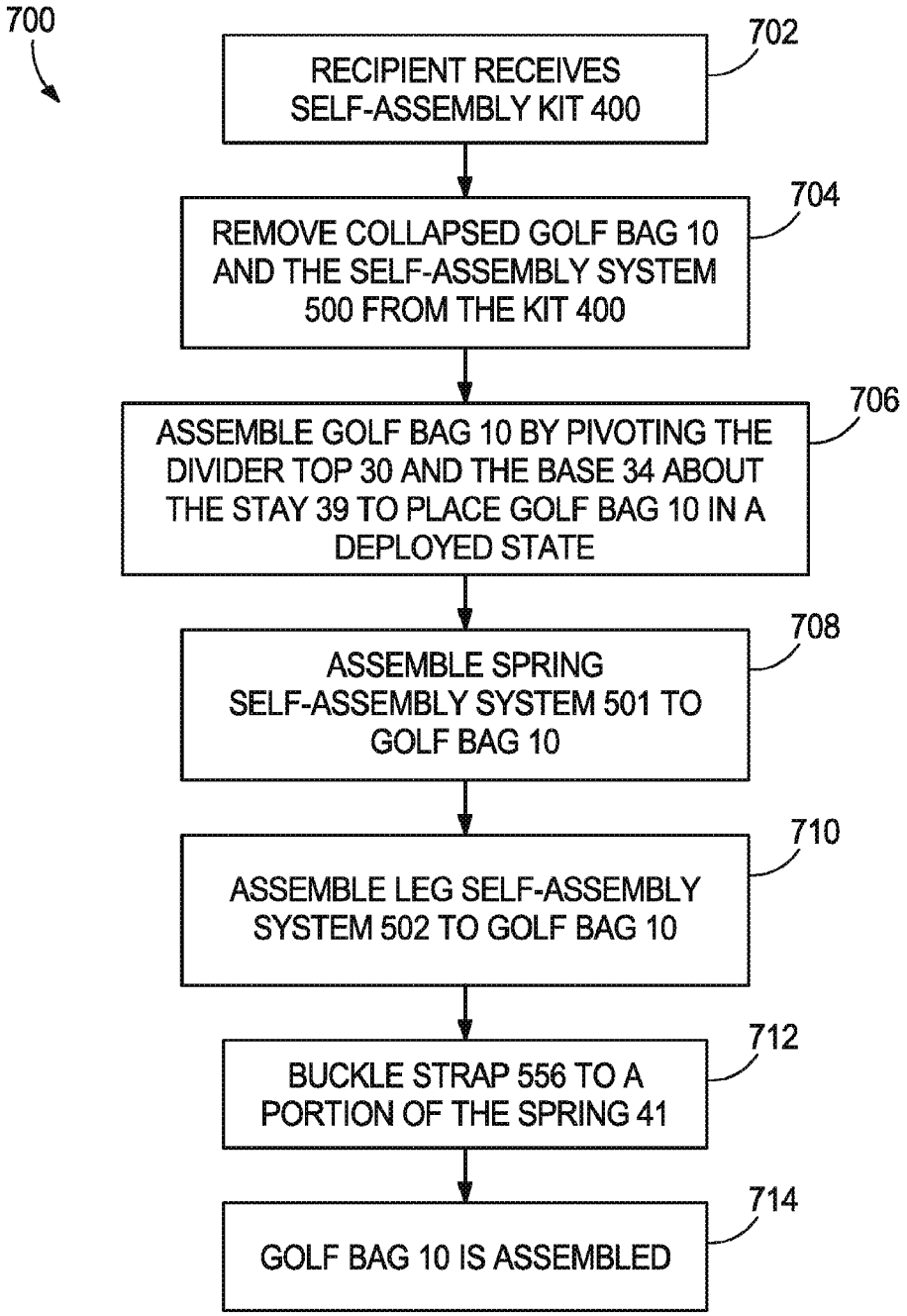
FIG. 76 is a schematic diagram of a method of assembling the collapsed, partially assembled golf bag of FIG. 57.

FIG. 76 illustrates an example of a method of self-assembling a golf bag 700 by the self-assembly system 500. The method includes a series of assembly steps that are executed by a recipient, the steps being depicted in flow diagram form. It should be appreciated that the method steps are provided as an example, and the method 700 may include fewer than all of the disclosed steps. The method 700 begins at step 702, where the recipient receives the self-assembly kit 400. The self-assembly kit 400 includes the collapsible golf bag 10 and the self-assembly system 500. The self-assembly kit 400 can be delivered to the recipient by the box 404.

Next, at step 704, the recipient removes the golf bag 10 (in its collapsed form) and the self-assembly system 500 from the self-assembly kit 400. For example, the recipient removes the golf bag 10 out of the box 404. The recipient can also orient the indicia 420 (or instructions for assembling) in a readable orientation.

At step 706, the recipient pivots the divider top 30 about the stay 39 (by the top stay hinge 162), and the base 34 about the stay 39 (by the base stay hinge 170). This converts the golf bag 10 from the collapsed state to a deployed state.

At step 708, the recipient assembles the spring self-assembly system 501 to the golf bag 10. More specifically, the recipient connects the spring connector 504 to the base 34 (e.g., by positioning the base engaging hook 508 within the aperture 520 and concurrently having the channel defined by the hook 508 receive the member 524).

Next at step 710, the recipient assembles the leg self-assembly system 502 to the golf bag 10.

For example, in the embodiment illustrated in FIGS. 61-66, the recipient removes each pin 516 from the respective end cap 528*a, b* (or alignment aid 512*a*). The recipient then aligns each end cap 528*a, b* with the respective mounting channels 552*a, b* of the mounting bracket 32. This alignment is facilitated (or streamlined) by the alignment aid 512, 512*a*. Once aligned, the recipient inserts each pin 516 through the opposing apertures (not shown) on the sides of the channel 552*a, b* and the pin aperture 532 through the end cap 528*a, b*. The recipient then removes the alignment aid 512, 512*a* from the legs 40*a, b*.

Alternatively, in the embodiment illustrated in FIGS. 68-72, the recipient connects the second piece 572 of the multi-component end cap 564 (which is attached to each leg 40*a, b*) to the respective first piece 568 (which is attached to the mounting bracket 32 in the respective mounting channels 552*a, b*). The first and second pieces 568, 572 snap fit together by the snap fit assembly 584 to connect the legs 40*a, b* to the mounting bracket 32.

At step 712, the recipient buckles the strap 556 about a portion of the spring 41 to constrain the legs 40*a, b* by the spring 41. At step 714, the process in complete and the recipient has assembled the golf bag 10.

A method of manufacturing the collapsible golf bag 10 includes inserting the sub-assembly 42 into the flat 14, base 34 end first. Once inserted, the sub-assembly 42 is fastened to the flat 14. The stay 39 is inserted through a slit (not shown) in the flat 14 where it is inserted at a first end to the divider top 30 and at a second, opposite end to the base 34. The divider top 30 and the base 34 are then pivoted about the stay 39 into a collapsed configuration. The golf bag 10, in this collapsed configuration, is then placed in the shipping box 404, along with a portion of the stand assembly 26 for user self-assembly. Instructions for self-assembly are included in the shipping box, and more specifically are printed on the shipping box.

The golf bag 10 incorporating the snap-fit components disclosed herein provides advantages over golf bags that are known in the art. Among them, utilizing the snap-fit components provides manufacturers with less machinery and equipment overhead for golf bag assembly. Further, shipping volume of the snap-fit components is reduced by approximately 30% to 50%, providing for more efficient use of package volume during shipping and limiting excess shipping costs due to oversized or bulky components. In addition, the snap-fit components can be assembled by a manufacturer at an assembly facility, or alternatively the components can be direct shipped to an end user for assembly. Further, the snap-fit components provide interchangeable parts, allowing for replacement of worn components and customization by a manufacturer or end user.

The golf bag self-assembly kit 400, which incorporates the collapsible golf bag 10 and the self-assembly system 500 provides advantages over golf bags that are known in the art. Among them, the collapsible golf bag has a reduced shipping box size than pre-assembled golf bags. This leads to a reduction in shipping costs, especially shipping costs based on box size or volume. In addition, less material is used for manufacturing the shipping box, reducing the cost of manufacturing. Further, by shifting assembly of the golf bag to a recipient, the manufacturer does not incur those additional assembly costs. The collapsible golf bag and self-assembly system provides easy assembly by the recipient based on clear assembly instructions, and components that are easily aligned and assembled. These and other advantages are may be realized from one or more embodiments of the golf bag, golf bag self-assembly kit, and golf bag self-assembly system disclosed herein.

VI. Shipping

The sub-assembly 42, 1042 can be assembled at one manufacturing site and shipped to another manufacturing site. The sub-assembly 42, 1042 can alternately be shipped to a recipient along with the other necessary components as a self-assembly kit. Typically, the sub-assembly 42, 1042 is collapsible, removing the requirement of shipping fully assembled, which reduces the volume of the box needed for shipping due to the reduction in "bulk" of the non-assembled parts.

The volume required for shipping the sub-assembly and any other necessary components for completion of the golf bag is significantly lower than the volume required to ship a fully-assembled golf bag. A prior art golf bag having the same size as the deployed or operational golf bag 10, 1010 is shipped in a box having a volume of roughly 4600 to 4700 cubic inches (75,380 cc to 77,019 cc). In a collapsed configuration, the golf bag 10, 1010 is shipped in a box with a volume of roughly 2500 to 3500 cubic inches (40,968 cc to 57,355 cc). The volume needed for shipping the collapsible golf bag 10, 1010 can be between 40% to 50%, 50% to 60%, 60% to 70%, 70% to 80% of volume needed to ship the golf bag without the sub-assembly features described above. In one comparison study, the non-sub-assembly golf bag is shipped in a box with a volume of 4655 cubic inches (76,229 cc). The golf bag 10, 1010 is shipped in a box with a volume of 3085 cubic inches (50,635 cc). In this study, the collapsible golf bag 10 with a sub-assembly required a shipping volume that is 66% of the required shipping volume for a non-sub-assembly golf bag.

The reduced shipping volume can result in a reduced shipping cost of between 10% and 50% for the collapsed golf bag 10, 1010. For example, the shipping cost can be reduced by 10% to 20%, 20% to 30%, 30% to 40%, or 40% to 50%. In one example, a carry bag 10 self-assembly system can be shipped to a recipient for a cost that is between 20% and 30% less than the cost of shipping a fully assembled carry bag 10 of the same size. According to one comparison study, a carry bag self-assembly system can be shipped to a recipient for a cost that is 25% less than the cost of shipping the fully assembled carry bag 10.

The supplying company can also ship the components and/or sub-assembly 42, 1042 of the collapsible golf bag 10, 1010 in separate boxes to facilitate efficient assembly line processes at both the first and second manufacturing sites. The shipping volume of the components and/or sub-assembly 42, 1042 is reduced by a similar percentage regardless of how the components are packaged for shipping. The method where the final assembly steps are completed at the second manufacturing site avoids tariffs as well.

One of the many benefits of the collapsible sub-assembly 42, 1042 design is that a large fraction of the assembly process can be completed at a first manufacturing site while retaining a cost of shipping similar to the cost of shipping unassembled components between the first and second sites. The reduction of the package volume of the collapsible sub-assembly 42, 1042 over the deployed golf bag also reduces the necessary storage space at the manufacturing sites. Reducing the storage space required to keep inventory lowers the overhead cost for the supplying company.

VII. Time and Cost Benefits

The snap fit golf bag 10, 1010 simplifies manufacturing, which reduces the manufacturing time and manual labor costs. The snap fit golf bag 10, 1010 reduces the need for riveting, for sewing components together, and/or for tools and equipment. Time savings are engineered into the golf bag 10, 1010 through the snap fit connections. The snap fit connections described above allow the assembler to complete the manufacturing steps more efficiently and quickly, which increases the parts per hour (PPH) manufacturing rate. The snap fit connections and self-fasteners at least partially eliminate work, such as riveting or sewing, that requires machinery and skilled labor. This allows the snap fit golf bag to be produced with a lower overhead cost.

The cart bag two-piece base assembly 1900 has a PPH manufacturing rate that is 20% to 30% faster than the PPH rate for producing prior art cart bags with one-piece bases. In one embodiment of the assembly process, certain assembly steps require the assembler to reach into the flat of the golf bag from the base. Due to these steps, when manufacturing a golf bag with a one-piece base, the assembler must wait until late in the manufacturing process to secure the base onto flat because once the flat is attached to the base, the inside of the golf bag cannot be easily accessed. Alternately, the one-piece base can be sewn onto the flat at a first manufacturing site, which restricts assemblers at a second manufacturing site to inconveniently reaching through pockets or a top of the bag in order to complete certain assembly steps. The base assembly 1900 allows the assembler convenient access into the inside of the golf bag 1010 during the second manufacturing stage. This reduces the required production time.

In one comparison study, a cart bag with a one-piece base was compared with the cart bag 1010 with the two-piece snap on base assembly disclosed herein. The assembly of the cart bag 1010 with the two-piece snap on base was 20%-30% faster than the assembly of the cart bag with the one-piece base, because the two-piece snap base can be connect to the flat faster. Additionally, the two-piece snap base can be connected to the flat without the use of riveting. In one instance, assembly of the cart bag 1010 with the two-piece snap base was 24% faster than the assembly of the cart bag with the one-piece base.

The two-piece base assembly 900, 1900 allows for a more efficient assembly of the golf bag 10, 1010 as compared to a system have a one piece base 34, 1034. The ring portion 910, 1910 can be coupled to the flat via a snap fit connection, stitches, pins, buttons, clamps, zippers or any other suitable mechanism. The base assembly 900, 1900 provides access to the interior of the flat 14 via the opening in the bottom of the ring portion 910, 1910. This allows for an easier coupling process, as opposed to coupling the flat 14, 1014 to the base 34, 1034 by entering through the top portion of the golf bag 10, 1010. Coupling of the divider sleeve 46 to the base portion 920, 1920 can be completed prior to the coupling of the base portion 920, 1920 and the ring portion 910, 1910. This provides easy access to the interior of the base portion 910, 1910, allowing for an easier manufacturing process as opposed to attaching the divider sleeve 46 to the base portion 920, 1920 by entering through the top of the golf bag 10, 1010.

Another benefit of the golf bag 10, 1010 described herein is time and cost savings from the engineered-in customization features of the golf bag. For example, the detachable pocket reduces the turnaround time for golf bags that are custom-ordered with logos on the pocket, as described above in the detachable pockets section. For further example, the modular (snap fit) divider top allows customization of the number of divider top apertures and/or color of the divider top. For golf bags with a single-piece, riveted-on divider top, a recipient's requested style of divider top must be determined before the assembly of the bag due to permanent rivets used to secure the divider top. However, if golf bag 10, 1010 is configured to have the modular divider top described above, then the golf bag 10, 1010 can be assembled into a sub-assembly 42, 1042 or an almost complete golf bag before the desired style is known. The modular divider top, detachable pockets, and other customization features allow the supplying company to produce an inventory of partially assembled bags that can be quickly customized when a customer order is received.

The engineered-in customization features can reduce turnover time (between the customer order and shipping of the golf bag) by roughly 40% to 50%, 50% to 60%, or 60% to 70%. For some features, the turnover time is reduced from 90-180 days to 30-45 days. Reducing the amount of time between the customer order and the shipping of the golf bag to the recipient increases customer satisfaction.

Providing the golf bag 10, 1010 as a self-assembly kit to the recipient can also reduce manufacturing cost and time. For example, a carry bag 10 self-assembly kit 400, described in detail below, requires the recipient to install the stand assembly 500, which reduces the bag manufacturing time for the supplying company by roughly 30 to 60 seconds per carry bag 10. This reduction in manufacturing time adds up to roughly 380 to 400 hours (47.5 to 50 days) of labor time savings per year for the supplying company. Furthermore, separating the stand assembly 500 from the rest of the carry bag 10 for shipping reduces the necessary box volume and shipping cost, as described above.

CLAUSES

Clause 1: A sub-assembly for a golf bag, the sub-assembly comprising: a divider top; a base; a plurality of stays comprising a first stay, a second stay, and a main stay having a first end opposite a second end; a top hinge coupled to the first end of the main stay; a base hinge coupled to the second end of the main stay, wherein the main stay is hingedly connected to the divider top by the top hinge, and the stay is hingedly connected to the base by the base hinge.

Clause 2: The sub-assembly of clause 1, wherein the sub-assembly is configured to be assembled into a cart-type golf bag.

Clause 3: The sub-assembly of clause 1, wherein the sub-assembly is collapsible when the first and second stay are both disengaged with the divider top.

Clause 4: The sub-assembly of clause 1, wherein the sub-assembly is collapsible when the first and second stay are both disengaged with the base.

Clause 5: The sub-assembly of clause 1, wherein the main stay is rigid from the first end to the second end.

Clause 6: The sub-assembly of clause 1, wherein the divider top is configured to pivot relative to the main stay and the base is configured to pivot relative to the stay.

Clause 7: The sub-assembly of clause 1, further comprising a divider sleeve coupled to the divider top and the base.

Clause 8: The sub-assembly of clause 1, wherein: the base comprises a base stay receiving channel, a first base stay hub, and a second base stay hub; the base stay receiving channel is configured to engage the base hinge which is coupled to the main stay; the first base stay hub is configured to engage the first stay; and the second base stay hub is configured to engage the second stay.

Clause 9: The sub-assembly of clause 1, wherein: the divider top comprises a top stay receiving channel, a first top stay hub, and a second top stay hub; the top stay receiving channel is configured to engage the top hinge which is coupled to the main stay; the first top stay hub is configured to engage the first stay; and the second top stay hub is configured to engage the second stay.

Clause 10: The sub-assembly of clause 8, wherein the base further comprises a outer ring and the base stay receiving channel is located on an internal surface of the outer ring.

Clause 11: The sub-assembly of clause 8, wherein the base further comprises a outer ring and the first stay hub and the second stay hub are located on an external surface of the outer ring.

Claus 12: The sub-assembly of clause 9, wherein the divider top further comprises an outer ring and the top stay receiving channel is located on an internal surface of the outer ring.

Clause 13: The sub-assembly of clause 9, wherein the divider top further comprises an outer ring and the first top stay hub and the second top stay hub are located on an external surface of the outer ring.

Clause 14: A golf bag, comprising: a flat; a sub-assembly having: a divider top; a base; a plurality of stays comprising a first stay, a second stay, and a main stay having a first end opposite a second end; a top hinge coupled to the first end of the main stay; a base hinge coupled to the second end of the main stay, wherein the main stay is hingedly connected to the divider top by the top hinge, and the stay is hingedly connected to the base by the base hinge; wherein the flat is configured to engage the sub-assembly to form the golf bag.

Clause 15: The golf bag of clause 14, wherein the golf bag is a cart-type golf bag.

Clause 16: The golf bag of clause 14, wherein the main stay is rigid from the first end to the second end.

Clause 17: The golf bag of clause 14, wherein the divider top is configured to pivot relative to the main stay and the base is configured to pivot relative to the stay.

Clause 18: The golf bag of clause 14, further comprising a divider sleeve coupled to the top divider and the base.

Clause 19: The golf bag of clause 14, wherein: the base comprises a base stay receiving channel, a first base stay hub, and a second base stay hub; the base stay receiving channel is configured to engage the base hinge which is coupled to the main stay; the first base stay hub is configured to engage the first stay; and the second base stay hub is configured to engage the second stay.

Clause 20: The golf bag of clause 14, wherein: the divider top comprises a top stay receiving channel, a first top stay hub, and a second top stay hub; the top stay receiving channel is configured to engage the top hinge which is coupled to the main stay; the first top stay hub is configured to engage the first stay; and the second top stay hub is configured to engage the second stay.

The invention claimed is:

1. A sub-assembly for a golf bag, the sub-assembly comprising:

a divider top;

a base;

a plurality of stays comprising a first stay, a second stay, and a main stay having a first end opposite a second end;

a top hinge coupled to the first end of the main stay;

a base hinge coupled to the second end of the main stay, wherein the main stay is hingedly connected to the divider top by the top hinge, and the main stay is hingedly connected to the base by the base hinge.

2. The sub-assembly of claim 1, wherein the sub-assembly is configured to be assembled into a cart-type golf bag that lacks a stand assembly.

3. The sub-assembly of claim 1, wherein the sub-assembly is collapsible when the first and second stay are both disengaged with the divider top; and wherein the sub-assembly is in an expanded configuration when the first stay and the second stay are engaged with the divider top.

4. The sub-assembly of claim 1, wherein the sub-assembly is collapsible when the first and second stay are both disengaged with the base; and wherein the sub-assembly is in an expanded configuration when the first stay and the second stay are engaged with the base.

5. The sub-assembly of claim 1, wherein the main stay is rigid from the first end to the second end.

6. The sub-assembly of claim 1, wherein the divider top is configured to pivot relative to the main stay and the base is configured to pivot relative to the main stay.

7. The sub-assembly of claim 1, further comprising a divider sleeve coupled to the divider top by one or more flaps and coupled to the base by a plurality of connection members.

8. The sub-assembly of claim 1, wherein:

the base comprises a base stay receiving channel, a first base stay hub, and a second base stay hub;

the base stay receiving channel is configured to engage the base hinge which is coupled to the main stay;

the first base stay hub is configured to engage the first stay; and the second base stay hub is configured to engage the second stay.

9. The sub-assembly of claim 8, wherein the base further comprises an outer ring and the base stay receiving channel is located on an internal surface of the outer ring.

10. The sub-assembly of claim 8, wherein the base further comprises a outer ring and the first stay hub and the second stay hub are located on an external surface of the outer ring.

11. The sub-assembly of claim 1, wherein:

the divider top comprises a top stay receiving channel, a first top stay hub, and a second top stay hub;

the top stay receiving channel is configured to engage the top hinge which is coupled to the main stay;

the first top stay hub is configured to engage the first stay; and the second top stay hub is configured to engage the second stay.

12. The sub-assembly of claim 11, wherein the divider top further comprises an outer ring and the top stay receiving channel is located on an internal surface of the outer ring.

13. The sub-assembly of claim 11, wherein the divider top further comprises an outer ring and the first top stay hub and the second top stay hub are located on an external surface of the outer ring.

14. A golf bag, comprising:

a flat;

a sub-assembly having:

a divider top;

a base;

a plurality of stays comprising a first stay, a second stay, and a main stay having a first end opposite a second end;

a top hinge coupled to the first end of the main stay;

a base hinge coupled to the second end of the main stay, wherein the main stay is hingedly connected to the divider top by the top hinge, and the main stay is hingedly connected to the base by the base hinge;

wherein the flat is configured to engage the sub-assembly to form the golf bag.

15. The golf bag of claim 14, wherein the golf bag is a cart-type golf bag.

16. The golf bag of claim 14, wherein the main stay is rigid from the first end to the second end.

17. The golf bag of claim 14, wherein the divider top is configured to pivot relative to the main stay and the base is configured to pivot relative to the main stay.

18. The golf bag of claim 14, further comprising a divider sleeve coupled to the divider top by one or more flaps and coupled to the base by a plurality of connection members.

19. The golf bag of claim 14, wherein:

the base comprises a base stay receiving channel, a first base stay hub, and a second base stay hub;

the base stay receiving channel is configured to engage the base hinge which is coupled to the main stay;

the first base stay hub is configured to engage the first stay; and the second base stay hub is configured to engage the second stay.

20. The golf bag of claim 14, wherein:

the divider top comprises a top stay receiving channel, a first top stay hub, and a second top stay hub;

the top stay receiving channel is configured to engage the top hinge which is coupled to the main stay;

the first top stay hub is configured to engage the first stay; and the second top stay hub is configured to engage the second stay.

* * * * *